US009074455B2

(12) United States Patent
Pilgrim et al.

(10) Patent No.: US 9,074,455 B2
(45) Date of Patent: Jul. 7, 2015

(54) SYSTEMS AND METHODS FOR CONTINUOUS AND NEAR CONTINUOUS DRILLING

(75) Inventors: Rick Pilgrim, Allen, TX (US); Tommy Duc Vu, Houston, TX (US); Paul Channon, Cardiff (GB); Erman Citirik, Houston, TX (US)

(73) Assignee: Cameron Rig Solutions, Inc., Houston, TX (US)

( * ) Notice: Subject to any disclaimer, the term of this patent is extended or adjusted under 35 U.S.C. 154(b) by 533 days.

(21) Appl. No.: 13/475,631

(22) Filed: May 18, 2012
(Under 37 CFR 1.47)

(65) Prior Publication Data

US 2013/0025937 A1 Jan. 31, 2013

Related U.S. Application Data

(63) Continuation-in-part of application No. 13/301,385, filed on Nov. 21, 2011, now Pat. No. 8,955,602.

(60) Provisional application No. 61/458,240, filed on Nov. 19, 2010.

(51) Int. Cl.
*E21B 19/20* (2006.01)
*E21B 21/01* (2006.01)
(Continued)

(52) U.S. Cl.
CPC ..... *E21B 44/00* (2013.01); *E21B 19/20* (2013.01); *E21B 7/00* (2013.01); *E21B 19/00* (2013.01); *E21B 19/16* (2013.01); *E21B 21/01* (2013.01)

(58) Field of Classification Search
CPC ..... E21B 19/20; E21B 21/01
See application file for complete search history.

(56) References Cited

U.S. PATENT DOCUMENTS 3,158,212 A 11/1964 Fanshawe et al.
3,658,298 A 4/1972 Moore et al.
(Continued)

FOREIGN PATENT DOCUMENTS

WO 98/16716 4/1998
WO 00/23686 4/2000
WO 00/79092 12/2000

OTHER PUBLICATIONS

Ratkay, Written Opinion from Intellectual Property Office of Singapore for Application No. 11201402434R (SG national stage entry of PCT/US12/38648), dated Sep. 18, 2014 (mailed by IPOS to Applicant on Oct. 20, 2014).
(Continued)

*Primary Examiner* — Giovanna C Wright
(74) *Attorney, Agent, or Firm* — Eubanks PLLC

(57) ABSTRACT

The present disclosure provides drilling and tripping equipment packages and control schemes and methods using two or more lifting systems that operate simultaneously and continuously in a synchronized manner such that the feeding of tubular into or out of a well bore is achieved with continuous or near continuous movement, without the need for periodic interruptions. The drilling and tripping equipment packages and control schemes are also able to rotate the tubular in the well bore with continuous speed and torque sufficient for both drilling and back-reaming operations. The drilling and tripping equipment package and control scheme is additionally able to circulate drilling fluid into the internal bore of the tubular with sufficient pressure and flow to facilitate both drilling and back-reaming operations, with minimal interruption to circulation.

28 Claims, 73 Drawing Sheets

(51) Int. Cl.

| | |
|---|---|
| ***E21B 44/00*** | (2006.01) |
| ***E21B 7/00*** | (2006.01) |
| ***E21B 19/00*** | (2006.01) |
| ***E21B 19/16*** | (2006.01) |

(56) References Cited

U.S. PATENT DOCUMENTS

| | | | | |
|---|---|---|---|---|
| 4,423,994 | A | 1/1984 | Schefers et al. | |
| 4,643,259 | A | 2/1987 | Zeringue | |
| 5,762,279 | A | 6/1998 | Horton | |
| 6,629,572 | B2 * | 10/2003 | Womer et al. | 175/219 |
| 6,688,394 | B1 * | 2/2004 | Ayling | 166/380 |
| 2003/0075023 | A1 * | 4/2003 | Robichaux | 81/57.37 |
| 2003/0221519 | A1 | 12/2003 | Haugen | |
| 2003/0234101 | A1 | 12/2003 | Ayling | |
| 2010/0200299 | A1 | 8/2010 | Vatne | |
| 2012/0181084 | A1 | 7/2012 | Pilgrim | |

OTHER PUBLICATIONS

Schouten, International Search Report and Written Opinion for PCT/US2012/038648, mailed Oct. 24, 2013.

* cited by examiner

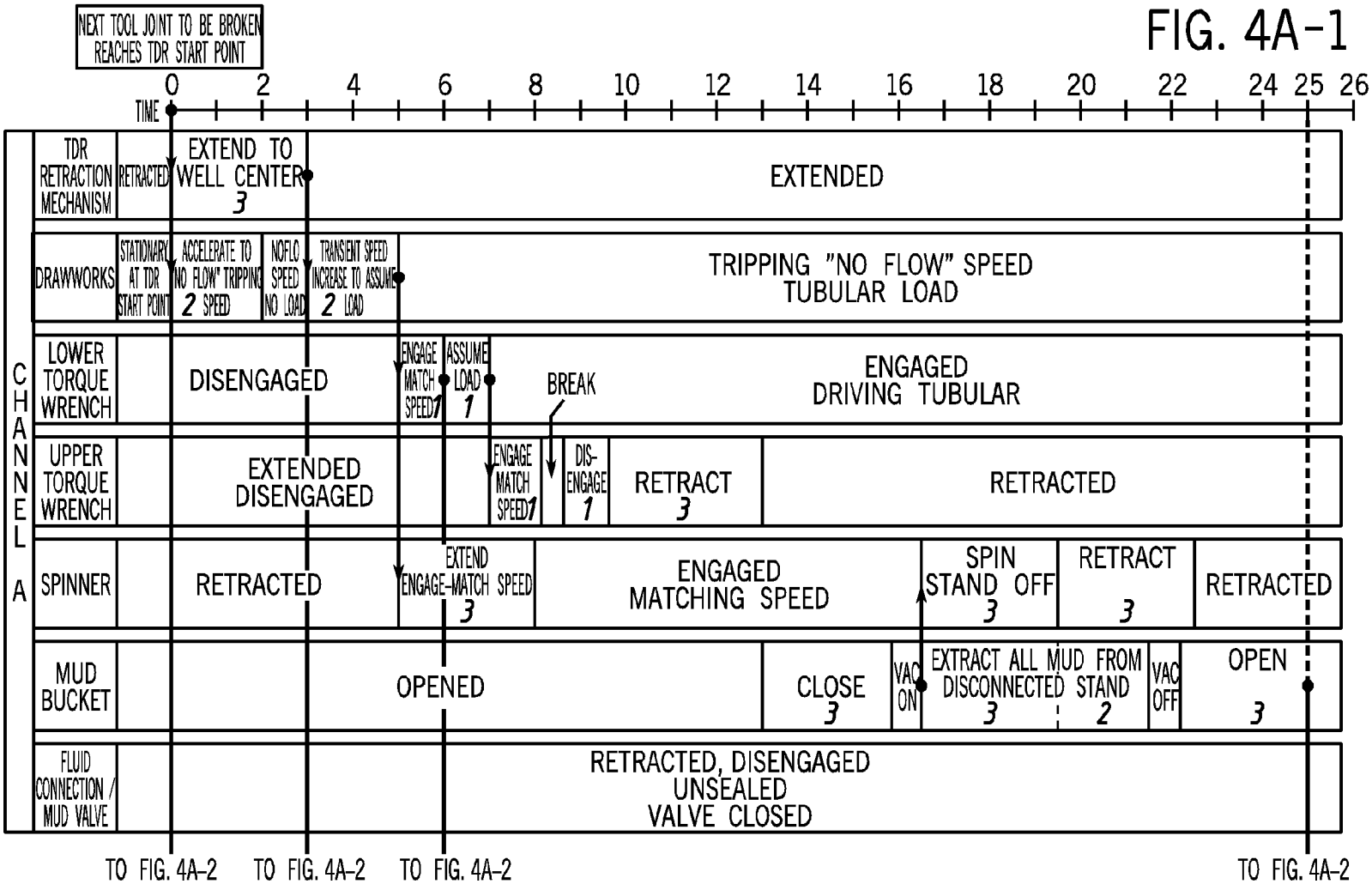
FIG. 4A-1
NEXT TOOL JOINT TO BE BROKEN REACHES TDR START POINT
TIME
0
2
4
6
8
10
12
14
16
18
20
22
24
25
26
CHANNEL
TDR RETRACTION MECHANISM
RETRACTED
EXTEND TO WELL CENTER 3
EXTENDED
DRAWWORKS
STATIONARY AT TDR START POINT
ACCELERATE TO "NO FLOW" TRIPPING SPEED 2
NOT C/C SPEED NO LOAD
TRANSIT SPEED INCREASE TO ASSUME 2 LOAD
TRIPPING "NO FLOW" SPEED TUBULAR LOAD
LOWER TORQUE WRENCH
DISENGAGED
ENGAGE MATCH SPEED 1
ASSUME LOAD 1
ENGAGED DRIVING TUBULAR
UPPER TORQUE WRENCH
EXTENDED DISENGAGED
ENGAGE MATCH SPEED 1
BREAK
DIS-ENGAGE 1
RETRACT 3
RETRACTED
SPINNER
RETRACTED
EXTEND ENGAGE-MATCH SPEED 3
ENGAGED MATCHING SPEED
SPIN STAND OFF 3
RETRACT 3
RETRACTED
MUD BUCKET
OPENED
CLOSE 3
VAC ON
EXTRACT ALL MUD FROM DISCONNECTED STAND 3 2
VAC OFF
OPEN 3
FLUID CONNECTION / MUD VALVE
RETRACTED, DISENGAGED UNSEALED VALVE CLOSED
TO FIG. 4A-2
TO FIG. 4A-2
TO FIG. 4A-2
TO FIG. 4A-2

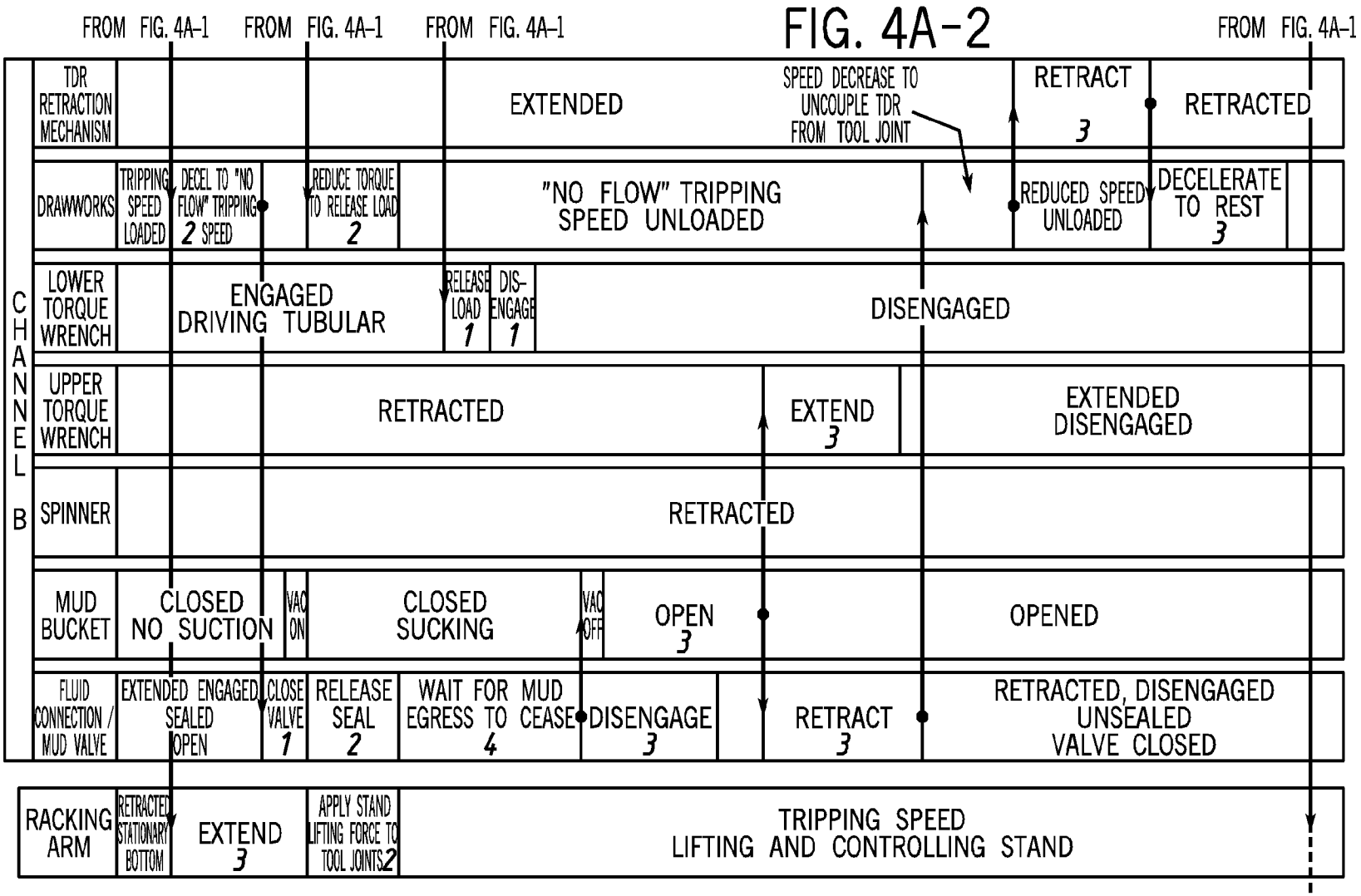
FIG. 4A-2
FROM FIG. 4A-1
FROM FIG. 4A-1
FROM FIG. 4A-1
FROM FIG. 4A-1
FROM FIG. 4A-1
CHANNEL B
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
RACKING ARM
EXTENDED
RETRACT 3
RETRACTED
TRIPPING SPEED LOADED
DECEL TO "NO FLOW" TRIPPING SPEED 2
REDUCE TORQUE TO RELEASE LOAD 2
"NO FLOW" TRIPPING SPEED UNLOADED
REDUCED SPEED UNLOADED
DECELERATE TO REST 3
SPEED DECREASE TO UNCOUPLE TDR FROM TOOL JOINT
ENGAGED DRIVING TUBULAR
RELEASE LOAD 1
DIS-ENGAGE 1
DISENGAGED
RETRACTED
EXTEND 3
EXTENDED DISENGAGED
RETRACTED
CLOSED NO SUCTION
VAC ON
CLOSED SUCKING
VAC OFF
OPEN 3
OPENED
EXTENDED ENGAGED SEALED OPEN
CLOSE VALVE 1
RELEASE SEAL 2
WAIT FOR MUD EGRESS TO CEASE 4
DISENGAGE 3
RETRACT 3
RETRACTED, DISENGAGED UNSEALED VALVE CLOSED
RETRACTED STATIONARY BOTTOM
EXTEND 3
APPLY STAND LIFTING FORCE TO TOOL JOINTS 2
TRIPPING SPEED LIFTING AND CONTROLLING STAND

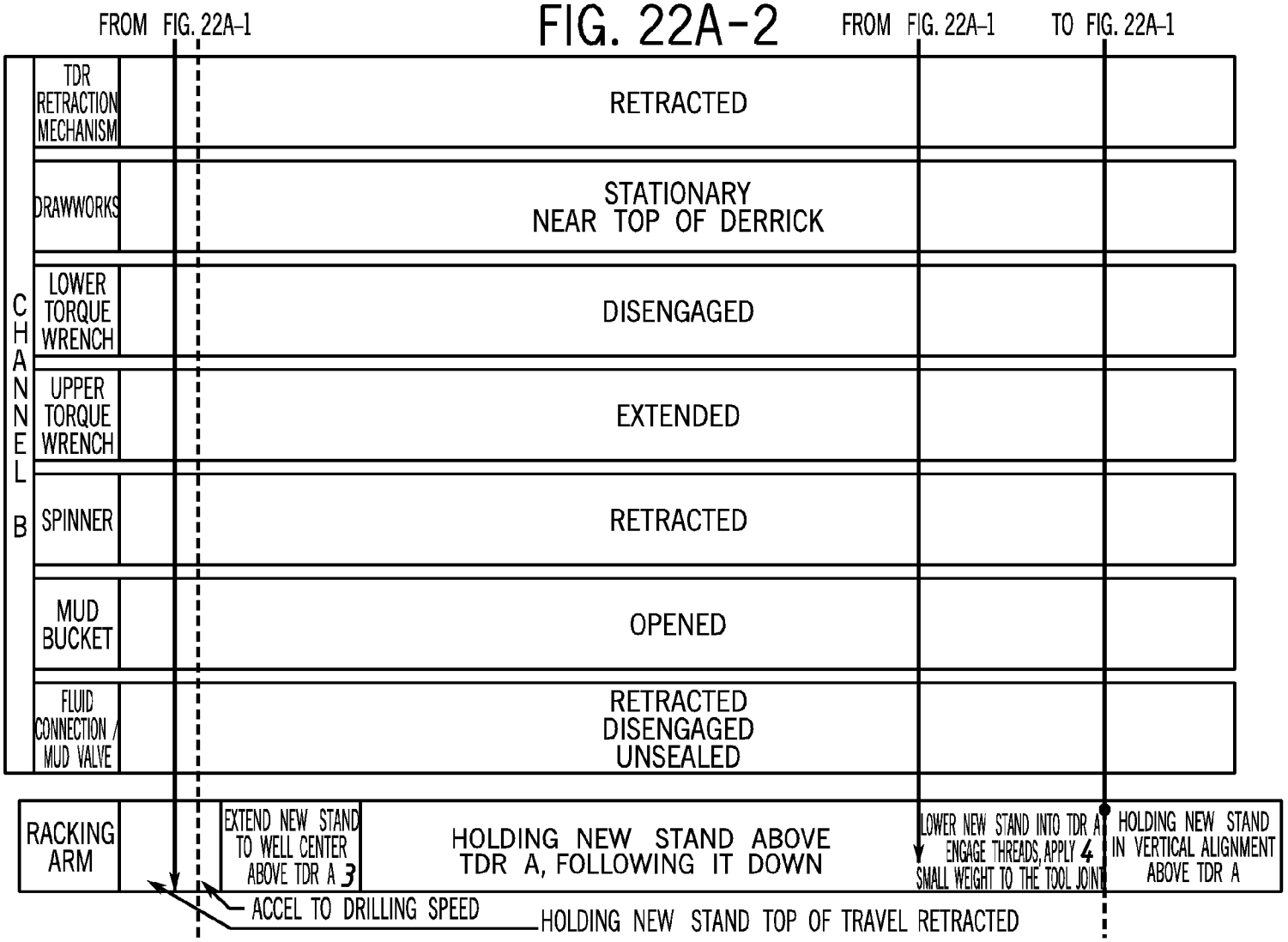
FIG. 22A-2
FROM FIG. 22A-1
FROM FIG. 22A-1
TO FIG. 22A-1
CHANNEL B
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
RACKING ARM
RETRACTED
STATIONARY NEAR TOP OF DERRICK
DISENGAGED
EXTENDED
RETRACTED
OPENED
RETRACTED DISENGAGED UNSEALED
EXTEND NEW STAND TO WELL CENTER ABOVE TDR A 3
HOLDING NEW STAND ABOVE TDR A, FOLLOWING IT DOWN
LOWER NEW STAND INTO TDR A, ENGAGE THREADS, APPLY 4 SMALL WEIGHT TO THE TOOL JOINT
HOLDING NEW STAND IN VERTICAL ALIGNMENT ABOVE TDR A
ACCEL TO DRILLING SPEED
HOLDING NEW STAND TOP OF TRAVEL RETRACTED

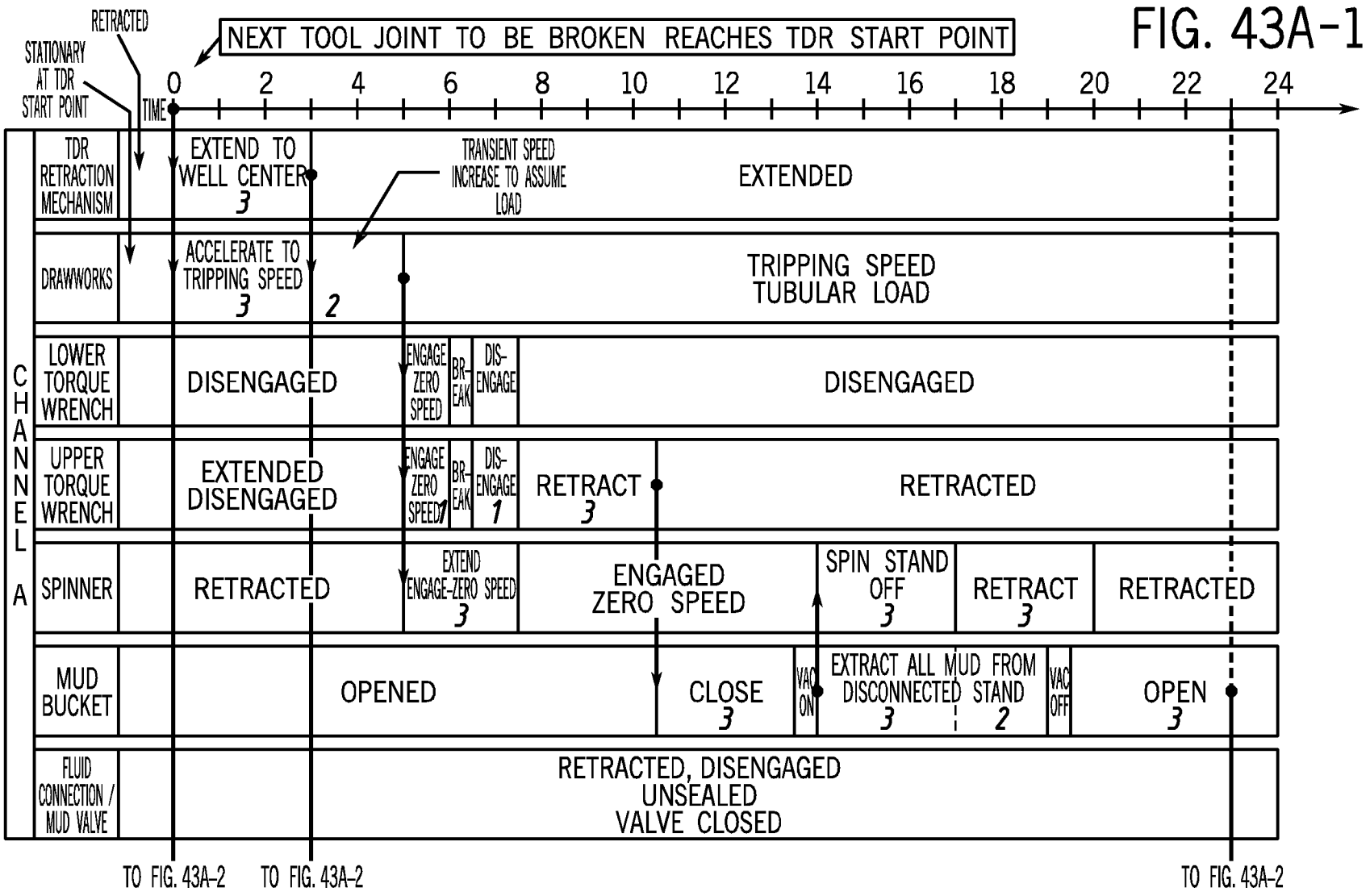
FIG. 43A-1
NEXT TOOL JOINT TO BE BROKEN REACHES TDR START POINT
TIME
0
2
4
6
8
10
12
14
16
18
20
22
24
RETRACTED
STATIONARY AT TDR START POINT
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
CHANNEL A
EXTEND TO WELL CENTER 3
EXTENDED
TRANSIENT SPEED INCREASE TO ASSUME LOAD
ACCELERATE TO TRIPPING SPEED 3
TRIPPING SPEED TUBULAR LOAD
2
DISENGAGED
ENGAGE ZERO SPEED
BR-EAK
DIS-ENGAGE
EXTENDED DISENGAGED
RETRACTED
RETRACT 3
ENGAGE ZERO SPEED
BR-EAK
DIS-ENGAGE 1
EXTEND ENGAGE-ZERO SPEED 3
ENGAGED ZERO SPEED
SPIN STAND OFF 3
RETRACT 3
RETRACTED
OPENED
CLOSE 3
VAC ON
EXTRACT ALL MUD FROM DISCONNECTED STAND 2
VAC OFF
OPEN 3
RETRACTED, DISENGAGED UNSEALED VALVE CLOSED
TO FIG. 43A-2
TO FIG. 43A-2
TO FIG. 43A-2

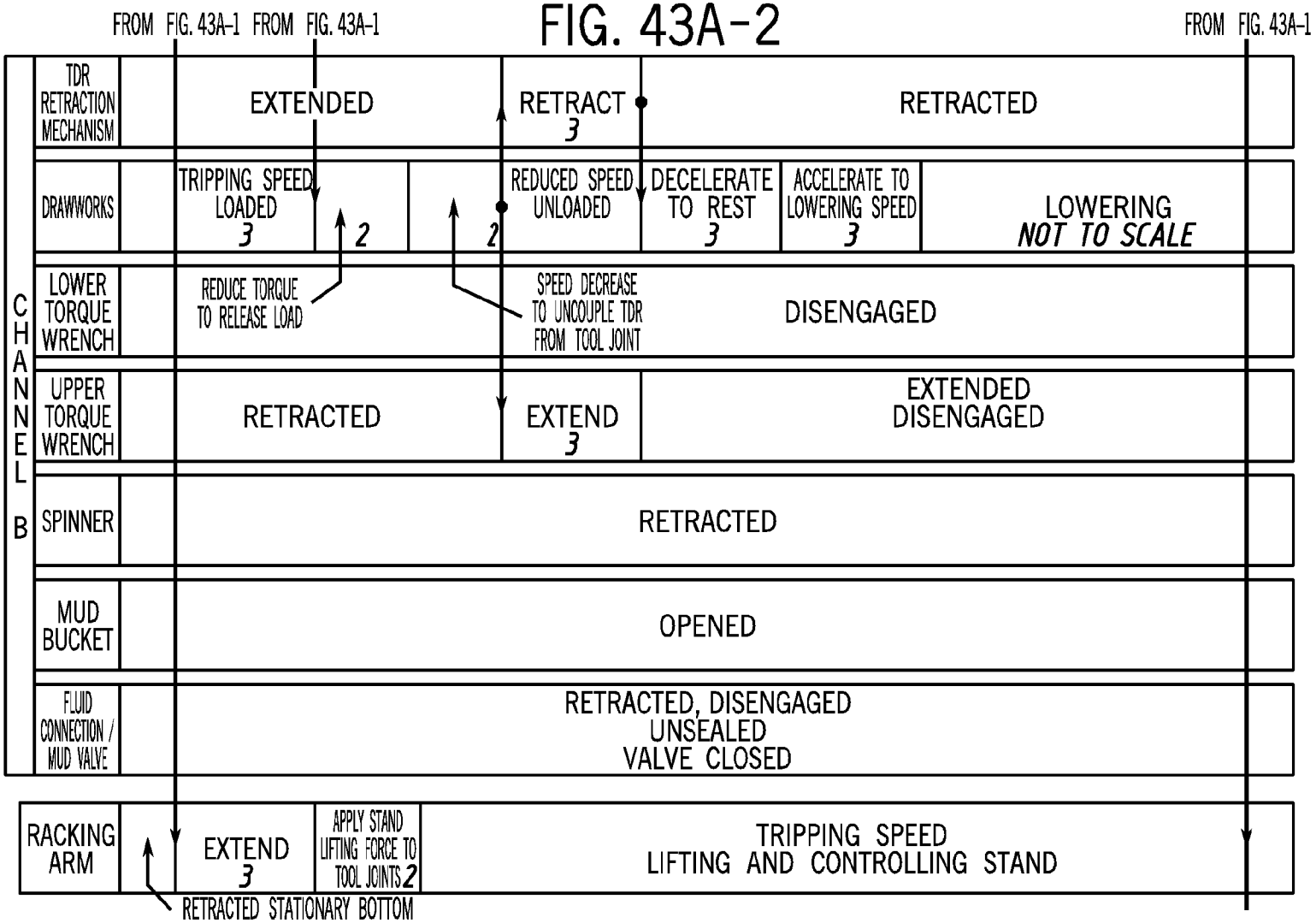
FIG. 43A-2
FROM FIG. 43A-1
FROM FIG. 43A-1
FROM FIG. 43A-1
TDR RETRACTION MECHANISM
DRAWWORKS
LOWER TORQUE WRENCH
UPPER TORQUE WRENCH
SPINNER
MUD BUCKET
FLUID CONNECTION / MUD VALVE
RACKING ARM
CHANNEL B
EXTENDED
TRIPPING SPEED LOADED 3
REDUCE TORQUE TO RELEASE LOAD
2
RETRACT 3
RETRACTED
REDUCED SPEED UNLOADED
2
SPEED DECREASE TO UNCOUPLE TDR FROM TOOL JOINT
DECELERATE TO REST 3
ACCELERATE TO LOWERING SPEED 3
LOWERING NOT TO SCALE
DISENGAGED
RETRACTED
EXTEND 3
EXTENDED DISENGAGED
RETRACTED
OPENED
RETRACTED, DISENGAGED UNSEALED VALVE CLOSED
EXTEND 3
APPLY STAND LIFTING FORCE TO TOOL JOINTS 2
RETRACTED STATIONARY BOTTOM
TRIPPING SPEED LIFTING AND CONTROLLING STAND 100
110
111
112
113
114
114a
115
117
117a
117b
117c
118
118a
119
120
121
122
123
124'
124"
127
128
130
131
132
133

100
110
111
112
113
114
114a
115
117
117a
117b
117c
118
118a
119
120
121
122
123
124'
124"
127
128
130
132
133

100
110
111
112
113
114
114a
115
117
117a
117b
117c
118
118a
119
120
121
122
123
124'
124"
127
130
131
132
133

100
110
111
112
113
114
114a
115
117
117a
117b
117c
118
118a
119
120
121
122
123
124'
124"
127
129
130
131
133

SYSTEMS AND METHODS FOR CONTINUOUS AND NEAR CONTINUOUS DRILLING

CROSS-REFERENCE TO RELATED APPLICATION

This application is a continuation-in-part of U.S. patent application Ser. No. 13/301,385, filed on Nov. 21, 2011, which claims the benefit of U.S. Provisional Patent Application Ser. No. 61/458,240, filed on Nov. 19, 2010, each of which is incorporated herein by reference in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

The invention relates generally to systems and methods useful in drilling applications. More specifically, the invention relates to systems and methods useful for drilling for oil and/or natural gas, although not necessarily limited to such applications.

BACKGROUND OF THE ART

Those skilled in the art of drilling applications for oil and gas will appreciate that a great deal of time can be consumed by various operations during the course of drilling a well. Among other things, each time a drill string needs to be tripped out of a wellbore, a potentially substantial amount of time is lost to drilling operations. Because the daily cost of drilling a well can be substantial, especially in connection with offshore drilling in deepwater applications, efforts have been made to reduce the time spent on tripping operations. Similarly, efforts have been made to try to speed up and obtain greater efficiencies in drilling operations generally. Specifically, efforts have been made to try to maintain the continuous and near continuous drilling of the well. The inputs that the driller has at his disposal to manage the well are rotation of the drill pipe, hoisting (raising or sometimes lowering) the drill pipe, and the circulation of fluid down through the drill pipe and back to the surface. A significant problem with existing drilling techniques is that they require the drill pipe to stop at the drillfloor to be connected to the next section of drill pipe entering or being pulled from the well. During this stopping period all dynamic inputs used by the driller to manage the well stops because the drilling equipment can no longer rotate, hoist or pump fluids while moving. It is during this stopping time, or connection time, that the well experiences many of the classic well management issues that cause non-productive time (NPT). Of course, such efforts must be taken with care so as not to compromise safety and to also prevent or minimize the potential for accidents or pollution.

In the past, attempts have been made to automate various operations relating to drilling. For example, U.S. Pat. No. 3,404,741, issued to Gheorghe et al. on Oct. 8, 1968, titled "Automated System and Drilling Rig for Continuously and Automatically Pulling and Running a Drill-Pipe String" ("Gheorghe"), which is hereby incorporated by reference as if fully set forth herein, describes one approach. In Gheorghe, a drilling rig is described as including two lifts which are synchronized in order to allow for a tripping operation to be performed continuously. Gheorghe fails to disclose, among other things, a rig or systems to be used on a rig in which drilling, back reaming, and tripping operations can be performed in a continuous or nearly continuous fashion, and also fails to disclose systems for controlling various systems on a rig to allow for continuous or nearly continuous drilling, back reaming, and tripping operations One approach taken in the past involves the use of a "multi-activity" drilling assembly which includes two tubular stations. Such an approach is described in U.S. Pat. No. 6,085,851, issued to Scott, et al., on Jul. 11, 2000, titled "Multi-Activity Offshore Exploration and/or Development Drill Method and Apparatus ("Scott")," which is hereby incorporated by reference as if fully set forth herein. In Scott, an apparatus and method is described that involves the use of two drill strings so that certain auxiliary actions can be ongoing with respect to one drill string while drilling or tripping operations are ongoing with respect to a second drill string. This approach has certain drawbacks, not least of which are the use of two drill strings and the added complexity of ongoing operations with both in connection with a single derrick.

What is needed is an apparatus and methods for drilling and tripping that take less time than standard drilling and tripping equipment and methods.

BRIEF SUMMARY OF THE INVENTION

Those skilled in the art will appreciate that this summary of the invention, and the accompanying detailed description of embodiments of the invention do not define the scope of the invention and do not provide a substitute for the claims in defining the scope of the invention, but are merely provided for guidance in providing a better understanding of the full scope of the invention as measured by the claims. In one embodiment of the invention, a system is provided which has as its goal and provides as an advantage the ability to obtain continuous or near continuous tripping operations in connection with a rig having a derrick, two independently operable drawworks, two independently operable traveling differential roughnecks, a drilling fluid divert system, and an integrated control system for automatically controlling drilling operations. In another embodiment of the invention, the system further includes a number of sensors responsive to well parameters that feed information regarding the well to the integrated control system which takes action based on one or more of such well parameters to further control drilling operations. In another embodiment of the invention, a method is provided for automatically controlling the operation of two independently operable traveling differential roughnecks in a derrick to obtain continuous or near continuous tripping operations. In still another method, an operator may modify the automated drilling activities by specifying additional conditions or parameters for safety, environmental and other preferences or concerns. In still another embodiment, the system automatically stores data regarding drilling activities, well conditions and parameters, and operating conditions in a database.

One benefit provided by the present disclosure is that, while drilling, it does not stop during connection times, and this continuous or near continuous rotation, hoisting capability and mud circulation of the drill string significantly decreases the likelihood of classic oil and gas well drilling challenges such as, but not limited to, differentially sticking the drill pipe to the wellbore wall and complications arising from buildup of wellbore cuttings due to loss of circulation.

The present disclosure provides a drilling and tripping system, comprising a plurality of lifting systems, a plurality of traveling differential roughnecks, each associated with at least one of the plurality of lifting systems, one or more pipe handling and storage system associated with at least one of the plurality of traveling differential roughnecks, one or more drilling fluid diverting system associated with at least one of the plurality of traveling differential roughnecks, and a control system. In certain embodiments the drilling and tripping system comprises a first lifting system and a second lifting system. In alternative embodiments, the drilling and tripping system comprises a first lifting system, a second lifting system, and a third lifting system. In some embodiments, the first lifting system and/or the second lifting system and/or the third lifting system comprises a drawworks, a winch, a hydraulic ram, a rack and pinion system, or a high load linear motor.

In other embodiments the drilling and tripping system comprises a first traveling differential roughneck and a second traveling differential roughneck. In further embodiments the drilling and tripping system comprises a first traveling differential roughneck, a second traveling differential roughneck, and a third traveling differential roughneck. In particular embodiments, the first traveling differential roughneck and/or the second traveling differential roughneck and/or the third traveling differential roughneck comprises one, some or all of the following components: a rotating elevator bowl; a lower rotating torque wrench; an upper rotating torque wrench; a spinner; a mud bucket; and a fluid connection system. In further embodiments the rotating elevator bowl comprises one, some or all of the following components: a main body; a bowl; a thrust bearing; an aligned radial opening in the main body, bowl and thrust bearing; a motor; and a plurality of sensors. In still other embodiments the lower rotating torque wrench comprises one, some or all of the following components: a ring gear comprising a gate; at least a first motor; and a plurality of cam locked jaws. In additional embodiments the upper rotating torque wrench comprises one, some or all of the following components: a ring gear comprising a gate; at least a first motor; and a plurality of cam locked jaws. In certain embodiments, the spinner is a two-part spinner. In particular embodiments the mud bucket is a two-part mud bucket.

In some embodiments, the control system comprises a computer, the computer further comprising instructions for operating the drilling and tripping system. In other embodiments the control system comprises instructions for simultaneously controlling the operations of the lifting systems, the travelling differential roughnecks, the pipe handling and storage system, and the drilling fluid diverting system. In still other embodiments the control system comprises instructions responsive to data associated with drilling or tripping operations. In further embodiments the control system comprises instructions responsive to data stored in non-volatile memory, real-time data associated with drilling or tripping operations, and user inputs.

The present disclosure also provides a method for removing a portion of a drillstring from a hole with continuous or nearly continuous rotation and near continuous mud circulation, comprising outfitting a drilling rig with a disclosed drilling and tripping system, and operating the drilling and tripping system to remove at least a portion of a drillstring from a hole with continuous or nearly continuous rotation and nearly continuous mud circulation.

In addition, the present disclosure provides a method for drilling an oil or gas well, comprising outfitting a drilling rig with a disclosed drilling and tripping system, and operating the drilling and tripping system to drill an oil or gas well.

Additionally, the present disclosure provides a method for removing a tubular from a riser or a cased hole at maximum speed without the need for fluid circulation or rotation of the tubular, comprising outfitting a drilling rig with a disclosed drilling and tripping system, and operating the drilling and tripping system to remove a tubular from a riser or a cased hole at maximum speed without the need for fluid circulation or rotation of the tubular.

The present disclosure further provides a drilling and tripping system, comprising a plurality of lifting systems, a traveling differential roughneck associated with at least one of the plurality of lifting systems, a top drive associated with at least one of the plurality of lifting systems, the top drive connected to a saver sub, a pipe handling and storage system associated with the traveling differential roughneck, a drilling fluid diverting system associated with the traveling differential roughneck, and a control system. In certain embodiments the drilling and tripping system comprises a first lifting system, a second lifting system and a third lifting system. The first lifting system, second lifting system and/or third lifting system can comprise a drawworks, a winch, a hydraulic ram, a rack and pinion system, or a high load linear motor. In particular embodiments the first and second lifting system are associated with the traveling differential roughneck and the third lifting system is associated with the top drive.

The traveling differential roughneck can comprise a frame, a lower torque wrench, an upper torque wrench, and a mud bucket. The mud bucket can be a three part mud bucket, which can comprise an upper rotating chamber with an upper pipe ram, a middle stationary chamber with a blank ram, and a lower chamber with a lower pipe ram. The mud bucket can also comprise a second upper pipe ram and/or a second lower pipe ram. The lower torque wrench and/or the upper torque wrench can comprise a ring gear comprising a gate, at least a first motor, and a plurality of cam locked jaws. The upper torque wrench can also comprise a float mechanism. The top drive can also comprise a float mechanism.

The control system can comprise a computer comprising instructions for operating the drilling and tripping system. The control system can also comprise instructions for simultaneously controlling the operations of said lifting systems, said travelling differential roughneck, said pipe handling and storage system, and said drilling fluid diverting system. In addition, the control system can comprise instructions responsive to data associated with drilling or tripping operations. The control system can additionally comprise instructions responsive to data stored in non-volatile memory, real-time data associated with drilling or tripping operations, and user inputs.

The present disclosure further provides a traveling differential roughneck comprising a frame, a lower torque wrench, an upper torque wrench, and a mud bucket. The mud bucket can comprise an upper rotating chamber comprising at least a first upper pipe ram, a middle stationary chamber comprising a blank ram, and a lower rotating chamber comprising at least a first lower pipe ram. The mud bucket can further comprise a second upper pipe ram and a second lower pipe ram. The lower and/or upper torque wrench can comprise a ring gear, at least a first motor, and a plurality of cam locked jaws. The upper torque wrench can further comprise a float mechanism.

The present disclosure also provides a mud bucket, comprising an upper rotating chamber comprising at least a first upper pipe ram, a middle stationary chamber comprising a blank ram, and a lower rotating chamber comprising at least a first lower pipe ram. The mud bucket can further comprise a slew ring between the upper rotating chamber and the middle stationary chamber and/or a slew ring between the middle stationary chamber and the lower rotating chamber. The mud bucket can also comprise a plurality of mud ports.

The present disclosure additionally provides a control system for a drilling and tripping system, comprising a computer comprising instructions for operating the drilling and tripping system. The computer can further comprise instructions for simultaneously controlling the operations of a plurality of lifting systems, a travelling differential roughneck, a top drive, a pipe handling and storage system, and a drilling fluid diverting system. The computer can also comprise instructions responsive to data associated with drilling or tripping operations. Furthermore, the computer can comprise instructions responsive to data stored in non-volatile memory, real-time data associated with drilling or tripping operations, or user inputs.

The present disclosure also provides a method for removing a portion of a drillstring from a hole, comprising outfitting a drilling rig with the drilling and tripping system comprising a plurality of lifting systems, a traveling differential roughneck associated with at least one of the plurality of lifting systems, a top drive associated with at least one of the plurality of lifting systems, the top drive connected to a saver sub, a pipe handling and storage system associated with the traveling differential roughneck, a drilling fluid diverting system associated with the traveling differential roughneck, and a control system, and operating the drilling and tripping system to remove at least a portion of the drillstring from the hole.

The present disclosure further provides a method for drilling an oil or gas well, comprising outfitting a drilling rig with a drilling and tripping system comprising a plurality of lifting systems, a traveling differential roughneck associated with at least one of the plurality of lifting systems, a top drive associated with at least one of the plurality of lifting systems, the top drive connected to a saver sub, a pipe handling and storage system associated with the traveling differential roughneck, a drilling fluid diverting system associated with the traveling differential roughneck, and a control system, and operating the drilling and tripping system to drill the oil or gas well.

Furthermore, the present disclosure provides a method for removing a tubular from a riser or a cased hole without the need for fluid circulation or rotation of the tubular, comprising outfitting a drilling rig with a drilling and tripping system comprising a plurality of lifting systems, a traveling differential roughneck associated with at least one of the plurality of lifting systems, a top drive associated with at least one of the plurality of lifting systems, the top drive connected to a saver sub, a pipe handling and storage system associated with the traveling differential roughneck, a drilling fluid diverting system associated with the traveling differential roughneck, and a control system, and operating the drilling and tripping system to remove the tubular from the riser or the cased hole without the need for fluid circulation or rotation of the tubular.

BRIEF DESCRIPTION OF THE SEVERAL VIEWS OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 4A and FIG. 4B. A block diagram showing one embodiment of a detailed operational sequence for one cycle of removing a tubular from a hole at 1 foot/second with continuous rotation and near continuous mud circulation. At the end of each of the described cycle, the cycle repeats with Channel A performing the tasks done by Channel B and vice-versa. FIG. 4A. A block diagram showing one embodiment of a detailed operational sequence for the first approximately 62.5% of one cycle of removing a tubular from a hole at 1 foot/second with continuous rotation and near continuous mud circulation. FIG. 4B. A block diagram showing one embodiment of a detailed operational sequence for the last approximately 37.5% of one cycle of removing a tubular from a hole at 1 foot/second with continuous rotation and near continuous mud circulation.

FIG. 5A. Schematic of drilling and tripping system at t=0 seconds before the first TDR extends and engages below the tool joint. FIG. 5B. Close-up of the first TDR at t=0 seconds.

FIG. 6A. Schematic of drilling and tripping system at t=5 seconds as the spinner of the first TDR extends to engage the tubular. FIG. 6B. Close-up of the first TDR at t=5 seconds.

FIG. 7A. Schematic of drilling and tripping system at t=11 seconds as the upper torque wrench of the first TDR retracts. FIG. 7B. Close-up of the first TDR at t=11 seconds.

FIG. 8A. Schematic of drilling and tripping system at t=14 seconds as the mud bucket of the first TDR closes. FIG. 8B. Close-up of the first TDR at t=14 seconds.

FIG. 9A. Schematic of drilling and tripping system at t=19 seconds as the mud bucket of the first TDR extracts mud as the spinner disconnects the tubular. FIG. 9B. Close-up of the first TDR at t=19 seconds.

FIG. 10A. Schematic of drilling and tripping system at t=24 seconds as the mud bucket of the first TDR retracts. FIG. 10B. Close-up of the first TDR at t=24 seconds.

FIG. 11A. Schematic of drilling and tripping system at t=26 seconds as the racking arm removes the disconnected tubular. FIG. 11B. Close-up of the first TDR at t=26 seconds.

FIG. 12A. Schematic of drilling and tripping system at t=32 seconds as the fluid connection system of the first TDR engages the rotating tubular. FIG. 12B. Close-up of the first TDR at t=32 seconds.

FIG. 13A. Schematic of drilling and tripping system at t=36 seconds as the mud flow begins upon sealing. FIG. 13B. Close-up of the first TDR at t=36 seconds.

FIG. 14A. Schematic of drilling and tripping system at t=45 seconds as the tubular is being pulled with rotation and mud flow. FIG. 14B. Close-up of the first TDR at t=45 seconds.

FIG. 15A. Schematic of drilling and tripping system at t=77 seconds as the second TDR engages with the next tool joint. FIG. 15B. Close-up of the first TDR at t=77 seconds.

FIG. 16A. Schematic of drilling and tripping system at t=81 seconds as the second TDR takes over weight load and rotation of the tubular. FIG. 16B. Close-up of the first TDR at t=81 seconds.

FIG. 17A. Schematic of drilling and tripping system at t=92 seconds as the fluid connection system of the first TDR is disengaged. FIG. 17B. Close-up of the first TDR at t=92 seconds.

FIG. 18A. Schematic of drilling and tripping system at t=95 seconds as the first TDR begins to retract from the tubular. FIG. 18B. Close-up of the first TDR at t=95 seconds.

FIG. 19A. Schematic of drilling and tripping system at t=103 seconds as the first TDR descends the derrick while the racking arm removes the stand. FIG. 19B. Close-up of the first TDR and the second TDR at t=103 seconds.

FIG. 20A. Schematic of drilling and tripping system at t=115 seconds as the second TDR pulls and rotates the tubular. FIG. 20B. Close-up of the first TDR at t=115 seconds.

FIG. 21A. Schematic of drilling and tripping system at t=129 seconds as the first TDR is back in the start position, awaiting the next tool joint. FIG. 21B. Close-up of the first TDR at t=129 seconds.

FIG. 22A. A block diagram showing one embodiment of a detailed operational sequence for the first approximately 46.5% of one cycle of drilling at 1 foot/second. FIG. 22B. A block diagram showing one embodiment of a detailed operational sequence for the last approximately 53.5% of one cycle of drilling at 1 foot/second.

FIG. 23A. Schematic of drilling and tripping system at t=1 second as the first TDR is drilling—rotating and lowering tubular and circulating mud. FIG. 23B. Close-up of the first TDR at t=1 second.

FIG. 24A. Schematic of drilling and tripping system at t=8 seconds as the stand reaches the drill floor, penetration stops and the mud valve is closed. FIG. 24B. Close-up of the first TDR at t=8 seconds.

FIG. 25A. Schematic of drilling and tripping system at t=19 seconds as the fluid connection system of the first TDR retracts and the mud bucket of the first TDR is opened. FIG. 25B. Close-up of the first TDR at t=19 seconds.

FIG. 26A. Schematic of drilling and tripping system at t=23 seconds as the racking arm inserts a new stand while the spinner and upper torque wrench of the first TDR engages. FIG. 26B. Close-up of the first TDR at t=23 seconds.

FIG. 27A. Schematic of drilling and tripping system at t=26 seconds as the spinner and upper torque wrench of the first TDR connects the new stand. FIG. 27B. Close-up of the first TDR at t=26 seconds.

FIG. 28A. Schematic of drilling and tripping system at t=30 seconds as the spinner and upper torque wrench of the first TDR disengages. FIG. 28B. Close-up of the first TDR at t=30 seconds.

FIG. 29A. Schematic of drilling and tripping system at t=34 seconds as the second TDR engages with the tubular at the top of the derrick. FIG. 29B. Close-up of the first TDR at t=34 seconds.

FIG. 30A. Schematic of drilling and tripping system at t=36 seconds as the first TDR retracts from the well center. FIG. 30B. Close-up of the first TDR at t=36 seconds.

FIG. 31A. Schematic of drilling and tripping system at t=43 seconds as the first TDR is lifted to the top of the derrick. FIG. 31B. Close-up of the first TDR at t=43 seconds.

FIG. 32A. Schematic of drilling and tripping system at t=50 seconds as the drilling continues via the second TDR. FIG. 32B. Close-up of the first TDR and the second TDR at t=50 seconds.

FIG. 33A. Schematic of drilling and tripping system at t=129 seconds as the second TDR reaches the drill floor and penetration stops. FIG. 33B. Close-up of the second TDR at t=129 seconds.

FIG. 34A. Schematic of drilling and tripping system at t=146 seconds as the second TDR disconnects while the racking arm brings in the next stand. FIG. 34B. Close-up of the second TDR at t=146 seconds.

FIG. 35A. Schematic of drilling and tripping system at t=152 seconds as the second TDR connects the new stand. FIG. 35B. Close-up of the second TDR at t=152 seconds.

FIG. 36A. Schematic of drilling and tripping system at t=162 seconds as the first TDR engages the top of the new stand. FIG. 36B. Close-up of the first TDR at t=162 seconds.

FIG. 37A. Schematic of drilling and tripping system at t=165 seconds as the first TDR picks up the weight, rotational load and engages the fluid connections system. FIG. 37B. Close-up of the first TDR at t=165 seconds.

FIG. 38A. Schematic of drilling and tripping system at t=170 seconds as the second TDR has retracted and the first TDR is drilling. FIG. 38B. Close-up of the first TDR at t=170 seconds.

FIG. 39A. Schematic of drilling and tripping system at t=175 seconds as the second TDR is raised to the top of the derrick. FIG. 39B. Close-up of the first TDR at t=175 seconds.

FIG. 40A. Schematic of drilling and tripping system at t=185 seconds as the racking arm positions the next stand. FIG. 40B. Close-up of the first TDR and the second TDR at t=185 seconds.

FIG. 41A. Schematic of drilling and tripping system at t=210 seconds as the first TDR continues to drill. FIG. 41B. Close-up of the first TDR at t=210 seconds.

FIG. 42A. Schematic of drilling and tripping system at t=250 seconds as the first TDR reaches the drill floor and the cycle repeats. FIG. 42B. Close-up of the first TDR at t=250 seconds.

FIG. 43A and FIG. 43B. A block diagram showing one embodiment of a detailed operational sequence for one cycle of removing a tubular from a riser or a cased hole at 3 feet/second without the need for fluid circulation or rotation of the tubular. At the end of the described cycle, the cycle repeats with Channel A performing the tasks done by Channel B and vice-versa. FIG. 43A. A block diagram showing one embodiment of a detailed operational sequence for the first approximately 54.8% of one cycle of removing a tubular from a riser or a cased hole at 3 feet/second without the need for fluid circulation or rotation of the tubular. FIG. 43B. A block diagram showing one embodiment of a detailed operational sequence for the last approximately 45.2% of one cycle of removing a tubular from a riser or a cased hole at 3 feet/second without the need for fluid circulation or rotation of the tubular.

The drilling and tripping system is shown at t=32 seconds as the second TDR picks up the weight and the first TDR retracts.

Figure 52:
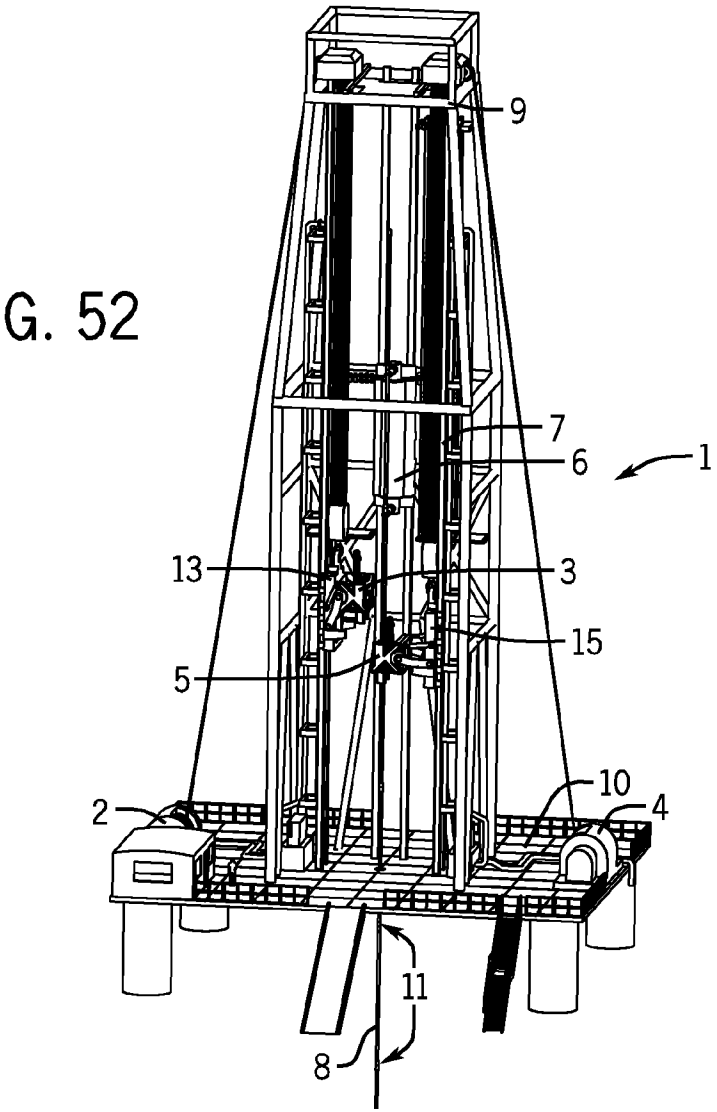

FIG. 52. A schematic representation of the drilling and tripping system shown in FIG. 1 during removal of the tubular from a hole at 3 feet/second without circulation or rotation. The drilling and tripping system is shown at t=36 seconds as the second TDR disconnects the tool joint while the first TDR descends the derrick.

Figure 53:
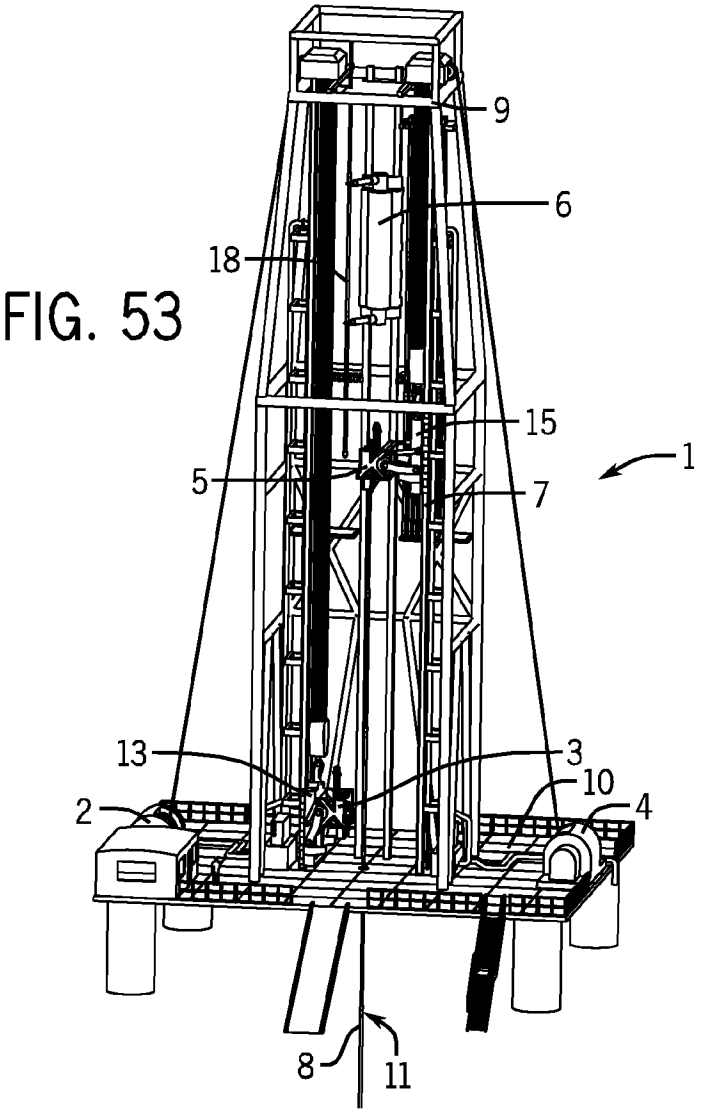

FIG. 53. A schematic representation of the drilling and tripping system shown in FIG. 1 during removal of the tubular from a hole at 3 feet/second without circulation or rotation. The drilling and tripping system is shown at t=49 seconds as the second TDR has disconnected the stand and the racking arm racks it.

Figure 54:
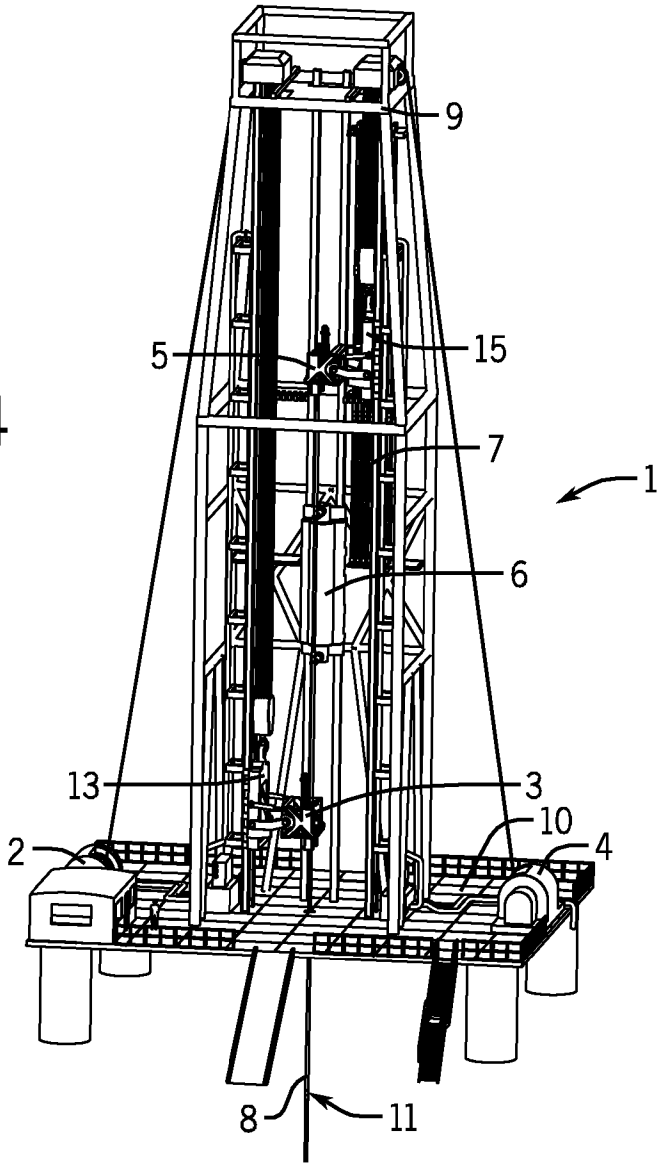

FIG. 54. A schematic representation of the drilling and tripping system shown in FIG. 1 during removal of the tubular from a hole at 3 feet/second without circulation or rotation. The drilling and tripping system is shown at t=60 seconds as the cycle repeats.

Figure 55:
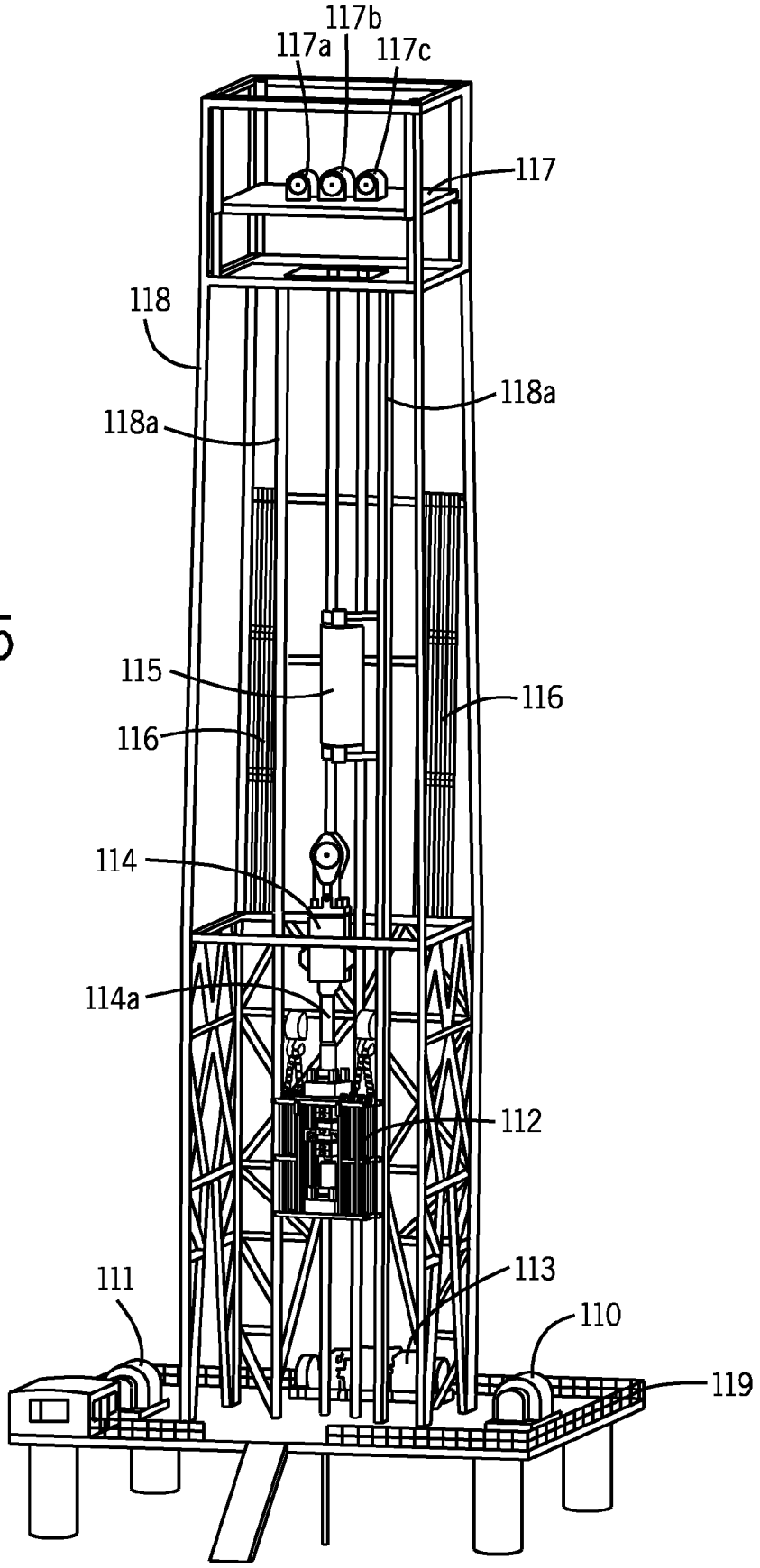

FIG. 55. A schematic representation of another embodiment of a disclosed drilling and tripping system.

Figure 56:
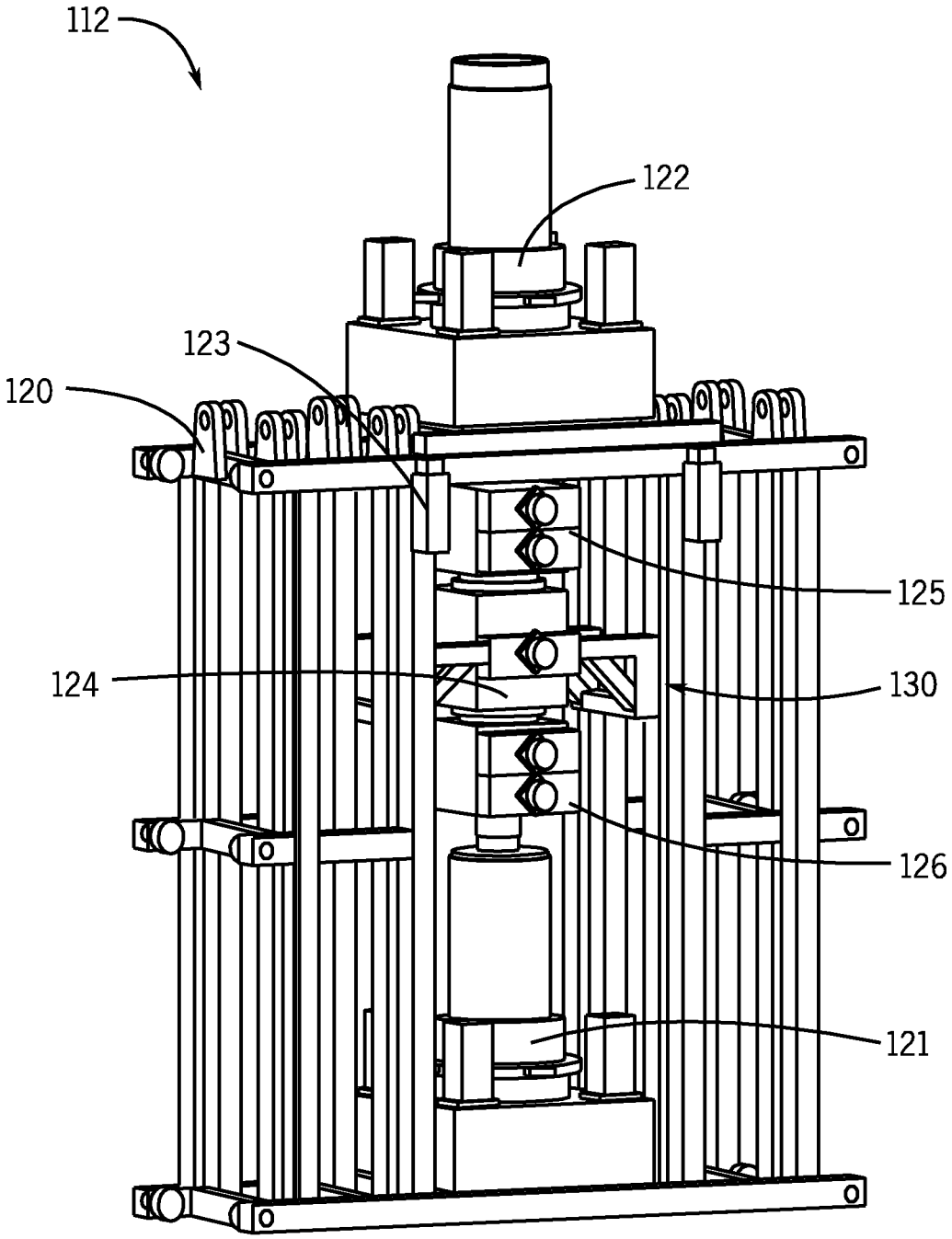

FIG. 56. A schematic representation of one embodiment of a travelling differential roughneck.

Figure 57:
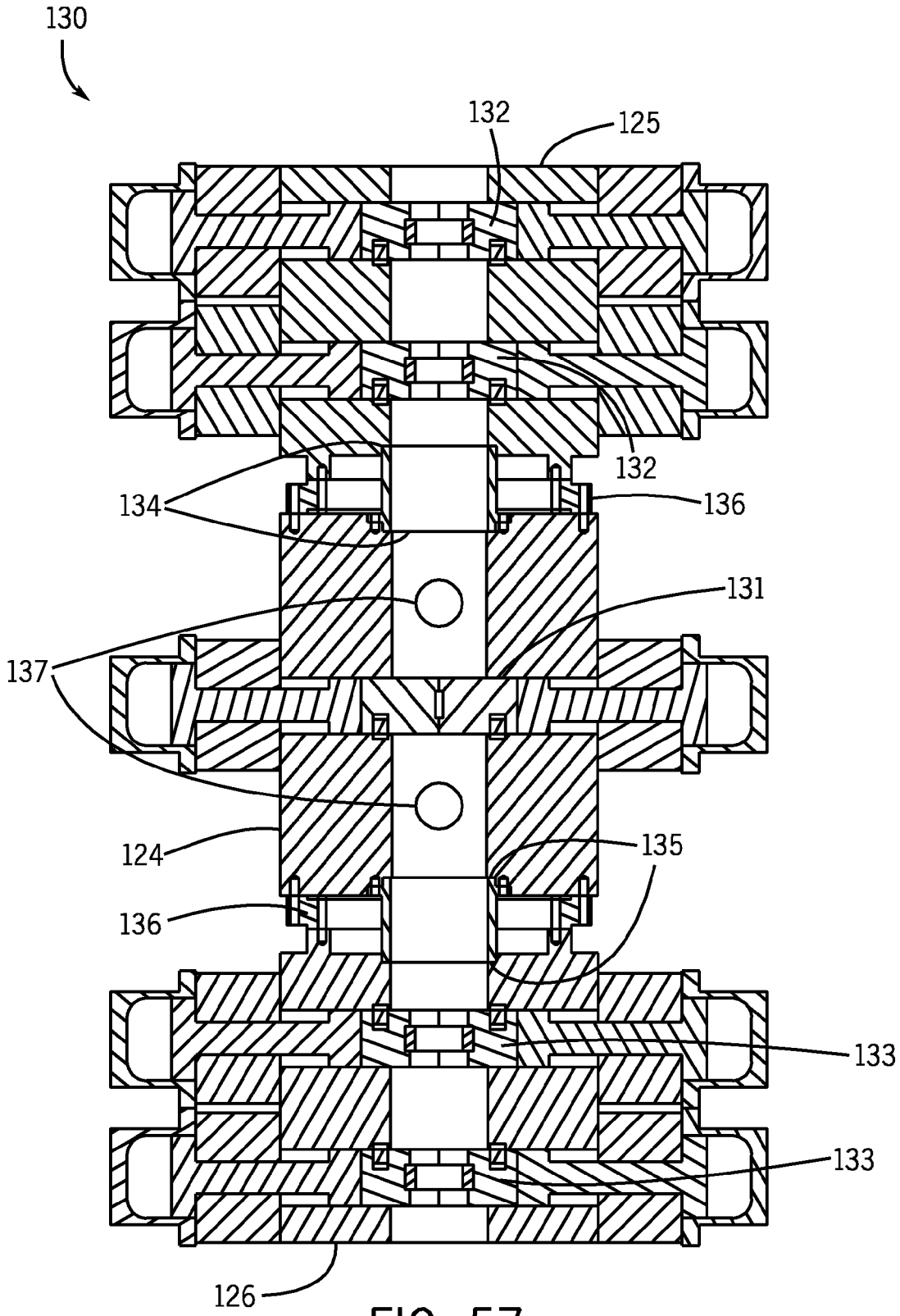

FIG. 57. A schematic representation of one embodiment of a mud bucket.

Figure 58:
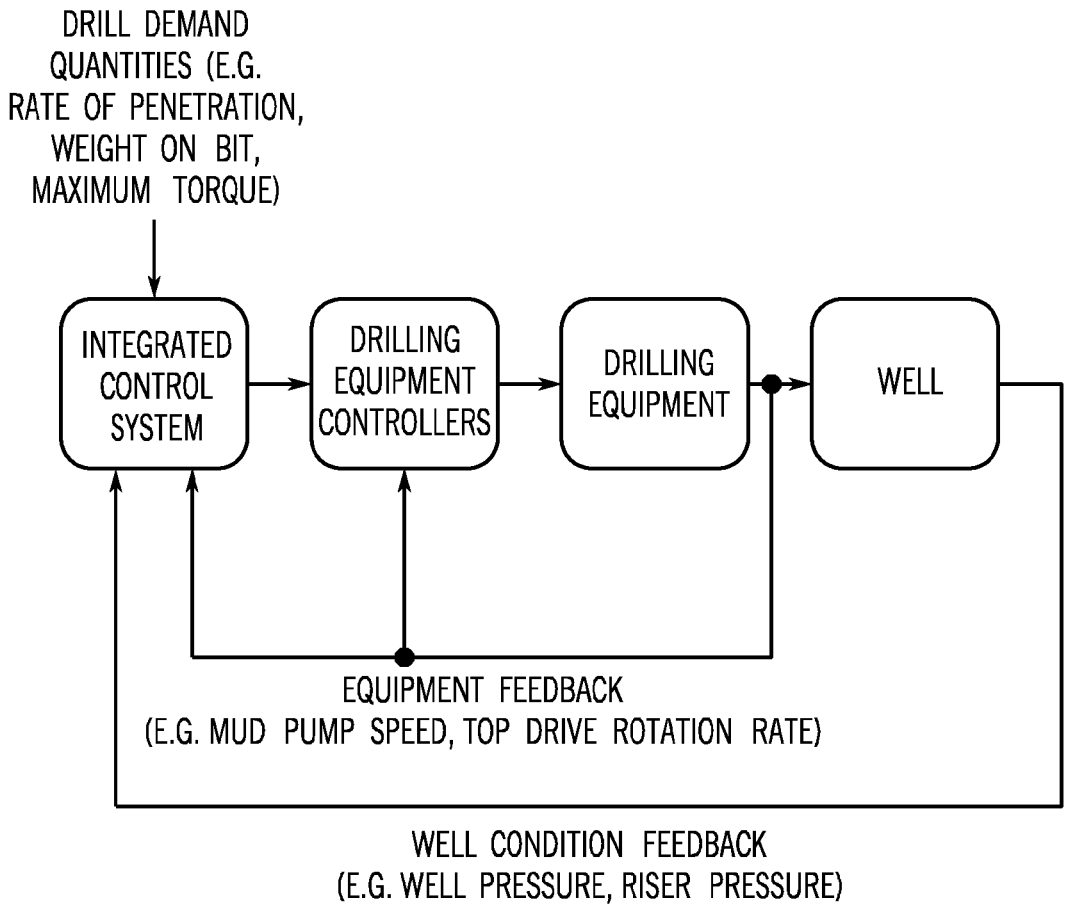

FIG. 58. A block diagram of one embodiment of a concept of an integrated control system.

Figure 59:
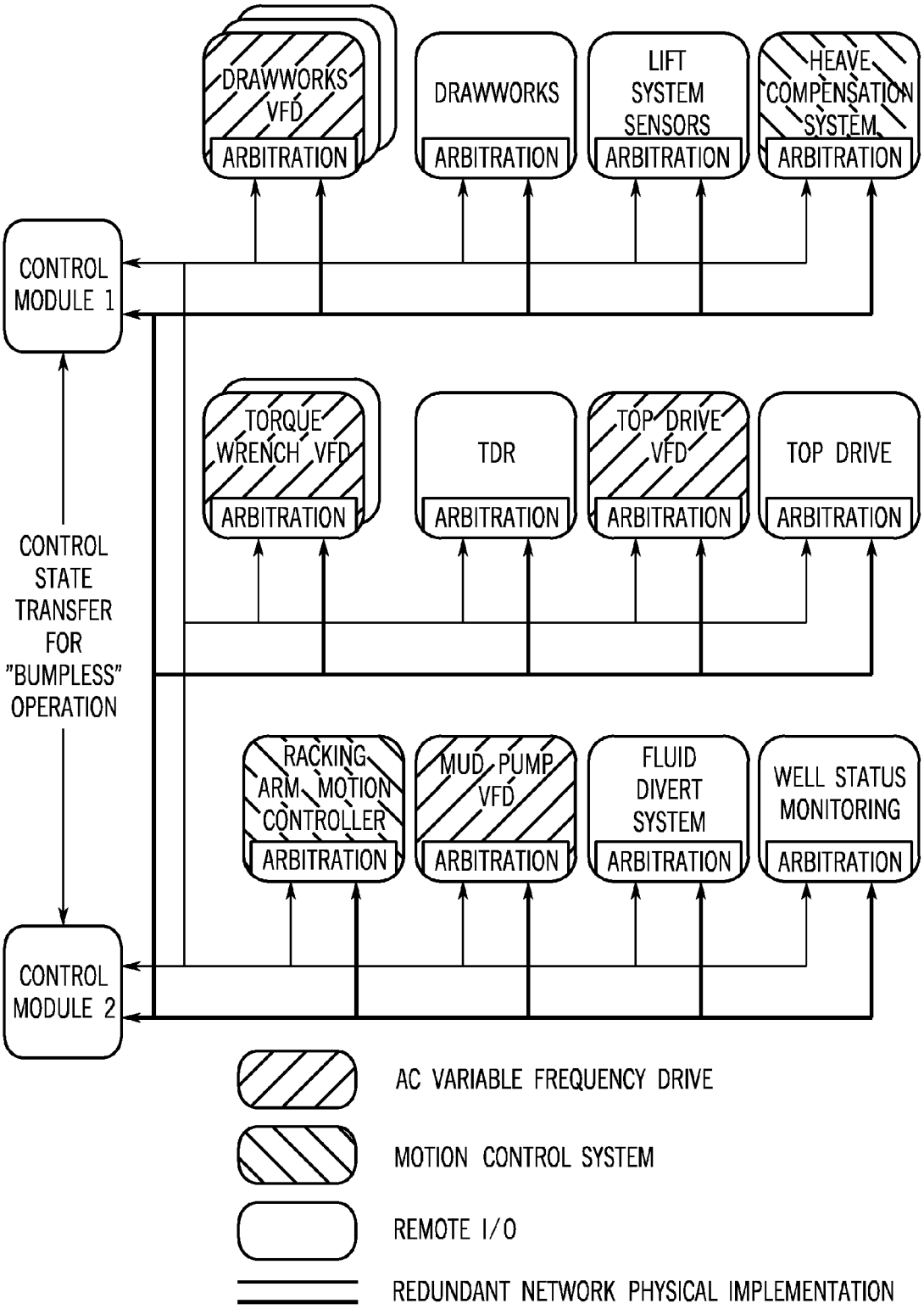

FIG. 59. A block diagram of one embodiment of an integrated control system top level hardware.

Figures 60, 61, 62, 63:
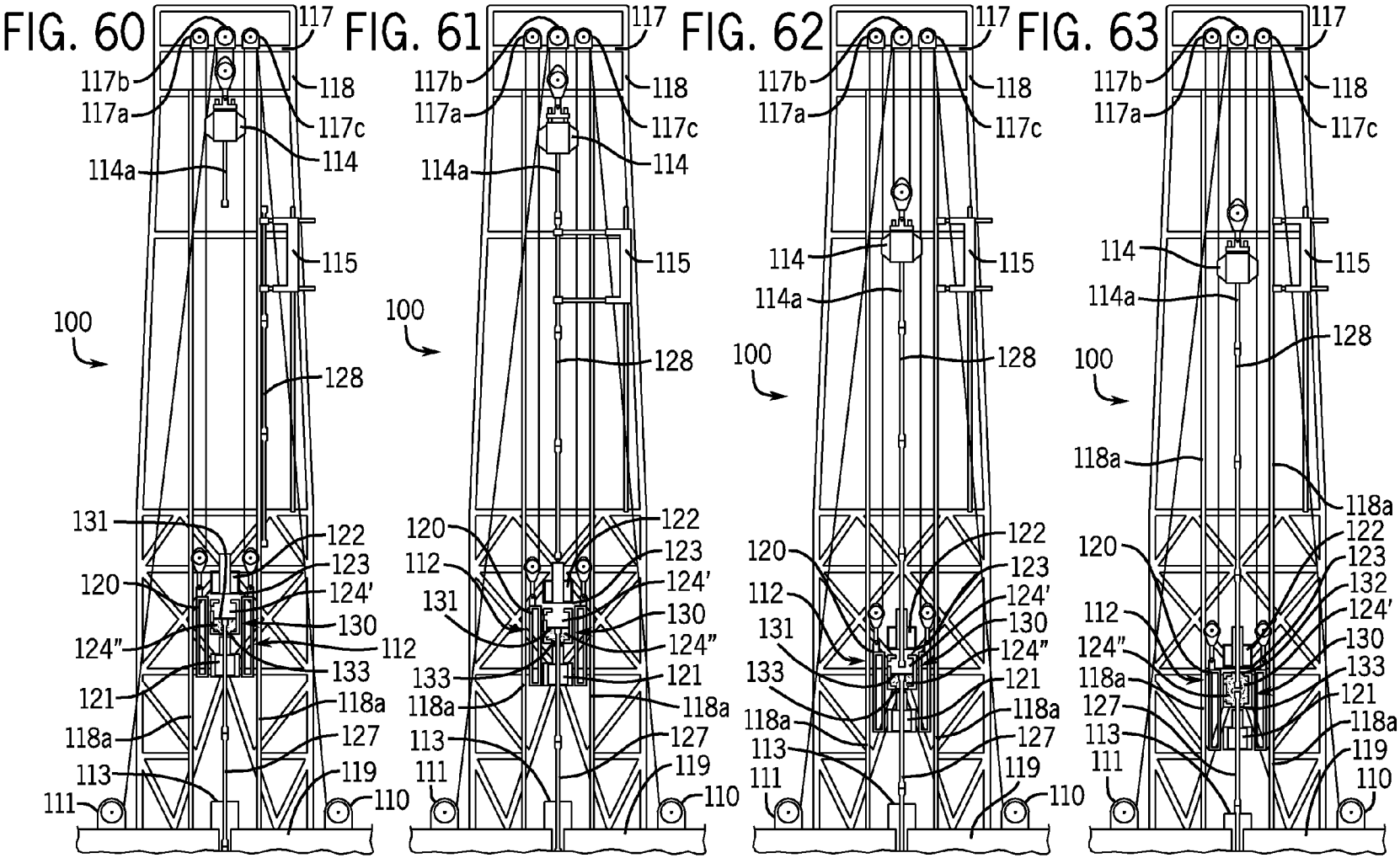

FIG. 60. A schematic representation of the drilling and tripping system shown in FIG. 55 during drilling at 1 foot/second at t=0 seconds (starting state).

FIG. 61. A schematic representation of the drilling and tripping system shown in FIG. 55 during drilling at 1 foot/second at t=3 seconds as the racking arm moves the top joint of the new stand of tubular under the saver sub, the top drive floating mechanism applies an insertion force and the top drive makes up the joint between the saver sub and the stand.

FIG. 62. A schematic representation of the drilling and tripping system shown in FIG. 55 during drilling at 1 foot/second at t=17 seconds as the top drive accelerates downwards to catch up with the TDR and spins up to drilling speed, the top drive floating mechanism retracts, and the bottom joint of the new stand is inserted into the upper chamber of the mud bucket.

FIG. 63. A schematic representation of the drilling and tripping system shown in FIG. 55 during drilling at 1 foot/second at t=21 seconds as the upper seal closes around the new pipe stand and the fluid divert system directs fluid through the top drive filling the stand and mud bucket.

Figures 64, 65, 66, 67:
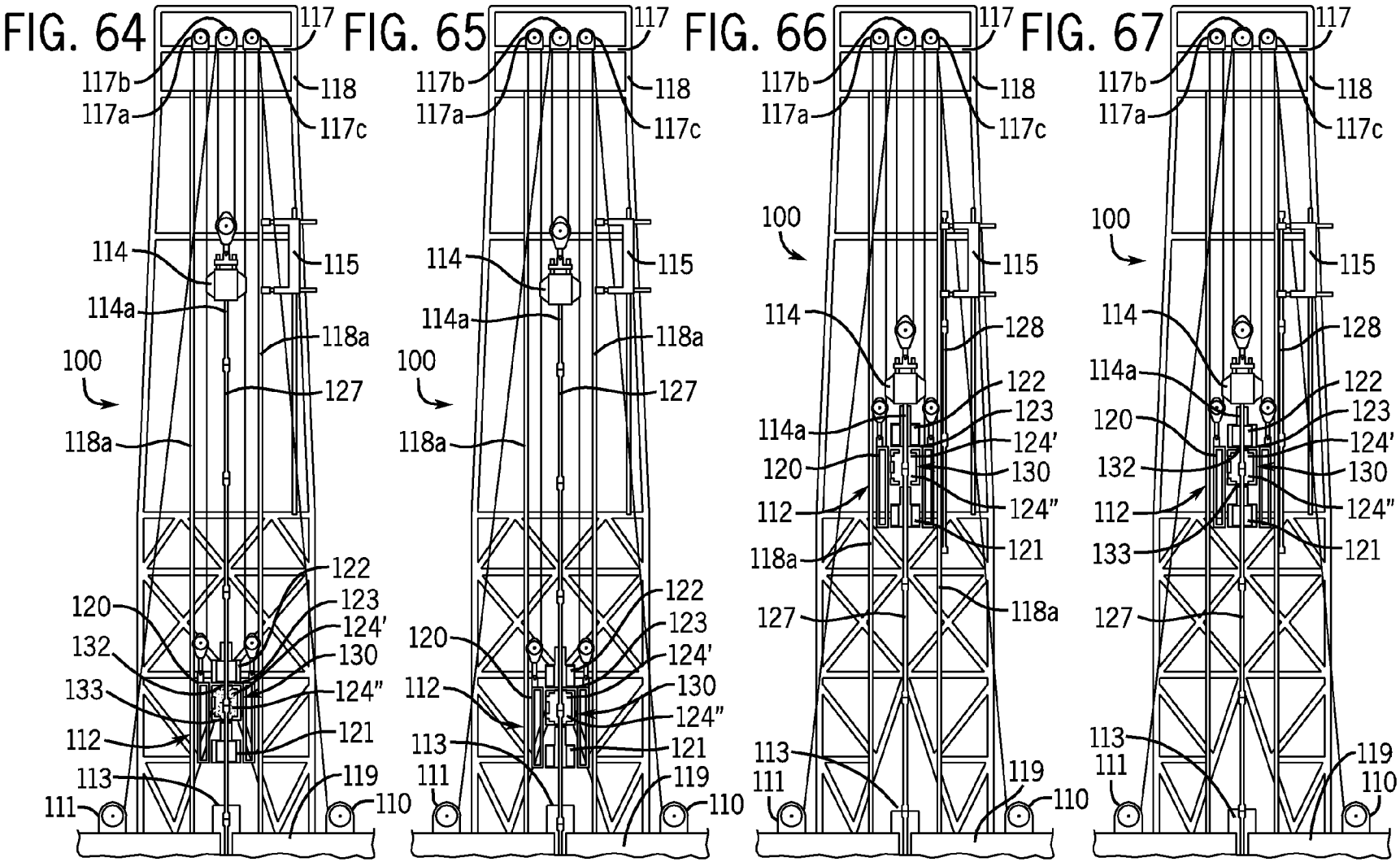

FIG. 64. A schematic representation of the drilling and tripping system shown in FIG. 55 during drilling at 1 foot/second at t=25 seconds as the upper torque wrench engages on the pipe, the top drive float mechanism applies an insertion force and the top drive increases speed to make up the joint between the stand and drilling tubular.

FIG. 65. A schematic representation of the drilling and tripping system shown in FIG. 55 during drilling at 1 foot/second at t=26 seconds as the upper and lower torque wrenches disengage, transferring the weight of the drilling tubular to the top drive, drilling fluid is vacuumed from the mud bucket and the upper and lower mud bucket seals open.

FIG. 66. A schematic representation of the drilling and tripping system shown in FIG. 55 during drilling at 1 foot/second at t=56 seconds as the top drive carries on drilling down, the TDR is lifted to a position ready to retake the drilling tubular from the top drive, and as the saver sub joint starts to enter the TDR, the TDR accelerates down to match motion with the top drive.

FIG. 67. A schematic representation of the drilling and tripping system shown in FIG. 55 during drilling at 1 foot/second at t=56 seconds as the upper and lower torque wrenches engage above and below the saver sub joint and the upper and lower mud bucket seals close.

Figures 68, 69, 70, 71:
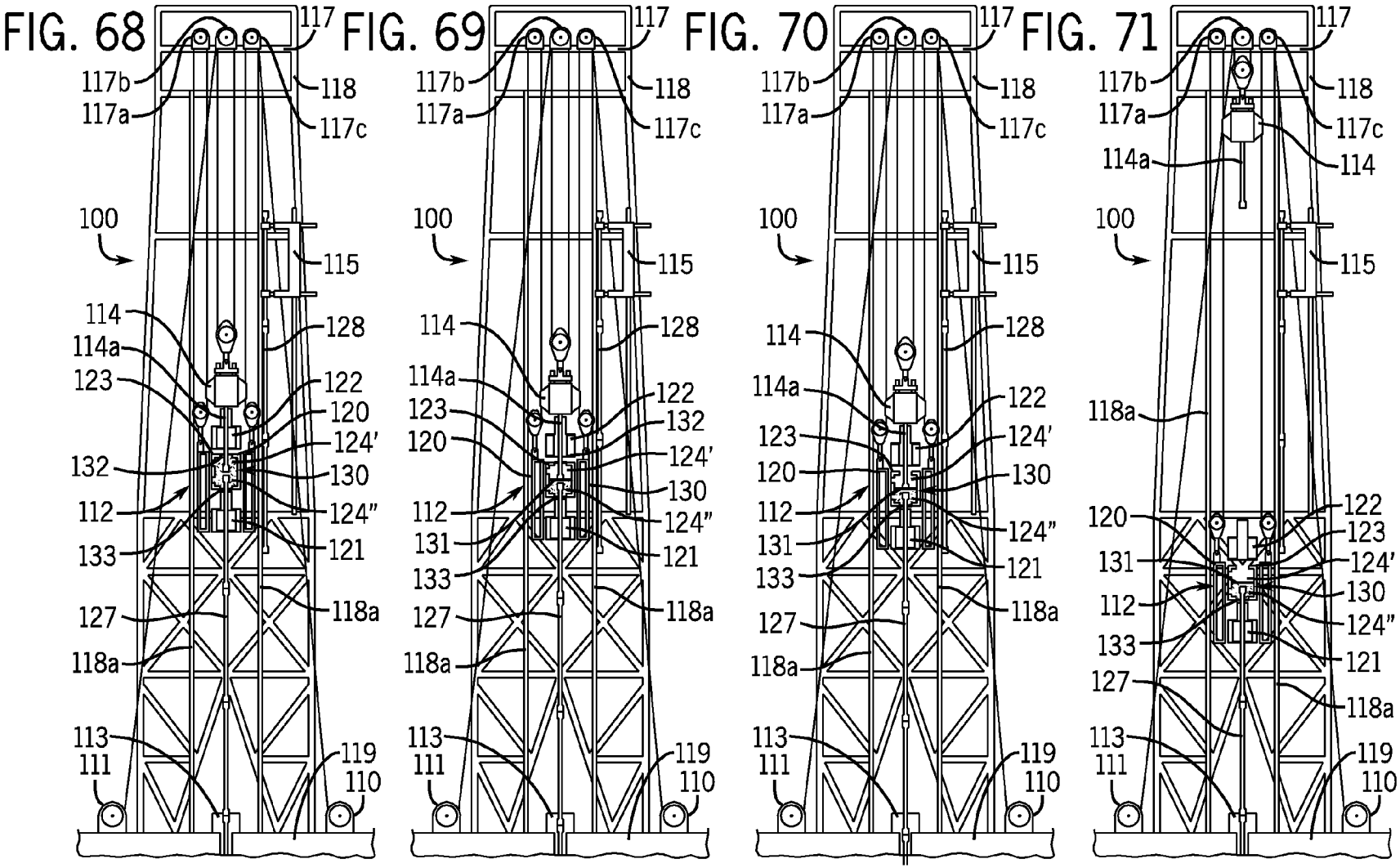

FIG. 68. A schematic representation of the drilling and tripping system shown in FIG. 55 during drilling at 1 foot/second at t=57 seconds as the fluid divert system directs fluid into the lower chamber of the TDR and the top drive and upper torque wrench float mechanisms apply a separation force to the joint while the upper and lower torque wrenches break it out.

FIG. 69. A schematic representation of the drilling and tripping system shown in FIG. 55 during drilling at 1 foot/second at t=60 seconds as the upper torque wrench disengages, the TDR carries the weight of the drilling tubular, the middle mud bucket seal closes and mud is vacuumed from the upper chamber and saver sub.

FIG. 70. A schematic representation of the drilling and tripping system shown in FIG. 55 during drilling at 1 foot/second at t=63 seconds as the upper mud bucket seal opens and the top drive is fully disengaged from the drilling tubular and TDR.

FIG. 71. A schematic representation of the drilling and tripping system shown in FIG. 55 during drilling at 1 foot/second at t=91 seconds as the top drive hoist lifts back to the highest position ready for the next cycle, while the TDR continues drilling down.

Figures 72, 73, 74, 75:
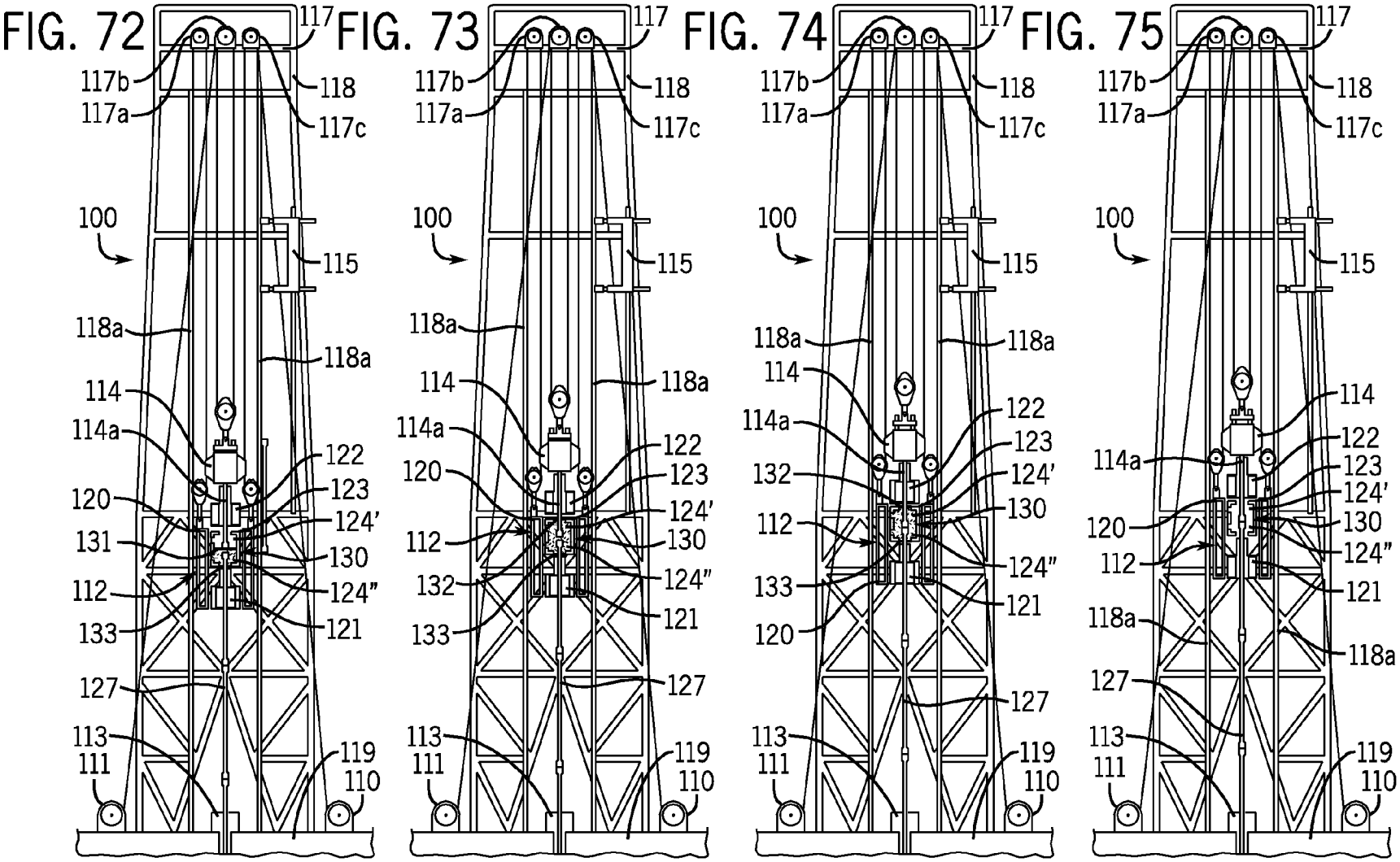

FIG. 72. A schematic representation of the drilling and tripping system shown in FIG. 55 during back reaming at 1 foot/second at t=0 seconds (starting state).

FIG. 73. A schematic representation of the drilling and tripping system shown in FIG. 55 during back reaming at 1 foot/second at t=4 seconds as the upper mud bucket seal closes around the saver sub, the fluid divert system starts directing drilling fluid through the top drive and saver sub, filling the mud bucket, and the middle mud bucket seal opens, joining the upper and lower chambers.

FIG. 74. A schematic representation of the drilling and tripping system shown in FIG. 55 during back reaming at 1 foot/second at t=8 seconds as the upper torque wrench engages with the saver sub, the top drive and upper torque wrench float mechanisms apply an insertion force and the upper torque wrench makes up the saver sub joint.

FIG. 75. A schematic representation of the drilling and tripping system shown in FIG. 55 during back reaming at 1 foot/second at t=9 seconds as the upper and lower torque wrenches disengage, the top drive takes the weight of the drilling tubular, drilling fluid is vacuumed from the mud bucket and the upper and lower mud bucket seals open.

Figures 76, 77, 78, 79:
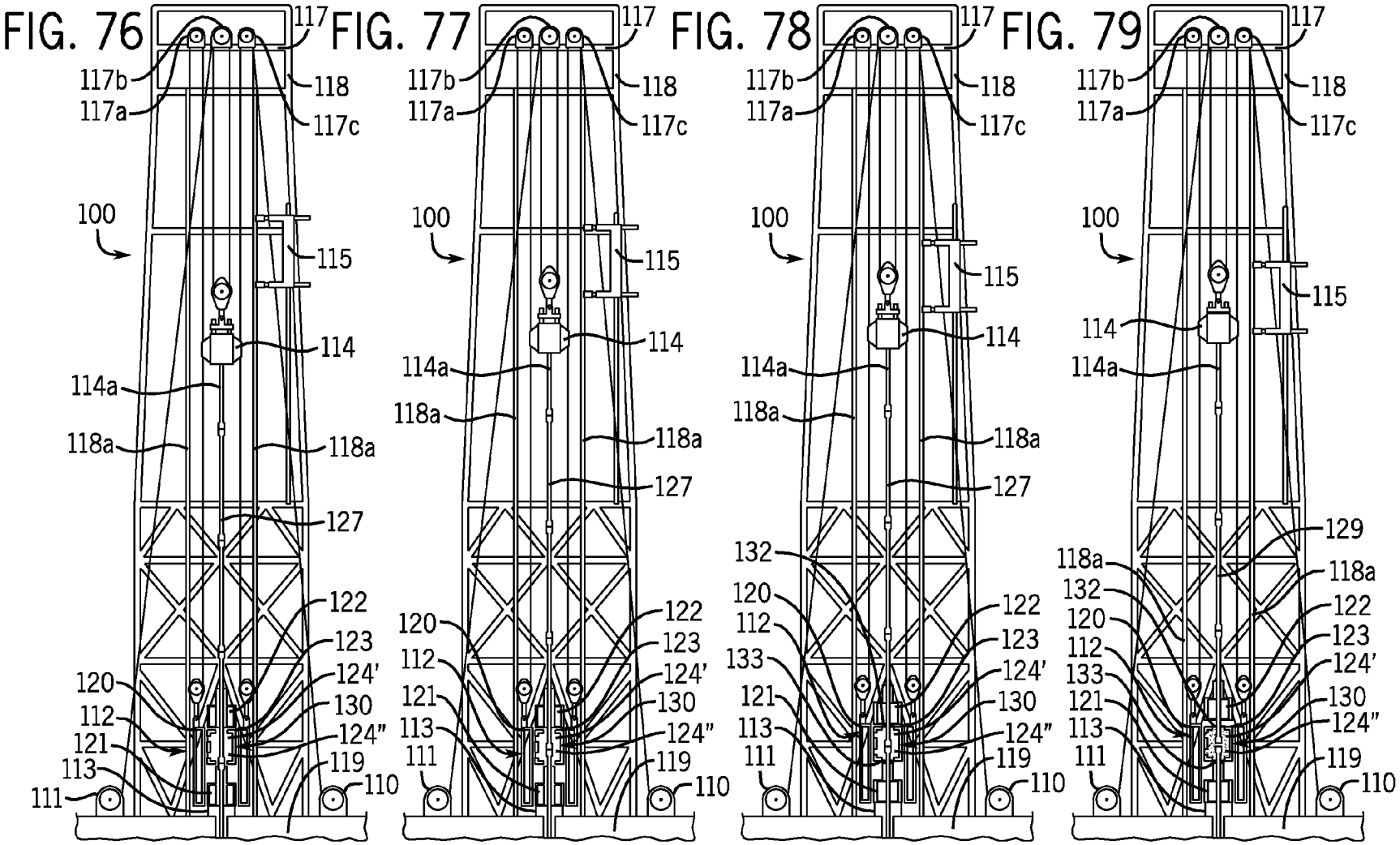

FIG. 76. A schematic representation of the drilling and tripping system shown in FIG. 55 during back reaming at 1 foot/second at t=35 seconds as the TDR moves to its lowest position while the top drive hoist continues to pull the drilling tubular from the hole.

FIG. 77. A schematic representation of the drilling and tripping system shown in FIG. 55 during back reaming at 1 foot/second at t=38 seconds as the system waits until the bottom joint of the next stand to be removed starts to enter the TDR, and the TDR matches vertical velocity with top drive.

FIG. 78. A schematic representation of the drilling and tripping system shown in FIG. 55 during back reaming at 1 foot/second at t=39 seconds as the upper and lower mud bucket seals close and the upper and lower torque wrenches engage with the tubular either side of the joint.

FIG. 79. A schematic representation of the drilling and tripping system shown in FIG. 55 during back reaming at 1 foot/second at t=40 seconds as the top drive and upper torque wrench float mechanism apply a separation force, the upper wrench breaks out the joint and the fluid divert system directs drilling fluid into the mud bucket.

Figures 80, 81, 82, 83:
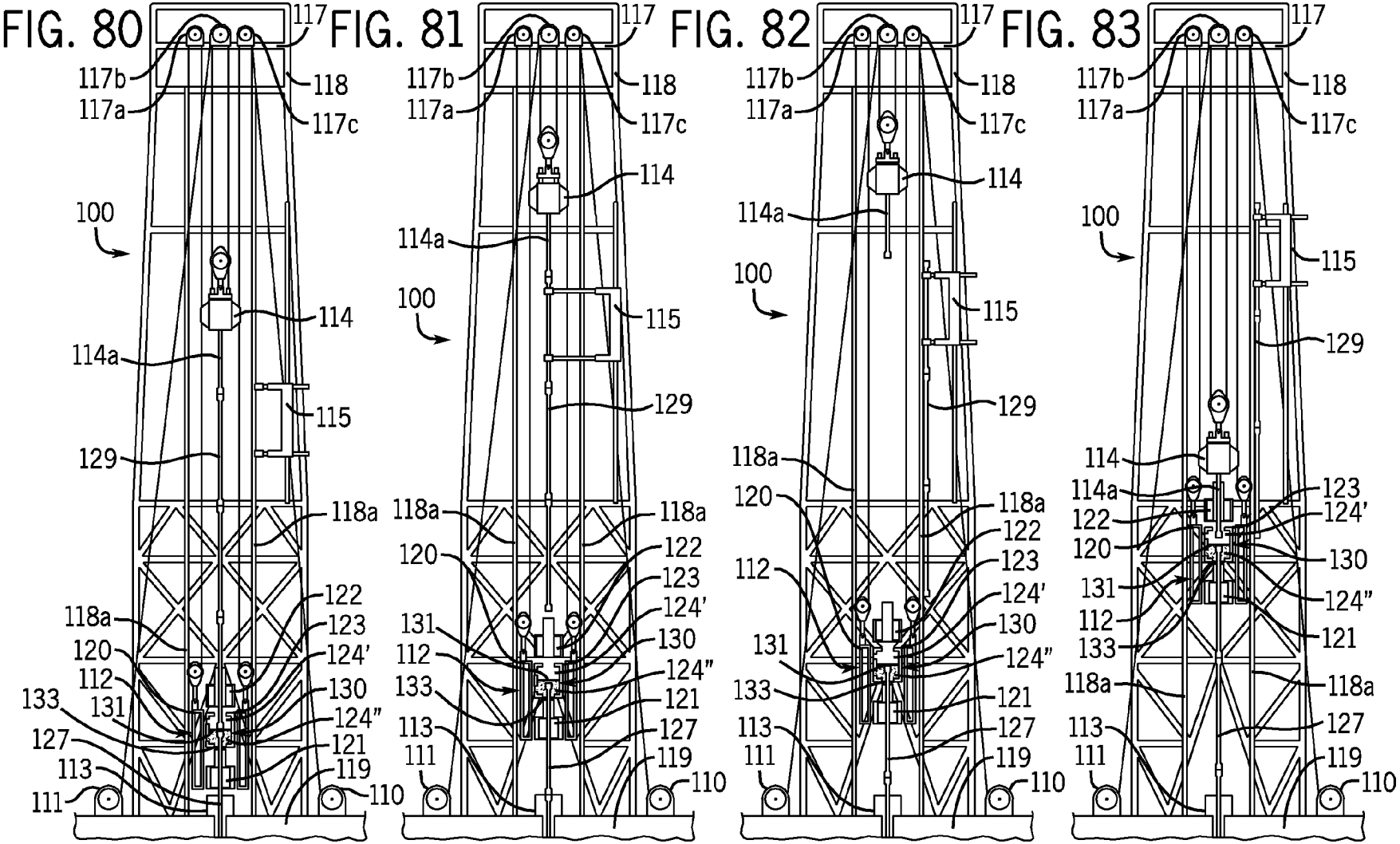

FIG. 80. A schematic representation of the drilling and tripping system shown in FIG. 55 during back reaming at 1 foot/second at t=43 seconds as the upper torque wrench disengages, the middle mud bucket seal closes, fluid is vacuumed from the upper chamber of the mud bucket and the saver sub and the upper seal is opened.

FIG. 81. A schematic representation of the drilling and tripping system shown in FIG. 55 during back reaming at 1 foot/second at t=58 seconds as the top drive accelerates upwards so that the lower end of the stand clears the top of the TDR, with the top drive maintaining this distance above the TDR, the top drive stops rotating, the TDR continues pulling tubular from the hole and the racking arm moves in and grips the stand.

FIG. 82. A schematic representation of the drilling and tripping system shown in FIG. 55 during back reaming at 1 foot/second at t=64 seconds as the top drive float mechanism applies a separation force, the top drive breaks out the saver sub joint, the racking arm withdraws the stand and then begins the process of returning the stand to the pipe rack ready for the next cycle.

FIG. 83. A schematic representation of the drilling and tripping system shown in FIG. 55 during back reaming at 1 foot/second at t=100 seconds as the top drive lowers back down to the starting position ready for the next cycle. Once the saver sub joint enters the mud bucket, the top drive matches vertical velocity with the TDR and starts rotating at the same speed as the drilling tubular.

Figures 84, 85, 86, 87:
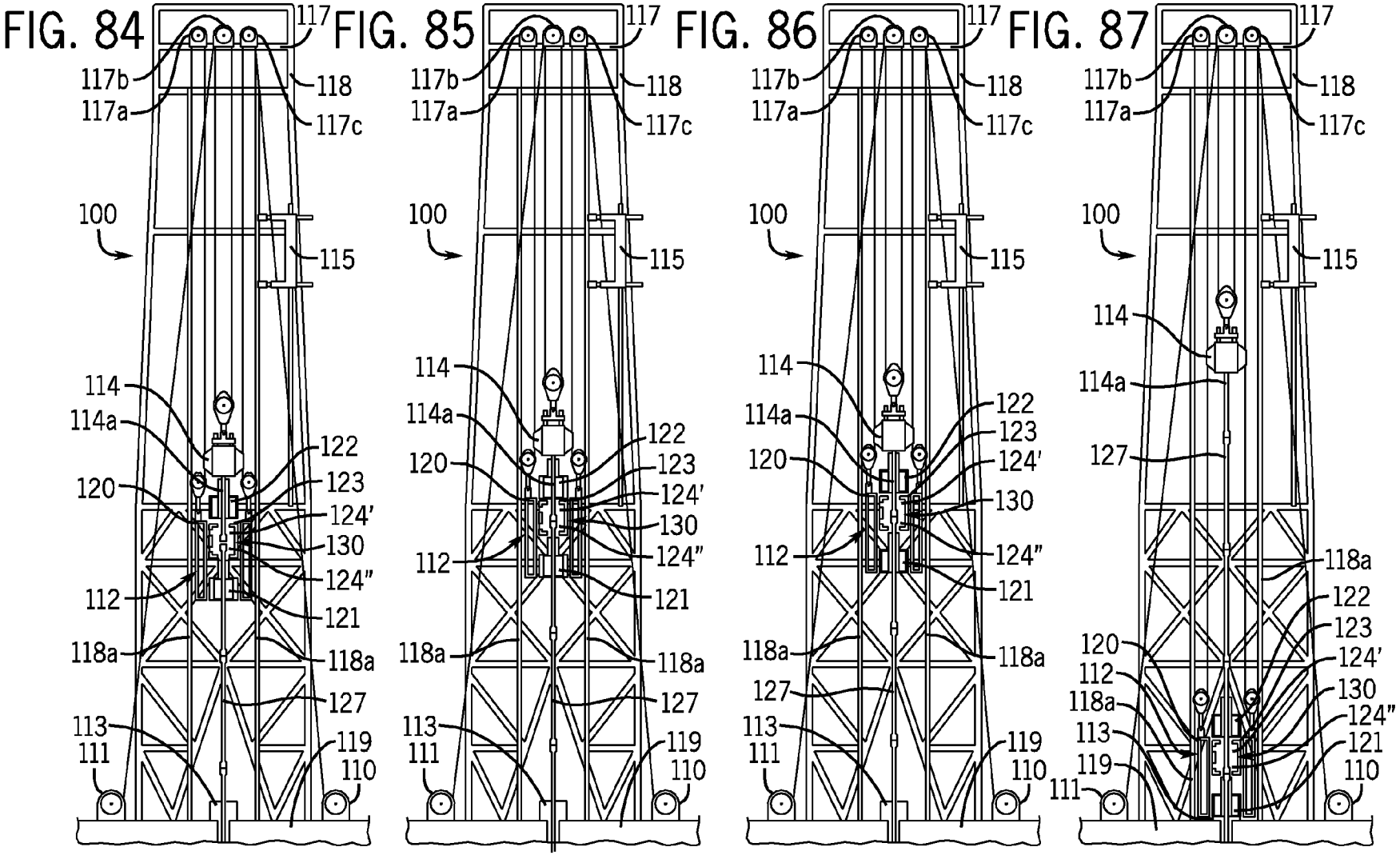

FIG. 84. A schematic representation of the drilling and tripping system shown in FIG. 55 during tripping out at 3 feet/second at t=0 seconds (starting state).

FIG. 85. A schematic representation of the drilling and tripping system shown in FIG. 55 during tripping out at 3 feet/second at t=2 seconds as the upper torque wrench engages with the saver sub, the top drive and upper torque wrench float mechanisms apply an insertion force and the upper torque wrench makes up the saver sub joint.

FIG. 86. A schematic representation of the drilling and tripping system shown in FIG. 55 during tripping out at 3 feet/second at t=3 seconds as the upper and lower torque wrenches disengage and the top drive takes the weight of the drilling tubular.

FIG. 87. A schematic representation of the drilling and tripping system shown in FIG. 55 during tripping out at 3 feet/second at t=11 seconds as the TDR moves to its lowest position while the top drive hoist continues to pull the drilling tubular from the hole.

Figure 88:
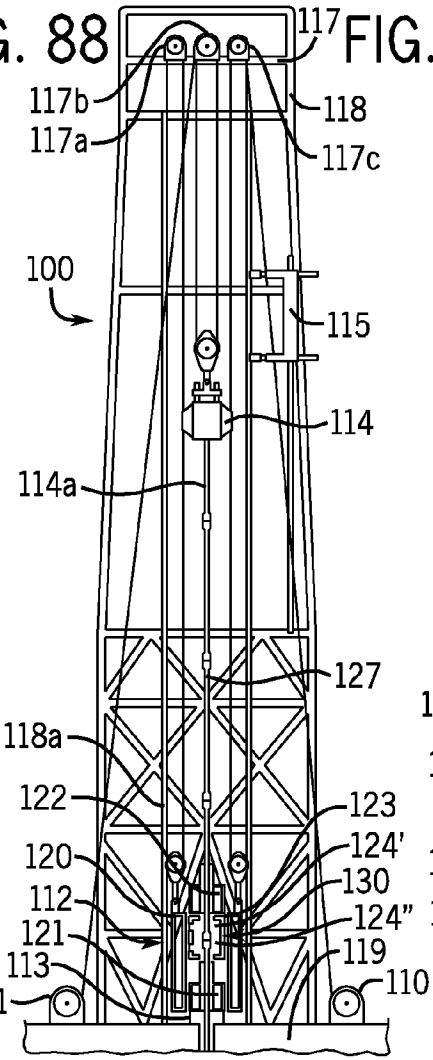

FIG. 88. A schematic representation of the drilling and tripping system shown in FIG. 55 during tripping out at 3 feet/second at t=13 seconds as the system waits until the bottom joint of the next stand to be removed starts to enter the TDR, and the TDR matches vertical velocity with top drive.

Figure 89:
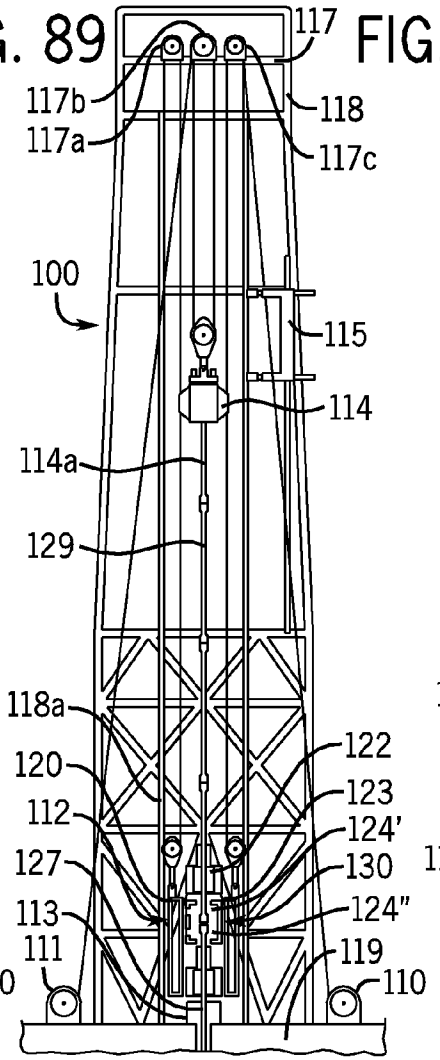

FIG. 89. A schematic representation of the drilling and tripping system shown in FIG. 55 during tripping out at 3 feet/second at t=14 seconds as the upper and lower torque wrenches engage with the tubular either side of the joint, the top drive and upper torque wrench float mechanism apply a separation force and the upper wrench breaks out the joint.

Figure 90:
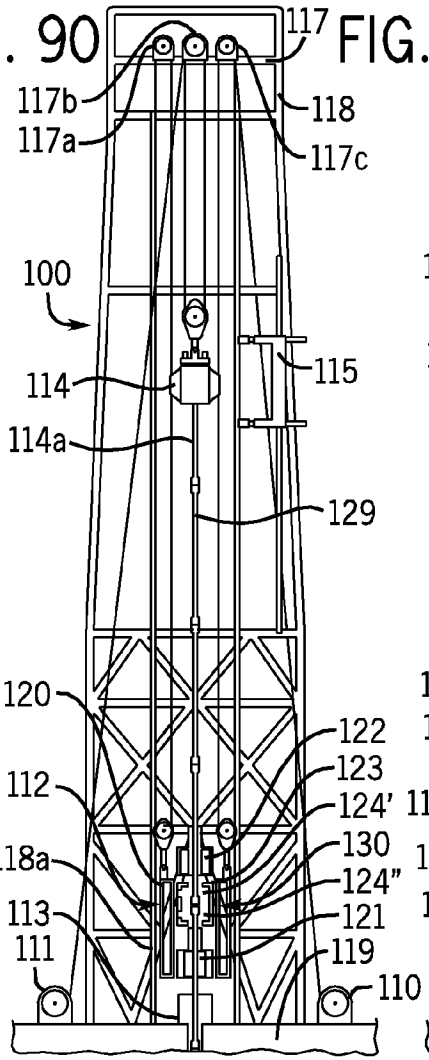

FIG. 90. A schematic representation of the drilling and tripping system shown in FIG. 55 during tripping out at 3 feet/second at t=16 seconds as the upper torque wrench disengages and the TDR supports the weight of the drilling tubular.

Figure 91:
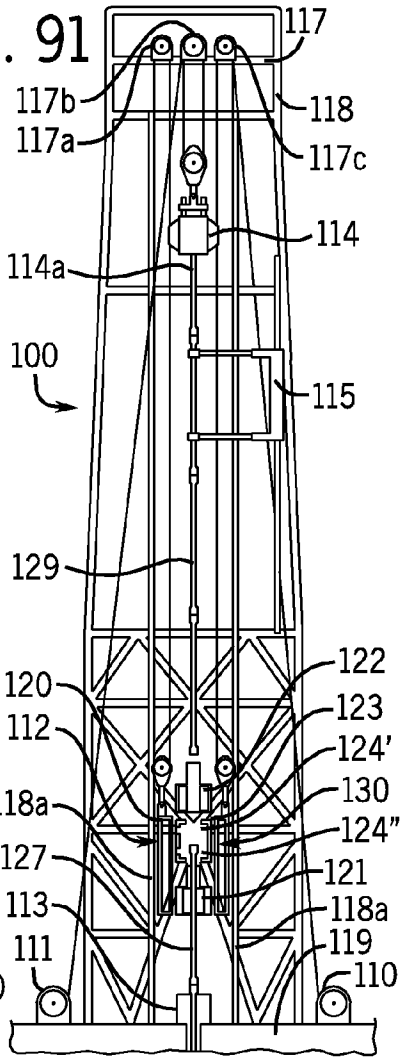

FIG. 91. A schematic representation of the drilling and tripping system shown in FIG. 55 during tripping out at 3 feet/second at t=21 seconds as the top drive accelerates upwards so that the lower end of the stand clears the top of the TDR, the top drive maintains this distance above the TDR and the racking arm moves in and grips the stand.

Figure 92:
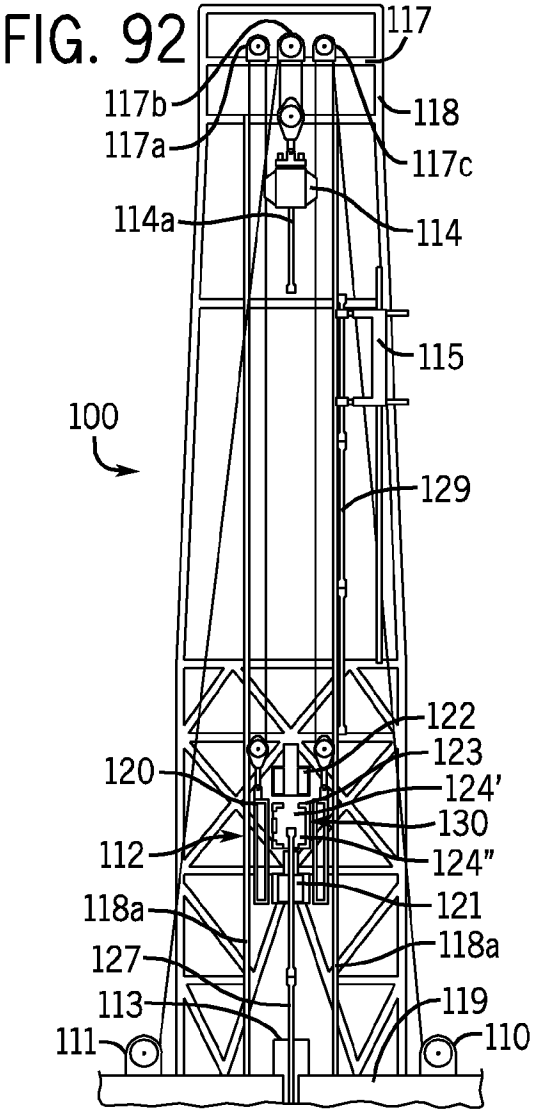

FIG. 92. A schematic representation of the drilling and tripping system shown in FIG. 55 during tripping out at 3 feet/second at t=25 seconds as the top drive float mechanism applies a separation force, the top drive breaks out the saver sub joint, the racking arm withdraws the stand and then begins the process of returning the stand to the pipe rack ready for the next cycle.

Figure 93:
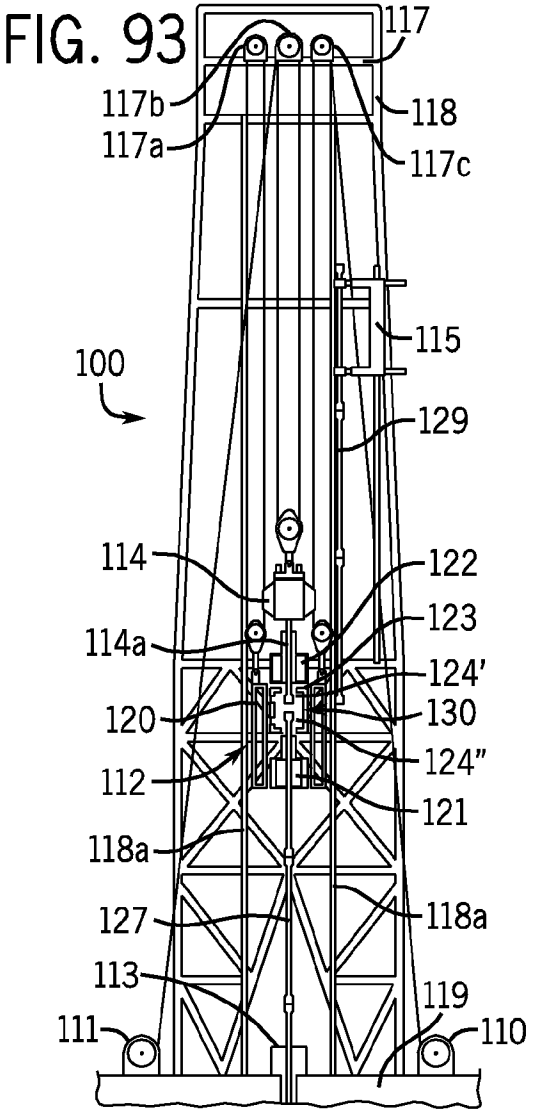

FIG. 93. A schematic representation of the drilling and tripping system shown in FIG. 55 during tripping out at 3 feet/second at t=34 seconds as the top drive lowers back down to the starting position ready for the next cycle. Once the saver sub joint enters the mud bucket, the top drive matches vertical velocity with the TDR such that the saver sub joint stays in the upper mud bucket chamber and the top drive starts rotating at the same speed as the drilling tubular.

Figure 94:
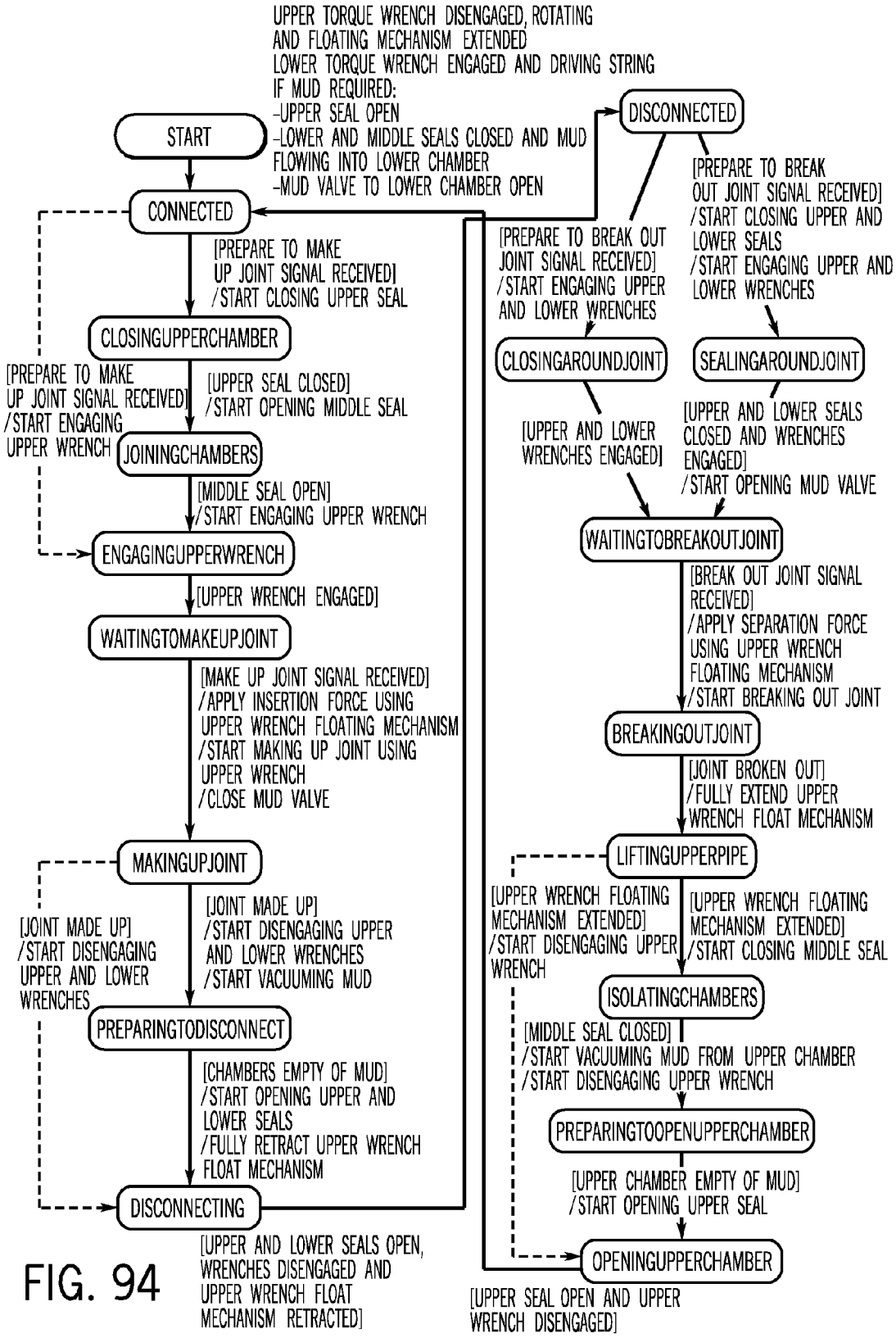

FIG. 94. A block diagram of a TDR state machine.

DETAILED DESCRIPTION OF THE INVENTION

The present disclosure provides a drilling and tripping equipment package and control scheme, such as may be useful for, but is not limited to, operations on any offshore drilling rigs and related methods containing two or more complete systems that operate simultaneously and continuously or nearly continuously in a synchronized manner such that the feeding of tubular into or out of a well bore is achieved with continuous or nearly continuous movement, without the need for periodic interruptions. The drilling and tripping equipment package and control scheme is also able to rotate the tubular in the well bore with continuous speed and torque sufficient for both drilling and back-reaming operations. The drilling and tripping equipment package and control scheme is additionally able to circulate drilling fluid into the internal bore of the tubular with sufficient pressure and flow to facilitate both drilling and back-reaming operations, with minimal interruption to circulation.

The present disclosure also provides a drilling and tripping equipment package and control scheme capable of feeding tubular into or out of a well bore with continuous or nearly continuous movement, without the need for periodic interruptions. The drilling and tripping equipment package and control scheme is also able to rotate the tubular in the well bore with continuous speed and torque sufficient for both drilling and back-reaming operations. The drilling and tripping equipment package and control scheme is additionally able to circulate drilling fluid into the internal bore of the tubular with sufficient pressure and flow to facilitate both drilling and back-reaming operations, with minimal or no interruption to circulation.

As detailed herein, the systems and methods shown and described may be used to automatically control operations and activities in connection with drilling an oil or gas well such that continuous or near continuous operations are achieved. In addition, the integrated control system allows for user input of drilling parameters that may be desired for operation of the system, as well as control of operations based on data relating to ongoing drilling or tripping operations and/or data relevant to drilling or tripping operations that may be stored in memory associated with the control system. The integrated control system alternatively can be used to follow some or all preset parameters and information that it is programmed to follow. The integrated control system thus allows an operator to modify or customize the operations of the integrated control system and the overall system, such as by allowing the operator to specify additional parameters that may indicate an unsafe condition that are an operator preference or are applicable to a given well but not necessarily to other wells or applications. Moreover, the integrated control system and its database can be used to store a wide variety of data regarding drilling activities and operations, wellbore conditions, drilling parameters and the like, which can then be used to evaluate the operations and the well, and to plan one or more other wells and the operations and activities relevant thereto.

Those skilled in the art will appreciate that many terms used in this disclosure are well-known and understood in the related field of art, and do not necessarily need definition. Nevertheless, the following generally understood definitions are provided for additional background and the convenience of the reader. Those skilled in the art will further appreciate that this general usage is not limiting with respect to the invention as claimed.

Back reaming: The process of withdrawing the drill string from the bore hole while rotating.

Break out: Usually the process of breaking (loosening) and spinning out (unscrewing the threads) to disconnect two drill pipes.

Crown block: The upper set of pulleys in a hoist.

Crown mounted compensator: A hydraulic device which compensates for the up and down motion of a ship or rig, usually during offshore operations. This is typically done to raise and lower the top drive so that the drill bit stays in contact with the end of the bore hole.

Drawworks: A motorized unit which is used to feed drill line to or from the hoist.

Drill line: The cable which runs from the drawworks and over the crown and travelling blocks.

Drill pipe: Typically a length of steel pipe, often 10*m* or so long, that forms part of the drill "string". Steel bosses are often welded to either end of the pipe. Generally, one boss incorporates a male thread and the other a female thread. This allows drill pipes to be made up (screwed or otherwise connected together) to form the drill string.

Drill stand: A short sequence of typically two or three drill pipes connected together prior to their use in drilling. Use of a drill stand often speeds up the operations by reducing the number of times pipe joints have to be made up or broken out.

Drill string: Generally, A series of drill pipes which are connected together and lowered into the bore hole. The top end of the drill string usually attaches to the top drive or TDR, while the bottom end usually attaches to the drill bit.

Hoist: Typically a block and tackle system used in conjunction with the drawworks to raise and lower the top drive and TDR.

Make up: The process of connecting one drill pipe with another usually including stabbing (inserting the female thread on one drill pipe into the male thread of another), spinning in (screwing the threads together) and torquing up (tightening the thread).

Mud: A mixture usually pumped through the drill string and out of the bore hole during a drilling or reaming operation. The mud is usually used to provide lubrication for the drill string, carry rock cuttings away from the drill bit, and maintain the correct pressure in the bore hole.

Mud bucket: A container for holding mud which can seal around a portion of a pipe while the joint is broken out or made up.

Racking: Usually an area where pipe stands are held ready for connecting to the drill string, or placed after being broken out.

Rate of penetration (ROP): Typically the vertical speed at which a drill string is lowered into the well bore during drilling.

Saver sub: Often a short length of drill pipe which is connected to the top drive to save wear on the thread on the top drive shaft as joints are broken out and made up. As contemplated in one embodiment for a continuous drilling system, the saver sub will be longer than typical, allowing it to project into the TDR.

Top drive: An electric or hydraulic motor which rotates the drill string such as during drilling or reaming.

Torque wrench: Generally, a motorised wrench which can clamp either side of a pipe joint and provide sufficient torque to make up or break out the joint.

Travelling block: Usually the lower set of pulleys in a hoist.

Travelling differential roughneck (TDR): A device, described and defined in more detail as follows, which can make up and break out pipe joints while the drill string is rotating and/or mud is circulating.

Tripping in: Typically the process of lowering the drill string into the hole prior to drilling.

Tripping out: Usually the process of raising the drill string from the hole after a period of drilling. This is required when, for example, the drill bit needs changing.

Figure 1:
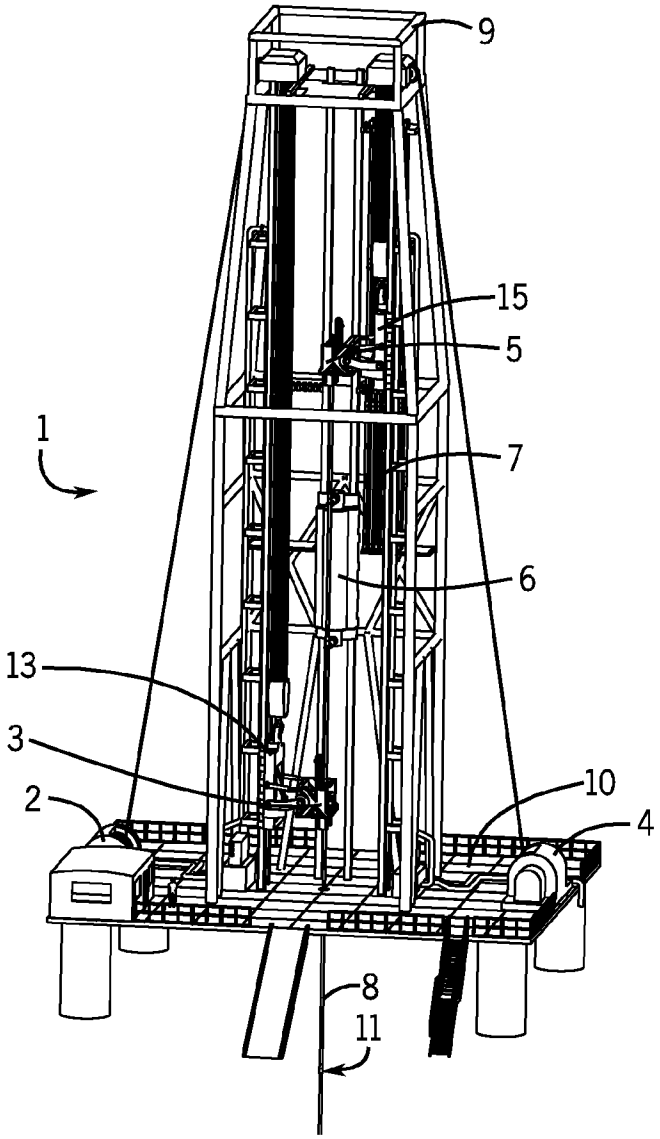
FIG. 1. A schematic representation of one embodiment of a disclosed drilling and tripping system.

Referring now to FIG. 1, a schematic representation of one embodiment of a disclosed drilling and tripping system 1 is shown. In this particular embodiment, drilling and tripping system 1 includes a first drawworks 2 (also referred to herein as drawworks A), a first traveling differential roughneck 3, which is mounted on a first moving dolly 13, a second drawworks 4 (also referred to herein as drawworks B), a second traveling differential roughneck 5, which is mounted on a second moving dolly 15, a racking arm 6, pipe rack 7, tubular 8, and tool joint 11. Also shown in FIG. 1 is a derrick 9 and the drill floor 10 of the derrick 9.

The disclosed drilling and tripping system includes two or more coordinated, automatically controlled lifting systems capable of lifting and/or lowering the rated weight of the tubular, with any required overpull and safety factors. In the embodiment of the drilling and tripping system shown in FIG. 1, this lifting system is a traditional drawworks (winch), although in other embodiments (not shown) the lifting system can be a hydraulic ram, a rack and pinion system, a high load linear motor, or any other device capable of lifting the required weight. The embodiment of the drilling and tripping system shown in FIG. 1 includes a first drawworks 2 and a second drawworks 4.

The disclosed drilling and tripping system also includes two or more coordinated, automatically controlled retractable tools mounted on moving dollies and lifted/lowered by the aforementioned lifting system. This tool is generally referred to as a traveling differential roughneck, or TDR. As depicted in FIG. 1, the drilling and tripping system includes a first TDR 3 (also referred to herein as TDR-A) and a second TDR 5 (also referred to herein as TDR-B). The TDR implements numerous functions, including attaching the lifting device to the tubular, allowing it to be lifted and lowered while rotating, rotating the tubular for drilling and back-reaming operations, making and breaking joints between stands of tubular, containing and returning excess drilling fluid to the drilling fluid system, aligning and connecting stands of tubular while the tubular is rotating and in continuous vertical motion, disconnecting and removing stands while the tubular is rotating and in continuous vertical motion, connecting the high pressure and flow drilling fluid system into the tubular to allow near continuous fluid flow as stands are added and removed from the tubular. Thus, the TDR carries the weight of the drilling tubular or drillstring in a manner that allows free rotation, rotates the drilling tubular with sufficient torque for drilling and back-reaming operations, makes-up and breaks-out tool joints in the tubular, connects and disconnects stands of tubular into and out of connection with existing stands, captures drilling fluid that egresses from the tubular at different points in the operating cycle, cleans and pre-treats tubular threads, and couples the circulating drilling fluid into the tubular for drilling and back-reaming operations. As detailed herein, all of the functions of the TDR may be carried out as the tubular is in continuous rotation and vertical motion.

The bottom part of the TDR includes a rotating elevator bowl (REB; not visible in FIG. 1) that functions to carry the weight of the drilling tubular in such a manner that the tubular is free to rotate. The weight of the tubular is carried on the bottom shoulder of the tool joint. The major components of the REB are: a main body that carries the tubular weight back to the TDR main frame; a bowl that is free to rotate, supported by a thrust bearing wherein the bearing elements are not free to precess as the bowl rotates; an aligned radial opening (termed the "throat") in the main body, the bowl, and the thrust bearing that allows the REB to engage on and off the tubular from the side of the derrick; a "pony" motor (electrical or hydraulic) that is able to rotate the bowl when disconnected from the tubular to allow for alignment of the throat between the bowl and the main body; and sensors to indicate the alignment of the bowl throat with the body throat.

The TDR also includes a lower rotating torque wrench (LTW; not visible in FIG. 1; see, for example, FIG. 23B), which is an electrically or hydraulically powered wrench that engages on the bottom half of the tool joint and is used to rotate the tubular for all drilling operations. The major components of the LTW are: a ring gear with a "gate" that may be opened to create a throat allowing the wrench to engage and disengage the tubular in the horizontal axis (when this "gate" is closed the ring gear is a complete 360° gear ring): one or more motor(s) (hydraulic or electrical) for driving pinion gears that are coupled to the ring gear (the power and speed ratings of these motors, together with the gear ratio of the ring and pinion gears is determined based on the torque and speed requirements of the drilling application); and a plurality of cam locked jaws that can be coupled and uncoupled from the tubular.

The TDR also includes an upper rotating torque wrench (UTW; not visible in FIG. 1; see, for example, FIG. 26B), which is hydraulically powered wrench that engages on the top half of the tool joint and is used to connect and disconnect tool joints in the tubular. Unlike the LTW, the UTW either rotates at zero torque, or makes small incremental movements at high torque, hence its power requirements are much smaller than the LTW. In addition, unlike the LTW, it is necessary to allow the UTW to be retracted from the tool joint in order to allow the mud bucket to engage during spinner and fluid connection operations. Notwithstanding the difference in power rating and the need for retraction, the main components of the UTW are the same as the LTW.

The TDR also includes a spinner (not visible in FIG. 1; see, for example, FIG. 7B), which is a hydraulically or electrically powered device for rapid rotation of stands of tubular during connection and disconnection. The spinner operates after the UTW has "broken" the joint in "pulling out of hole" operations and before the UTW "makes" the joint in "going into hole" operations. In addition, the TDR also includes a mud bucket (MB; not visible in FIG. 1; see, for example, FIG. 9B), which is a two part mud container that closes around the tool joint whenever the egress of drilling fluid is expected. The MB is provided with a suitable vacuum pipe that is able to extract the drilling fluid at its maximum egress rate and return it to the fluid handling system. Also, the MB may have the necessary detergent and air systems to clean drilling fluid from threads that are about to be connected. Additionally, the MB may incorporate a system for dispensing "pipe dope" onto threads that are about to be connected.

The TDR also includes a fluid connection system (FCS; not visible in FIG. 1; see, for example, FIG. 12B and FIG. 25B), which is a retractable quick connect system for connecting the drilling fluid into the top of the drilling tubular during drilling and back-reaming operations, and utilizes similar technology to an inflatable packer. The FCS includes a rotating coupling to allow the tubular to rotate freely, and is rated for suitable pressure and flow for drilling and back-reaming operations. The FCS is equipped with one or more valves for sealing the line from the mud pumps and Drilling Fluid Divert System (FDS; not visible in FIG. 1) as needed during drilling operations. The FDS is an additional series of valves between the mud pumps and the first and second TDR due to the need to rapidly divert drilling fluid to the first TDR, the second TDR, or to neither TDR. The FDS allows drilling fluid to be routed to either the first TDR, the second TDR, or to circulate back to the mud tanks without stopping the mud pumps.

The disclosed drilling and tripping system also includes one or more pipe handling and storage systems that allows stands of drill pipe to be moved from the well center to suitable storage rack(s) as they are disconnected from the drill string and disengaged from the TDR, and to move them back to well center as they engage with the TDR. All of these actions are carried out with the tubular in constant rotation and vertical motion. As depicted in FIG. 1, the main component of this system is a racking arm 6, and also includes a pipe rack 7, although in other in other embodiments (not shown) additional racking arm(s) and/or pipe racks can be included.

The disclosed drilling and tripping system also includes a drilling fluid diverting system (not visible in FIG. 1; see, for example, FIG. 14B and FIG. 37B) that allows drilling fluid to be directed to either the first TDR 3 or the second TDR 5, or to be re-circulated to the mud system (not shown) without stopping the mud pumps (not shown).

Figure 2:
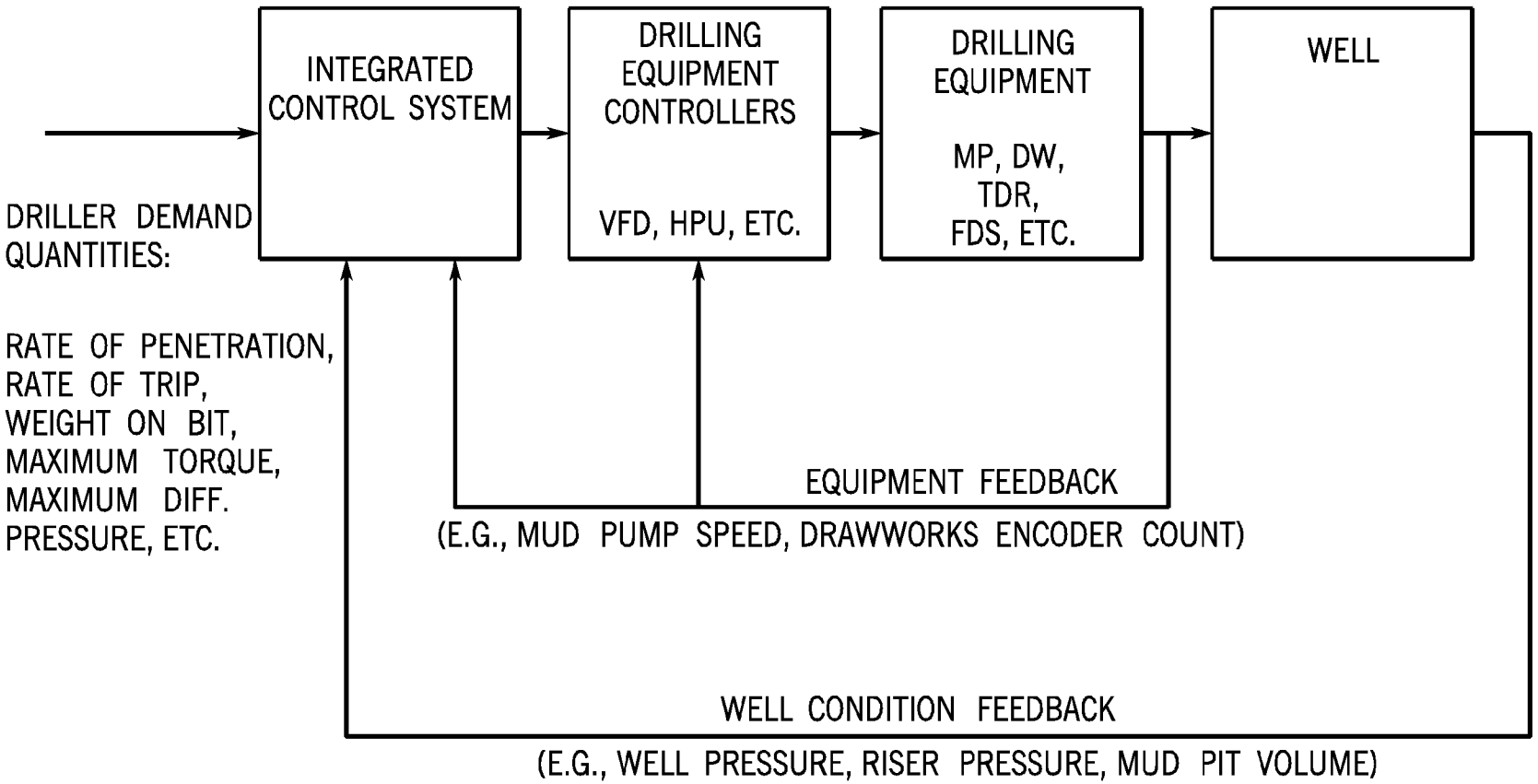
FIG. 2. A block diagram of one embodiment of a concept of an integrated control system.
Figure 3:
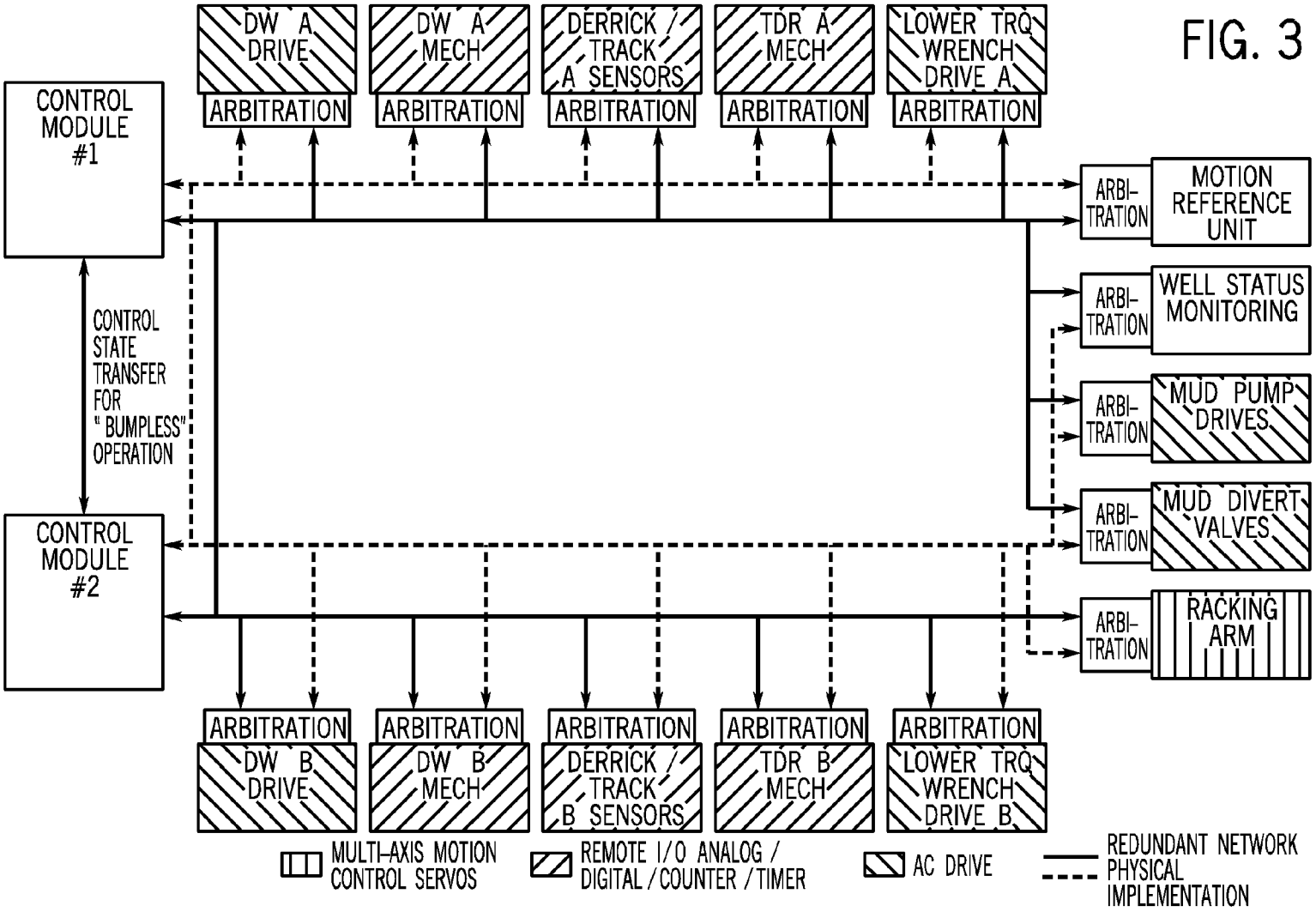
FIG. 3. A block diagram of one embodiment of an integrated control system top level hardware.

The disclosed drilling and tripping system also includes an integrated redundant control system (FIG. 2), with numerous sensors and actuators that can be used to control all of the above sub-systems in a synchronized manner to facilitate continuous or nearly continuous operation in both tripping and drilling modes of operation. This is generally referred to herein as the Integrated Control System or ICS. The ICS is a redundant digital controller that can be programmed to have and exert control over all functions of the drilling equipment. Alternatively, the ICS can be programmed to control only certain aspects of operations if that should be deemed desirable. Additionally, the ICS is integrated with all of the drive systems used in the drilling process (drawworks, mud pumps, torque wrenches, etc.) to allow for fully automated operation. The ICS is additionally provided with sensor information for monitoring various well parameters to allow for automatic control of such things as tripping speeds and rate of penetration based on well conditions. The ICS may also be provided with signals from motion feedback devices to allow active heave control to be incorporated into the automatic drilling process. The main components of the ICS are an integrated array of control modules, connected via redundant networks to all necessary input/output nodes to actuate all machinery and read all sensors. The hardware will comply with (or exceed) Safety Integrity Level 3, as per IEC 61508 (FIG. 3).

ronment of operation, rugged electrical characteristics (ESD, EMC, etc.) consistent with the oilfield environment of operation, and adequate data protection and/or data redundancy to ensure operation of the system is not compromised by data corruption.

Table 1 describes the Control Nodes:

TABLE 1

| Control Node | Description |
|---|---|
| Drawworks Drive (A & B) | These are the drives (assumed to be AC variable frequency drives) that drive the two drawworks on the system |
| Drawworks Machine (A & B) | Additional actuators and sensors for the drawworks machinery (e.g., drum encoders, brake pressure sensors, etc.) |
| Derrick Track Sensors (A & B) | Sensors from the derrick tracks for such things as motion limit switches |
| Lower Torque Wrench Drive (A & B) | Drives for the lower torque wrenches. These can be Hydraulic Power Units if the torque wrench motors are hydraulic, or AC variable frequency drives if they are AC motors) |
| TDR (A & B) | Sensors and actuators for all the equipment physically located on the TDR |
| Mud Pump Drives | AC variable speed drives for the mud pumps |
| Mud Divert Valves | Sensors and actuators for the mud flow control valves needed to route drilling fluid to the first TDR, the second TDR or to bypass flow to the mud tanks. This includes mud pit level sensors |
| Racking Arm Motion Controller | Multi-axis motion controller for sequencing the complex movements of the racking arm (and other components in the pipe handling system) This controller is assumed to interface to all the sensors and actuators required in the pipe handling system |
| Well Status Monitoring | A number of sensors that provide real time data to the ICS to allow drilling operations to be automated - e.g. well pressure sensors, marine riser pressure |
| Motion Reference Unit | Provides multi-dimensional position, velocity and acceleration feedback to allow for active heave control systems to be implemented in the ICS |

In the ICS, two or more control modules operate in a redundant mode with "bumpless" transfer between active and standby controller. There are several suitable physical implementations of the control module, including, but not limited to, a high performance industrial programmable logic controller, such as a high performance industrial PC, a high performance single board computer, etc. The requirements for the control module include sufficient processing capability to perform all necessary control algorithms within a suitable time period, sufficient network connectivity to connect with sufficient bandwidth and low enough latency to all the other nodes on the system (see discussion on network below), including connection to other control modules in the redundant array, and availability of suitable programming tools to allow the control system to be implemented in a manner suitable for industrial control and automation applications.

The ICS also includes two or more network physical layers with redundant operation. Depending on the required bandwidth and latency, the network may use a "multi-drop" or "star" topology, or a combination with each network spur being multi-dropped to a reduced number of nodes. There are several suitable physical implementation of the redundant network, including, but not limited to, Process Field Bus (PROFIBUS) or Ethernet-based (Modbus TCP, EtherCAT, ProfiNET). The requirements for the network are sufficient bandwidth and low enough latency to exchange all required data within time periods consistent with the required dynamic response of all control sequences and closed-loop control functions, deterministic timing to allow all sequence response times and closed-loop performances to be ascertained, rugged physical implementation consistent with the oilfield envi- Regarding the ICS data description, each of the nodes on the networks of the ICS exchange sensor feedback and/or actuator control signals with the control modules. Table 2 details the information that may be exchanged for each of the main nodes on the network in one embodiment. Those skilled in the art will appreciate that more or less information may be input, collected or obtained, stored in memory, and/or sent or transmitted to or from the various control nodes as may be desired in a given application.

TABLE 2

| Network Node | Sensor Information Sent to Control Modules | Actuator Information Received from Control Modules |
|---|---|---|
| Drawworks Drive (A & B) | Motor torque(s)<br>Motor speed<br>Motor encoder count(s)<br>Enable status<br>Health status | Enable command<br>Speed reference<br>Torque limit<br>Torque offset<br>Speed droop |
| Drawworks Machine (A & B) | Brake status<br>Drum encoders | Brake control |
| Derrick Track Sensors (A & B) | TDR carriage motion limit switches | |
| Lower Torque Wrench Drive (A & B) | Motor torque(s)<br>Motor speed<br>Motor encoder count(s)<br>Enable status<br>Health status | Enable command<br>Speed reference<br>Torque limit<br>Torque offset<br>Speed droop |
| TDR (A & B) | Extended limit switch<br>Retracted limit switch<br>REB alignment sensor<br>LTW ring gear alignment sensor<br>LTW "gate" position sensor<br>LTW jaws engaged sensor<br>UTW retracted/extended limit switches<br>UTW ring gear alignment sensor<br>UTW "gate" position sensor<br>UTW jaws engaged sensor<br>UTW Torque sensor<br>MB open/closed limit switches<br>MB vacuum pressure feedback<br>MB fluid presence sensor<br>Spinner retracted/engaged limit switches<br>Spinner rotation counter<br>FCS retracted/extended limit switches<br>FCS disengaged/engaged limit switches<br>FCS sealed limit switches<br>FCS valve status limit switches | Enable rotary elevator bowl pony motor<br>Extend/retract command for TDR carriage<br>LTW gate control command<br>LTW jaw engage command<br>UTW retract/engage command<br>UTW "gate" control command<br>UTW motor command<br>UTW jaw engage command<br>MB open/close command<br>MB vacuum on/off command<br>Spinner engage/retract command<br>Spinner rotate/direction commands<br>FCS extend/retract command<br>FCS engage/disengage command<br>FCS seal commands<br>FCS valve control command |
| Mud Pump Drives | Motor torque(s)<br>Motor speed<br>Enable status<br>Health status | Enable command<br>Speed reference<br>Torque limit |
| Mud Divert Valves | Position feedback (Closed, A, B, Divert)<br>Mud level sensors | Position demand (Closed, A, B, Divert) |
| Racking Arm Motion Controller | Motion status e.g.:<br>moving pos1→ pos2<br>in pos1<br>Health status | Motion commands, e.g.:<br>Move to next pos<br>Enable command |
| Well Status Monitoring | Well head pressure<br>Riser pressure | BOP<br>Diverter |
| Motion Reference Unit | Six axis acceleration<br>Six axis velocity<br>Six axis position | Integration control signals |

In one embodiment, the ICS is a computer with memory and computer software which is programmed to have direct control over the following functions: the rate of lowering/raising the lifting mechanisms (e.g., the drawworks); the rate of rotation of the tubular; the rate of spinner rotation during connection and disconnection of the tubular; connection and disconnection of the FCS, including the drilling fluid control valves on the TDR; movements of the racking arm and other pipe handling equipment; forces applied by the racking arm to stands of tubular as they are added and removed from the drilling tubular; drawworks control parameters during drilling—"Weight on Bit" and/or "Rate of Penetration"; drawworks control parameters during active heave compensation, in both "Fixed to Bottom" and "Non-Fixed to Bottom" modes (and during mode transitions); mud pump speed; and the FDS.

The ICS is capable of operating with normal driller inputs for traditional drilling controls (e.g., Weight on Bit, Rate of Penetration, Rate of Trip, etc.). Additionally, the ICS is able to determine optimal settings for these parameters based upon well condition monitoring (e.g., fluid pressure, rate of mud addition), with operator set parameters serving as upper limits. The ICS also implements functions such as active heave compensation and collision avoidance. Since the ICS has direct control over all drilling equipment, and is provided with all available feedback data from the well, additional capabilities can be added as the science and technology of oil well drilling advances. In its fully developed implementation, the ICS will trip, drill and ream wells in a fully automated, intelligent, adaptive manner, basing its decisions and controlling operations based on data measured directly from the well, among other things.

There are numerous specific operational sequences that are required under different phases and conditions of the drilling process. The operational sequences for three typical scenarios are detailed below. The first scenario is removing a tubular from a hole with continuous rotation and near continuous mud circulation, the second scenario is drilling, and the third scenario is removing a tubular from a riser or a cased hole at maximum speed without the need for fluid circulation or rotation of the tubular. At the end of each of the described cycles, the cycle repeats with Channel A performing the tasks done by Channel B and vice-versa. The skilled artisan will readily appreciate that numerous other scenarios are applicable using the present disclosure, although most other scenarios are generally simplifications or combinations of the sequences of these three scenarios.

Removing Tubular with Continuous Rotation and Near Continuous Mud Circulation

Figures 1, 4B:
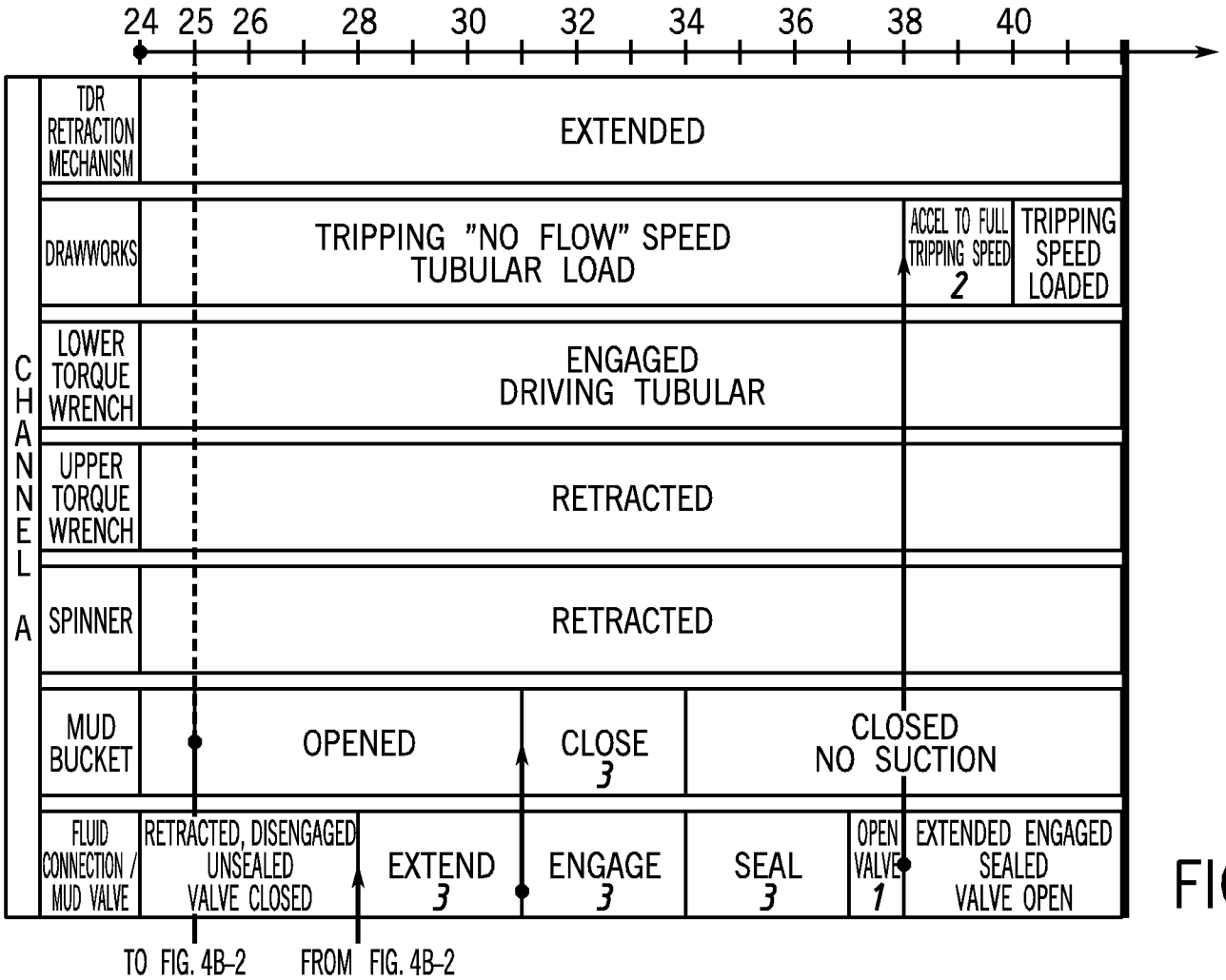
Figures 2, 4B:
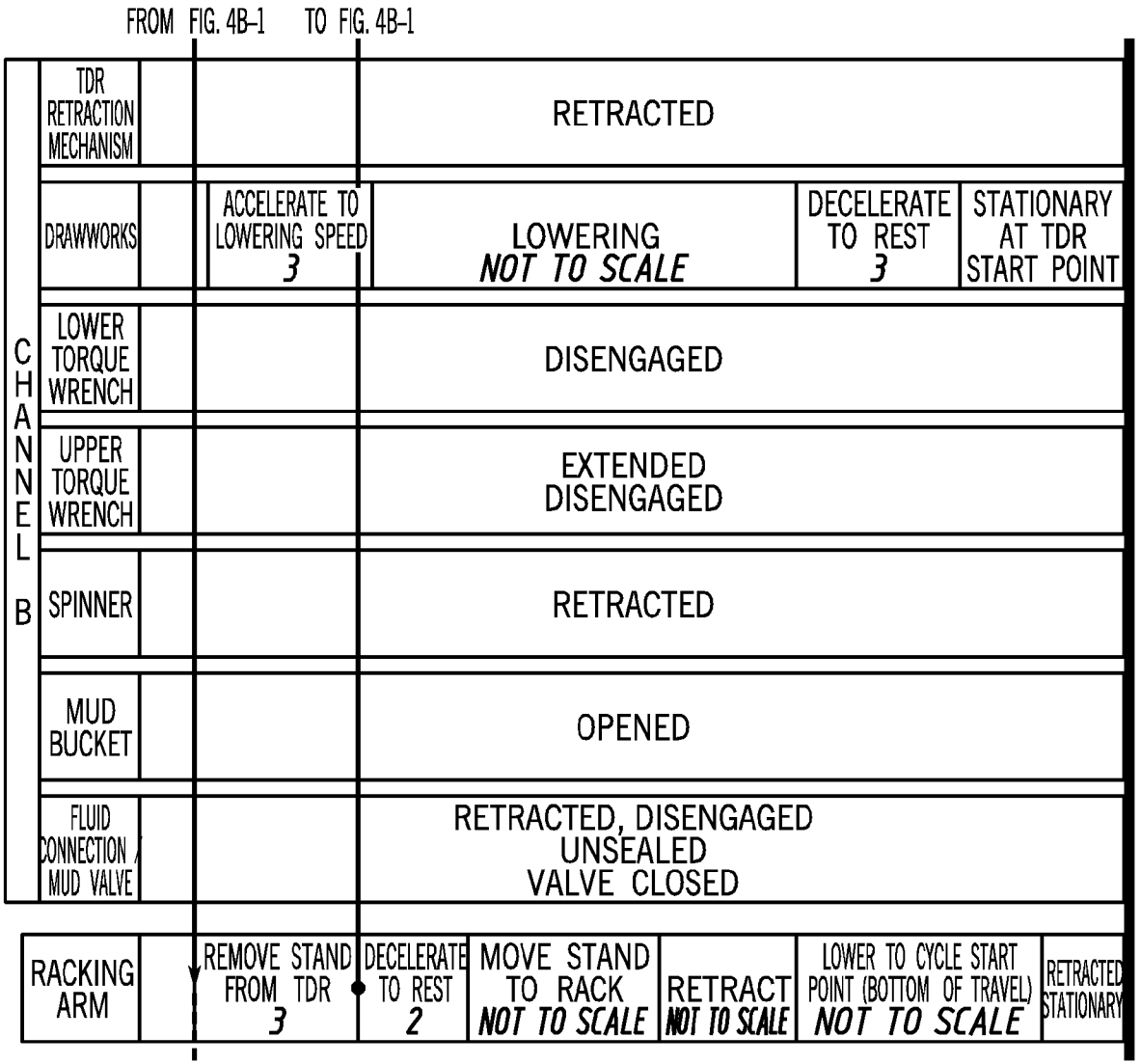
Figure 5A:
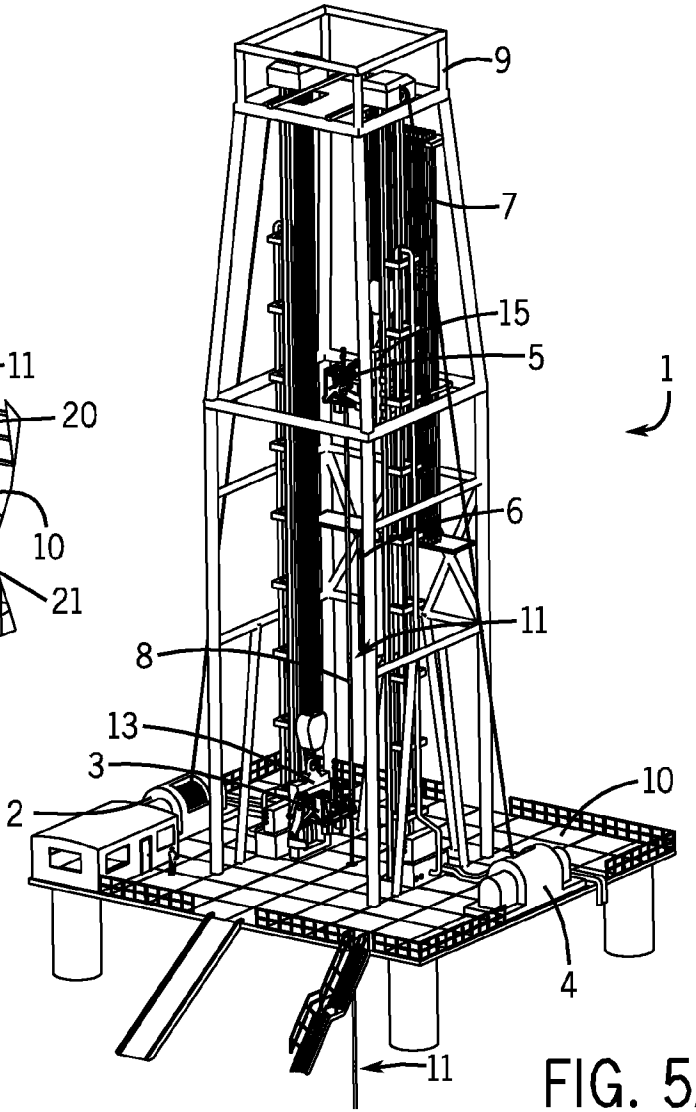
FIG. 5A and FIG. 5B. A schematic representation of the drilling and tripping system shown in FIG. 1 during removal of tubular from a hole at 1 foot/second with continuous rotation and near continuous mud circulation.
Figure 5B:
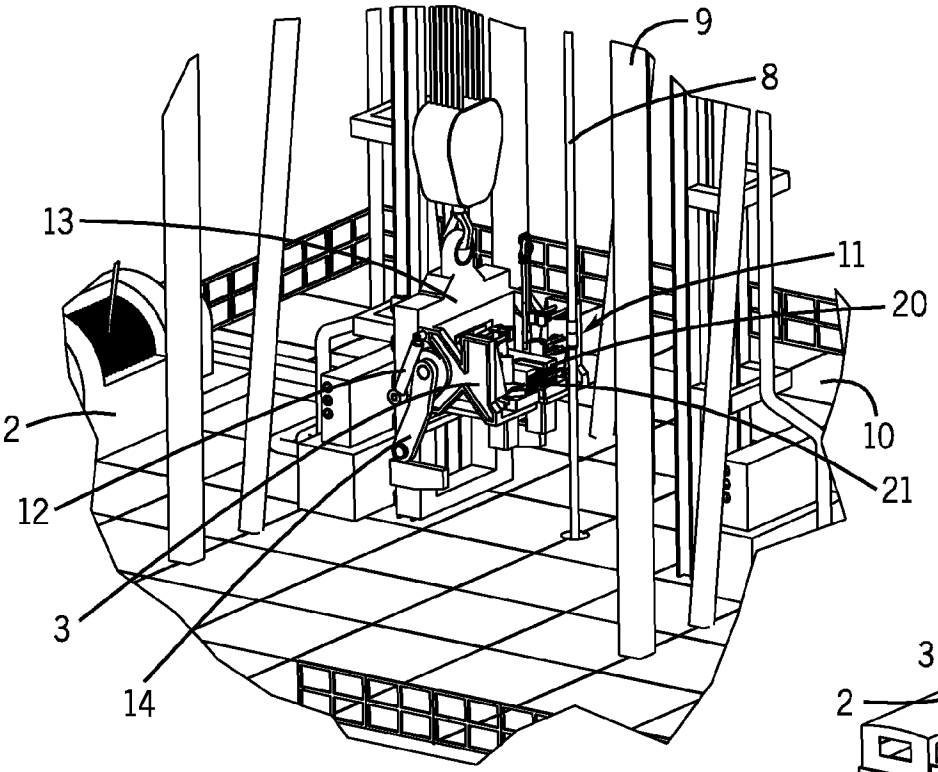

FIG. 4A and FIG. 4B shows the detailed operational sequence of one cycle for removing a tubular from a hole at 1 foot/second with continuous rotation and near continuous mud circulation. FIGS. 5 through 21 provide "snapshots" of one embodiment of a presently disclosed drilling and tripping system as it completes two cycles of the operational sequence shown in FIG. 4A and FIG. 4B. Referring to FIG. 5A, which is a schematic of one embodiment of a drilling and tripping system 1 is shown at t=0 seconds just before the first TDR 3 extends and engages the tubular 8 below the tool joint 11. Like features and elements in the drawings have the same numerals in the various figures. Shown in FIG. 5A are first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 5B, which shows a close-up view of the first TDR 3 at t=0 seconds. Shown in FIG. 5B are portions of the derrick 9 and drill floor 10, first drawworks 2, first TDR 3, first moving dolly 13, tubular 8, tool joint 11, and piston 12 and pivot arm 14, which are retracted and attached to the first TDR 3 and the first moving dolly 13. Features of the first TDR 3 that are visible include UTW 20 and LTW 21.

Figure 6A:
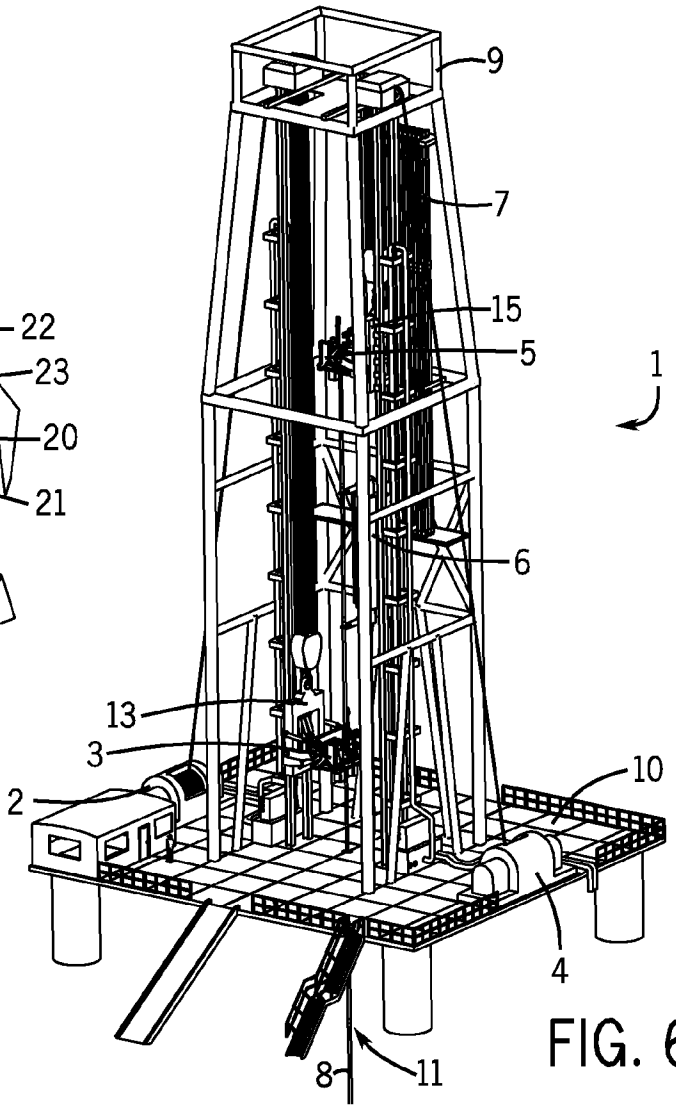
FIG. 6A and FIG. 6B. A schematic representation of the drilling and tripping system shown in FIG. 1 during removal of tubular from a hole at 1 foot/second with continuous rotation and near continuous mud circulation.
Figure 6B:
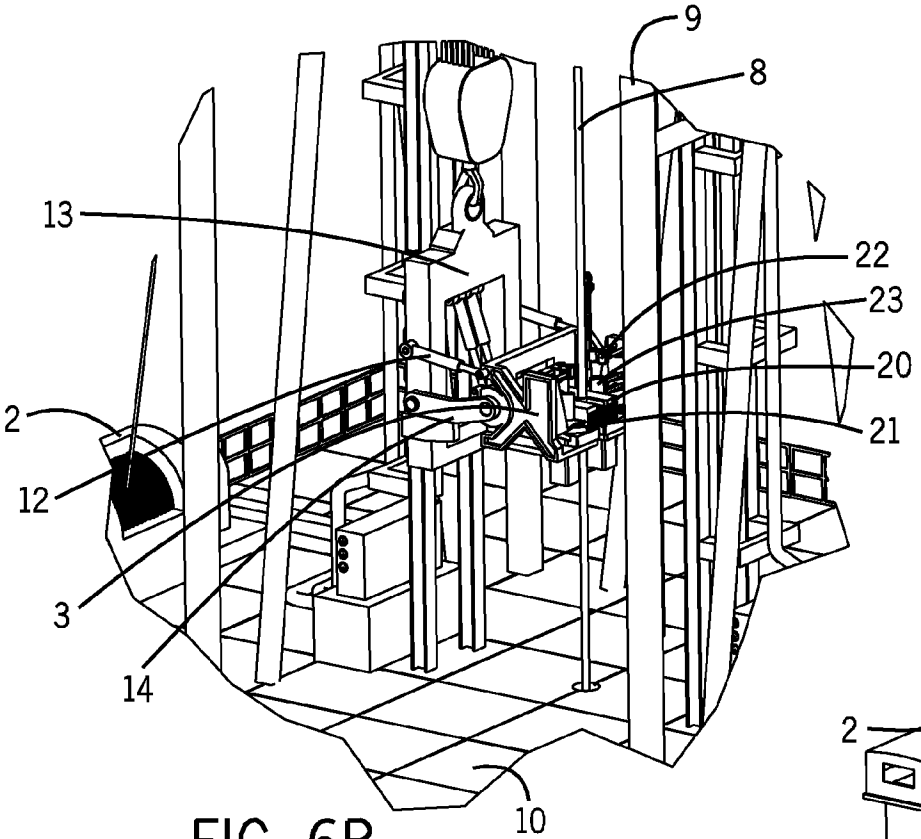

Referring now to FIG. 6A, which is a schematic of one embodiment of a drilling and tripping system 1 at t=5 seconds as the spinner 22 of the first TDR 3 extends to engage the tubular 8. Shown in FIG. 6A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 6B, which shows a close-up view of the first TDR 3 at t=5 seconds. Shown in FIG. 6B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, and mud bucket 23.

Figure 7A:
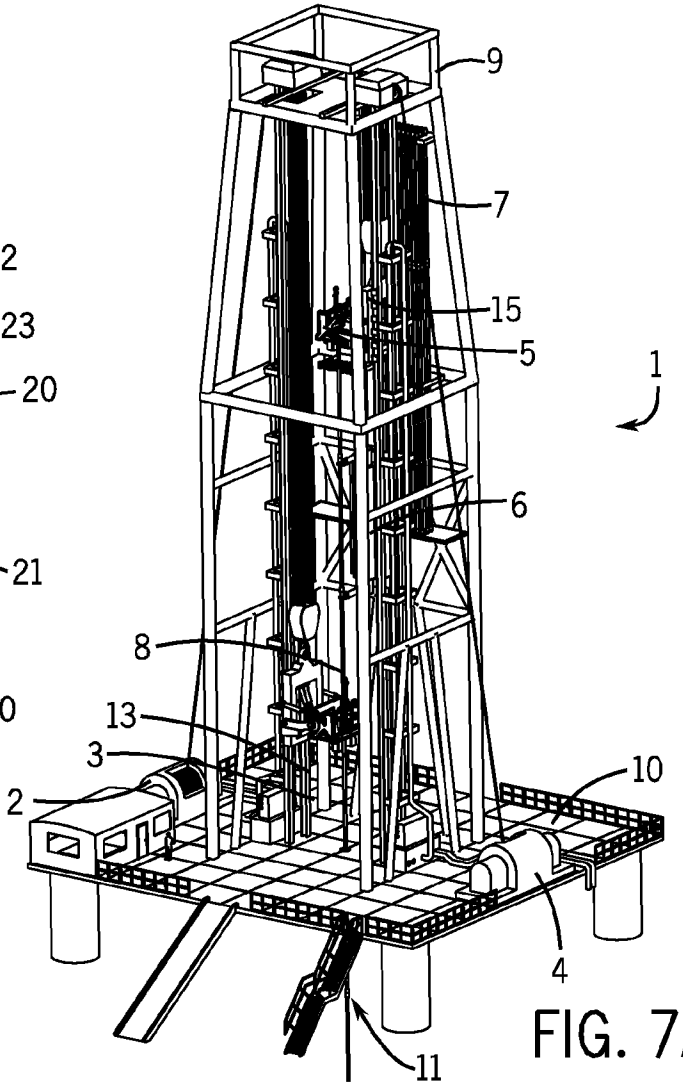
FIG. 7A and FIG. 7B. A schematic representation of the drilling and tripping system shown in FIG. 1 during removal of tubular from a hole at 1 foot/second with continuous rotation and near continuous mud circulation.
Figure 7B:
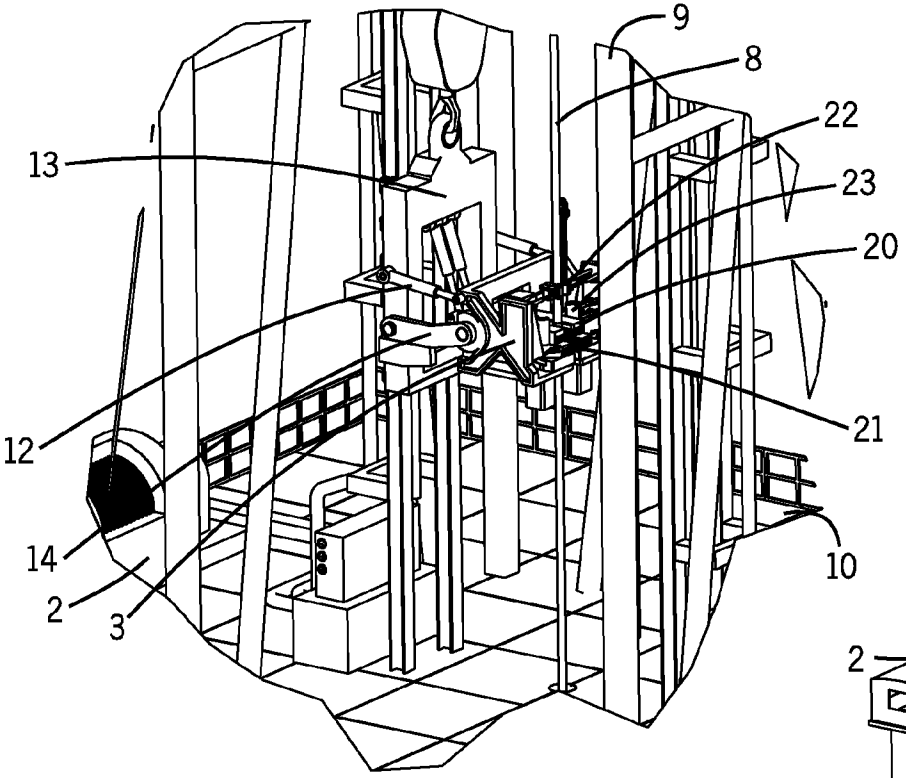

Referring now to FIG. 7A, which is a schematic of one embodiment of a drilling and tripping system 1 at t=11 seconds as the UTW 20 of the first TDR 3 retracts. Shown in FIG. 7A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 7B, which shows a close-up view of the first TDR 3 at t=11 seconds. Shown in FIG. 7B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, and mud bucket 23.

Figure 8A:
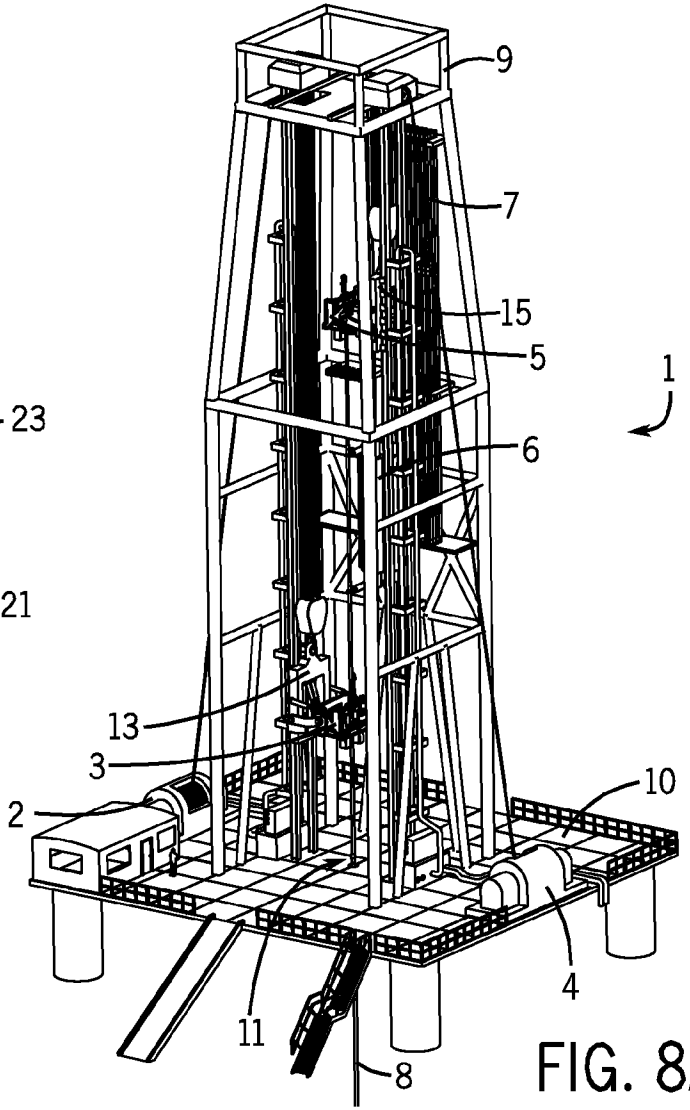
FIG. 8A and FIG. 8B. A schematic representation of the drilling and tripping system shown in FIG. 1 during removal of tubular from a hole at 1 foot/second with continuous rotation and near continuous mud circulation.
Figure 8B:
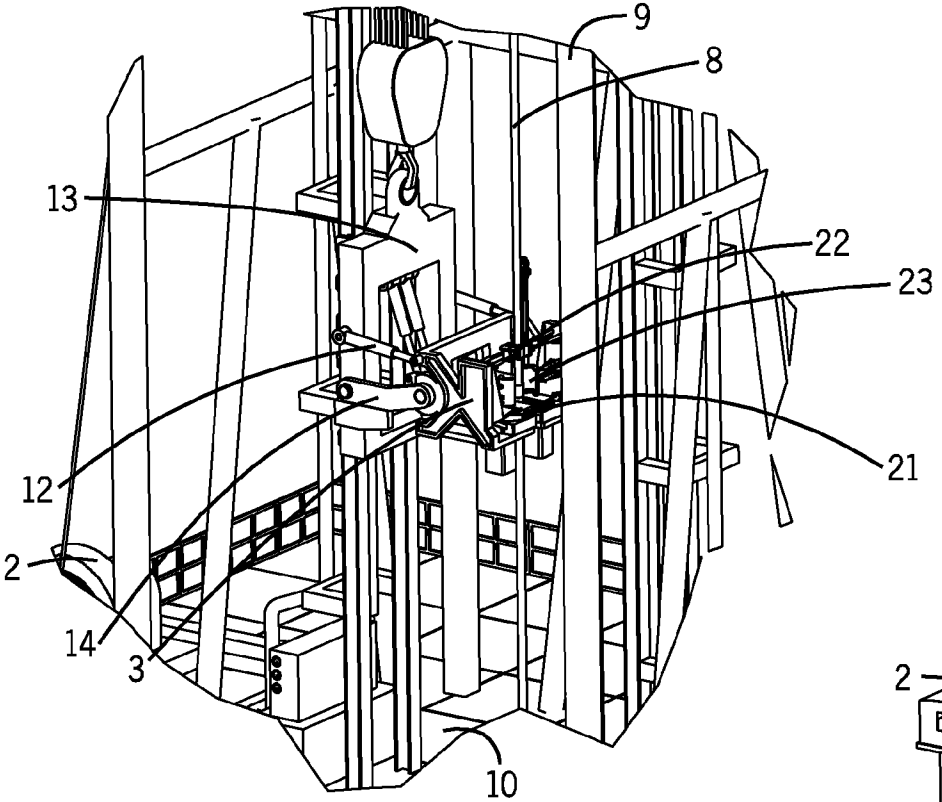

Referring now to FIG. 8A, which is a schematic of one embodiment of a drilling and tripping system 1 at t=14 seconds as the mud bucket 23 of the first TDR 3 closes. Shown in FIG. 8A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 8B, which shows a close-up view of the first TDR 3 at t=14 seconds. Shown in FIG. 8B are portions of the derrick 9 and drill floor 10, first drawworks 2, first TDR 3, first moving dolly 13, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 9A:
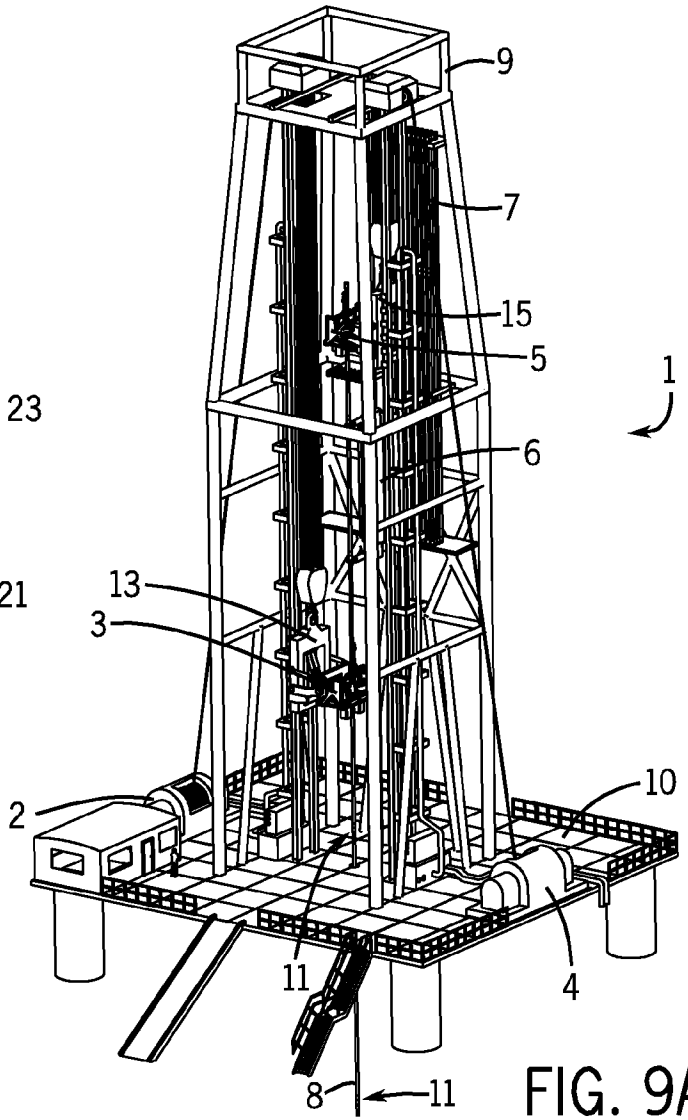
FIG. 9A and FIG. 9B. A schematic representation of the drilling and tripping system shown in FIG. 1 during removal of tubular from a hole at 1 foot/second with continuous rotation and near continuous mud circulation.
Figure 9B:
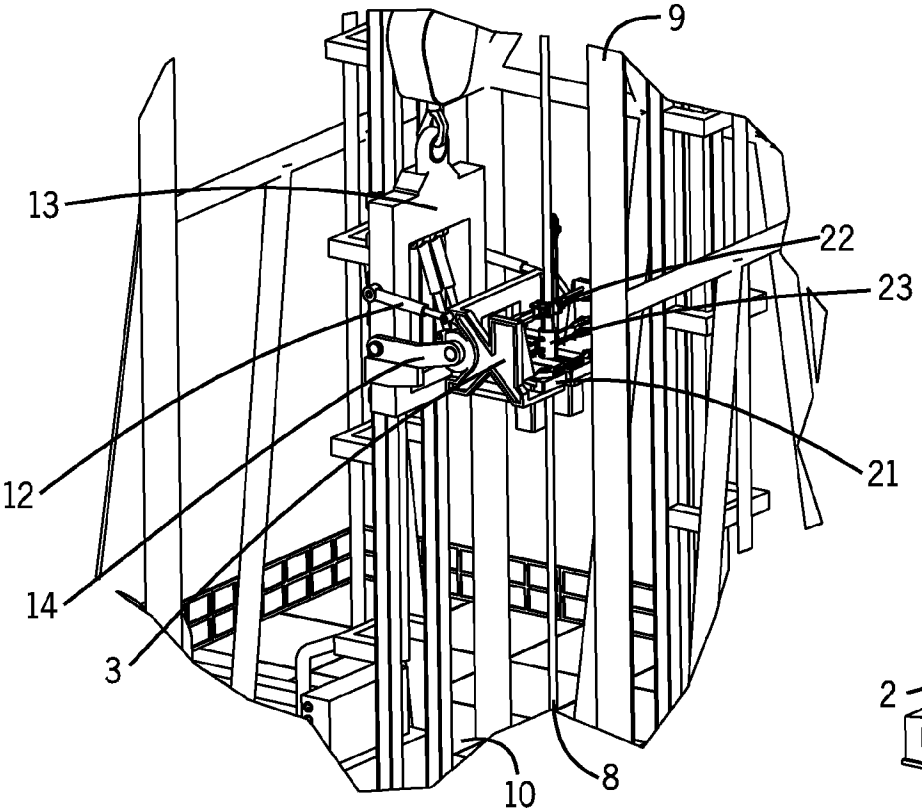

Referring now to FIG. 9A, which is a schematic of one embodiment of a drilling and tripping system 1 at t=19 seconds as the mud bucket 23 of the first TDR 3 extracts mud as the spinner 22 disconnects the tubular 8. Shown in FIG. 9A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 9B, which shows a close-up view of the first TDR 3 at t=19 seconds. Shown in FIG. 9B are portions of the derrick 9 and drill floor 10, first TDR 3, first moving dolly 13, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 10A:
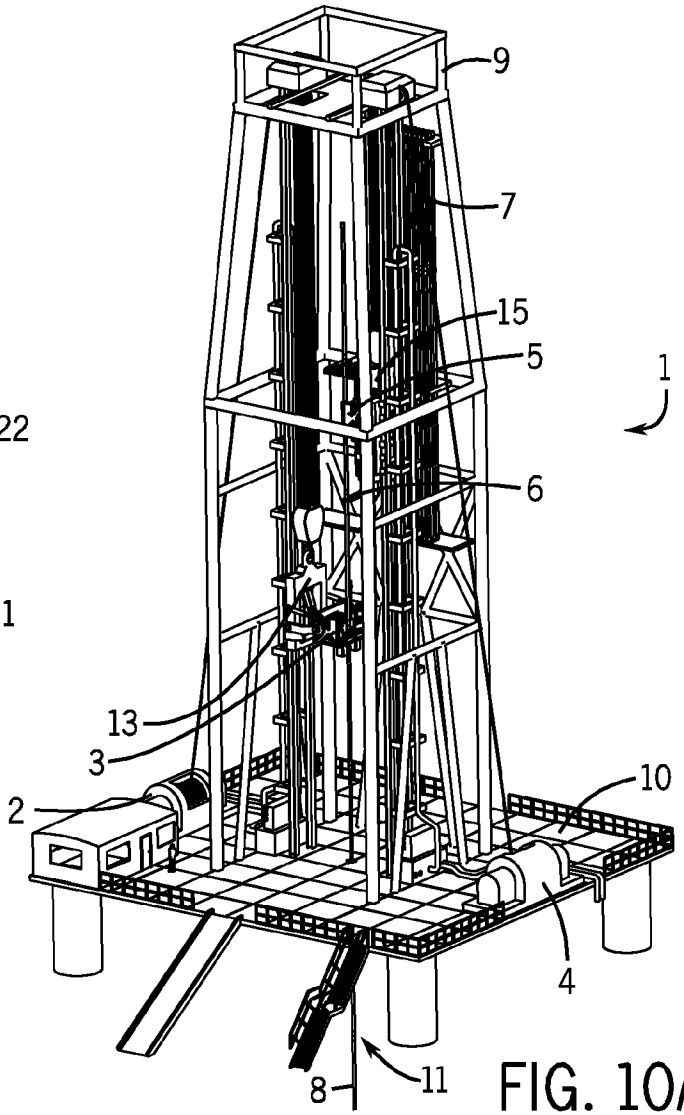
FIG. 10A and FIG. 10B. A schematic representation of the drilling and tripping system shown in FIG. 1 during removal of tubular from a hole at 1 foot/second with continuous rotation and near continuous mud circulation.
Figure 10B:
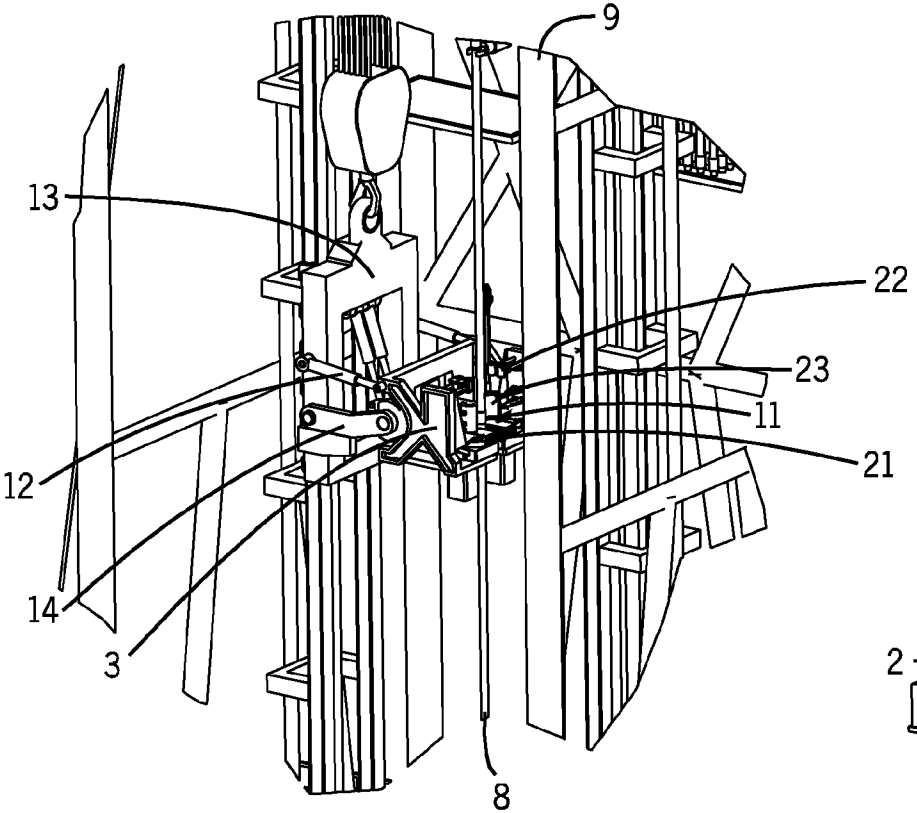

Referring now to FIG. 10A, which is a schematic of one embodiment of a drilling and tripping system 1 at t=24 seconds as the mud bucket 23 of the first TDR 3 retracts. Shown in FIG. 10A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 10B, which shows a close-up view of the first TDR 3 at t=24 seconds. Shown in FIG. 10B is a portion of the derrick 9, first TDR 3, first moving dolly 13, tubular 8, tool joint 11, and piston 12 and pivot arm 14, which are extended and attached to the first TDR 3 and the first moving dolly 13. Features of the first TDR 3 that are visible include LTW 21, spinner 22, and mud bucket 23.

Figure 11A:
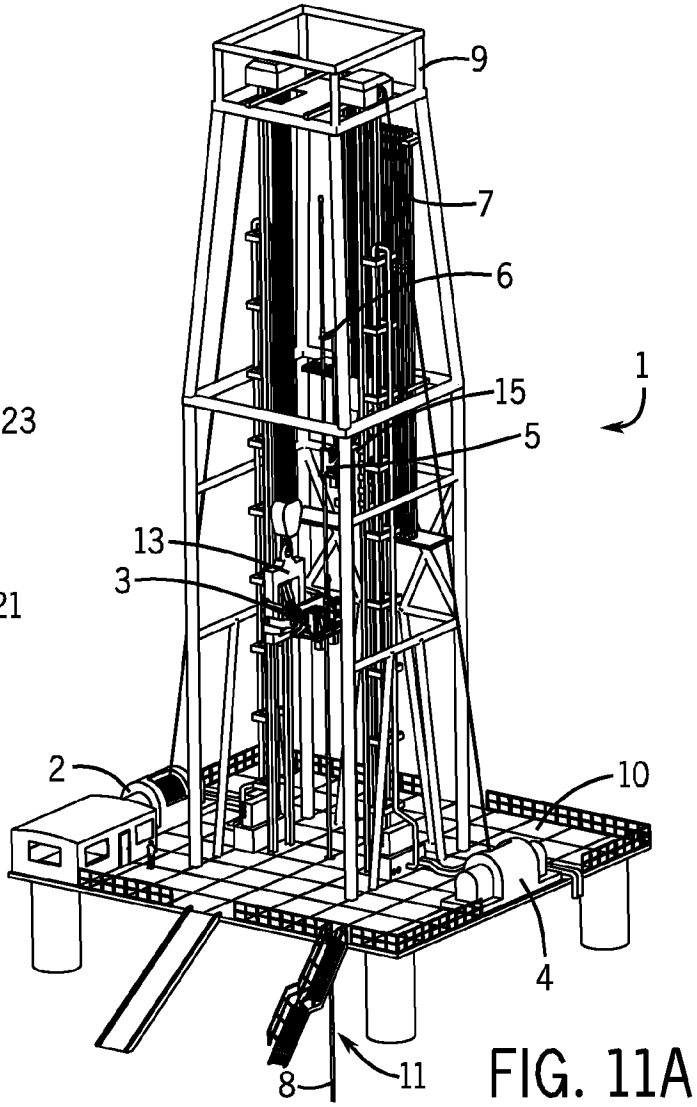
FIG. 11A and FIG. 11B. A schematic representation of the drilling and tripping system shown in FIG. 1 during removal of tubular from a hole at 1 foot/second with continuous rotation and near continuous mud circulation.
Figure 11B:
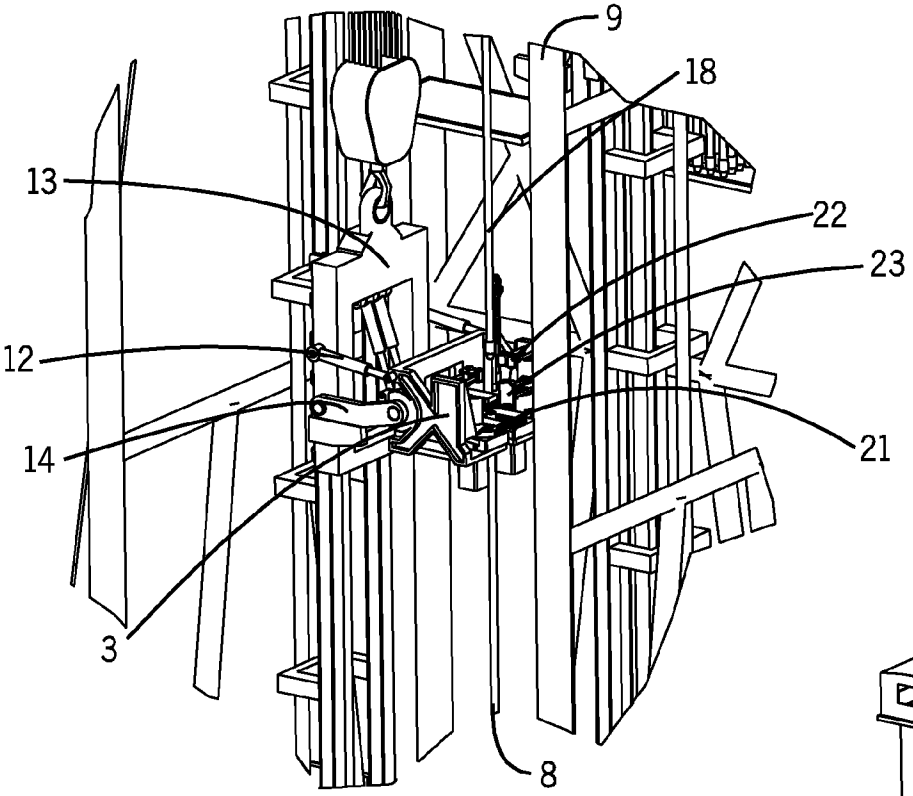

Referring now to FIG. 11A, which is a schematic of one embodiment of a drilling and tripping system 1 at t=26 seconds as the racking arm 6 removes the stand 18 (disconnected section of tubular 8). Shown in FIG. 11A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 11B, which shows a close-up view of the first TDR 3 at t=26 seconds. Shown in FIG. 11B is a portion of the derrick 9, first TDR 3, first moving dolly 13, stand 18, tubular 8, and piston 12 and pivot arm 14, which are extended and attached to the first TDR 3 and the first moving dolly 13. Features of the first TDR 3 that are visible include LTW 21, spinner 22, and mud bucket 23.

Figure 12A:
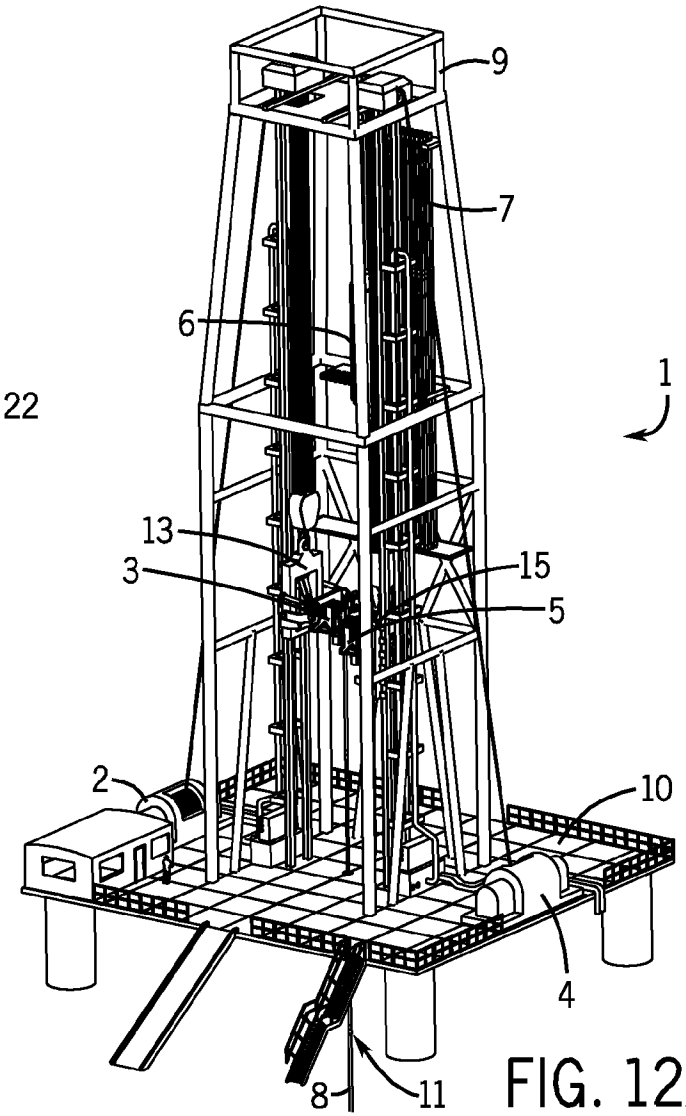
FIG. 12A and FIG. 12B. A schematic representation of the drilling and tripping system shown in FIG. 1 during removal of tubular from a hole at 1 foot/second with continuous rotation and near continuous mud circulation.
Figure 12B:
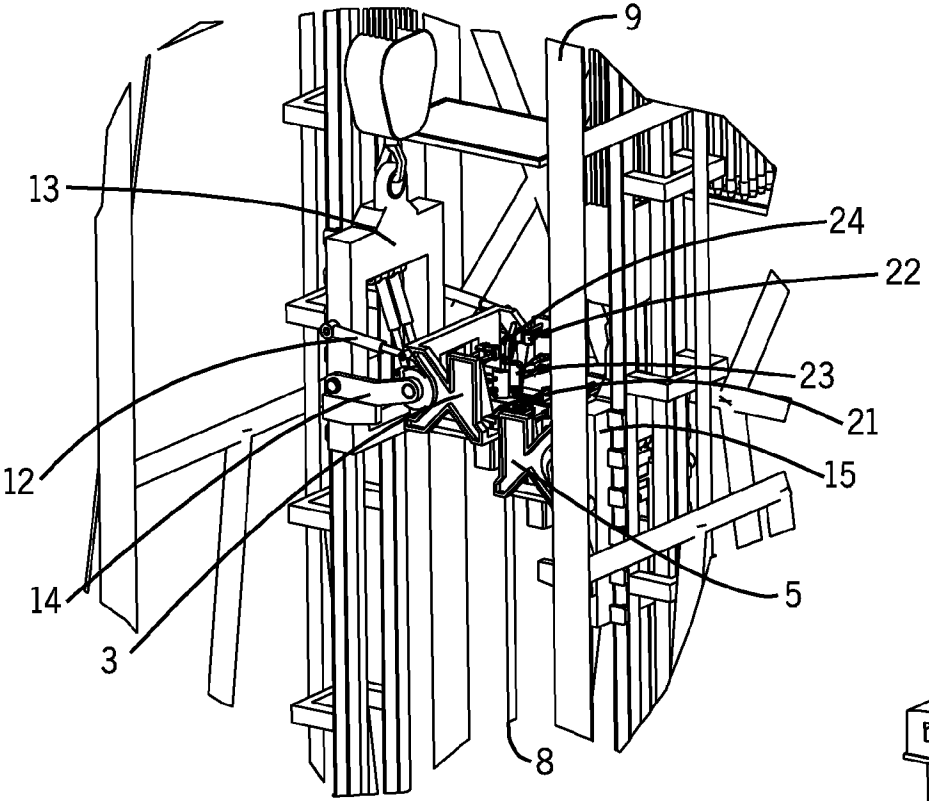

Referring now to FIG. 12A, which is a schematic of one embodiment of a drilling and tripping system 1 at t=32 seconds as the FCS 24 of the first TDR 3 engages the rotating tubular 8. Shown in FIG. 12A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 12B, which shows a close-up view of the first TDR 3 and the second TDR 5 at t=32 seconds. Shown in FIG. 12B is a portion of the derrick 9, first TDR 3, first moving dolly 13, second TDR 5, second moving dolly 15, tubular 8, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 13A:
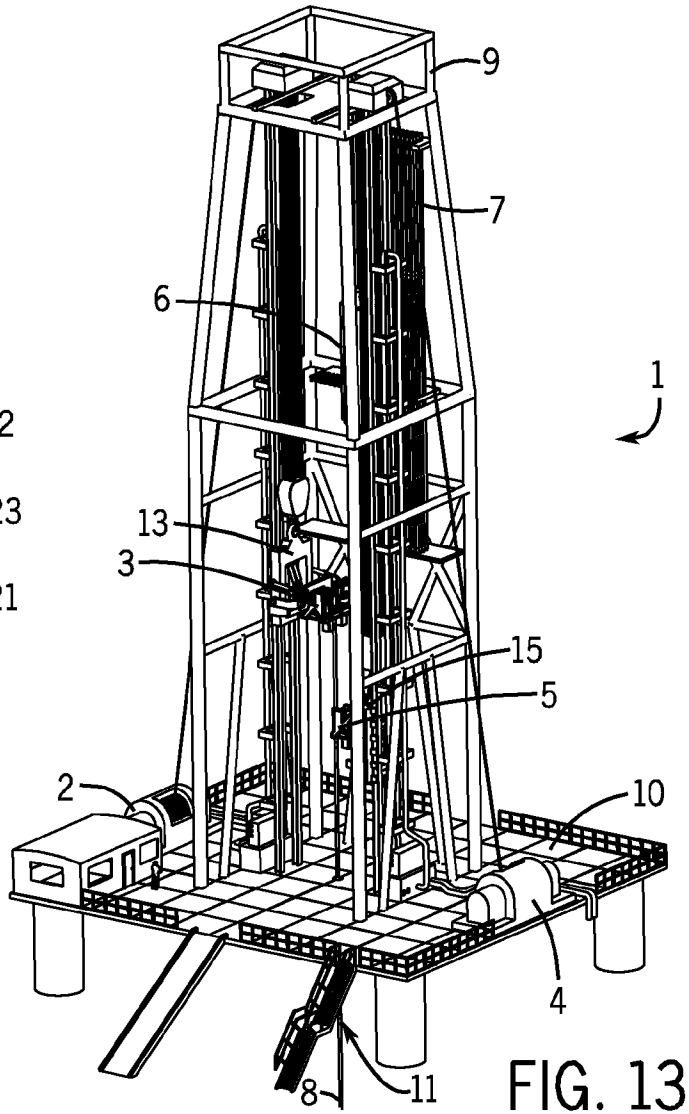
FIG. 13A and FIG. 13B. A schematic representation of the drilling and tripping system shown in FIG. 1 during removal of tubular from a hole at 1 foot/second with continuous rotation and near continuous mud circulation.
Figure 13B:
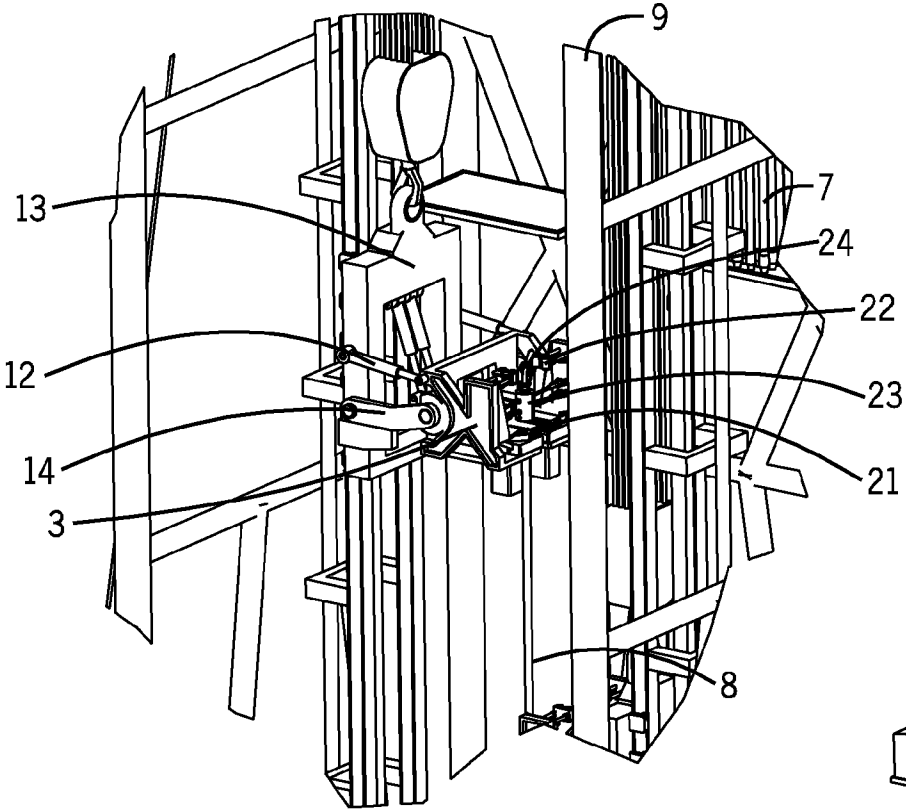

Referring now to FIG. 13A, which is a schematic of one embodiment of a drilling and tripping system 1 at t=36 seconds as the mud flow begins upon sealing. Shown in FIG. 13A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 13B, which shows a close-up view of the first TDR 3 at t=36 seconds. Shown in FIG. 13B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 14A:
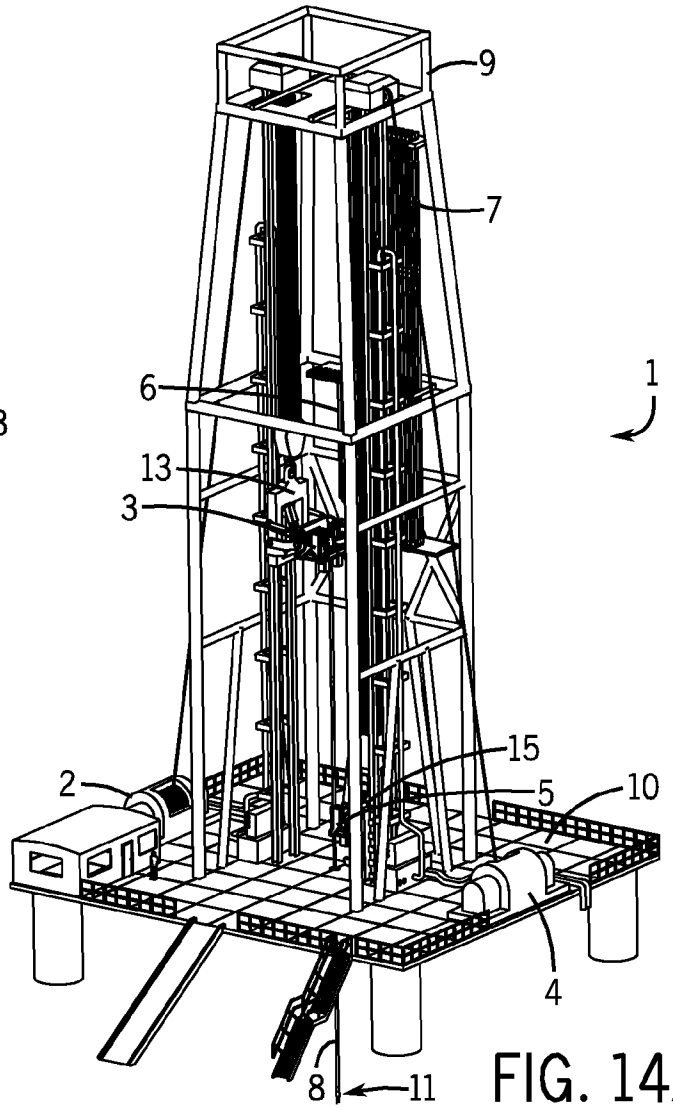
FIG. 14A and FIG. 14B. A schematic representation of the drilling and tripping system shown in FIG. 1 during removal of tubular from a hole at 1 foot/second with continuous rotation and near continuous mud circulation.
Figure 14B:
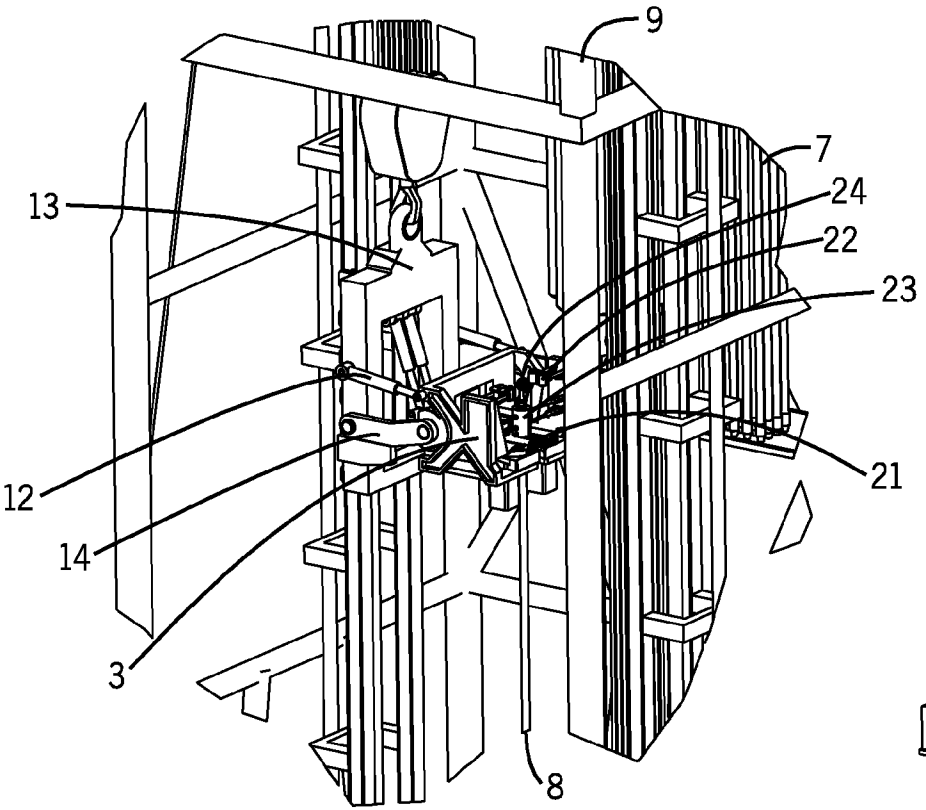

Referring now to FIG. 14A, which is a schematic of one embodiment of a drilling and tripping system at t=45 seconds as the tubular 8 is being pulled with rotation and mud flow. Shown in FIG. 14A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 14B, which shows a close-up view of the first TDR 3 at t=45 seconds. Shown in FIG. 14B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 15A:
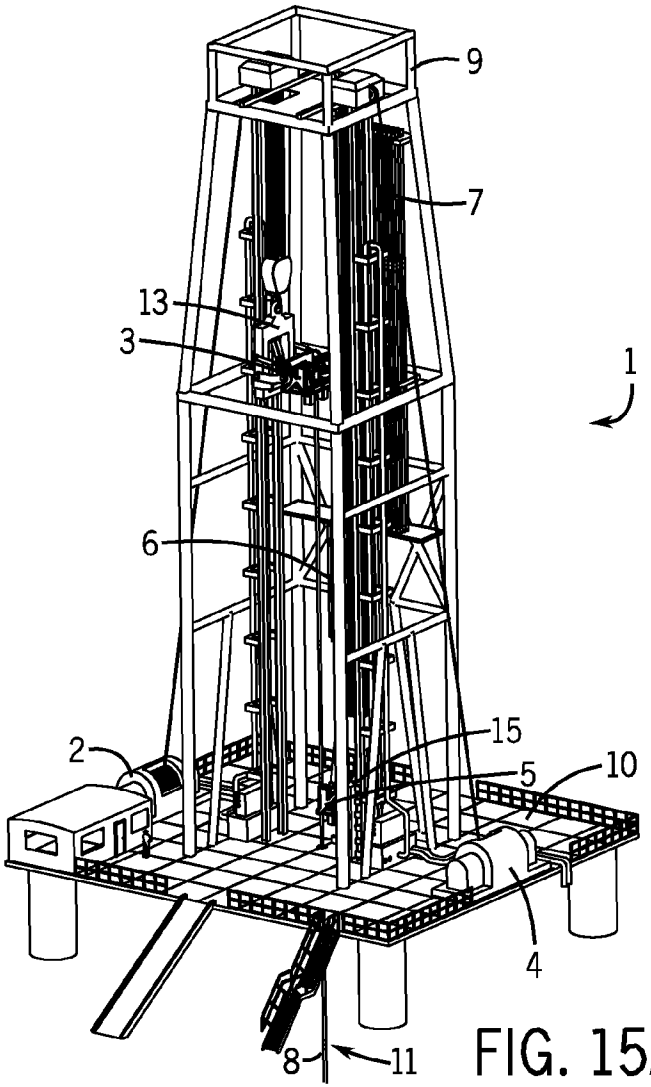
FIG. 15A and FIG. 15B. A schematic representation of the drilling and tripping system shown in FIG. 1 during removal of tubular from a hole at 1 foot/second with continuous rotation and near continuous mud circulation.
Figure 15B:
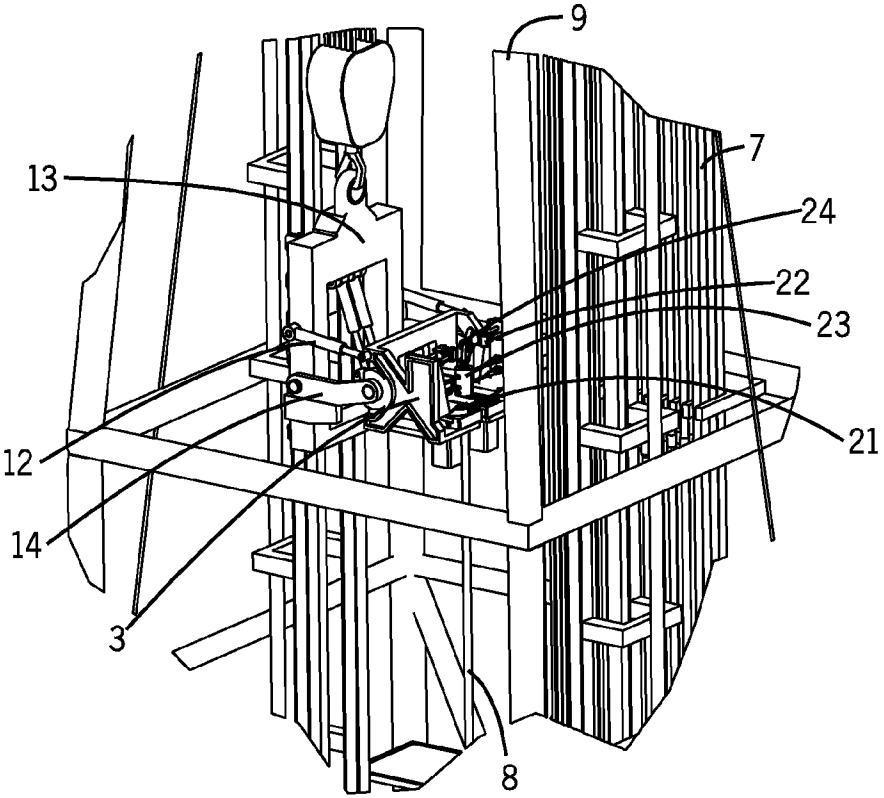

Referring now to FIG. 15A, which is a schematic of one embodiment of a drilling and tripping system 1 at t=77 seconds as the second TDR 5 engages with the next tool joint 11 of the tubular 8. Shown in FIG. 15A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 15B, which shows a close-up view of the first TDR 3 at t=77 seconds. Shown in FIG. 15B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 16A:
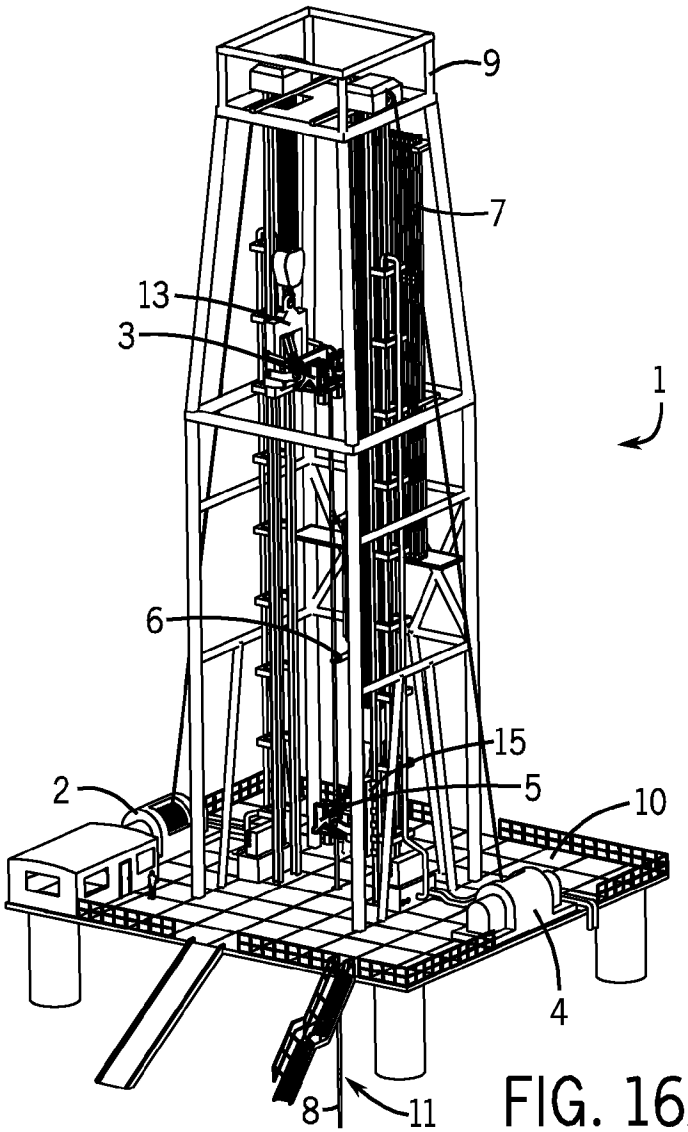
FIG. 16A and FIG. 16B. A schematic representation of the drilling and tripping system shown in FIG. 1 during removal of tubular from a hole at 1 foot/second with continuous rotation and near continuous mud circulation.
Figure 16B:
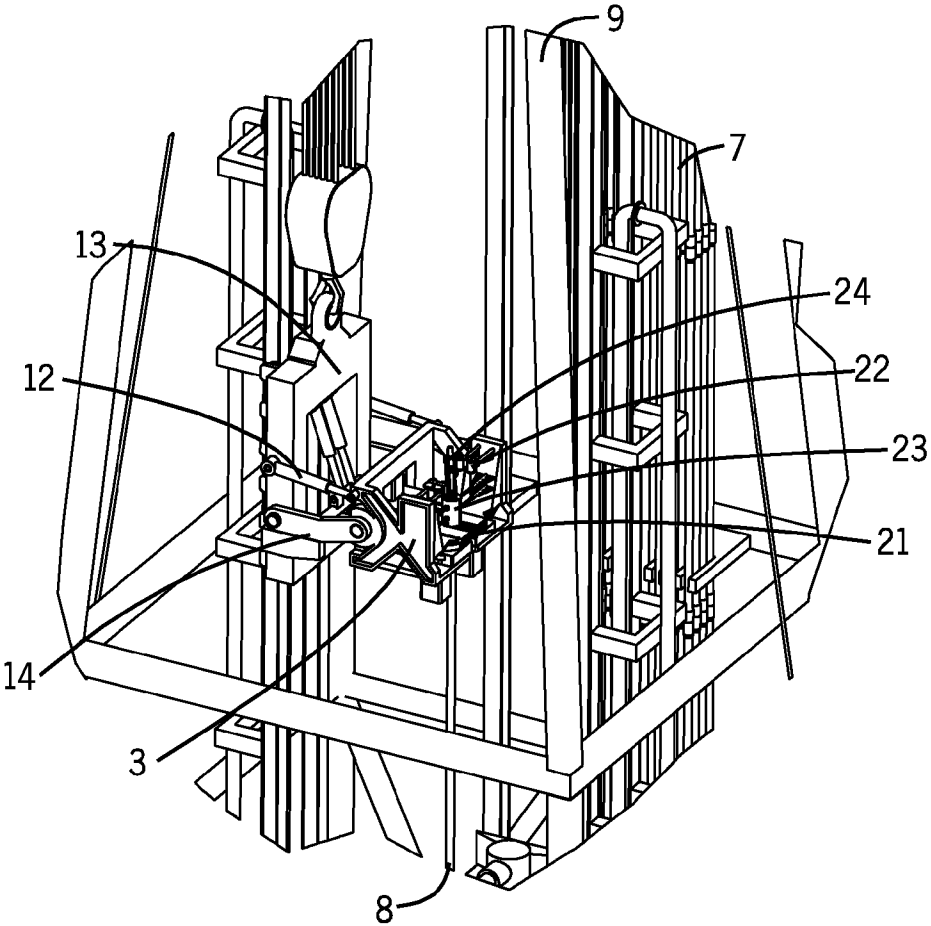

Referring now to FIG. 16A, which is a schematic of one embodiment of a drilling and tripping system 1 at t=81 seconds as the second TDR 5 takes over weight load and rotation of the tubular 8. Shown in FIG. 16A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 16B, which shows a close-up view of the first TDR 3 at t=81 seconds. Shown in FIG. 16B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 17A:
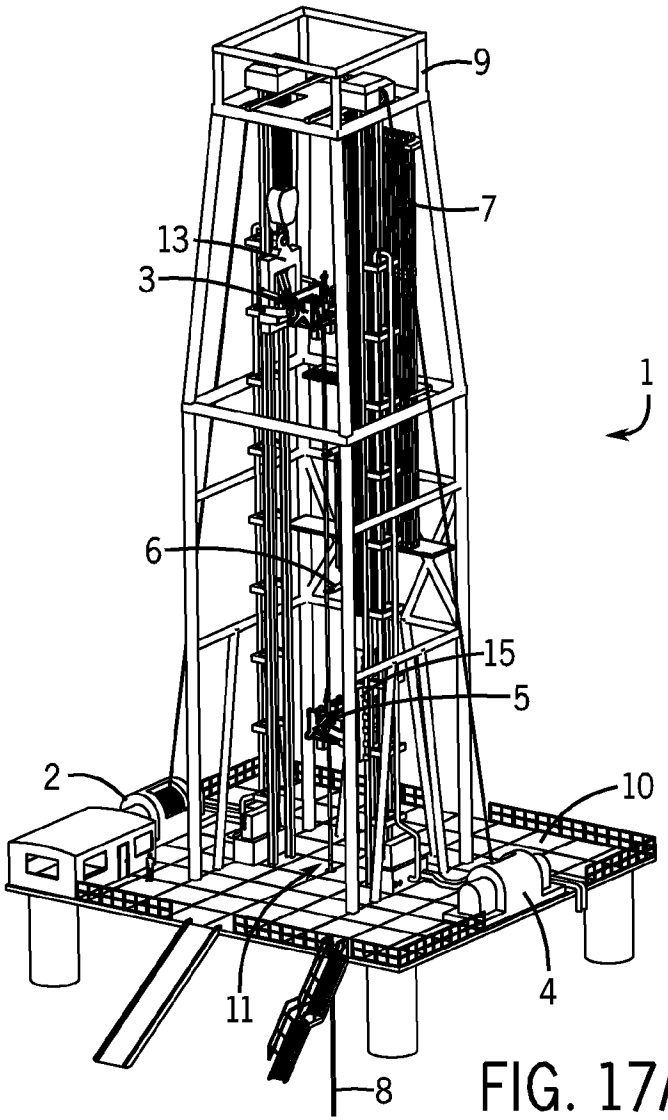
FIG. 17A and FIG. 17B. A schematic representation of the drilling and tripping system shown in FIG. 1 during removal of tubular from a hole at 1 foot/second with continuous rotation and near continuous mud circulation.
Figure 17B:
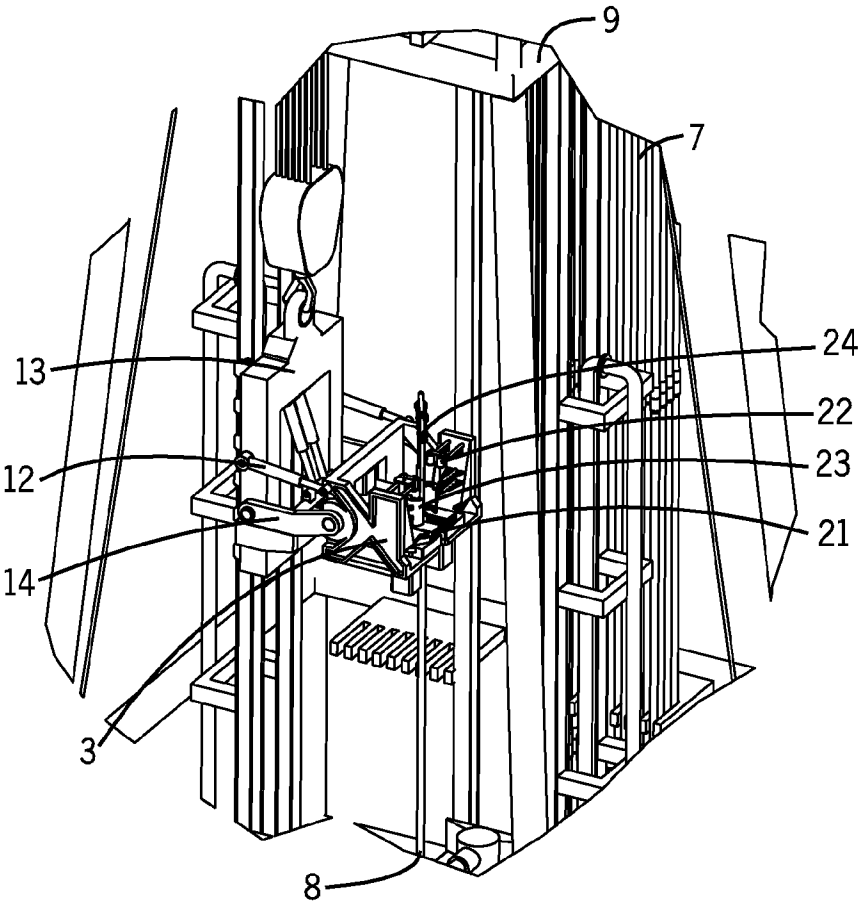

Referring now to FIG. 17A, which is a schematic of one embodiment of a drilling and tripping system 1 at t=92 seconds as the fluid connection system 24 of the first TDR 3 is disengaged. Shown in FIG. 17A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 17B, which shows a close-up view of the first TDR 3 at t=92 seconds. Shown in FIG. 17B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 18A:
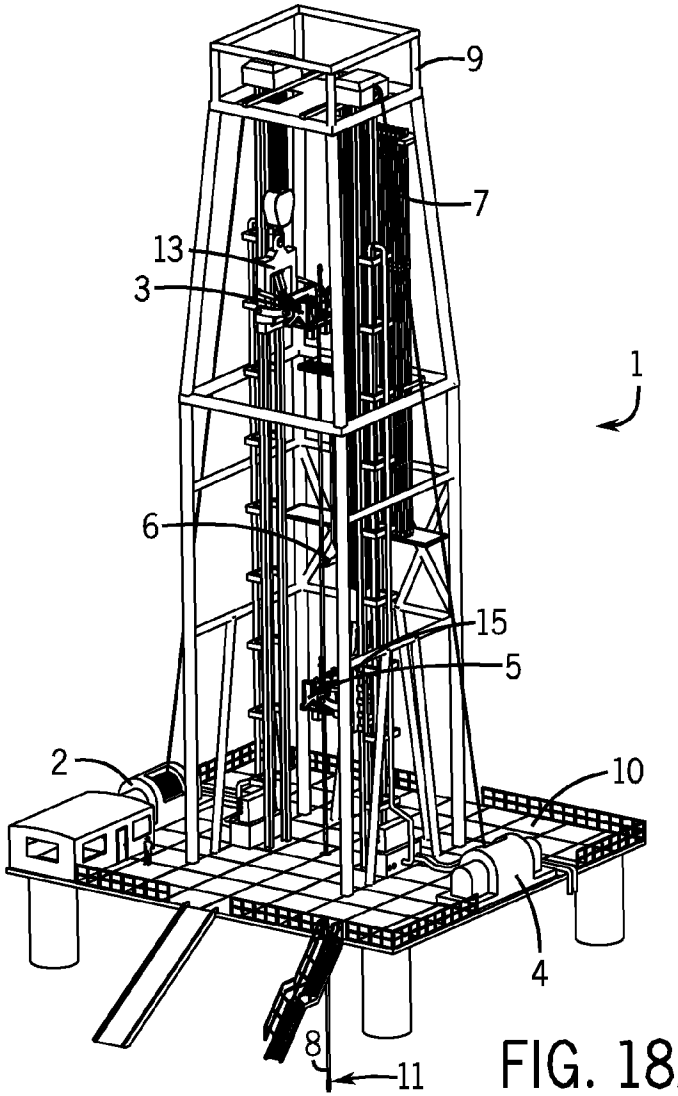
FIG. 18A and FIG. 18B. A schematic representation of the drilling and tripping system shown in FIG. 1 during removal of tubular from a hole at 1 foot/second with continuous rotation and near continuous mud circulation.
Figure 18B:
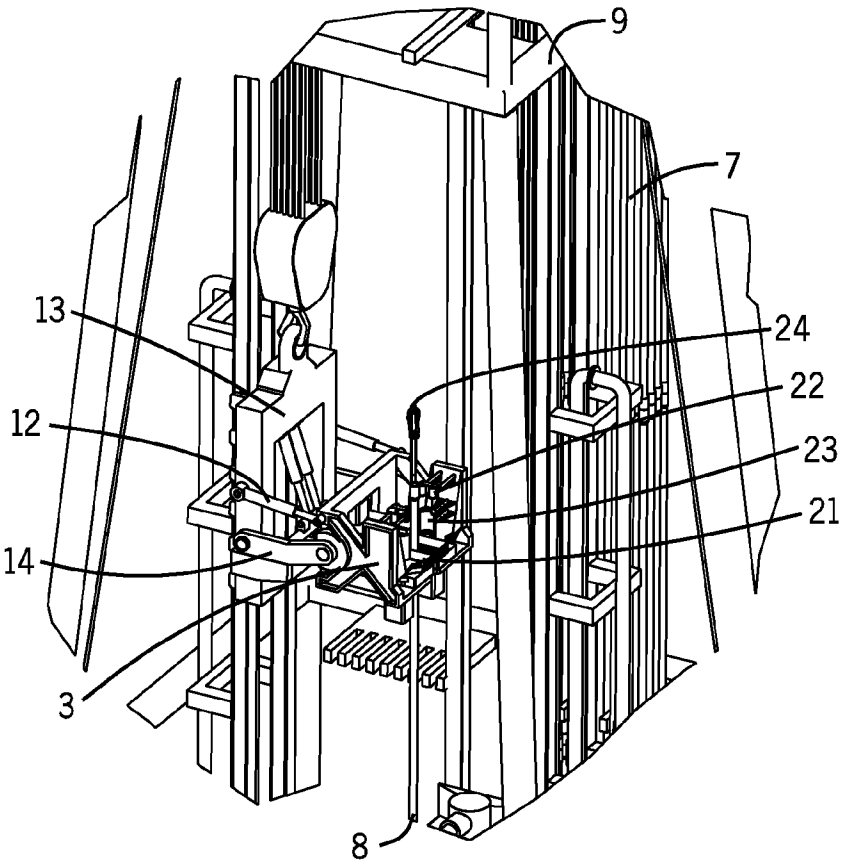

Referring now to FIG. 18A, which is a schematic of one embodiment of a drilling and tripping system 1 at t=95 seconds as the first TDR 5 begins to retract from the tubular. Shown in FIG. 18A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 18B, which shows a close-up view of the first TDR 3 at t=95 seconds. Shown in FIG. 18B is a portion of the derrick 9, first TDR 3, first moving dolly 13, tubular 8, pipe rack 7, and piston 12 and pivot arm 14, which are extended and attached to the first TDR 3 and the first moving dolly 13. Features of the first TDR 3 that are visible include LTW 21, spinner 22, mud bucket 23 and FCS 24.

Figure 19A:
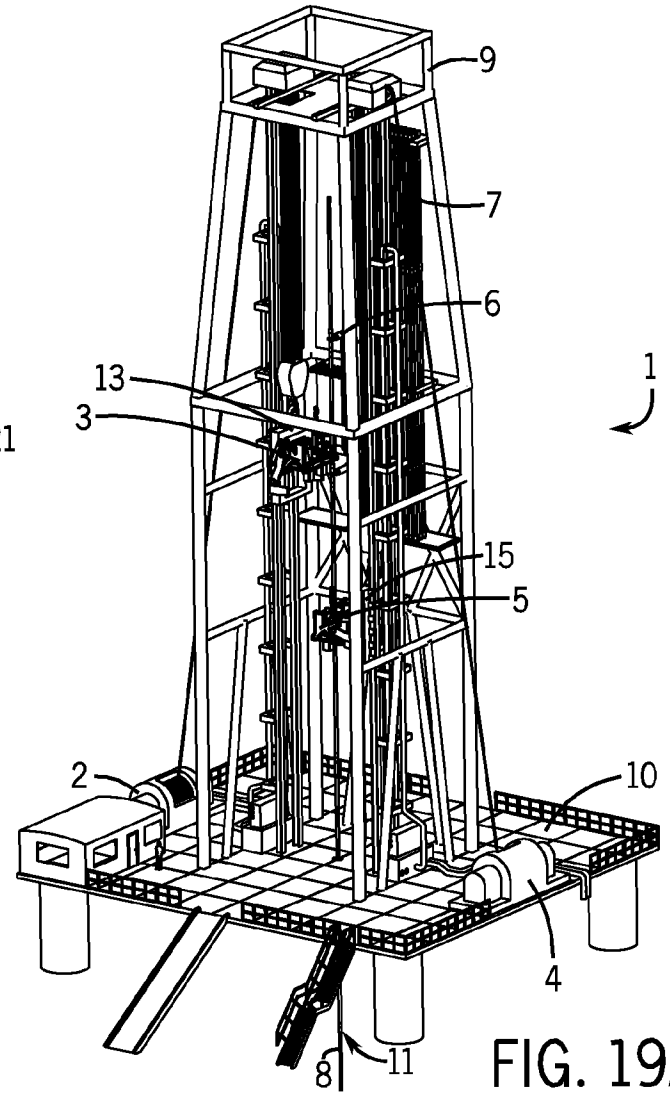
FIG. 19A and FIG. 19B. A schematic representation of the drilling and tripping system shown in FIG. 1 during removal of tubular from a hole at 1 foot/second with continuous rotation and near continuous mud circulation.
Figure 19B:
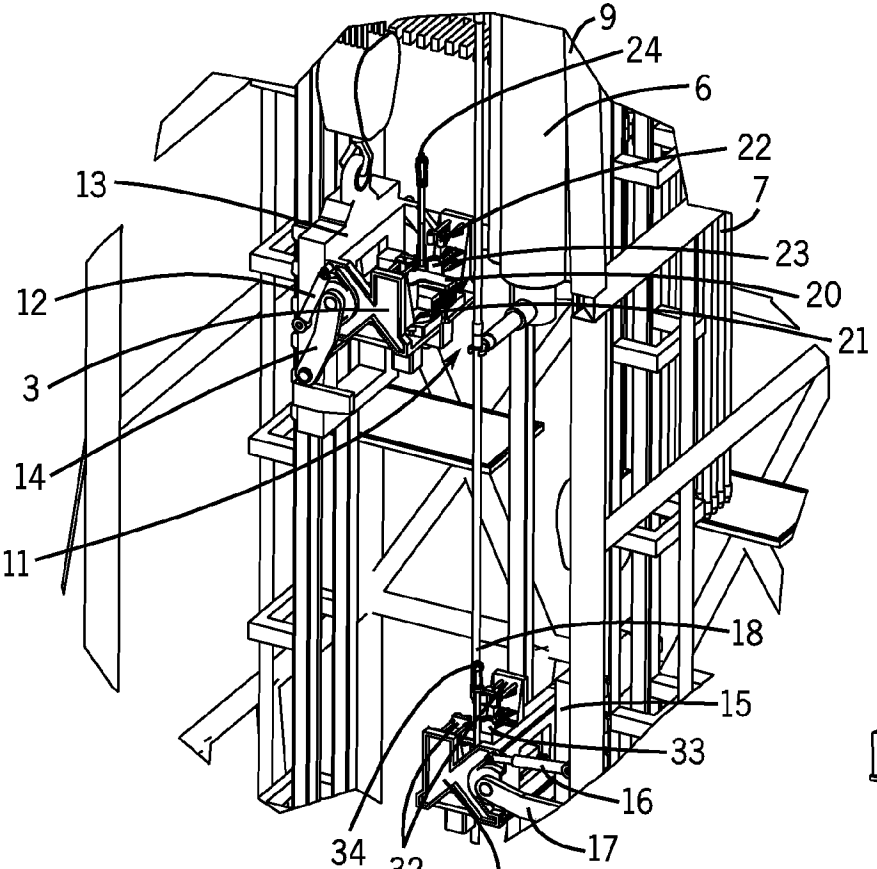

Referring now to FIG. 19A, which is a schematic of one embodiment of a drilling and tripping system 1 at t=103 seconds as the first TDR 3 descends the derrick 9 while the racking arm 6 removes the stand 18 of the tubular 8. Shown in FIG. 19A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 19B, which shows a close-up view of the first TDR 3 and the second TDR 5 at t=103 seconds. Shown in FIG. 19B is a portion of the derrick 9, first TDR 3, first moving dolly 13, stand 18, pipe rack 7, piston 12 and pivot arm 14, which are retracted and attached to the first TDR 3 and the first moving dolly 13, second TDR 5, second moving dolly 15, and second piston 16 and second pivot arm 17, which are extended and attached to the second TDR 5 and the second moving dolly 15. Features of the first TDR 3 that are visible include UTW 20, LTW 21, spinner 22, mud bucket 23 and FCS 24, and features of the second TDR 5 that are visible include second spinner 32, second mud bucket 33 and second FCS 34.

Figure 20A:
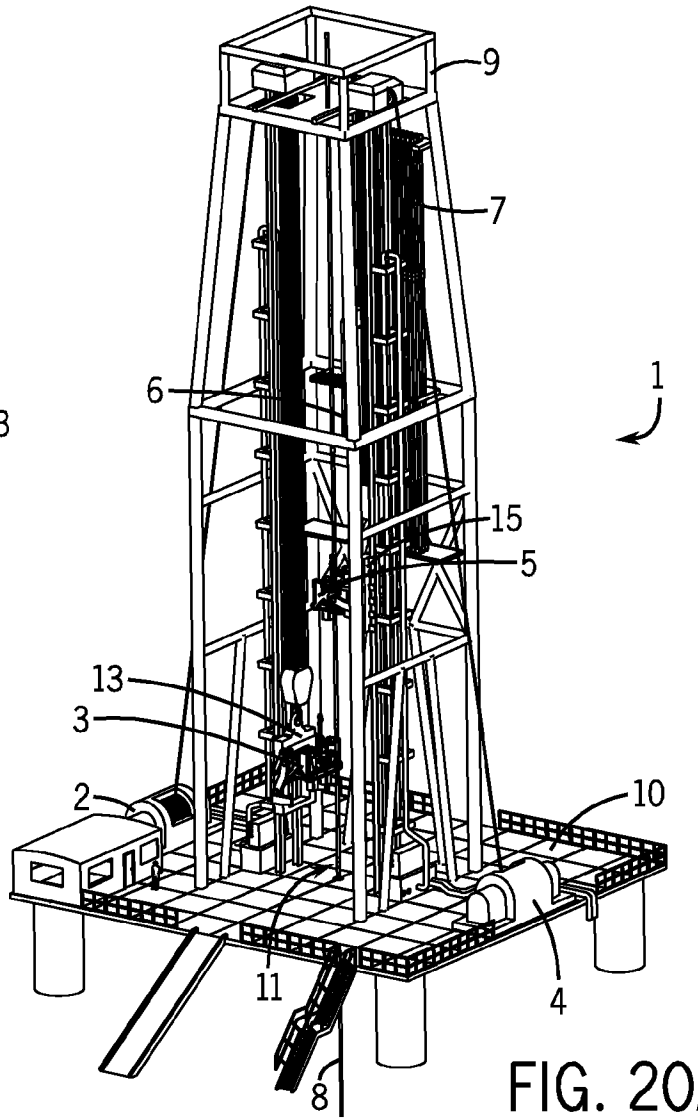
FIG. 20A and FIG. 20B. A schematic representation of the drilling and tripping system shown in FIG. 1 during removal of tubular from a hole at 1 foot/second with continuous rotation and near continuous mud circulation.
Figure 20B:
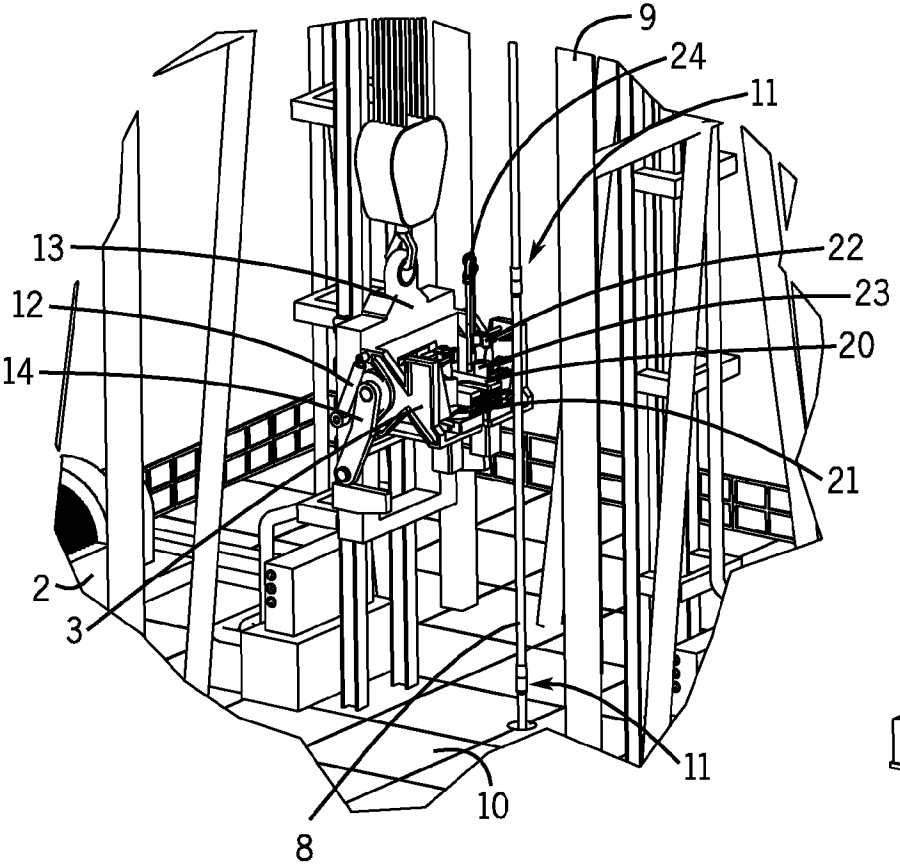

Referring now to FIG. 20A, which is a schematic of one embodiment of a drilling and tripping system 1 at t=115 seconds as the second TDR 5 pulls and rotates the tubular 8. Shown in FIG. 20A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 20B, which shows a close-up view of the first TDR 3 at t=115 seconds. Shown in FIG. 20B is a portion of the derrick 9 and drill floor 10, first drawworks 2, first TDR 3, first moving dolly 13, tubular 8, tool joints 11, and piston 12 and pivot arm 14, which are retracted and attached to the first TDR 3 and the first moving dolly 13. Features of the first TDR 3 that are visible include UTW 20, LTW 21, spinner 22, mud bucket 23 and FCS 24.

Figure 21A:
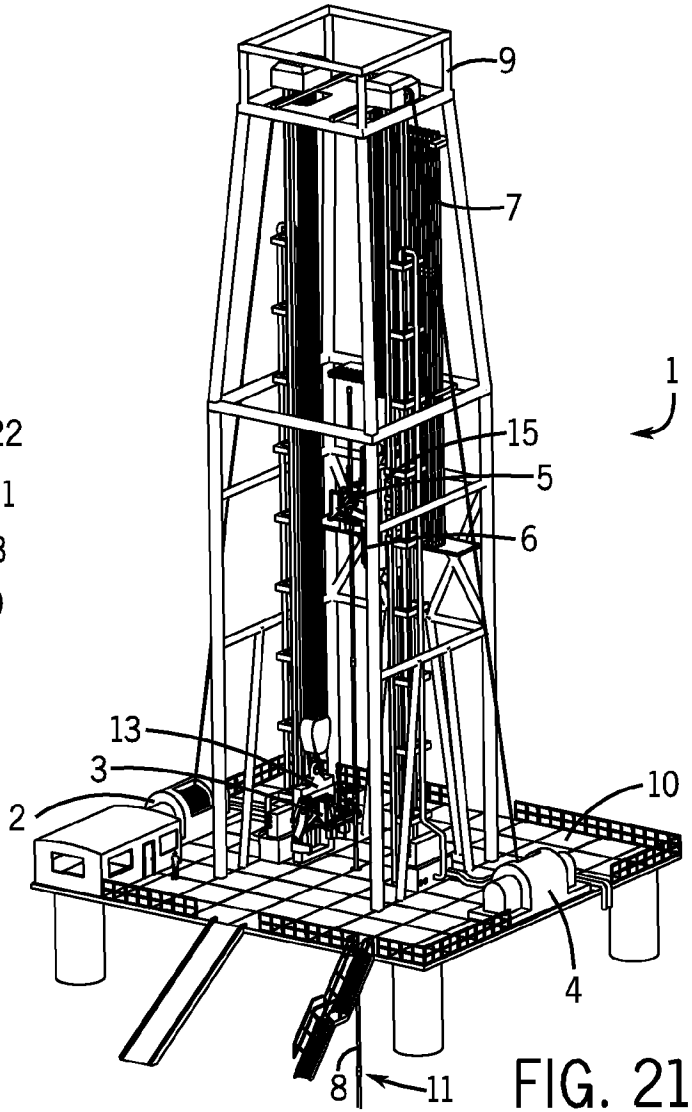
FIG. 21A and FIG. 21B. A schematic representation of the drilling and tripping system shown in FIG. 1 during removal of tubular from a hole at 1 foot/second with continuous rotation and near continuous mud circulation.
Figure 21B:
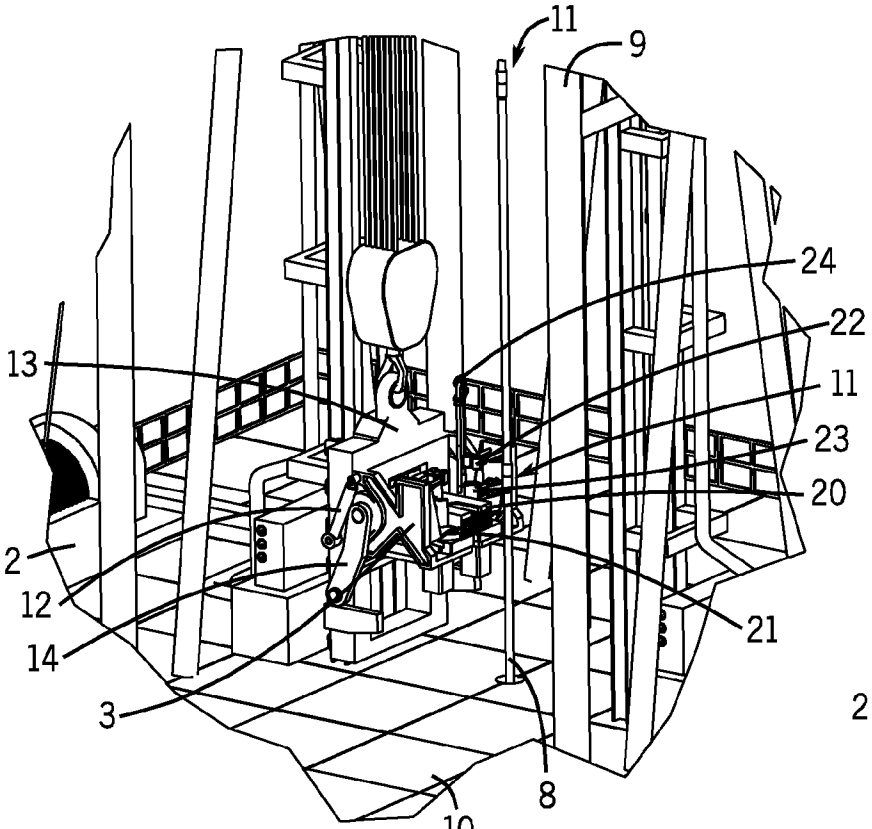

Referring now to FIG. 21A, which is a schematic of one embodiment of a drilling and tripping system at t=129 seconds as the first TDR 3 is back in the start position, awaiting the next tool joint 11 of the tubular 8. Shown in FIG. 21A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 21B, which shows a close-up view of the first TDR 3 at t=129 seconds. Shown in FIG. 21B is a portion of the derrick 9 and drill floor 10, first drawworks 2, first TDR 3, first moving dolly 13, tubular 8, tool joints 11, and piston 12 and pivot arm 14, which are retracted and attached to the first TDR 3 and the first moving dolly 13. Features of the first TDR 3 that are visible include UTW 20, LTW 21, spinner 22, mud bucket 23 and FCS 24.

Drilling

Figures 1, 22A:
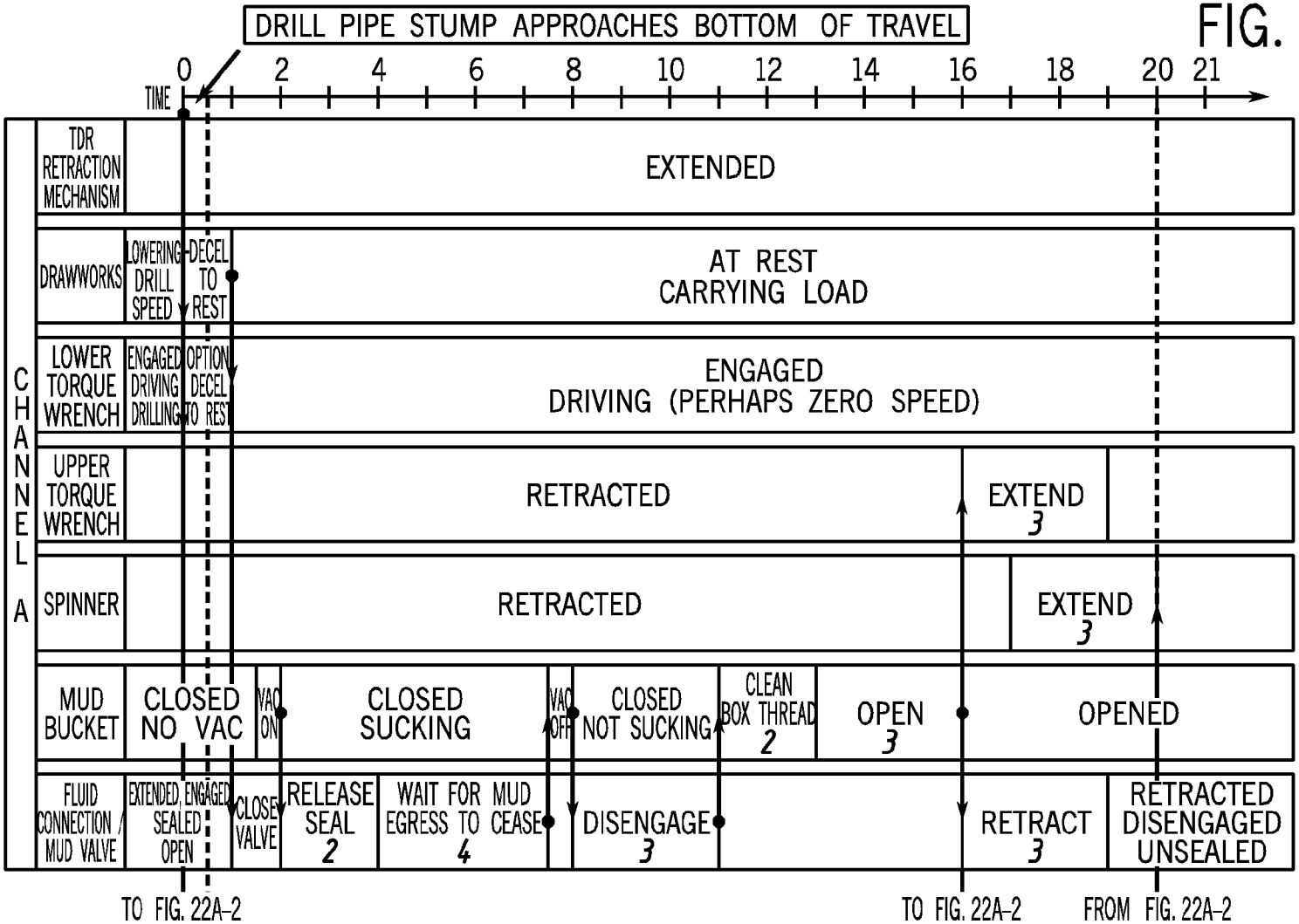
FIG. 22A and FIG. 22B. A block diagram showing one embodiment of a detailed operational sequence for one cycle of drilling at 1 foot/second. At the end of the described cycle, the cycle repeats with Channel A performing the tasks done by Channel B and vice-versa.
Figures 1, 22B:
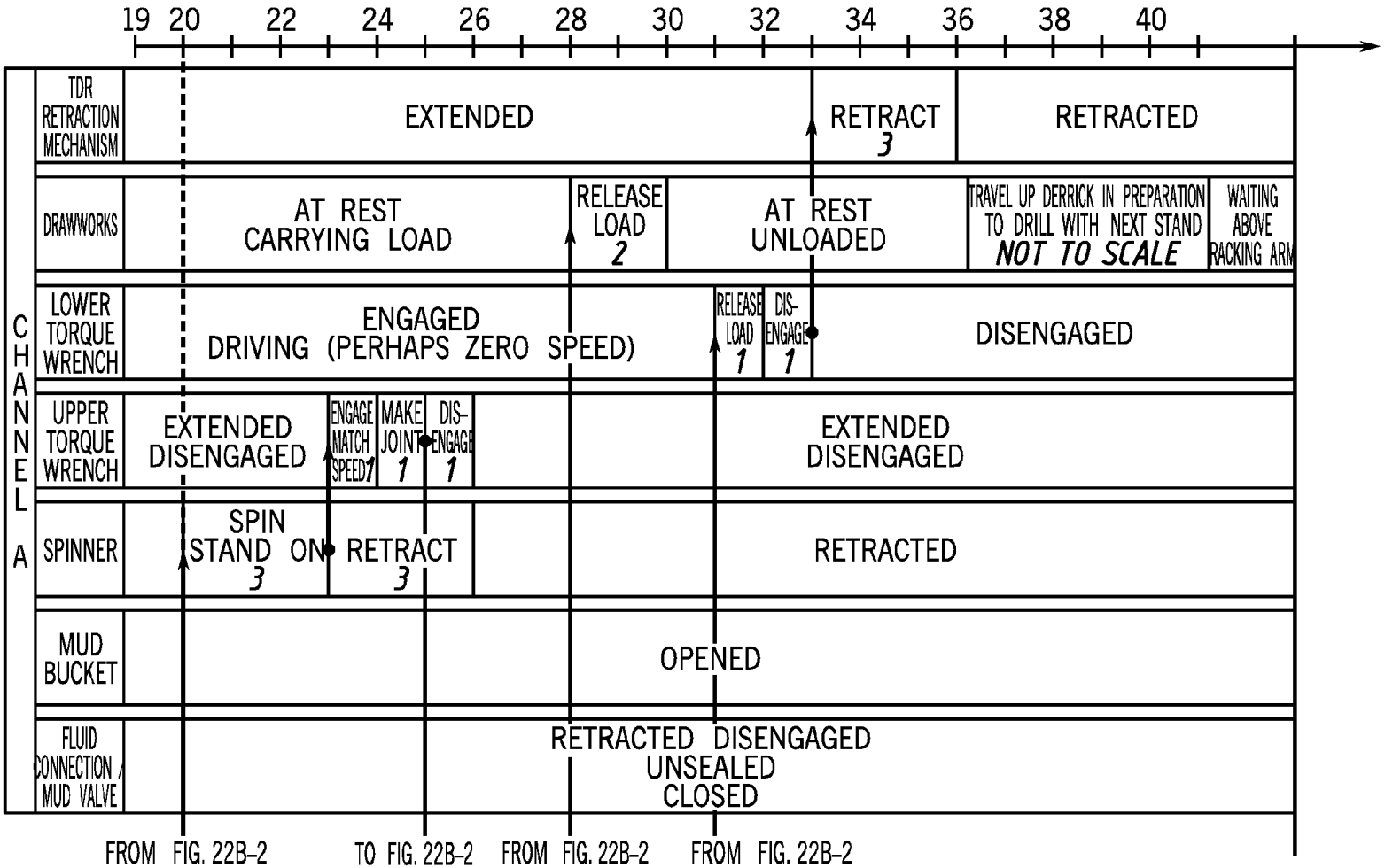
Figures 2, 22B:
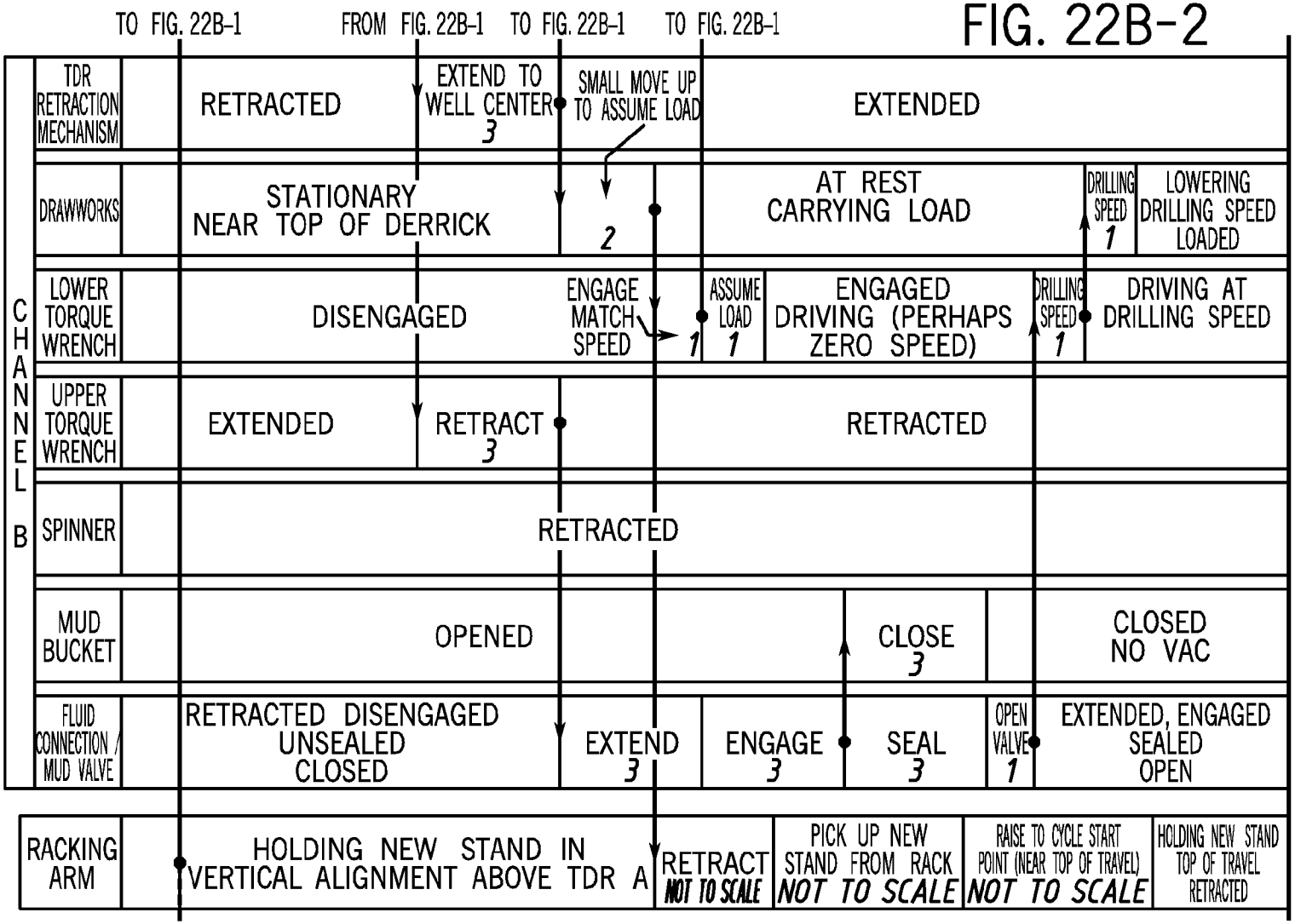
Figure 23A:
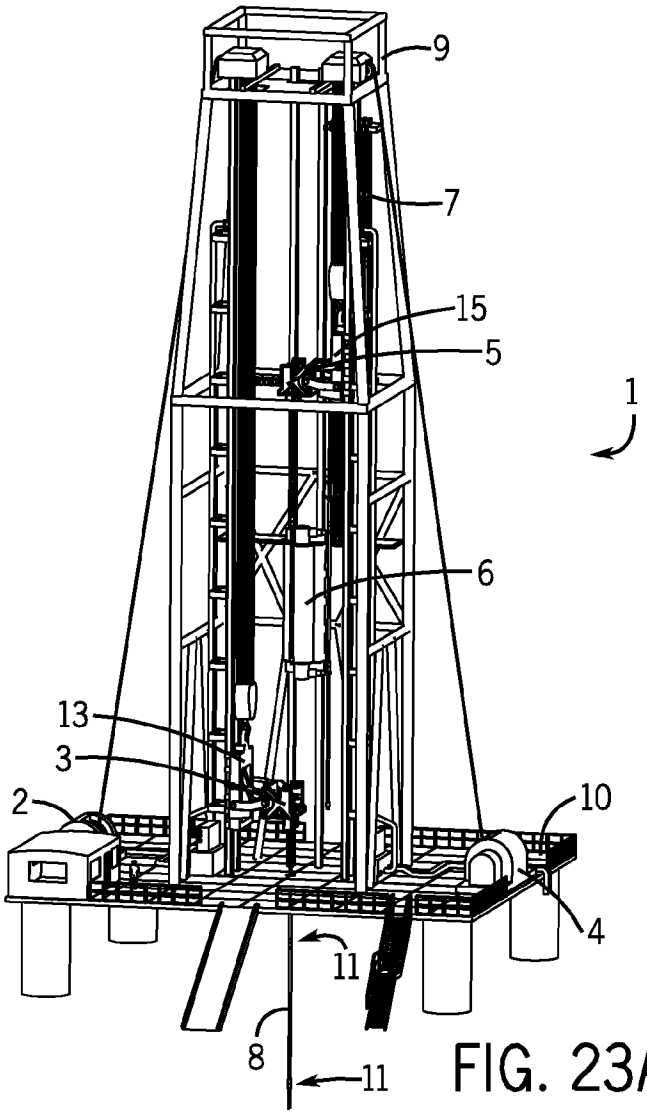
FIG. 23A and FIG. 23B. A schematic representation of the drilling and tripping system shown in FIG. 1 during drilling at 1 foot/second.
Figure 23B:
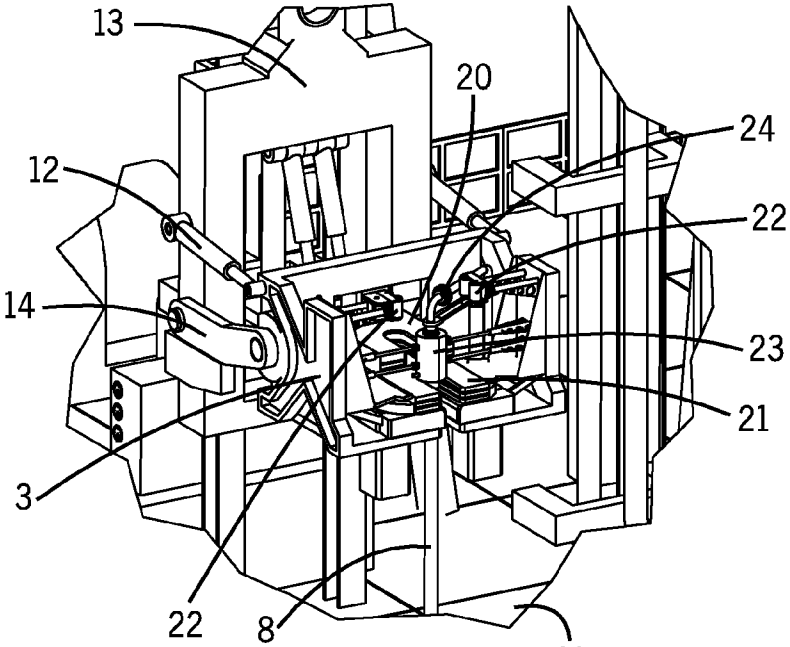

FIG. 22A and FIG. 22B shows the detailed operational sequence for one cycle of drilling at 1 foot/second. FIGS. 23 through 42 provide "snapshots" of one embodiment of a presently disclosed drilling and tripping system as it completes two cycles of the operational drilling sequence shown in FIG. 22A and FIG. 22B. Referring to FIG. 23A, which is a schematic of one embodiment of a drilling and tripping system 1 at t=1 second as the first TDR 3 is drilling—rotating and lowering tubular 8 and circulating mud. Shown in FIG. 23A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 23B, which shows a close-up view of the first TDR 3 at t=1 second. Shown in FIG. 23B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 24A:
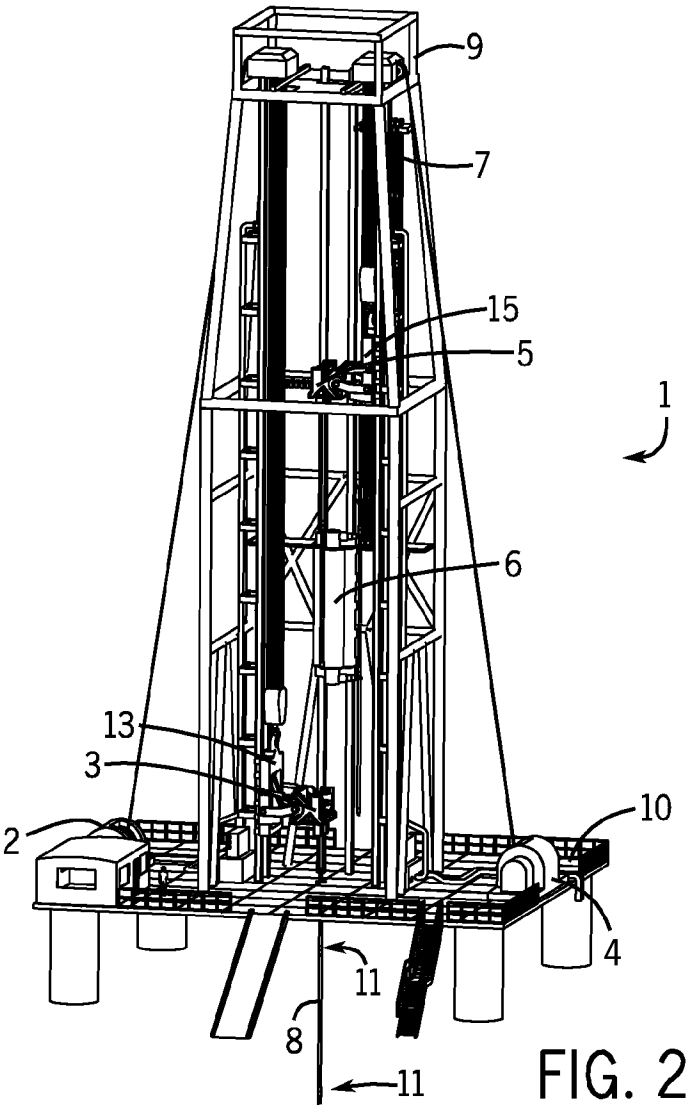
FIG. 24A and FIG. 24B. A schematic representation of the drilling and tripping system shown in FIG. 1 during drilling at 1 foot/second.
Figure 24B:
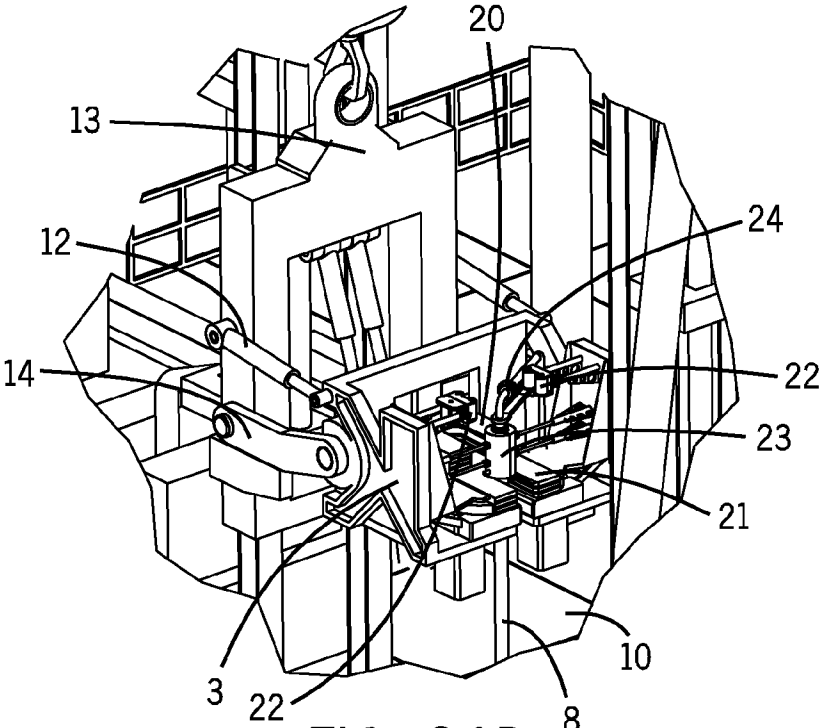

Referring now to FIG. 24A, which is a schematic of one embodiment of a drilling and tripping system 1 at t=8 seconds as the tubular 8 reaches the drill floor 10, penetration stops and the mud valve is closed. Shown in FIG. 24A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 24B, which shows a close-up view of the first TDR 3 at t=8 seconds. Shown in FIG. 24B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 25A:
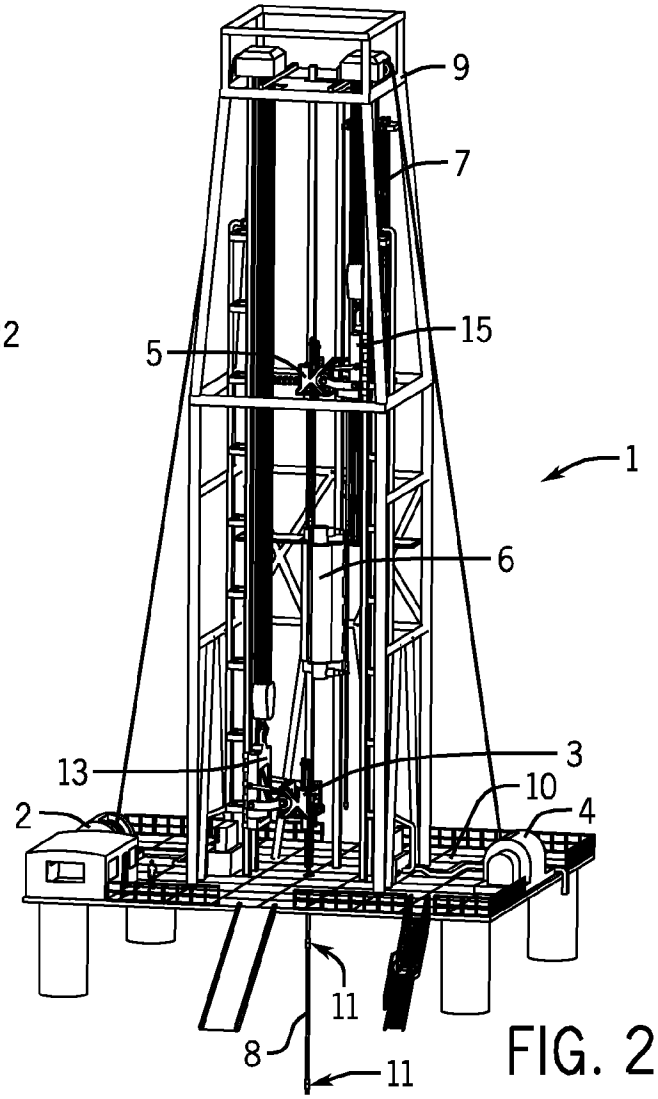
FIG. 25A and FIG. 25B. A schematic representation of the drilling and tripping system shown in FIG. 1 during drilling at 1 foot/second.
Figure 25B:
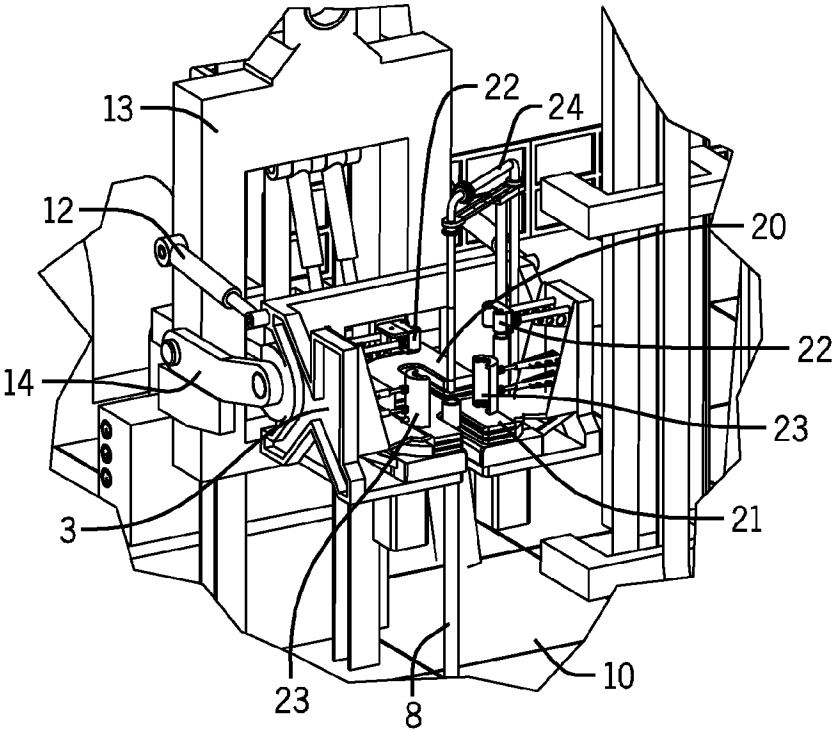

Referring now to FIG. 25A, which is a schematic of one embodiment of a drilling and tripping system 1 at t=19 seconds as the fluid connection system 24 of the first TDR 3 retracts and the mud bucket 23 of the first TDR 3 is opened. Shown in FIG. 25A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 25B, which shows a close-up view of the first TDR 3 at t=19 seconds. Shown in FIG. 25B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 26A:
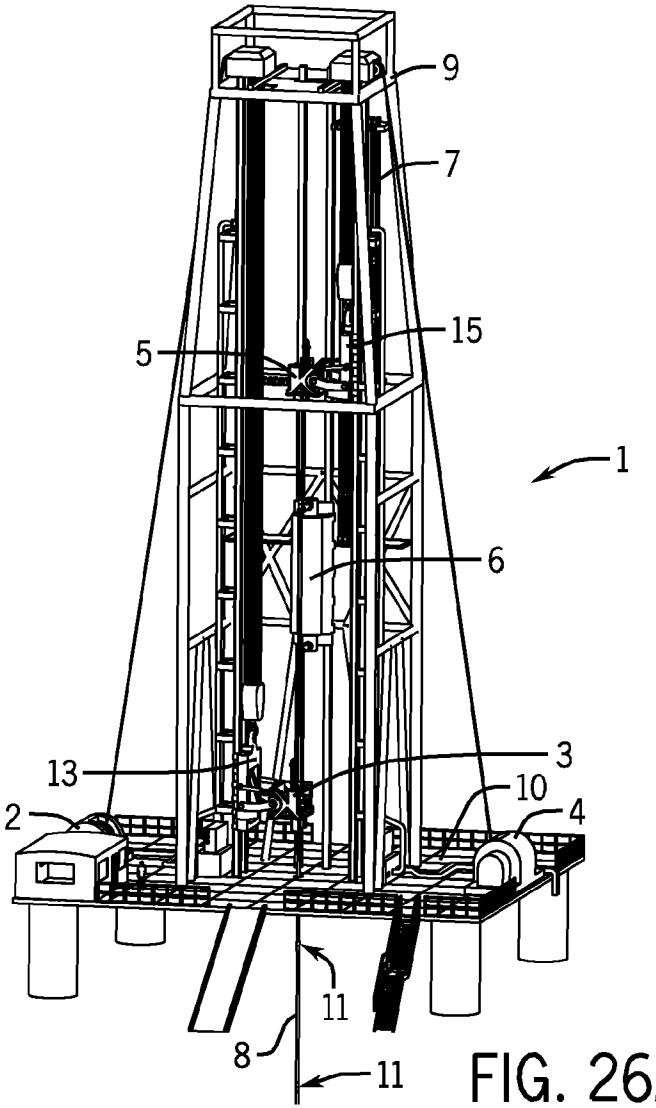
FIG. 26A and FIG. 26B. A schematic representation of the drilling and tripping system shown in FIG. 1 during drilling at 1 foot/second.
Figure 26B:
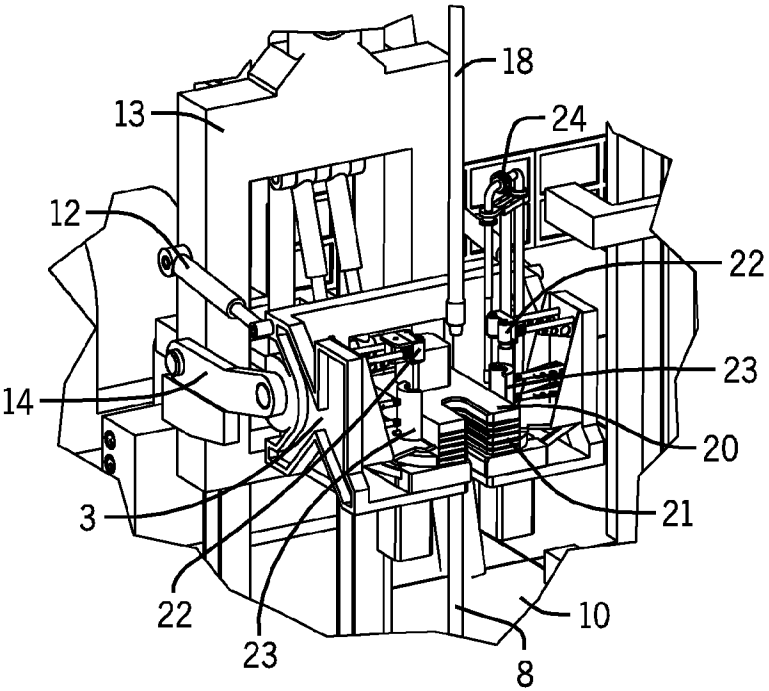

Referring now to FIG. 26A, which is a schematic of one embodiment of a drilling and tripping system 1 at t=23 seconds as the racking arm 6 inserts a new stand 18 while the spinner 22 and UTW 20 of the first TDR 3 engages. Shown in FIG. 26A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 26B, which shows a close-up view of the first TDR 3 at t=23 seconds. Shown in FIG. 26B is a portion of the drill floor 10, first TDR 3, first moving dolly 13, tubular 8, stand 18, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 27A:
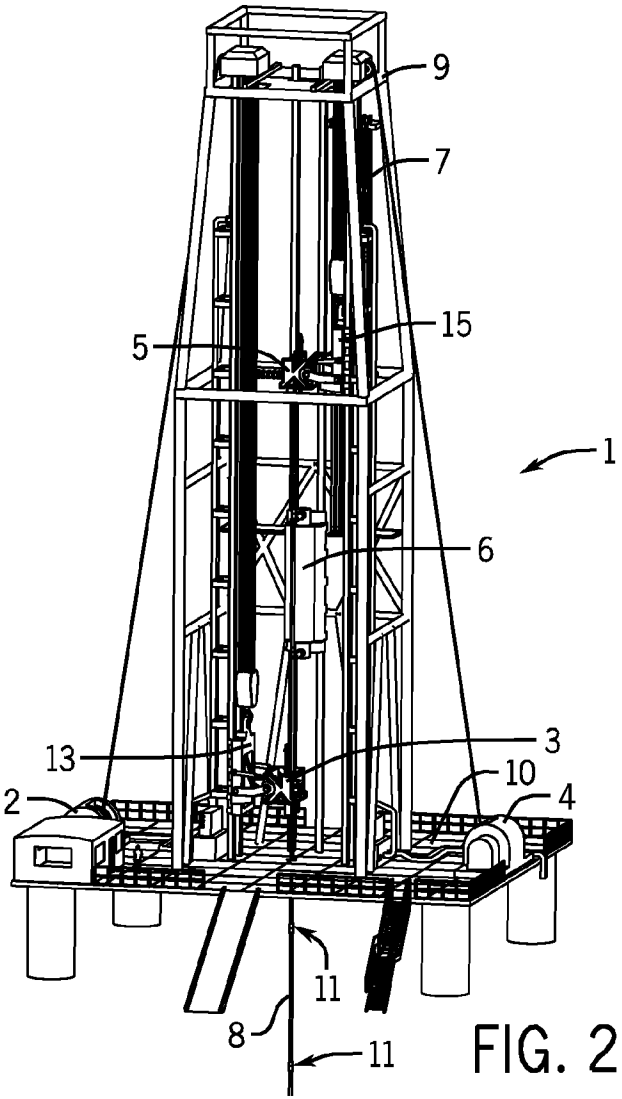
FIG. 27A and FIG. 27B. A schematic representation of the drilling and tripping system shown in FIG. 1 during drilling at 1 foot/second.
Figure 27B:
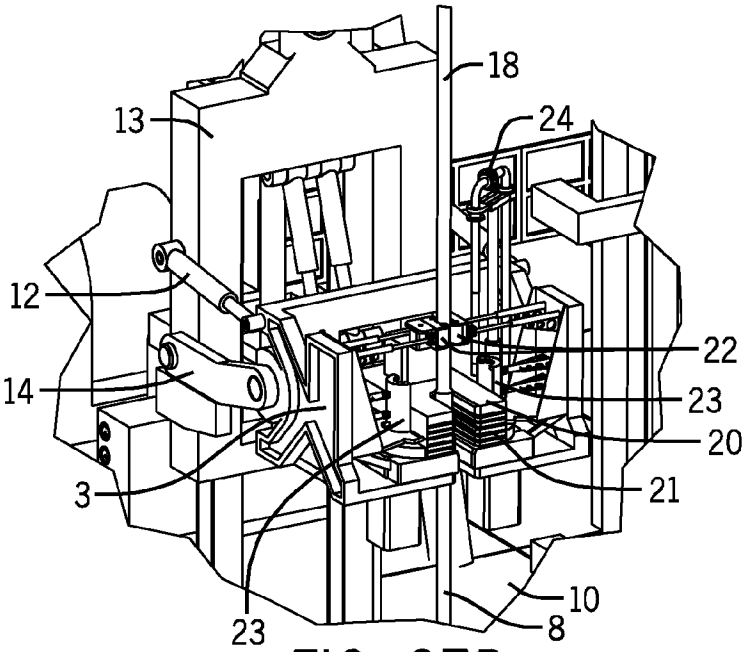

Referring now to FIG. 27A, which is a schematic of one embodiment of a drilling and tripping system 1 at t=26 seconds as the spinner 22 and UTW 20 of the first TDR 3 connects the new stand 18 to the tubular 8. Shown in FIG. 27A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 27B, which shows a close-up view of the first TDR 3 at t=26 seconds. Shown in FIG. 27B is a portion of the drill floor 10, first TDR 3, first moving dolly 13, tubular 8, stand 18, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 28A:
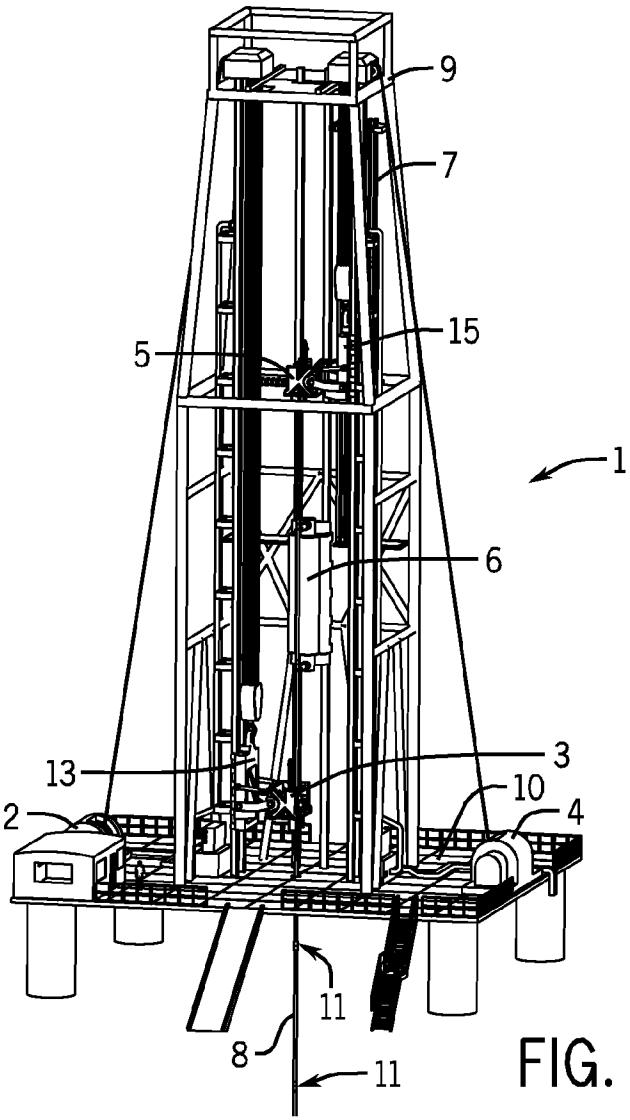
FIG. 28A and FIG. 28B. A schematic representation of the drilling and tripping system shown in FIG. 1 during drilling at 1 foot/second.
Figure 28B:
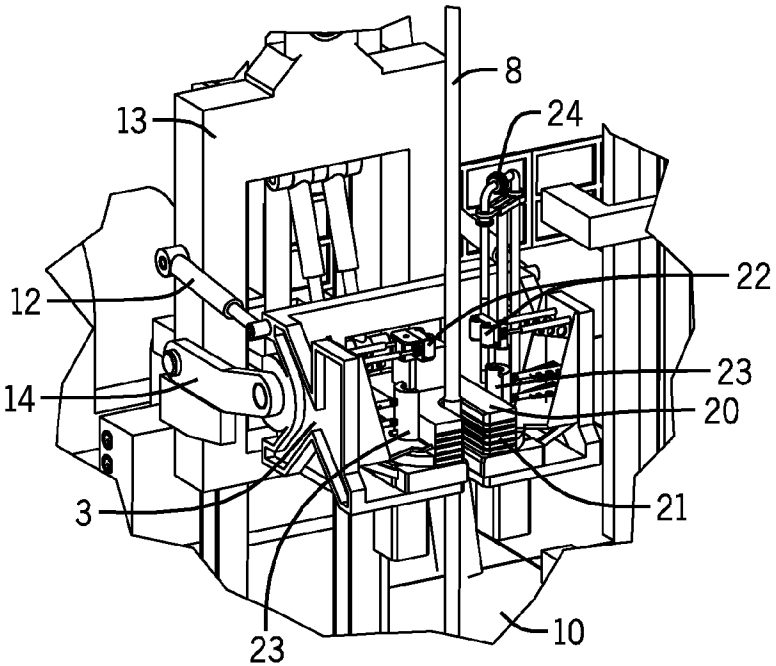

Referring now to FIG. 28A, which is a schematic of one embodiment of a drilling and tripping system 1 at t=30 seconds as the spinner 22 and UTW 20 of the first TDR 3 disengages. Shown in FIG. 28A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 28B, which shows a close-up view of the first TDR 3 at t=30 seconds. Shown in FIG. 28B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 29A:
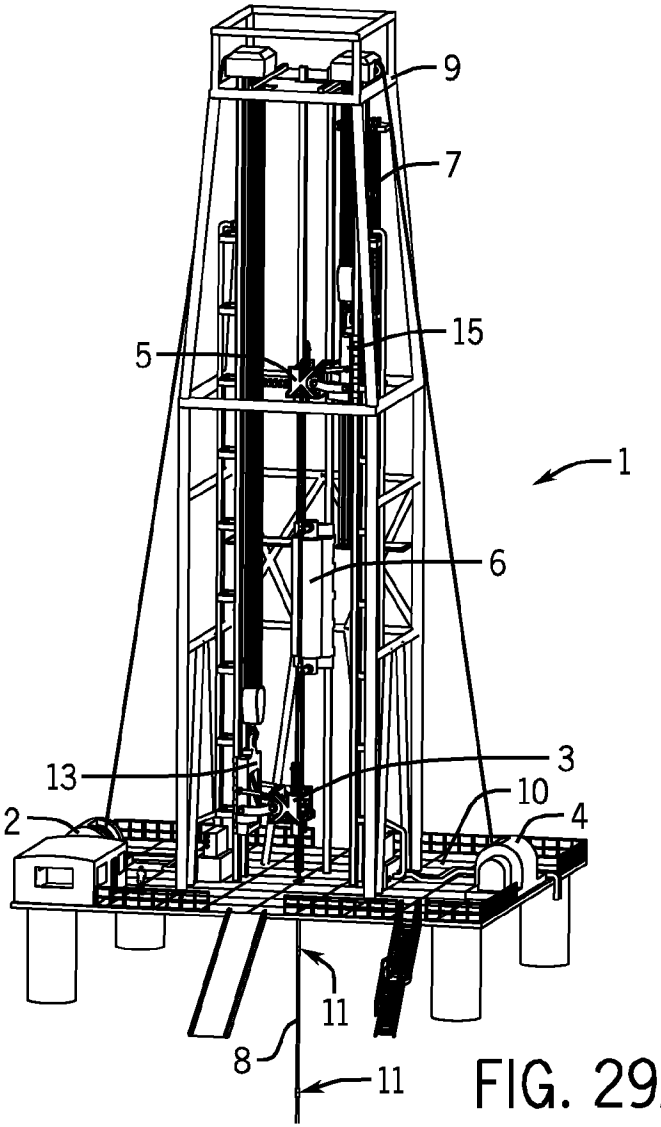
FIG. 29A and FIG. 29B. A schematic representation of the drilling and tripping system shown in FIG. 1 during drilling at 1 foot/second.
Figure 29B:
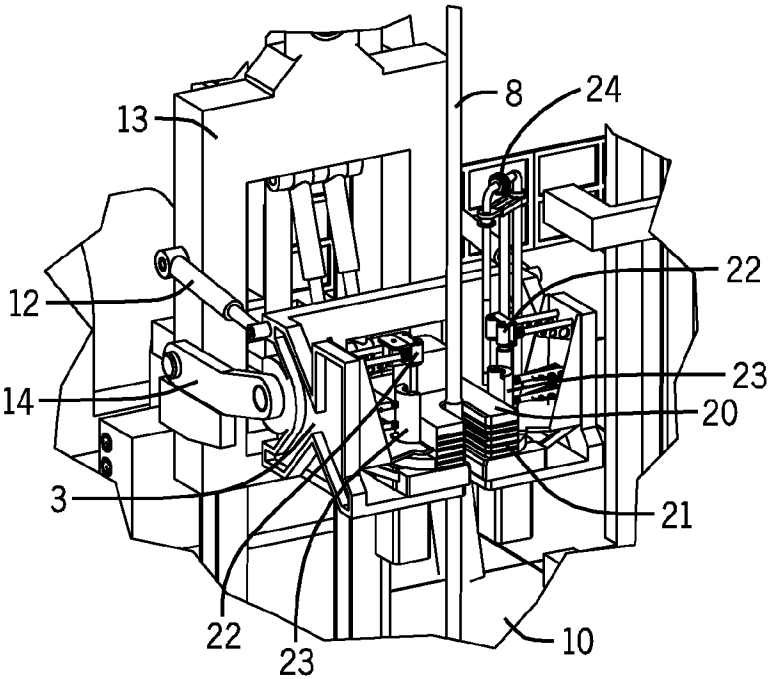

Referring now to FIG. 29A, which is a schematic of one embodiment of a drilling and tripping system 1 at t=34 seconds as the second TDR 5 engages with the tubular 8 at the top of the derrick 9. Shown in FIG. 29A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 29B, which shows a close-up view of the first TDR 3 at t=34 seconds. Shown in FIG. 29B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 30A:
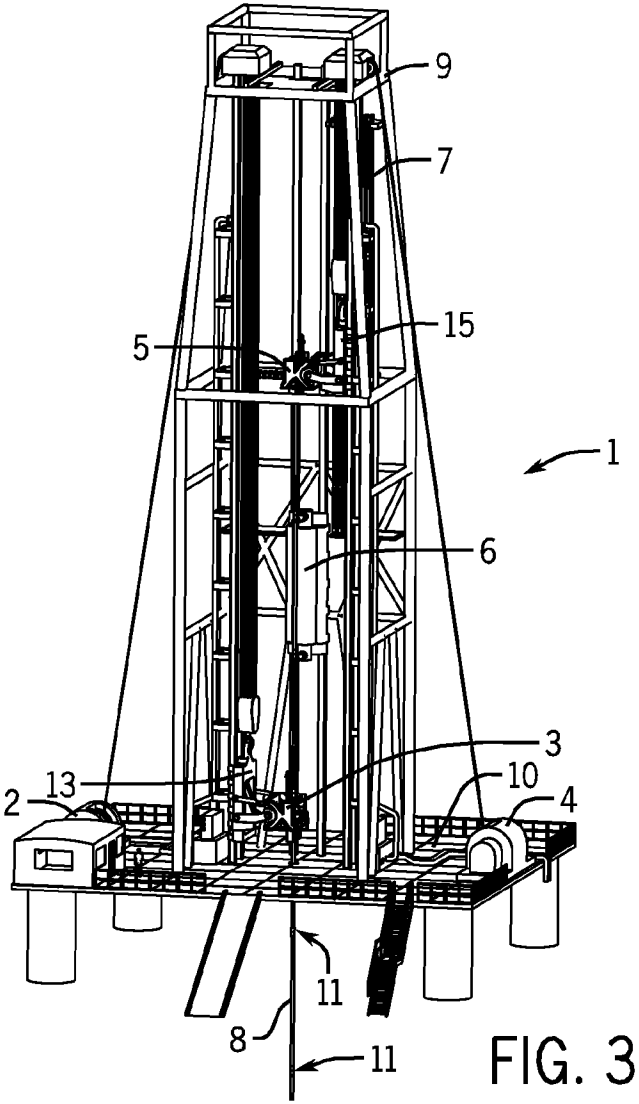
FIG. 30A and FIG. 30B. A schematic representation of the drilling and tripping system shown in FIG. 1 during drilling at 1 foot/second.
Figure 30B:
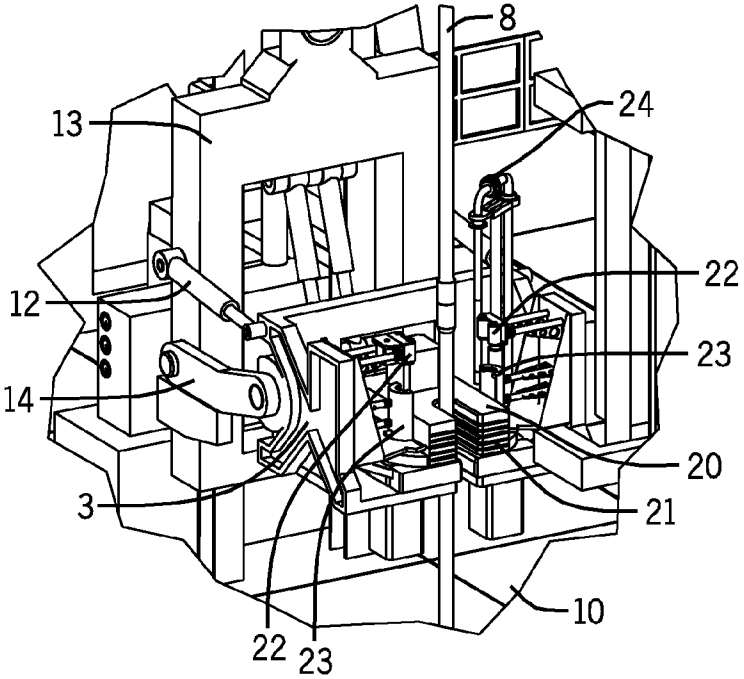

Referring now to FIG. 30A, which is a schematic of one embodiment of a drilling and tripping system 1 at t=36 seconds as the first TDR 3 retracts from the well center. Shown in FIG. 30A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 30B, which shows a close-up view of the first TDR 3 at t=36 seconds. Shown in FIG. 30B is a portion of the drill floor 10, first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23 and FCS 24.

Figure 31A:
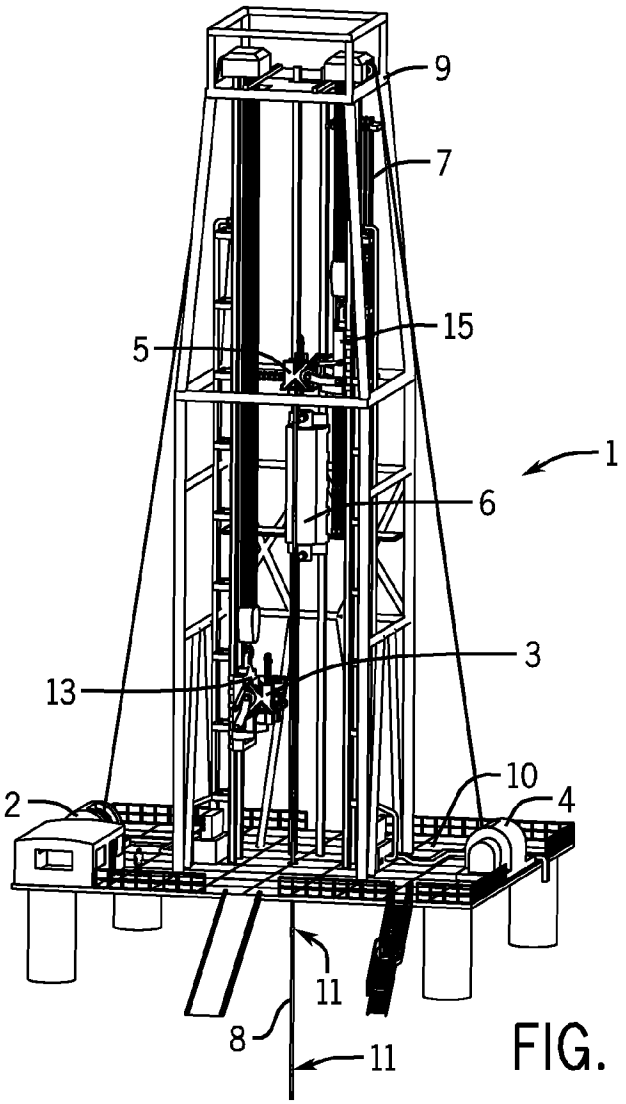
FIG. 31A and FIG. 31B. A schematic representation of the drilling and tripping system shown in FIG. 1 during drilling at 1 foot/second.
Figure 31B:
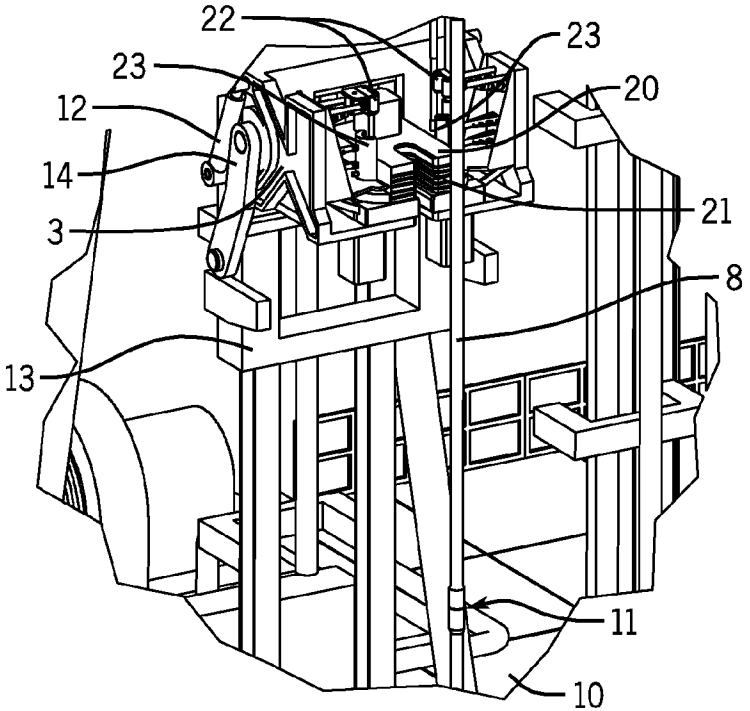

Referring now to FIG. 31A, which is a schematic of one embodiment of a drilling and tripping system 1 at t=43 seconds as the first TDR 3 is lifted to the top of the derrick. Shown in FIG. 31A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 31B, which shows a close-up view of the first TDR 3 at t=43 seconds. Shown in FIG. 31B is a portion of the drill floor 10, first TDR 3, first moving dolly 13, tubular 8, tool joint 11, and piston 12 and pivot arm 14, which are retracted and attached to the first TDR 3 and the first moving dolly 13. Features of the first TDR 3 that are visible include UTW 20, LTW 21, spinner 22, and mud bucket 23.

Figure 32A:
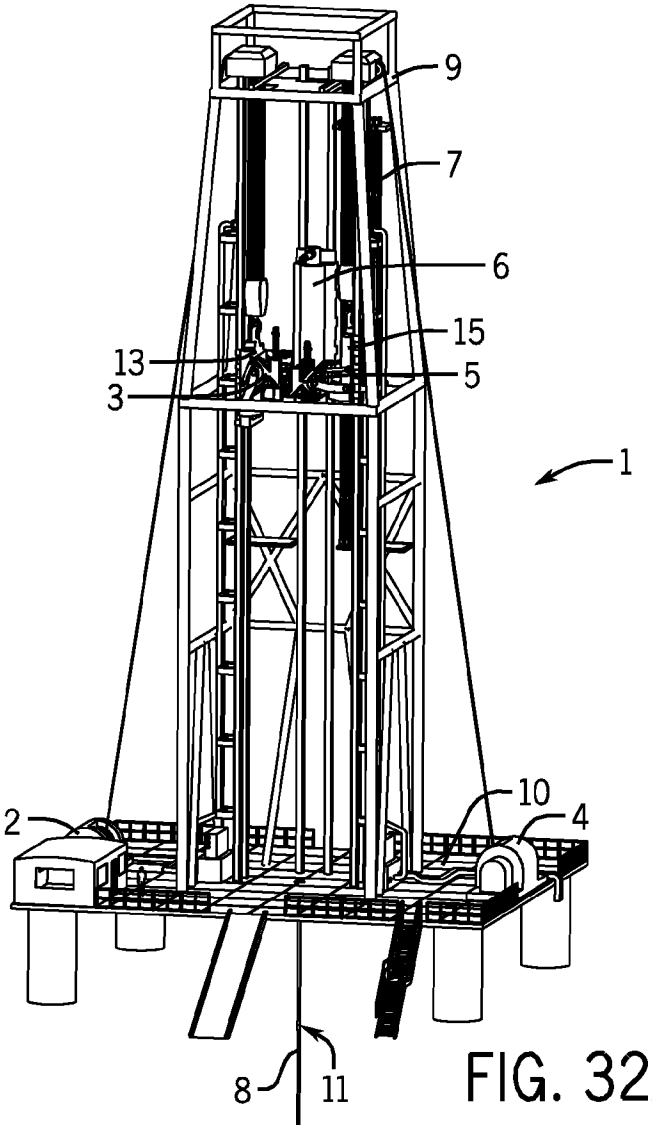
FIG. 32A and FIG. 32B. A schematic representation of the drilling and tripping system shown in FIG. 1 during drilling at 1 foot/second.
Figure 32B:
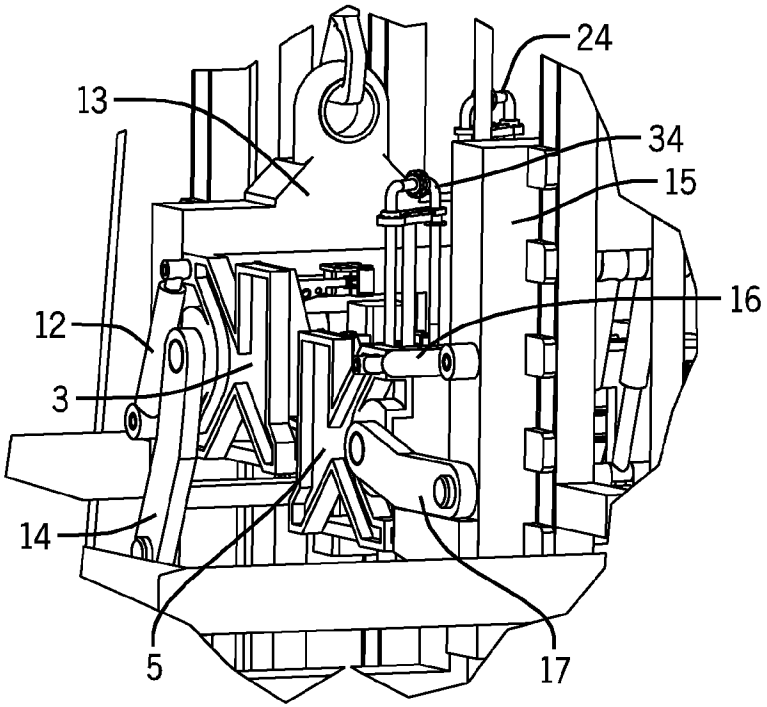

Referring now to FIG. 32A, which is a schematic of one embodiment of a drilling and tripping system 1 at t=50 seconds as the drilling continues via the second TDR 5. Shown in FIG. 32A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 32B, which shows a close-up view of the first TDR 3 and the second TDR 5 at t=50 seconds. Shown in FIG. 32B is a first TDR 3, first moving dolly 13, piston 12 and pivot arm 14, which are retracted and attached to the first TDR 3 and the first moving dolly 13, second TDR 5, second moving dolly 15, and second piston 16 and second pivot arm 17, which are extended and attached to the second TDR 5 and the second moving dolly 15. Features of the first TDR 3 that are visible include FCS 24, and features of the second TDR 5 that are visible include second FCS 34.

Figure 33A:
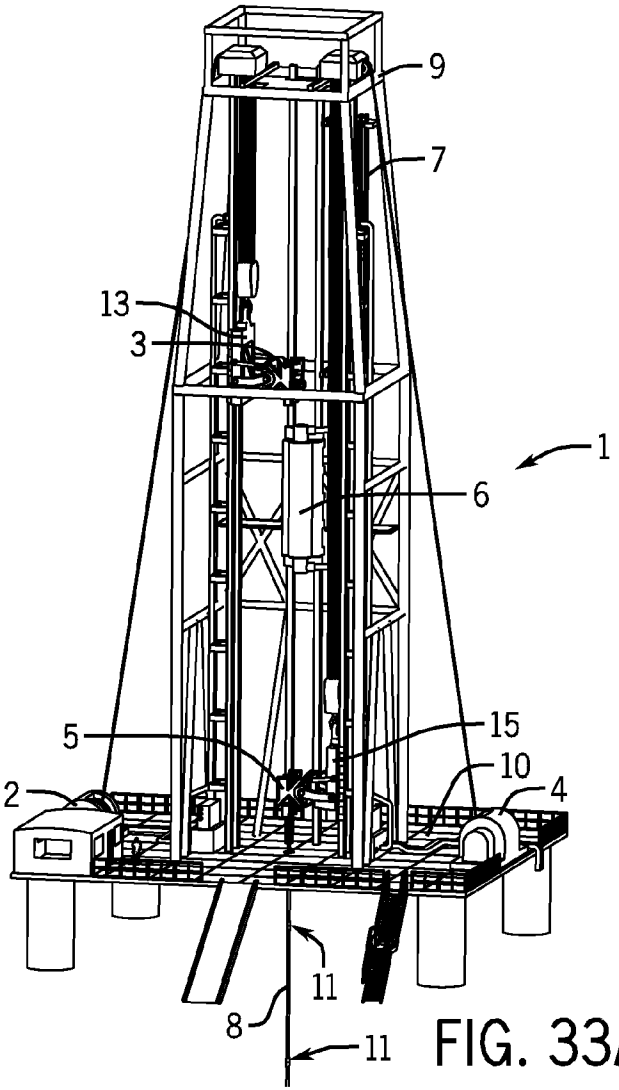
FIG. 33A and FIG. 33B. A schematic representation of the drilling and tripping system shown in FIG. 1 during drilling at 1 foot/second.
Figure 33B:
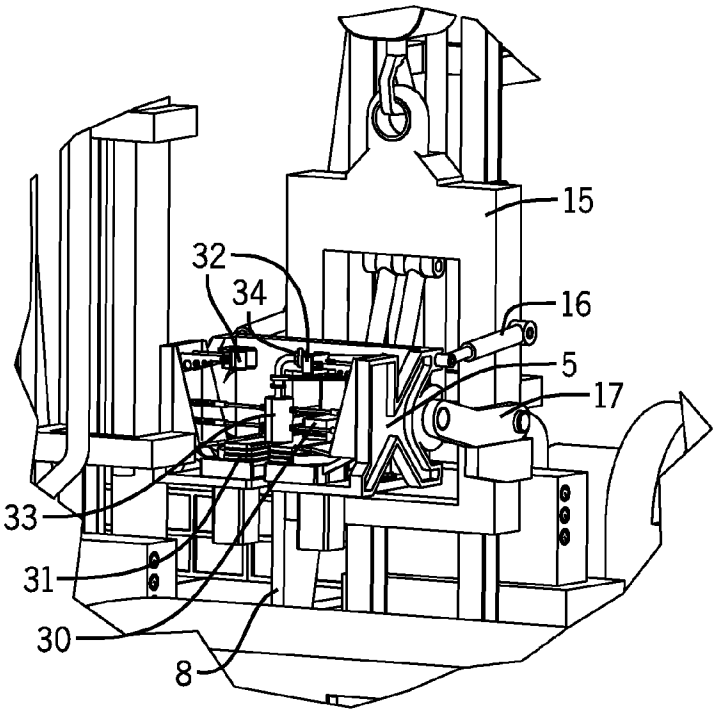

Referring now to FIG. 33A, which is a schematic of one embodiment of a drilling and tripping system 1 at t=129 seconds as the second TDR 5 reaches the drill floor 10 and penetration stops. Shown in FIG. 33A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 33B, which shows a close-up view of the second TDR 5 at t=129 seconds. Shown in FIG. 33B is a second TDR 5, second moving dolly 15, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 34A:
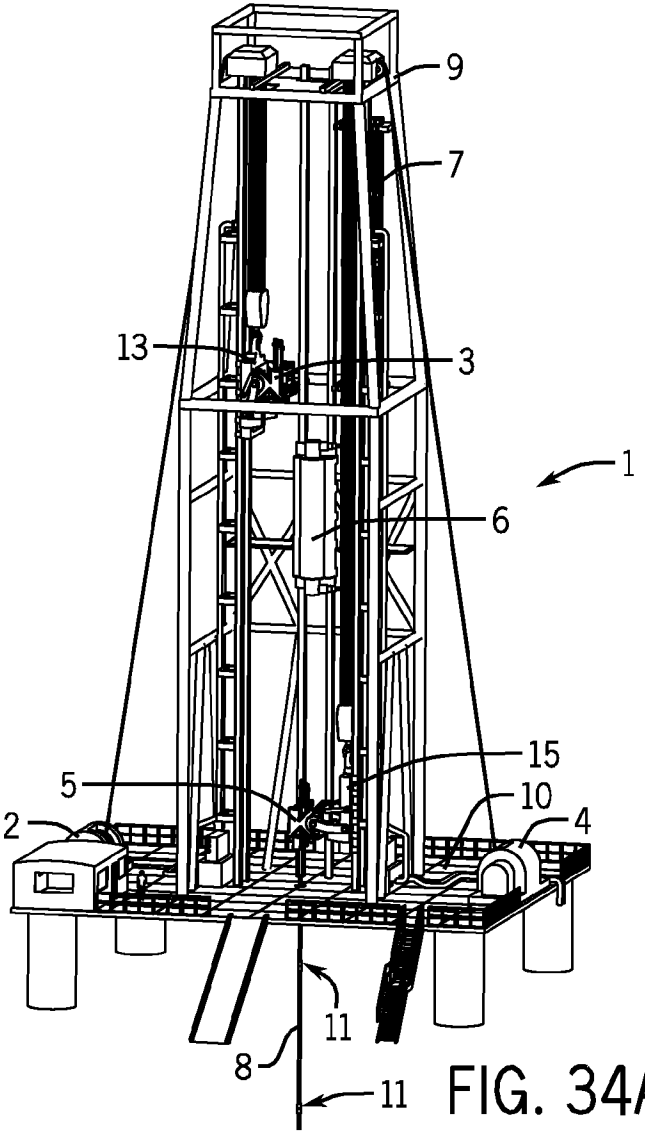
FIG. 34A and FIG. 34B. A schematic representation of the drilling and tripping system shown in FIG. 1 during drilling at 1 foot/second.
Figure 34B:
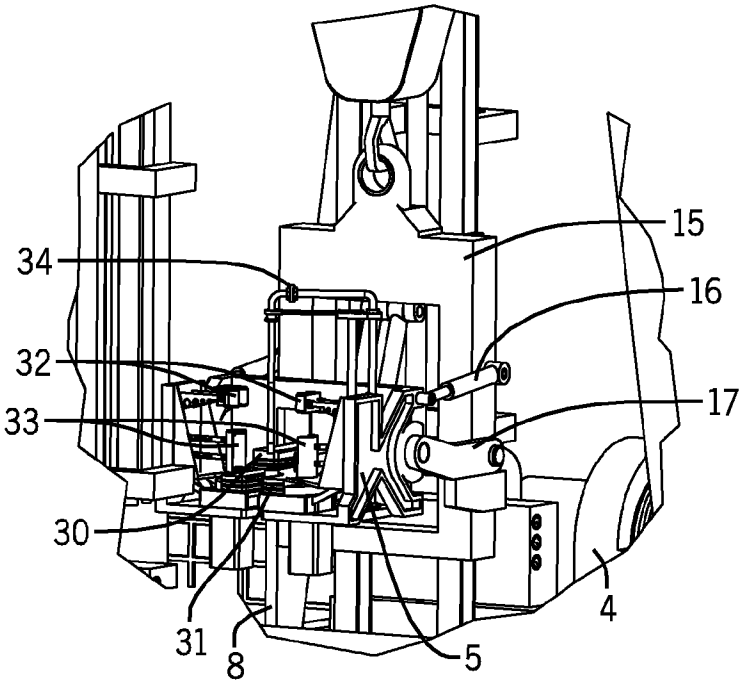

Referring now to FIG. 34A, which is a schematic of one embodiment of a drilling and tripping system 1 at t=146 seconds as the second TDR 5 disconnects while the racking arm 6 brings in the next stand. Shown in FIG. 34A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 34B, which shows a close-up view of the second TDR 5 at t=146 seconds. Shown in FIG. 34B is a second TDR 5, second moving dolly 15, second drawworks 4, tubular 8, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 35A:
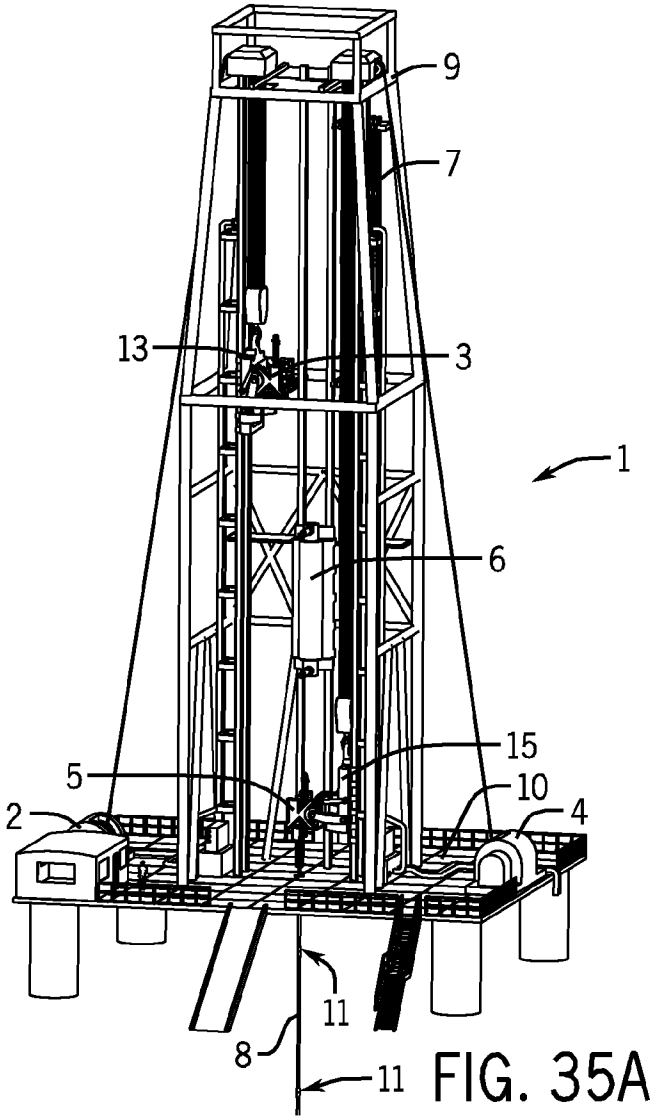
FIG. 35A and FIG. 35B. A schematic representation of the drilling and tripping system shown in FIG. 1 during drilling at 1 foot/second.
Figure 35B:
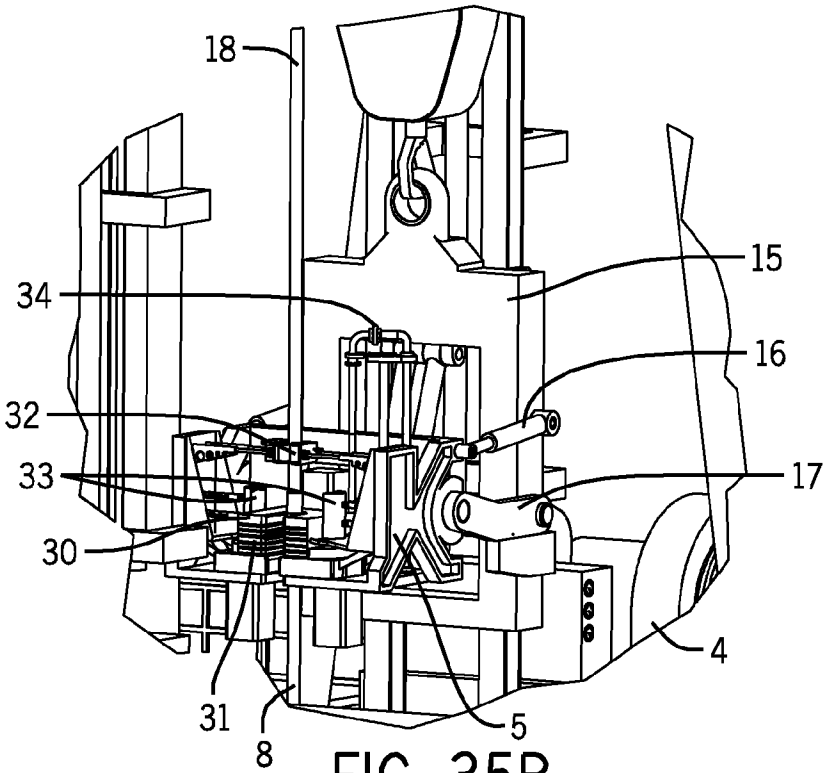

Referring now to FIG. 35A, which is a schematic of one embodiment of a drilling and tripping system 1 at t=152 seconds as the second TDR 5 connects the new stand 18 to the tubular 8. Shown in FIG. 35A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the second TDR 5 are more visible in FIG. 35B, which shows a close-up view of the second TDR 5 at t=152 seconds. Shown in FIG. 35B is a second TDR 5, second moving dolly 15, second drawworks 4, stand 18, tubular 8, and second piston 16 and second pivot arm 17, which are extended and attached to the second TDR 5 and the second moving dolly 15. Features of the second TDR 5 that are visible include second UTW 30, second LTW 31, second spinner 32, second mud bucket 33, and second FCS 34.

Figure 36A:
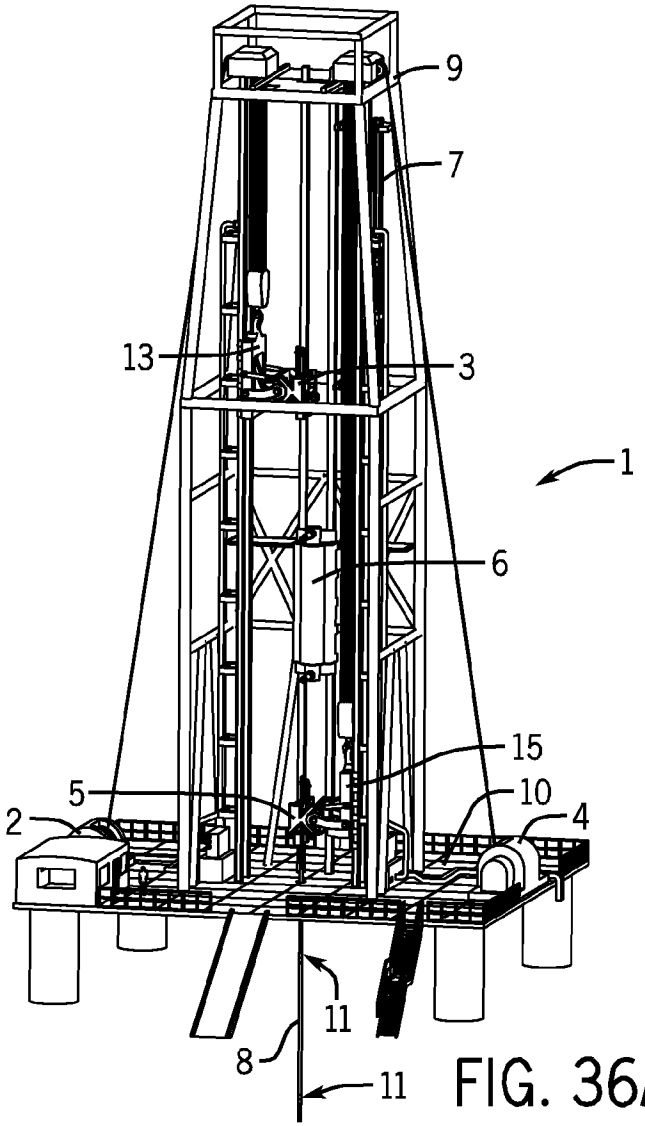
FIG. 36A and FIG. 36B. A schematic representation of the drilling and tripping system shown in FIG. 1 during drilling at 1 foot/second.
Figure 36B:
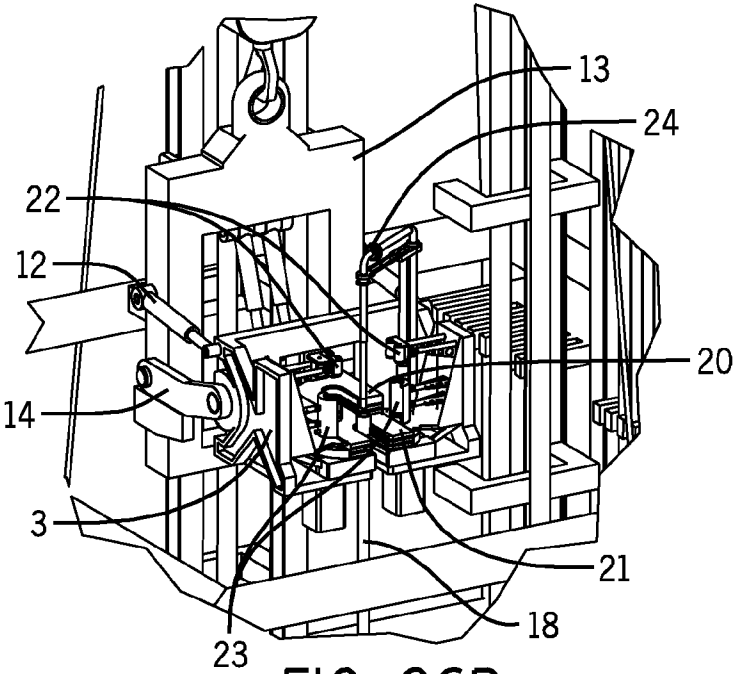

Referring now to FIG. 36A, which is a schematic of one embodiment of a drilling and tripping system 1 at t=162 seconds as the first TDR 3 engages the top of the new stand 18. Shown in FIG. 36A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 36B, which shows a close-up view of the first TDR 3 at t=162 seconds. Shown in FIG. 36B is a first TDR 3, first moving dolly 13, stand 18, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 37A:
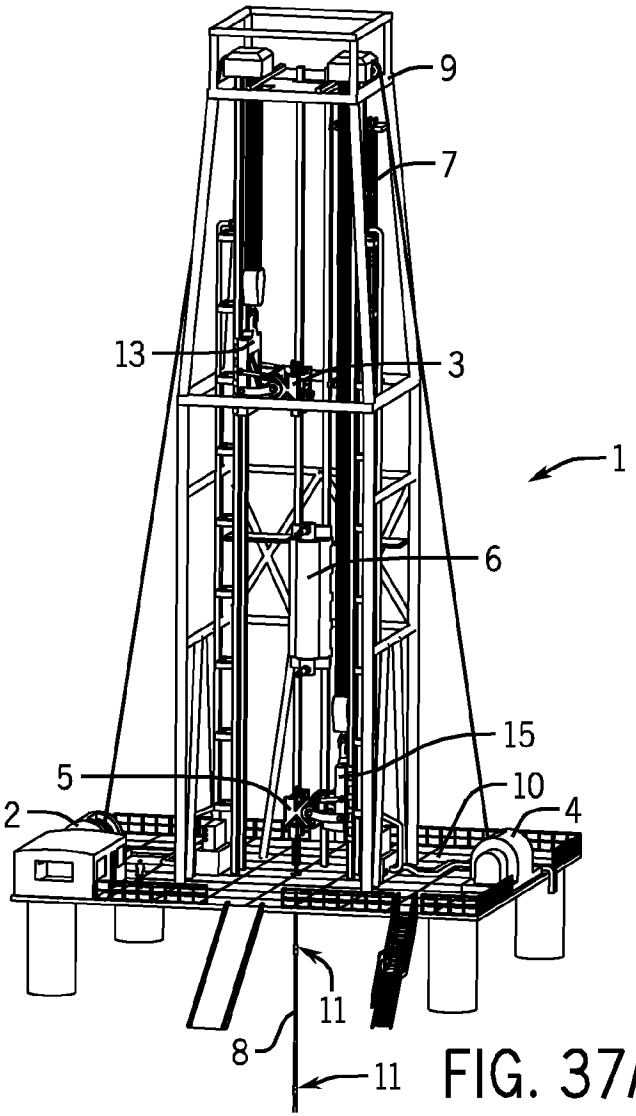
FIG. 37A and FIG. 37B. A schematic representation of the drilling and tripping system shown in FIG. 1 during drilling at 1 foot/second.
Figure 37B:
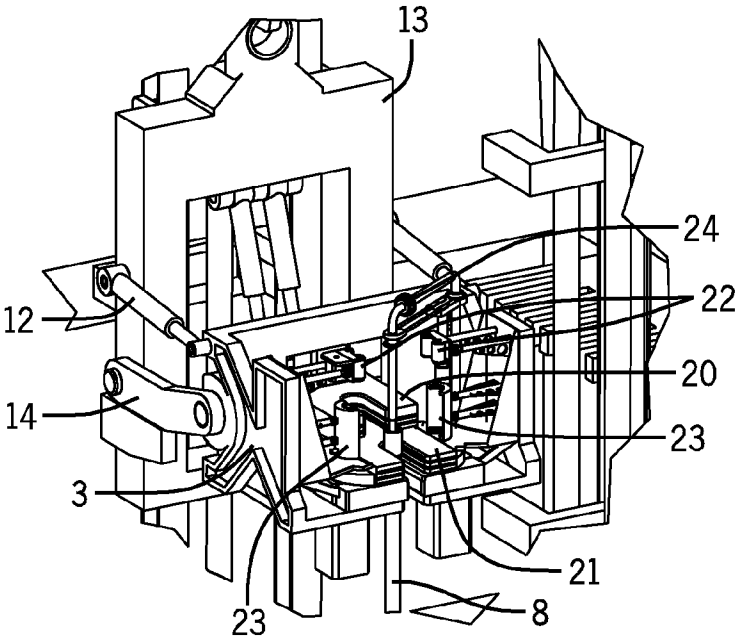

Referring now to FIG. 37A, which is a schematic of one embodiment of a drilling and tripping system 1 at t=165 seconds as the first TDR 3 picks up the weight and rotational load of the tubular 8 and engages the fluid connections system 24. Shown in FIG. 37A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 37B, which shows a close-up view of the first TDR 3 at t=165 seconds. Shown in FIG. 37B is a first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 38A:
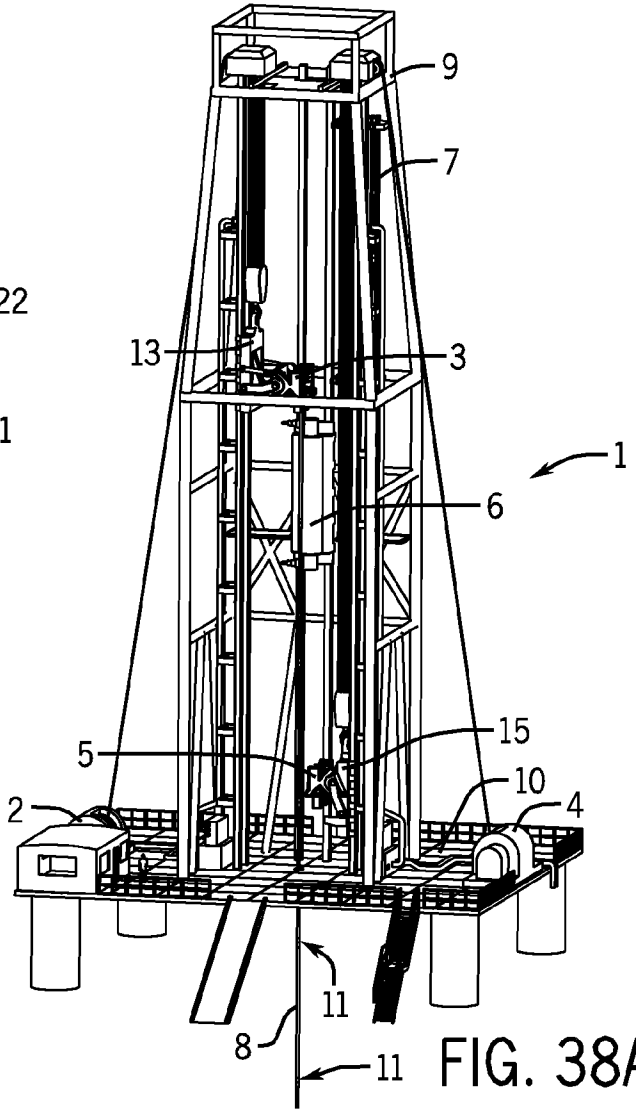
FIG. 38A and FIG. 38B. A schematic representation of the drilling and tripping system shown in FIG. 1 during drilling at 1 foot/second.
Figure 38B:
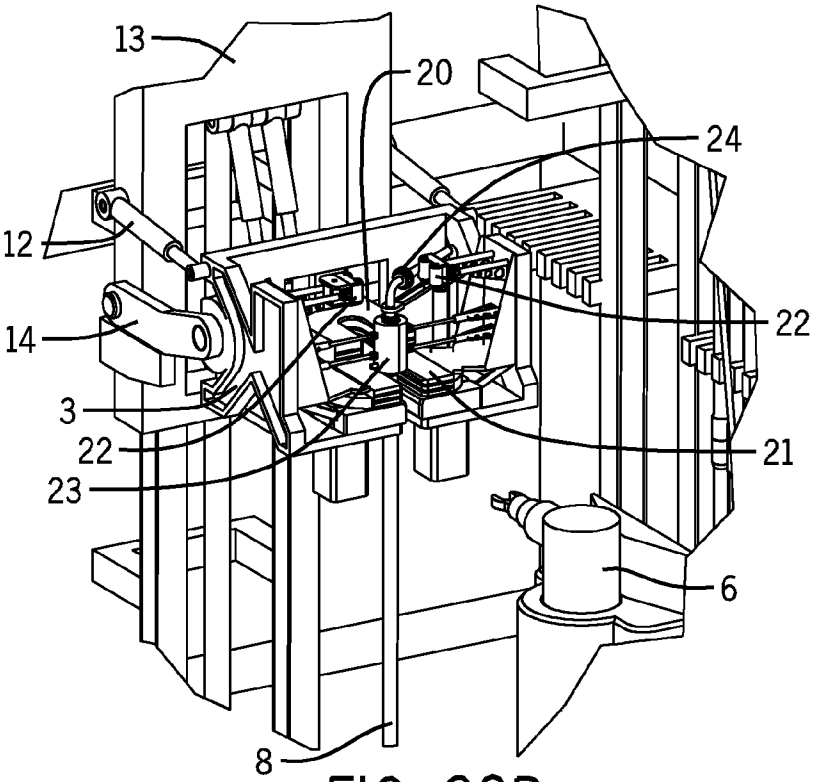

Referring now to FIG. 38A, which is a schematic of one embodiment of a drilling and tripping system 1 at t=170 seconds as the second TDR 5 has retracted and the first TDR 3 is drilling. Shown in FIG. 38A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 38B, which shows a close-up view of the first TDR 3 at t=170 seconds. Shown in FIG. 38B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 39A:
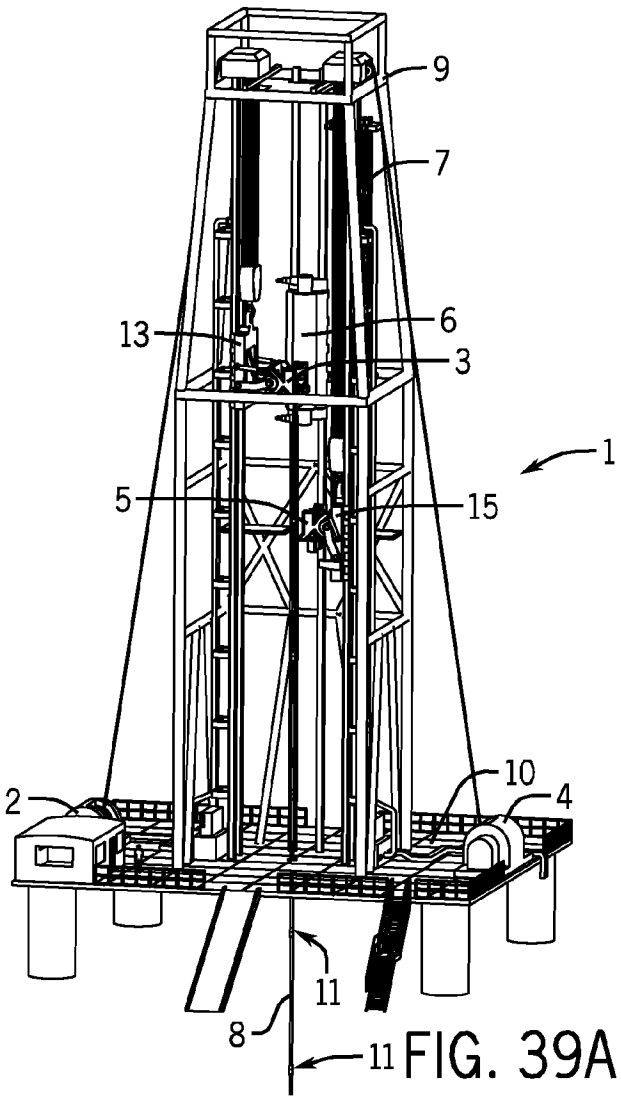
FIG. 39A and FIG. 39B. A schematic representation of the drilling and tripping system shown in FIG. 1 during drilling at 1 foot/second.
Figure 39B:
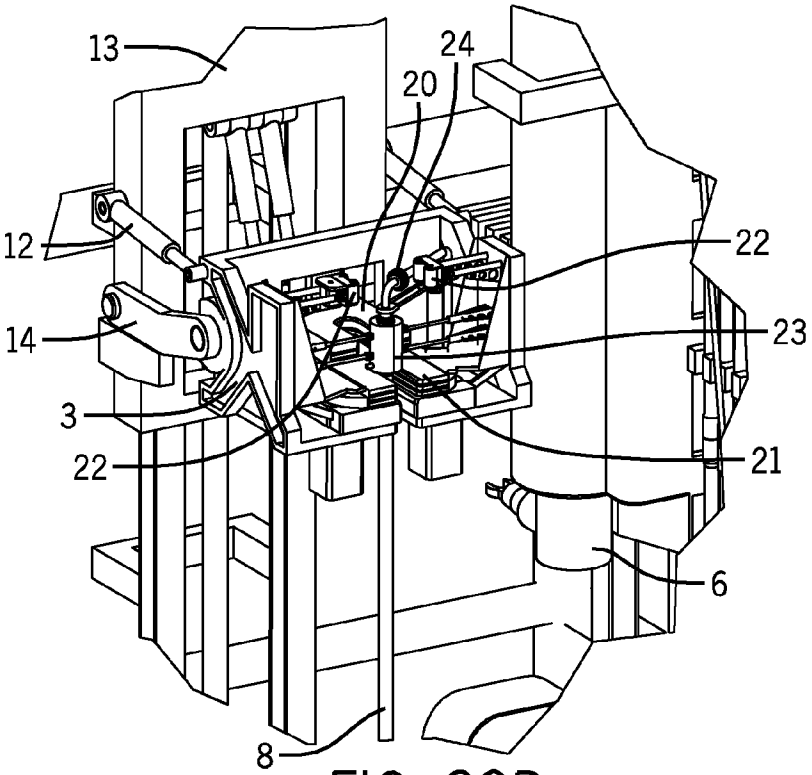

Referring now to FIG. 39A, which is a schematic of one embodiment of a drilling and tripping system 1 at t=175 seconds as the second TDR 5 is raised to the top of the derrick 9. Shown in FIG. 39A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 39B, which shows a close-up view of the first TDR 3 at t=175 seconds. Shown in FIG. 39B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 40A:
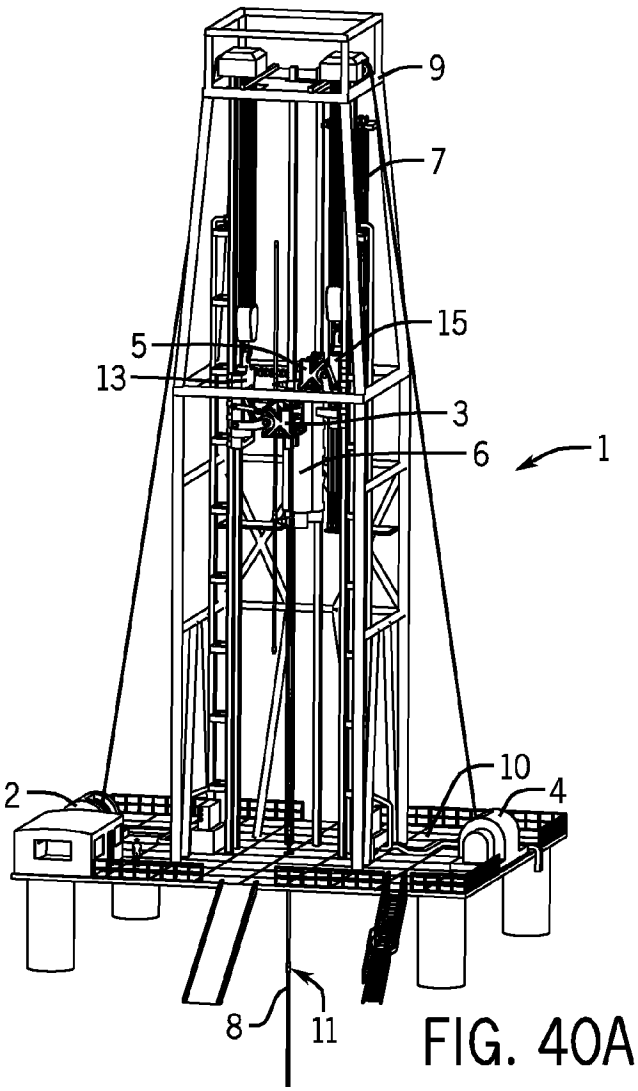
FIG. 40A and FIG. 40B. A schematic representation of the drilling and tripping system shown in FIG. 1 during drilling at 1 foot/second.
Figure 40B:
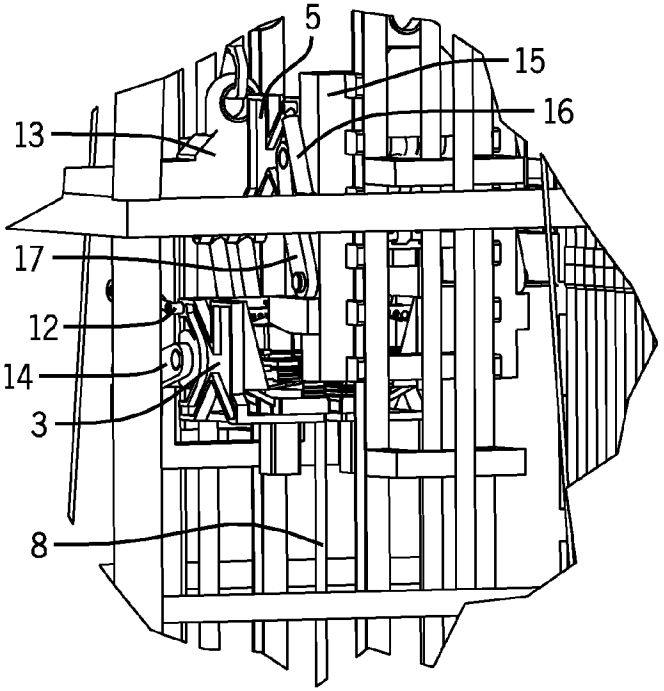

Referring now to FIG. 40A, which is a schematic of one embodiment of a drilling and tripping system 1 at t=185 seconds as the racking arm 6 positions the next stand 18. Shown in FIG. 40A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 and the second TDR 5 are more visible in FIG. 40B, which shows a close-up view of the first TDR 3 and the second TDR 5 at t=185 seconds. Shown in FIG. 40B is a first TDR 3, first moving dolly 13, tubular 8, piston 12 and pivot arm 14, which are extended and attached to the first TDR 3 and the first moving dolly 13, second TDR 5, second moving dolly 15, and second piston 16 and second pivot arm 17, which are retracted and attached to the second TDR 5 and the second moving dolly 15.

Figure 41A:
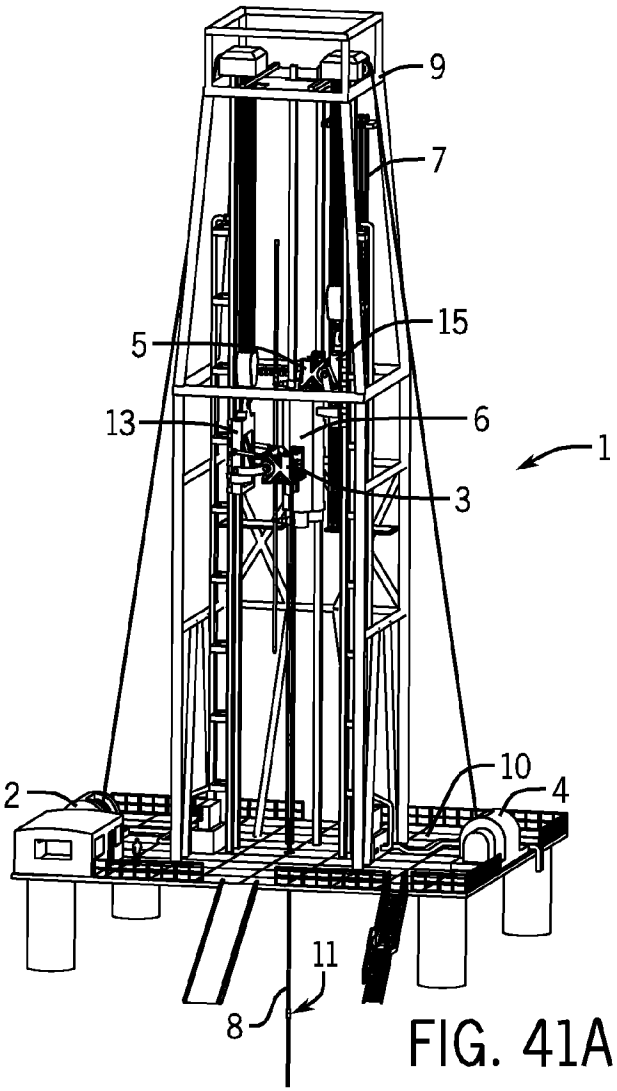
FIG. 41A and FIG. 41B. A schematic representation of the drilling and tripping system shown in FIG. 1 during drilling at 1 foot/second.
Figure 41B:
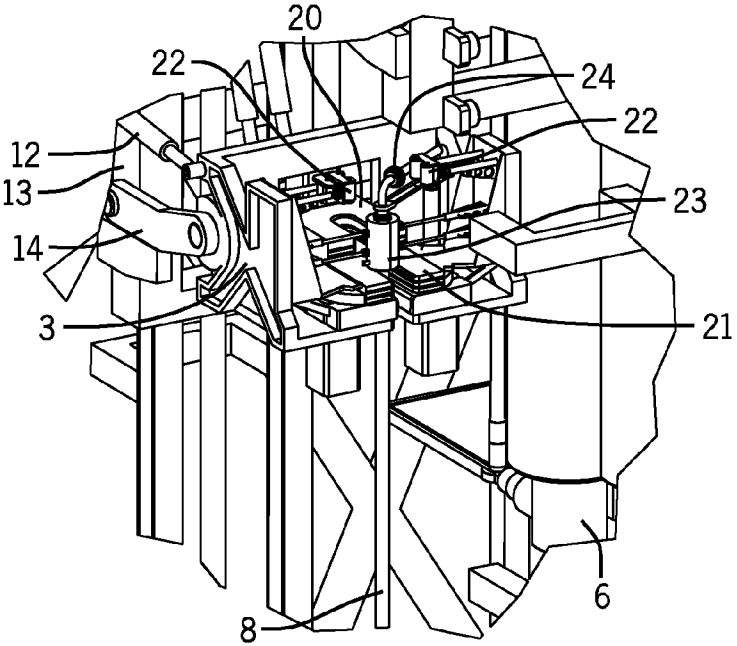

Referring now to FIG. 41A, which is a schematic of one embodiment of a drilling and tripping system 1 at t=210 seconds as the first TDR 3 continues to drill. Shown in FIG. 41A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 41B, which shows a close-up view of the first TDR 3 at t=210 seconds. Shown in FIG. 41B is a first TDR 3, first moving dolly 13, tubular 8, racking arm 6, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Figure 42A:
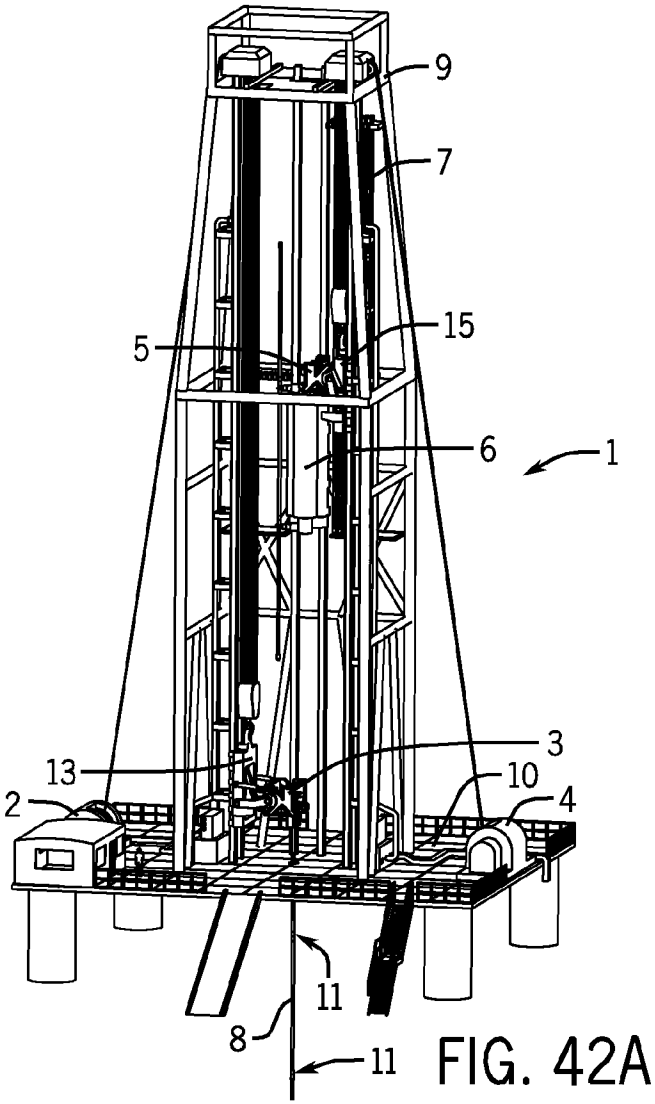
FIG. 42A and FIG. 42B. A schematic representation of the drilling and tripping system shown in FIG. 1 during drilling at 1 foot/second.
Figure 42B:
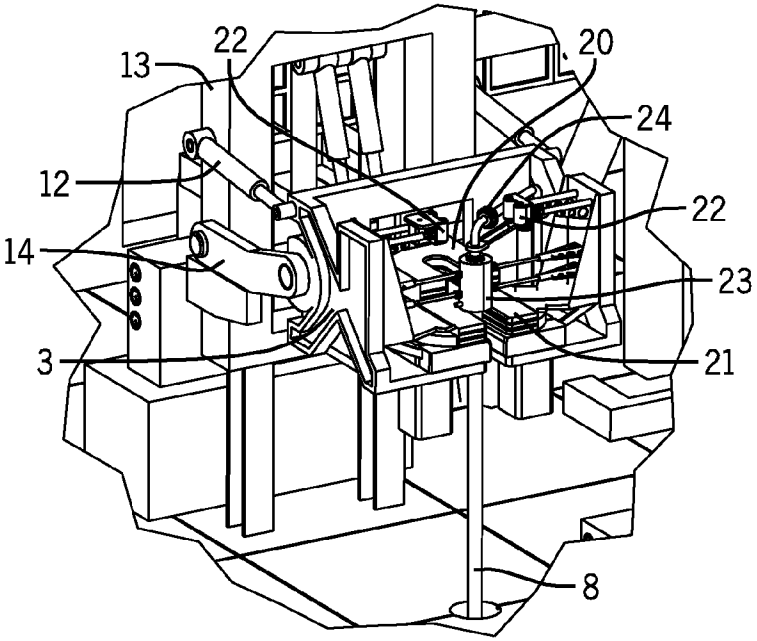

Referring now to FIG. 42A, which is a schematic of one embodiment of a drilling and tripping system 1 at t=250 seconds as the first TDR 3 reaches the drill floor 10 and the cycle repeats. Shown in FIG. 42A are once again first drawworks 2, first TDR 3, which is mounted on first moving dolly 13, second drawworks 4, second TDR 5, which is mounted on second moving dolly 15, racking arm 6, pipe rack 7, tubular 8, derrick 9, drill floor 10 of the derrick 9, and tool joints 11. The features of the first TDR 3 are more visible in FIG. 42B, which shows a close-up view of the first TDR 3 at t=250 seconds. Shown in FIG. 42B is a first TDR 3, first moving dolly 13, tubular 8, and piston 12 and pivot arm 14, which are extended and attached to the first TDR 3 and the first moving dolly 13. Features of the first TDR 3 that are visible include UTW 20, LTW 21, spinner 22, mud bucket 23, and FCS 24.

Removing Tubular without Fluid Circulation or Rotation of the Tubular

Figures 1, 43B:
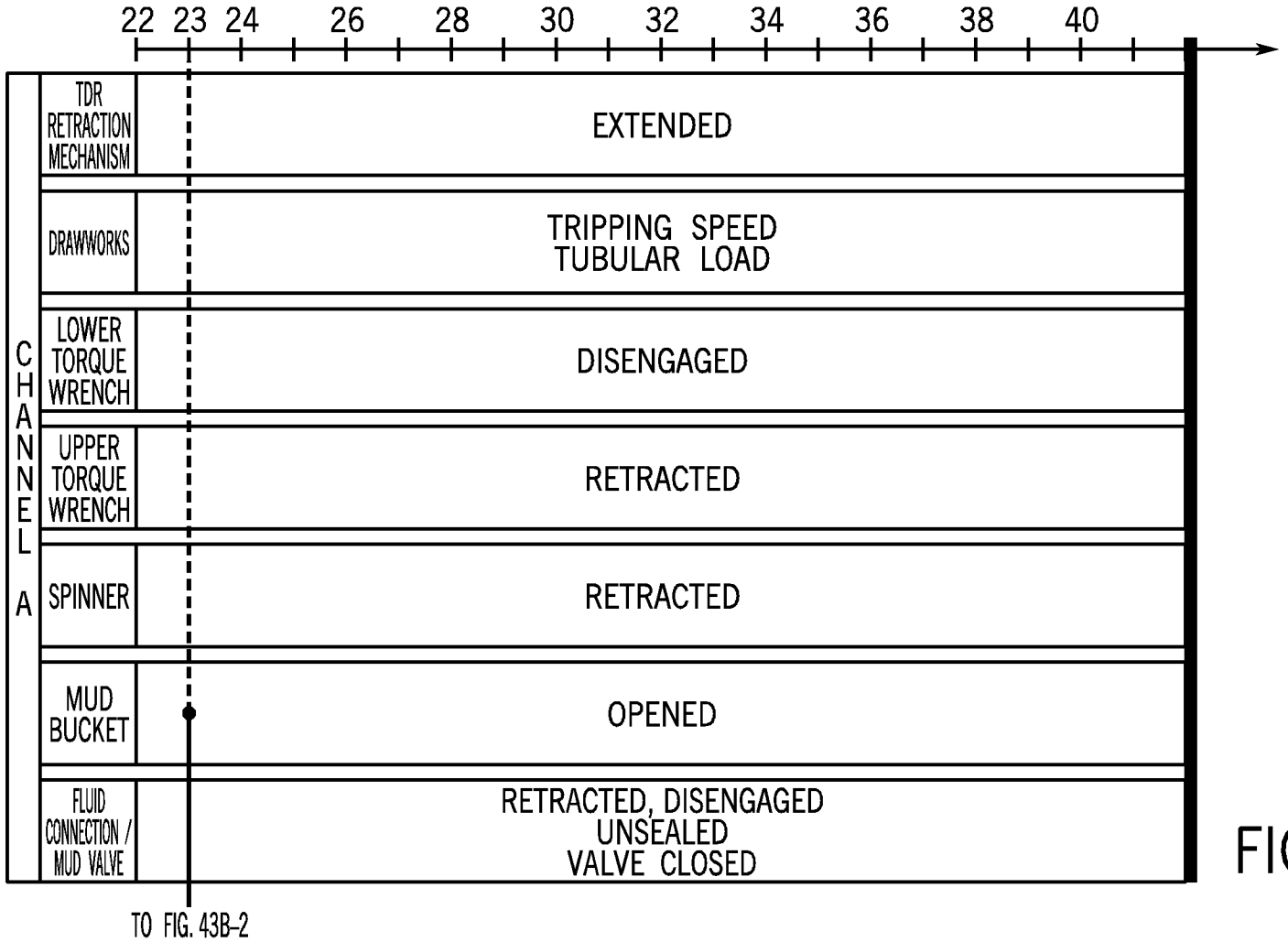
Figures 2, 43B:
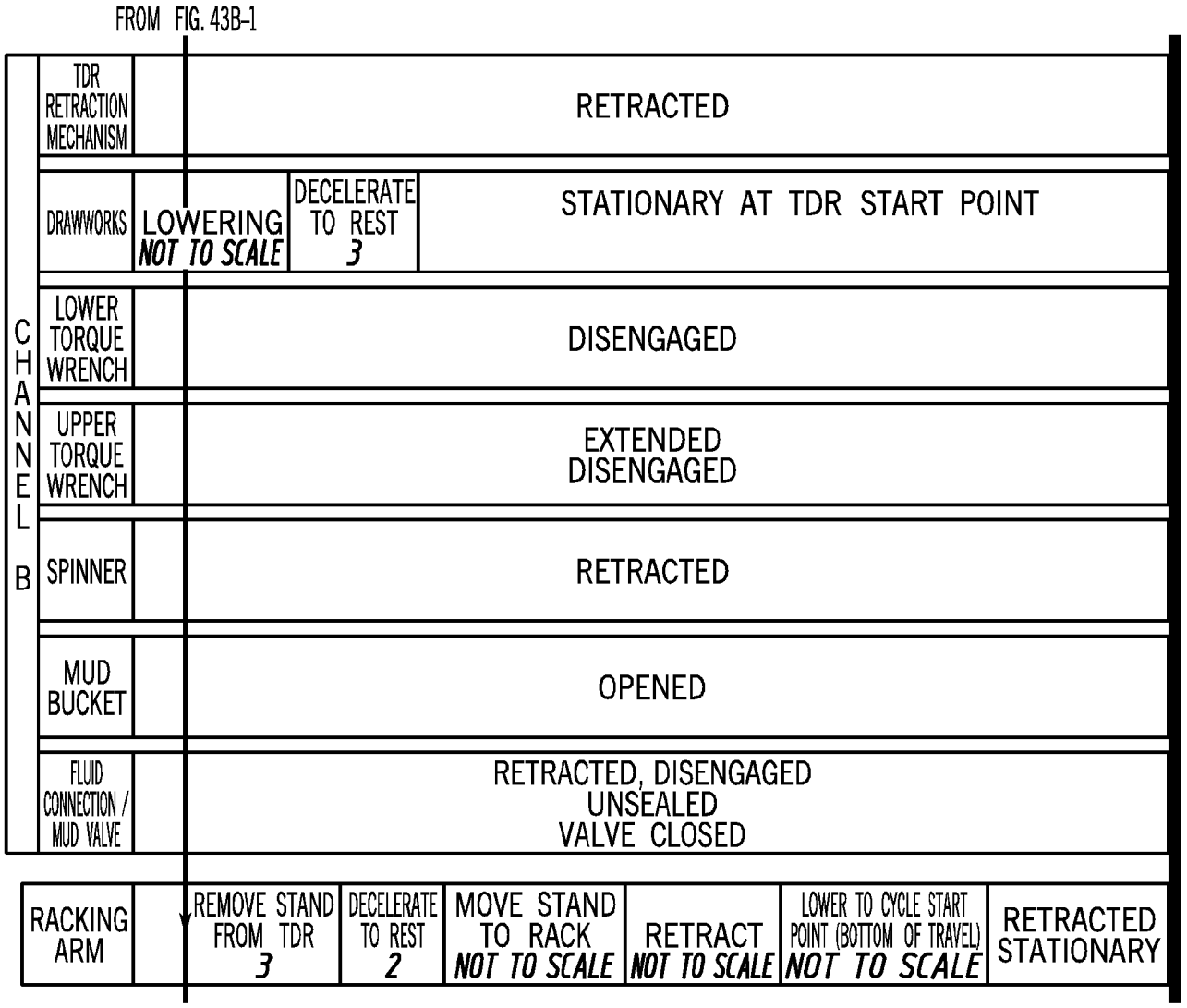
Figure 44:
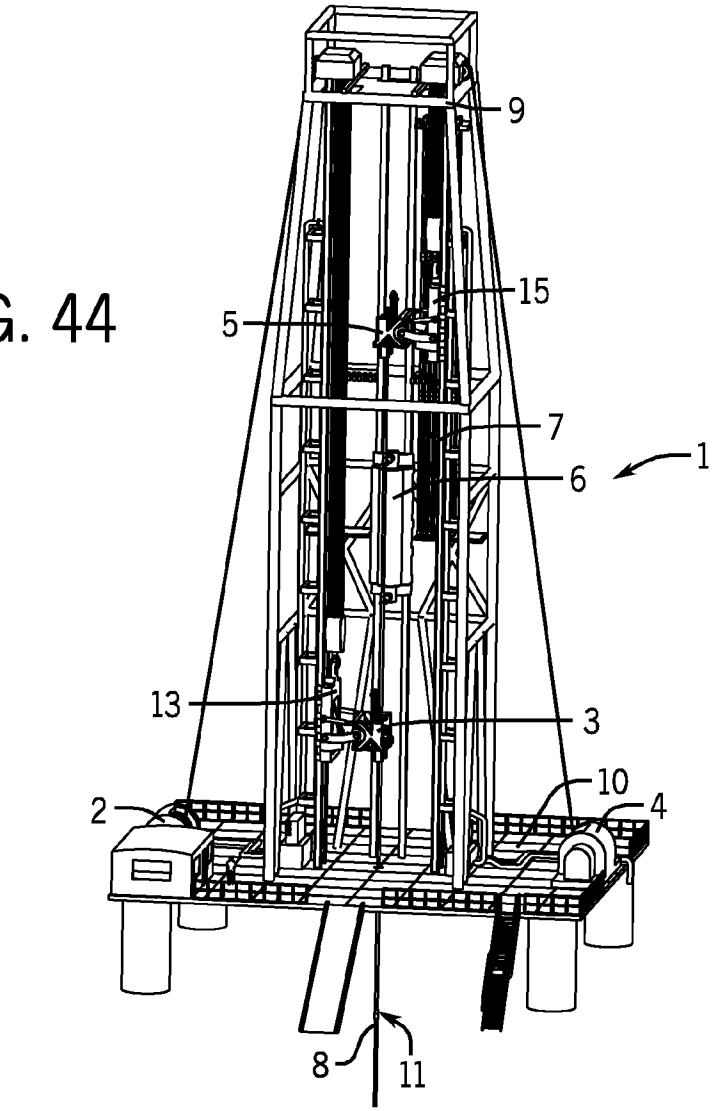
FIG. 44. A schematic representation of the drilling and tripping system shown in FIG. 1 during removal of the tubular from a hole at 3 feet/second without circulation or rotation. The drilling and tripping system is shown at t=0 seconds as the first TDR is pulling the tubular from the hole.

FIG. 43A and FIG. 43B shows the detailed operational sequence for one cycle of removing a tubular from a riser or a cased hole at 3 feet/second without the need for fluid circulation or rotation of the tubular. FIGS. 44 through 54 provide "snapshots" of one embodiment of a presently disclosed drilling and tripping system as it completes two cycles of the operational drilling sequence shown in FIG. 43A and FIG. 43B. Referring to FIG. 44, shown is a schematic representation of the drilling and tripping system 1 at t=0 seconds as the first TDR 3 is pulling the tubular 8 from the hole. Shown in FIG. 44 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 45:
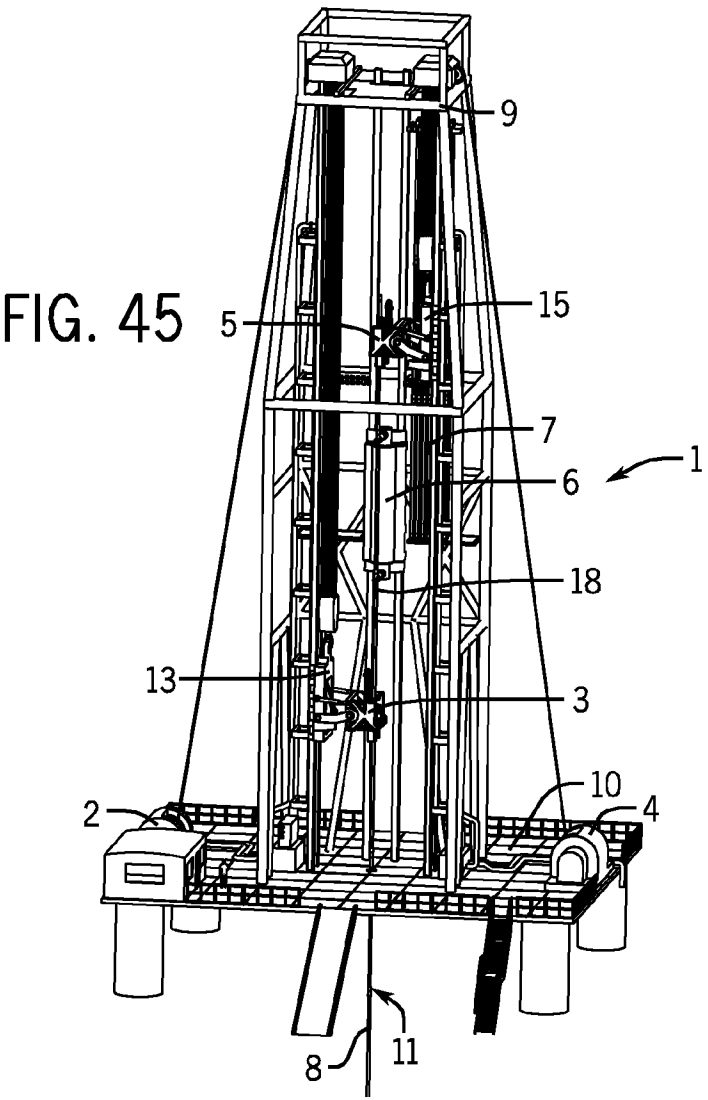
FIG. 45. A schematic representation of the drilling and tripping system shown in FIG. 1 during removal of the tubular from a hole at 3 feet/second without circulation or rotation. The drilling and tripping system is shown at t=2 seconds as the first TDR is disconnecting the top stand.

Referring to FIG. 45, shown is a schematic representation of the drilling and tripping system 1 at t=2 seconds as the first TDR 3 is disconnecting the top stand 18. Shown in FIG. 45 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 46:
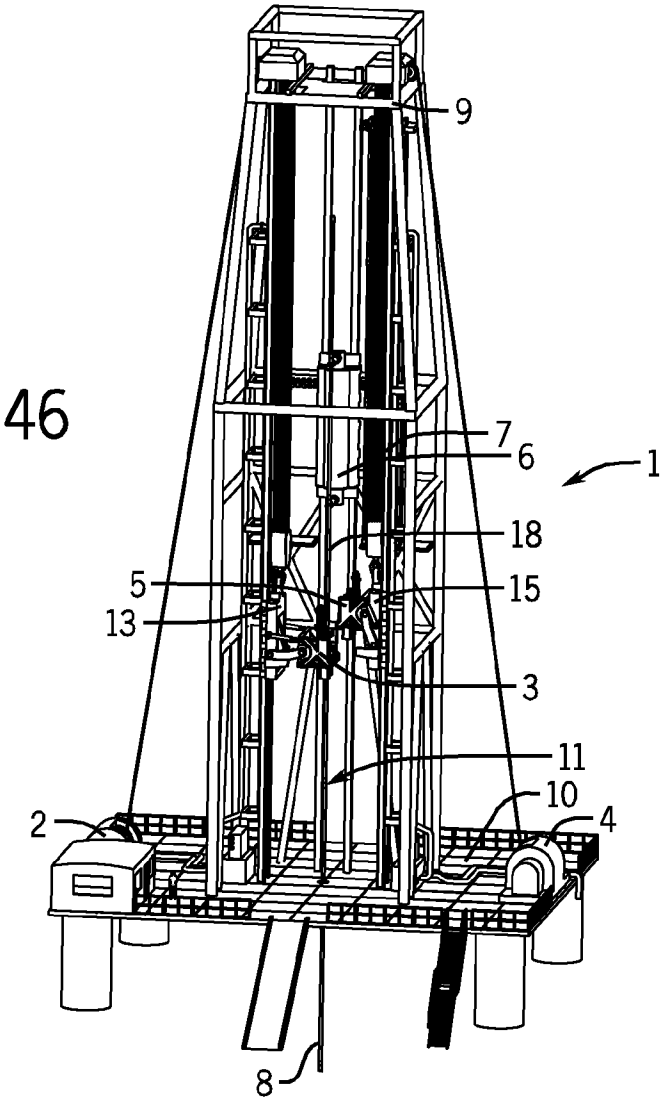
FIG. 46. A schematic representation of the drilling and tripping system shown in FIG. 1 during removal of the tubular from a hole at 3 feet/second without circulation or rotation. The drilling and tripping system is shown at t=6 seconds as the racking arm controls the top stand while the first TDR disconnects the top stand.

Referring to FIG. 46, shown is a schematic representation of the drilling and tripping system 1 at t=6 seconds as the racking arm 6 controls the top stand 18 while the first TDR 3 disconnects the top stand 18. Shown in FIG. 46 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 47:
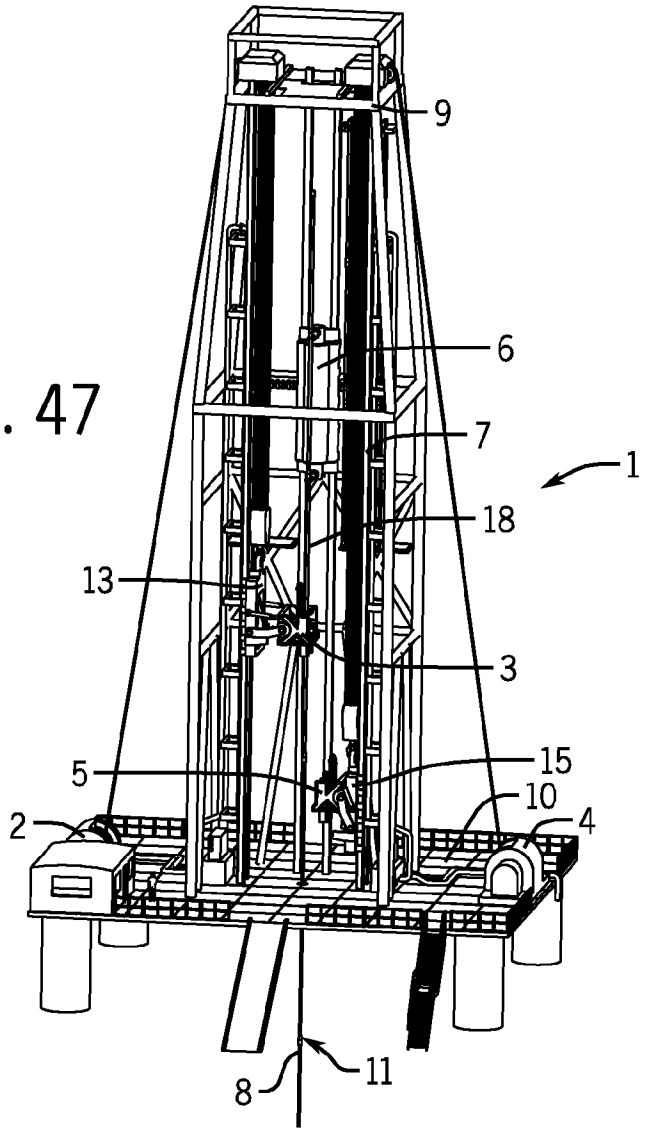
FIG. 47. A schematic representation of the drilling and tripping system shown in FIG. 1 during removal of the tubular from a hole at 3 feet/second without circulation or rotation. The drilling and tripping system is shown at t=9 seconds as the second TDR descends the derrick.

Referring to FIG. 47, shown is a schematic representation of the drilling and tripping system 1 at t=9 seconds as the second TDR 5 descends the derrick. Shown in FIG. 47 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 48:
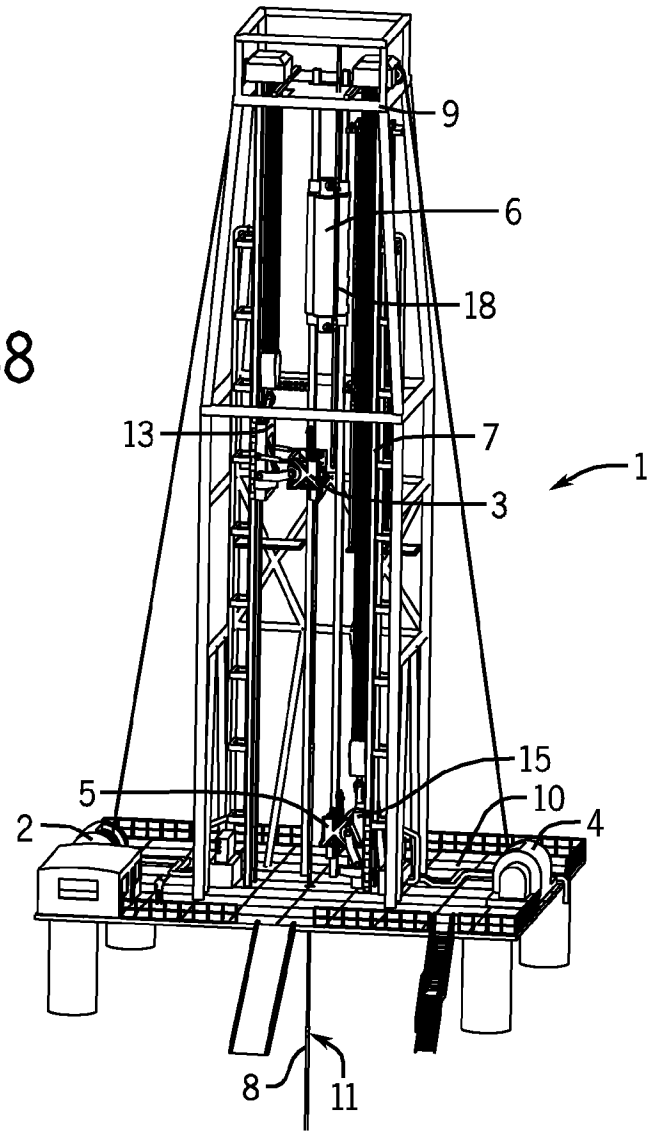
FIG. 48. A schematic representation of the drilling and tripping system shown in FIG. 1 during removal of the tubular from a hole at 3 feet/second without circulation or rotation. The drilling and tripping system is shown at t=19 seconds as the first TDR has completed disconnecting the top stand and the racking arm moves the top stand to the pipe rack.

Referring to FIG. 48, shown is a schematic representation of the drilling and tripping system 1 at t=19 seconds as the first TDR 3 has completed disconnecting the top stand 18 and the racking arm 6 moves the top stand 18 to the pipe rack 7. Shown in FIG. 48 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Figure 49:
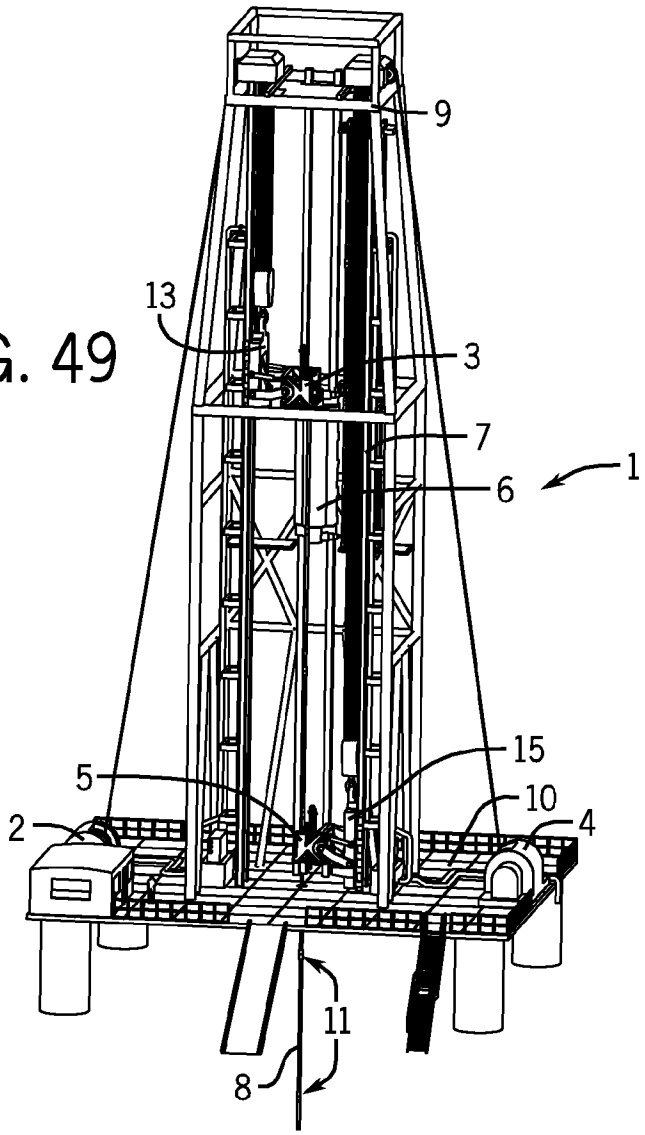
FIG. 49. A schematic representation of the drilling and tripping system shown in FIG. 1 during removal of the tubular from a hole at 3 feet/second without circulation or rotation. The drilling and tripping system is shown at t=26 seconds as the racking arm returns to the start position.

Referring to FIG. 49, shown is a schematic representation of the drilling and tripping system 1 at t=26 seconds as the racking arm 6 returns to the start position. Shown in FIG. 49 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 50:
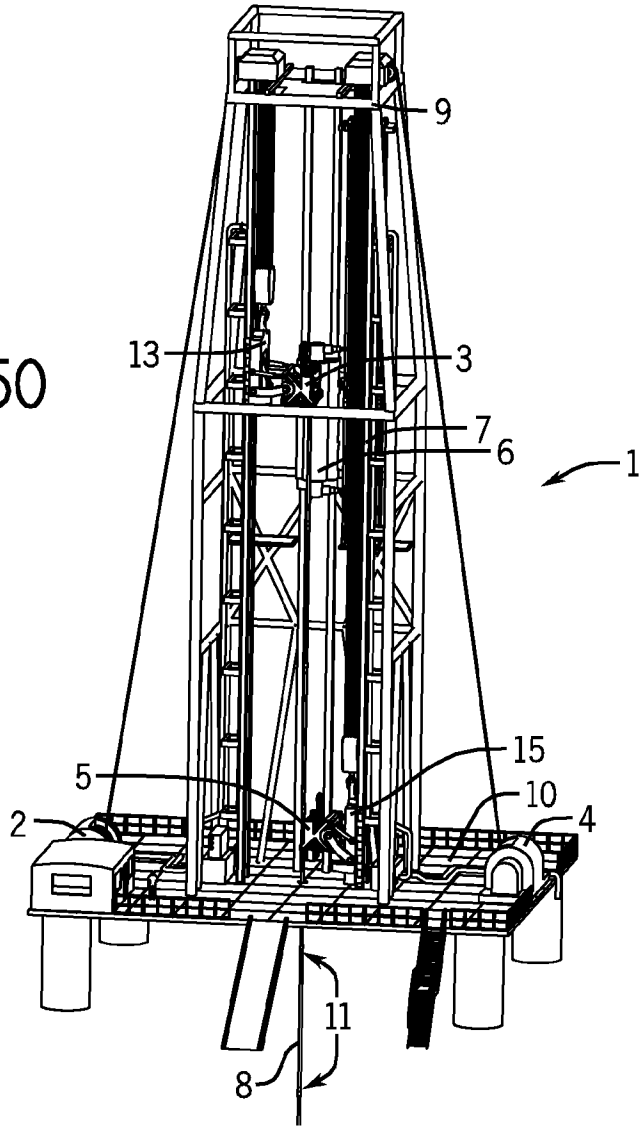
FIG. 50. A schematic representation of the drilling and tripping system shown in FIG. 1 during removal of the tubular from a hole at 3 feet/second without circulation or rotation. The drilling and tripping system is shown at t=27 seconds as the second TDR engages the next tool joint.

Referring to FIG. 50, shown is a schematic representation of the drilling and tripping system 1 at t=27 seconds as the second TDR 5 engages the next tool joint 11. Shown in FIG. 50 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Figure 51:
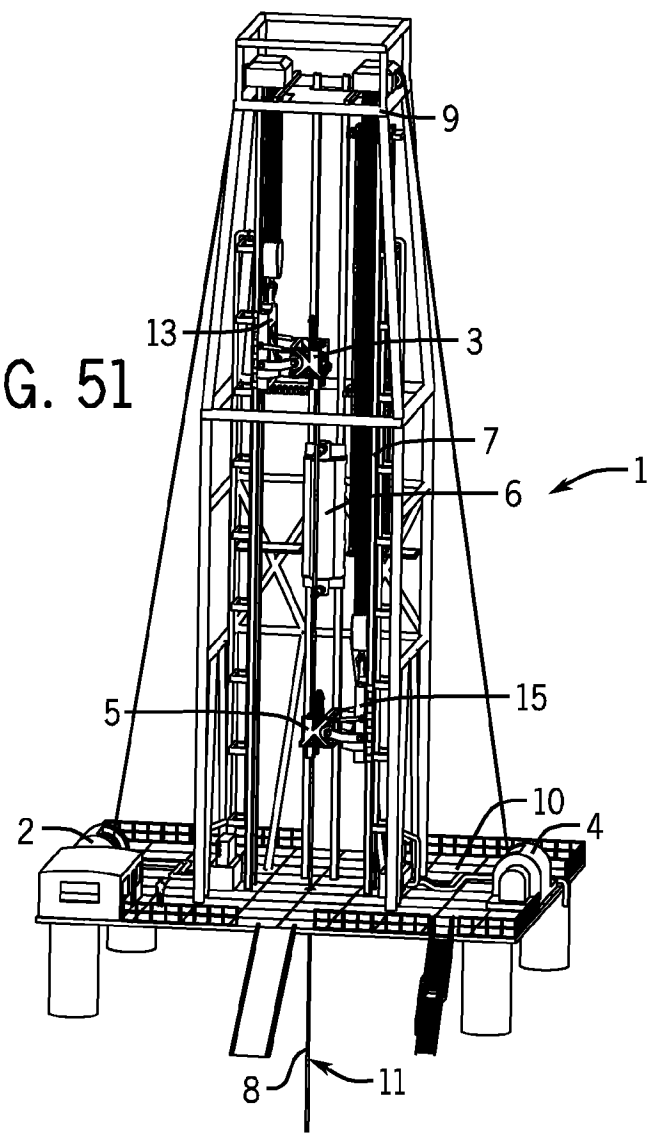
FIG. 51. A schematic representation of the drilling and tripping system shown in FIG. 1 during removal of the tubular from a hole at 3 feet/second without circulation or rotation.

Referring to FIG. 51, shown is a schematic representation of the drilling and tripping system 1 at t=32 seconds as the second TDR 5 picks up the weight of the tubular 8 and the first TDR 3 retracts. Shown in FIG. 51 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Referring to FIG. 52, shown is a schematic representation of the drilling and tripping system 1 at t=36 seconds as the second TDR 5 disconnects the tool joint 11 while the first TDR 3 descends the derrick. Shown in FIG. 52 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Referring to FIG. 53, shown is a schematic representation of the drilling and tripping system 1 at t=49 seconds as the second TDR 5 has disconnected the stand 18 and the racking arm 6 moves the stand 18 to the pipe rack 7. Shown in FIG. 53 is first drawworks 2, first TDR 3, which is mounted on a first moving dolly 13, second drawworks 4, second TDR 5, which is mounted on a second moving dolly 15, a racking arm 6, pipe rack 7, tubular 8, stand 18, tool joint 11, derrick 9 and the drill floor 10 of the derrick 9.

Referring to FIG. 54, shown is a schematic representation of the drilling and tripping system 1 at t=60 seconds as the cycle repeats. Shown in FIG. 54 is first drawworks 2, first TDR 3, which is mounted on a first moving dolly 13, second drawworks 4, second TDR 5, which is mounted on a second moving dolly 15, a racking arm 6, pipe rack 7, tubular 8, tool joint 11, derrick 9 and the drill floor 10 of the derrick 9.

Referring now to FIG. 55, a schematic representation of one embodiment of a disclosed drilling and tripping system 100 is shown. In this particular embodiment, drilling and tripping system 100 includes a first drawworks 110 (also referred to herein as a first TDR drawworks), a second drawworks 111 (also referred to herein as a second TDR drawworks), a traveling differential roughneck (TDR) 112, a third drawworks 113 (also referred to herein as a top drive drawworks), a top drive 114, tubular 114*a*, a racking arm 115, storage rack 116 and crown mounted heave compensator 117 with crown blocks 117*a*, 117*b* and 117*c*. Also shown in FIG. 55 is a derrick 118, guide rails 118*a*, and the drill floor 119 of the derrick 118. Those skilled in the art will appreciate that the system 100 can be included as part of a drilling rig for onshore or offshore operations, among other things.

The disclosed drilling and tripping system 100 includes two or more coordinated, automatically controlled lifting systems capable of lifting and/or lowering the rated weight of the tubular, with any required over-pull and safety factors. This lifting system can be a traditional drawworks (e.g., winch), as shown in FIG. 55, although in other embodiments (not shown) the lifting system can be a hydraulic ram, a rack and pinion system, a high load linear motor, or any other device capable of lifting the required weight. The embodiment of the drilling and tripping system shown in FIG. 55 comprises three lifting systems, two (the first drawworks 110 and the second drawworks 111) supporting the TDR 112, and the third (the third drawworks 113) supporting the top drive 114. Each lifting system comprises a conventional alternating current (AC) gear-driven drawworks and crown/travelling block hoist configuration. The two TDR lifting systems 110 and 111 are synchronized by the Integrated Control System, or ICS (see below and FIG. 58) so that they move in unison. The guide rails 118*a* along which the TDR 112 and top drive 114 run are equipped with sensors (not shown) measuring their distance above the drill floor 119. The information obtained by the sensors can be fed to the ICS. This allows the ICS to accurately control the vertical position and velocity of the top drive 114 and TDR 112. The three crown blocks (117*a*, 117*b* and 117*c*) are optionally mounted on a hydraulically activated platform 117 which, in conjunction with motion sensors and a motion controller, allow for active heave compensation.

In the embodiment of the drilling and tripping system 100 depicted in FIG. 55, the disclosed drilling and tripping system also includes a top drive 114, permanently connected to a short length of tubular (114*a*; an extended saver sub), which can be lifted and lowered by the aforementioned lifting systems. The top drive 114 performs the following functions: rotating the tubular during drilling and back-reaming operations; assisting in making and breaking joints between the saver sub and tubular while rotating and in continuous vertical motion; and directing drilling fluid from the drilling fluid system into the tubular. The top drive 114 can be a conventional direct drive, AC motor powered unit. This is fitted with an extended saver sub 114*a* which is long enough to enter the mud bucket (not shown in FIG. 55; see, for example, FIG. 56 and FIG. 57) through the top of the TDR 112. The top drive 114 runs on guide rails 118*a* attached to the derrick 118, which provide reaction torque while drilling, and constrain its motion to well center.

In the embodiment of the drilling and tripping system 100 depicted in FIG. 55, the disclosed drilling and tripping system also includes one or more pipe handling and storage systems that allows stands to be moved from a suitable storage rack towards the well center as they are connected to the tubular by the TDR, and to move them back to the storage rack when they are disconnected by the TDR. All these actions can be carried out with the tubular in continuing rotation and vertical motion. As depicted in FIG. 55, the main component of this system is a racking arm 115, and also includes storage rack 116, although in other in other embodiments (not shown) additional racking arm(s) and/or racked stand(s) can be included. The racking arm 115 is hydraulically operated with grippers that can clamp onto a stand. These grippers provide sufficient clamping force to provide reaction torque when the top drive 114 makes up and breaks out a joint between the stand and the saver sub. The arms can move in a horizontal plane, allowing stands to be moved from the rack to well center. The arms also move in the vertical axis, allowing joints to be made or broken even while the top drive is moving. The storage rack 116 is located on the derrick 118 such that the stands are close to the position where they are loaded into or unloaded from the top drive 114. The disclosed drilling and tripping system 100 also includes a drilling fluid diverting system (not visible in FIG. 55) that directs the flow of fluid to the top drive 114 and the mud bucket (see FIG. 56 and FIG. 57) of the TDR 112 using a system of valves. This allows just the top drive 114 to receive fluid, just the TDR 112, or neither. In the latter case, fluid circulates back to the mud tanks (not shown), eliminating the need to stop the mud pumps (not shown).

In the embodiment of the drilling and tripping system 100 depicted in FIG. 55, the disclosed drilling and tripping system also includes an automatically controlled tool, termed the traveling differential roughneck 112, also lifted and lowered by the aforementioned lifting systems. The TDR implements numerous functions, including: rotating the tubular for drilling and back-reaming operations; making and breaking joints between stands of tubular; making a breaking joints between the top drive saver sub and tubular; aligning and connecting stands of tubular while the tubular is rotating and in continuous vertical motion; disconnecting and removing stands while the tubular is rotating and in continuous vertical motion; directing drilling fluid from the drilling fluid system into the tubular to allow near continuous fluid flow as stands are added and removed from the tubular; containing and returning excess drilling fluid to the drilling fluid system; and cleaning and pre-treating tubular threads.

Schematically, the TDR 112 is shown in FIG. 56. The TDR 112 includes a support frame 120, which holds the components of the TDR 112 and attaches to the lifting systems 110 and 111. The frame 120 is constrained to only move in a vertical direction without rotation, by rollers (not shown) that engage with guide rails 118*a* attached to the derrick 118. The TDR 112 also includes a lower rotating torque wrench 121, or LTW, which is an electrically or hydraulically powered wrench that engages on the bottom half of the tool joint and is used to rotate the tubular during drilling and back-reaming operations, and to provide the torque necessary to make or break a tool joint held within the stationary mud bucket 124. The lower torque wrench 121 also carries the weight of the drilling tubular back to the support frame and lifting system. The major components of LTW 121 are: a ring gear with a "gate" that may be opened to create a throat allowing the wrench to engage and disengage the tubular in the horizontal axis (when this "gate" is closed the ring gear is a complete 360° gear ring): one or more motor(s) (hydraulic or electrical) for driving pinion gears that are coupled to the ring gear (the power and speed ratings of these motors, together with the gear ratio of the ring and pinion gears is determined based on the torque and speed requirements of the drilling application); and a plurality of cam locked jaws that can be coupled and uncoupled from the tubular. The lower torque wrench 121 engages on the pipe section of the tubular just below the tool joint, using hydraulically operated jaws. These jaws provide the grip required to transmit drilling and make up/break out torque while supporting the weight of the drilling tubular. The jaws are of sufficient length to achieve the necessary clamping pressure without damaging the pipe. Rotation torque is provided by one or more electric motors driving the jaws through pinions and a ring gear. The power and speed ratings of these motors, together with the gear ratio of the ring and pinion gears, are determined based on the torque and speed requirements of the drilling application.

The TDR 112 also includes an upper rotating torque wrench 122, or UTW, which is a hydraulically powered wrench that engages on the top half of the tool joint and is used to provide the torque necessary to connect and disconnect a tool joint in the stationary mud bucket 124, both while the tubular is rotating and stationary. Unlike the LTW 121, the UTW 122 does not provide drilling or back-reaming torque in this embodiment, and does not support the weight of the drilling tubular. Notwithstanding the difference in requirements, the main components of the UTW 122 are the same as the LTW 121, with hydraulically operated jaws and an electric drive for rotation. The upper torque wrench 122 is attached to the support frame 120 through a float mechanism 123. This mechanism is hydraulically operated and allows the tool joint to be opened or closed in a controlled fashion while making up or breaking out a joint.

In addition, the TDR 112 also includes a three chambered mud bucket 130, which is a container that can be used to close around the tool joint whenever the egress of drilling fluid is expected. Schematically, the mud bucket 130 is shown in FIG. 57. The mud bucket 130 comprises upper rotating chamber 125, middle stationary chamber 124 and lower rotating chamber 126, each of which can contain one half of a tool joint. The chambers 124, 125, and 126 can be separated by a hydraulically operated blank ram 131, mounted in the middle stationary chamber 124, which can be closed to prevent drilling fluid from flowing between the upper chamber 125 and the lower chamber 126. Hydraulically actuated upper pipe rams 132 and lower pipe rams 133 can either close around a drill pipe and keep mud within the mud bucket, or else open wide enough to allow a tool joint to pass through. Each of the upper pipe rams 132 and lower pipe rams 133 rotates with the corresponding upper torque wrench 122 and lower torque wrench 121, respectively, so that it is stationary relative to the pipe. The mud bucket 130 also comprises upper seals 134 and lower seals 135, which prevent mud from escaping to the environment and can be provided in pairs to provide redundancy in the event of failure. The mud bucket 130 also comprises slew rings 136 to hold the upper chamber 125, middle chamber 124, and lower chamber 126 together. The middle chamber 124 of the mud bucket 130 contains ports 137 allowing mud to be pumped into or vacuumed out of the chambers. Also, a vacuuming system (not shown) allows drilling fluid to be rapidly removed from the mud bucket 130 and returned to the fluid handling system. Also, the mud bucket 130 has the necessary detergent and air systems to clean drilling fluid from threads that are about to be connected, and a system for dispensing "pipe dope" onto threads that are about to be connected.

The disclosed drilling and tripping system 100 also includes an integrated redundant control system, with numerous sensors and actuators that can be used to control all of the above sub-systems in a synchronized manner to facilitate continuous or nearly continuous operation in both tripping and drilling modes of operation. This is generally referred to herein as the Integrated Control System, or ICS. The ICS is a redundant digital controller that can be programmed to have and exert control over all functions of the drilling equipment. Alternatively, the ICS can be programmed to control only certain aspects of operations if that should be deemed desirable. Additionally, the ICS can be integrated with some or all of the drive systems used in the drilling process (drawworks, mud pumps, torque wrenches, etc.) to allow for partially or fully automated operation. The ICS is additionally provided with sensor information for monitoring various well parameters to allow for automatic control of such things as tripping speeds and rate of penetration based on well conditions. The integrated control system can have direct control of the following drilling functions: position and rate of lowering/raising of the lifting systems; rate of rotation of tubular during drilling and back reaming; connection and disconnection of tubular; drilling fluid circulation via mud pump speed and the drilling fluid divert system; operation of the racking arm and other pipe handling equipment; control parameters during drilling, e.g., weight on bit or rate of penetration; control parameters during active heave compensation, in both fixed to bottom and non-fixed to bottom modes (and during mode transitions). The control concept is illustrated in FIG. 58.

The ICS provides different levels of operation, corresponding to varying degrees of drilling system automation, termed herein as Level 1 (Driller Inputs), Level 2 (Auto Drilling) and Level 3 (Full Autonomy). In Level 1, the ICS provides facilities similar to those found on traditional drilling controls. Here, the driller can provide inputs such as weight on bit, rate of penetration, rate of trip, and the like. Unlike the case with traditional controls, the driller does not have to be concerned with connecting and disconnecting stands. The ICS automatically sequences the various sub-systems to ensure that stands are taken from the rack and made up with the tubular when required, or broken from the tubular and put back in the rack. In addition, rotation and drilling fluid flow are maintained as required by the operation. In effect, it appears to the driller as though they are operating uninterrupted with one continuous tubular. In Level 2, the ICS takes over some of the functions normally performed by the driller. These include automatically adjusting drilling parameters based on well condition sensors (e.g., fluid pressure, rate of fluid flow) to optimize rate of penetration and eliminate vibration. The ICS also provides facilities such as automatically unwinding the drill string before lifting off bottom or freeing a stuck bit. In Level 3, the ICS will trip, drill and ream wells in a fully automated, intelligent, adaptive manner, basing its decisions on survey data, high level planning information, and data measured directly from the well. Since the control system in this mode has direct control over all drilling equipment, and is provided with feedback data from the well, additional capabilities can be added as the science and technology of oil well drilling advances.

The main components of the integrated control system are a set of control modules, connected via redundant networks to a number of control nodes. Each control node provides access to a particular part of the drill system machinery via actuators and sensors. The hardware will comply with (or exceed) Safety Integrity Level 3, as per IEC 61508. The hardware layout is illustrated in FIG. 59.

In the ICS, two or more control modules operate in a redundant mode with "bumpless" transfer between active and standby controller. There are several suitable physical implementations of the control module, including, but not limited to, a high performance industrial programmable logic controller, such as a high performance industrial PC, a high performance single board computer, etc. The requirements for the control module include sufficient processing capability to perform all necessary control algorithms within a suitable time period, sufficient network connectivity to connect with sufficient bandwidth and low enough latency to all the other control modules and nodes on the system (see discussion on network below), including connection to other control modules in the redundant array, and availability of suitable programming tools to allow the control system to be implemented in a manner suitable for industrial control and automation applications.

The ICS in this embodiment also includes two or more network physical layers with redundant operation. Depending on the required bandwidth and latency, each network may use a "multi-drop" or "star" topology, or a combination with each network spur being multi-dropped to a reduced number of nodes. There are several suitable physical implementation of the redundant network, including, but not limited to, Process Field Bus (PROFIBUS) or Ethernet-based (Modbus TCP, EtherCAT, ProfiNET). The requirements for the network are sufficient bandwidth and low enough latency to exchange all required data within time periods consistent with the required dynamic response of all control sequences and closed-loop control functions, deterministic timing to allow all sequence response times and closed-loop performances to be ascertained, rugged physical implementation consistent with the oilfield environment of operation, rugged electrical characteristics (ESD, EMC, etc.) consistent with the oilfield environment of operation, and adequate data protection and/or data redundancy to ensure operation of the system is not compromised by data corruption.

The control nodes for one embodiment of the drilling system 100 described herein are listed in Table 3.

TABLE 3

| Control Node | Description |
|---|---|
| Drawworks VFDs | AC variable frequency drive units that run the motors on the three drawworks |
| Drawworks | Additional actuators and sensors for the drawworks machinery (e.g., drum encoders, brake pressure brake pressure sensors, etc.) |
| Lift System Sensors | Sensors that track the vertical position of the top drive and TDR, plus motion limit switches as backup |
| Top Drive VFDs | An AC variable frequency drive unit that runs the top drive motor |
| Top Drive | Additional actuators and sensors for the top drive that operate the float mechanism and brake |
| Torque Wrench VFDs | AC variable frequency drive units that run the motors that rotate the upper and lower torque wrenches |
| TDR | Sensors and actuators for all the equipment physically located on the TDR, including the torque wrench jaw actuators, mud bucket seal actuators and upper torque |

TABLE 3-continued

| Control Node | Description |
|---|---|
| | wrench float mechanism actuators |
| Mud Pump VFDs | AC variable speed drives for the mud pumps |
| Fluid Divert System | Sensors and actuators for the mud flow control valves needed to route drilling fluid to the top drive and TDR or to bypass flow to the mud tanks. This includes mud pit level sensors |
| Racking Arm Motion Controller | Multi-axis motion controller used to sequence the complex movements of the racking arm and other components in the pipe handling system. This controller is assumed to interface to all of the sensors and actuators required in the pipe handling system |
| Well Status Monitoring | A number of sensors that provide real time data allowing drilling operations to be automated, e.g., well pressure sensors, marine riser pressure sensors |
| Heave Compensation System | Includes motion sensors and control systems to provide active crown block heave compensation |

Regarding the ICS data description, each of the nodes on the networks of the ICS exchange sensor feedback and/or actuator control signals with the control modules. Table 4 details the information that may be exchanged with each of the control nodes on the networks in one embodiment. Those skilled in the art will appreciate that more or less information may be input, collected or obtained, stored in memory, and/or sent or transmitted to or from the various control nodes as may be desired in a given application.

TABLE 4

| Control Node | Sensor Information Sent to Control Modules | Actuator Information Received from Control Modules |
|---|---|---|
| Drawworks VFD | Motor torque<br>Motor speed<br>Motor encoder count<br>Enable status<br>Health status | Enable command<br>Speed reference<br>Torque limit<br>Torque offset |
| Drawworks | Brake status<br>Drum encoders | Brake control |
| Lift System Sensors | Top drive and TDR position encoder counts<br>Limit switch states<br>Hook load sensor values | |
| Top Drive VFD | Motor Torque<br>Motor Speed<br>Motor encoder count<br>Enable status<br>Health status | Enable command<br>Speed/torque control mode command<br>Speed reference<br>Torque reference<br>Torque limit |
| Top Drive | Float mechanism position<br>Float mechanism force (cylinder pressure)<br>Drilling fluid pressure | Float mechanism position/force references |
| Torque Wrench VFD | Motor torque<br>Motor speed<br>Motor encoder count<br>Enable status<br>Health status | Enable command<br>Speed/torque control mode command<br>Speed reference<br>Torque reference<br>Torque limit |
| TDR | Upper wrench jaws engaged/disengaged<br>Upper wrench jaws engagement pressure<br>Lower wrench jaws engaged/disengaged<br>Lower wrench jaws engagement pressure<br>Float mechanism position<br>Float mechanism force (cylinder pressure)<br>Upper seal open/closed<br>Lower seal open/closed<br>Mud bucket middle seal open/closed<br>Mud bucket vacuum pressure<br>Mud bucket drilling fluid pressure | Upper wrench jaw engage/disengage commands<br>Lower wrench jaw engage/disengage commands<br>Float mechanism position/force references<br>Upper seal open/closed commands<br>Lower seal open/closed commands<br>Mud bucket middle seal open/close commands<br>Mud bucket vacuum on/off commands |
| Mud Pump VFD | Motor torque<br>Motor speed<br>Enable status<br>Health status | Enable command<br>Speed reference<br>Torque limit |
| Fluid Divert System | Divert valve positions<br>Mud pit level | Divert valve commands |
| Racking Arm Motion Controller | Position information<br>Motion status (e.g., at position, moving)<br>Health status | Motion commands (e.g., move to position, clamp on pipe) |
| Well Status Monitoring | Well head pressure<br>Riser pressure | BOP<br>Diverter |
| Heave Compensation System | Operating mode (e.g., fixed to bottom)<br>Motion sensor data<br>Compensation actuator information | Operating mode commands |

There are numerous specific operational sequences that are typically important under different phases and conditions of the drilling process. The usual operational sequences for three typical scenarios are detailed below. The first scenario is drilling at 1 foot/second, e.g., adding tubular to the hole with continuous rotation and fluid circulation, the second scenario is back-reaming at 1 foot/second, e.g., removing tubular from the hole with continuous rotation and fluid circulation, and the third scenario is tripping out at 3 feet/second, e.g., removing tubular from a riser or a cased hole without the need for fluid circulation or rotation of the tubular. At the end of each of the described cycles, the cycle repeats. The skilled artisan will readily appreciate that numerous other scenarios are applicable using the present disclosure, although most other scenarios are generally simplifications or combinations of the sequences of these three scenarios.

Drilling at 1 Foot/Second

FIG. 60 through FIG. 71 provide "snapshots" of one embodiment of a presently disclosed drilling and tripping system 100 as it completes one cycle of drilling at 1 foot/second. FIG. 60 shows the starting state at t=0. The top drive 114 in the highest position and the lower torque wrench 121 of the TDR 112 supporting the weight of and rotating the drilling tubular 127. For ease of representation the mud bucket 130 is depicted with upper portion 124', which includes the portion of the middle chamber 124 above the blank ram 131 and the upper chamber 125, and lower portion 124", which includes the portion of the middle chamber 124 below the blank ram 131 and the lower chamber 126. The blank ram 131 and lower pipe ram 133 of the mud bucket 130 are closed and fluid is being pumped into the tubular 127 through the lower portion 124" of the mud bucket 130. The racking arm 115 is holding a new stand of tubular 128 and is at a position ready to approach the top drive 114. The TDR 112, mounted on frame 120, is being lowered at the desired drilling rate of 1 foot/second. The top drive float mechanism (not shown) of the top drive 114 is retracted and the floating mechanism 123 of the upper torque wrench 122 is extended. Also shown in FIG. 60 are first drawworks 110, second drawworks 111, third drawworks 113, saver sub 114*a*, the crown mounted heave compensator 117 with crown blocks 117*a*, 117*b* and 117*c*, derrick 118, guide rails 118*a*, drill floor 119 of the derrick 118, and upper portion 124' of the mud bucket 130.

Referring to FIG. 61, which is a schematic of one embodiment of a drilling and tripping system 100 at t=3 seconds during drilling at 1 foot/second. The racking arm 115 moves the top joint of the new stand of tubular 128 under the saver sub 114*a*. The top drive floating mechanism (not shown) applies an insertion force and the top drive 114 makes up the joint between the saver sub 114*a* and the stand 128. Also shown in FIG. 61 are first drawworks 110, second drawworks 111, TDR 112, which is mounted on frame 120, including LTW 121, UTW 122, float mechanism 123, mud bucket 130, including upper portion 124', lower portion 124", blank ram 131 and lower pipe ram 133, third drawworks 113, crown mounted heave compensator 117 with crown blocks 117*a*, 117*b* and 117*c*, derrick 118, guide rails 118*a*, drill floor 119 of the derrick 118, and drilling tubular 127.

Referring now to FIG. 62, which is a schematic of one embodiment of a drilling and tripping system 100 at t=17 seconds during drilling at 1 foot/second. The racking arm 115 withdraws to a safe distance and then begins a new cycle of fetching a new stand 128 from the rack (not shown) ready for the next cycle. The top drive 114 accelerates downwards to catch up with the TDR 112, mounted on frame 120. At the same time, the top drive 114 spins up to drilling speed and the top drive floating mechanism (not shown) retracts. This continues until the bottom joint of the new stand is inserted into the upper portion 124' of the mud bucket 130. At this point the motion of the top drive 114 matches that of the TDR 112 in both vertical velocity and rotation speed. Also shown in FIG. 62 are first drawworks 110, second drawworks 111, LTW 121, UTW 122, float mechanism 123, lower portion 124", blank ram 131 and lower pipe ram 133 of mud bucket 130, third drawworks 113, saver sub 114*a*, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 63, which is a schematic of one embodiment of a drilling and tripping system 100 at t=21 seconds during drilling at 1 foot/second. The upper pipe ram 132 closes around the new pipe stand 128 and the fluid divert system directs fluid through the top drive 114 filling the stand and mud bucket 130. Once the mud bucket 130 is pressurized, the blank ram opens (thus not visible in FIG. 63), joining the upper portion 124' and lower portion 124" of the mud bucket 130. Also shown in FIG. 62 are first drawworks 110, second drawworks 111, TDR 112, which is mounted on frame 120, including LTW 121, UTW 122, float mechanism 123, lower pipe ram 133 of mud bucket 130, third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 64, which is a schematic of one embodiment of a drilling and tripping system 100 at t=25 seconds during drilling at 1 foot/second. The upper torque wrench 122 engages on the new stand of tubular 128. The top drive float mechanism (not shown) then applies an insertion force and the top drive 114 increases speed to make up the joint between the new stand 128 and drilling tubular 127. Also shown in FIG. 64 are first drawworks 110, second drawworks 111, TDR 112, which is mounted on frame 120, including LTW 121, float mechanism 123, mud bucket 130, including upper portion 124', lower portion 124", upper pipe ram 132 and lower pipe ram 133, third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 65, which is a schematic of one embodiment of a drilling and tripping system 100 at t=26 seconds during drilling at 1 foot/second. The upper torque wrench 122 and lower torque wrench 121 disengage, transferring the weight of the drilling tubular 127 to the top drive 114. Drilling fluid is vacuumed from the mud bucket 130 and the upper pipe ram (thus not visible in FIG. 65) and lower pipe ram (thus not visible in FIG. 65) of the mud bucket 130 open. The TDR 112 is now fully disengaged from the drilling tubular 127. Also shown in FIG. 65 are first drawworks 110, second drawworks 111, frame 120, float mechanism 123, upper portion 124' and lower portion 124" of mud bucket 130, third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 66, which is a schematic of one embodiment of a drilling and tripping system 100 at t=56 seconds during drilling at 1 foot/second. While the top drive 114 carries on drilling down, the TDR 112 is lifted to a position ready to retake the drilling tubular 127 from the top drive 114. Once the saver sub 114*a* joint starts to enter the TDR 112, the TDR 112 accelerates down to match motion with the top drive 114. Also shown in FIG. 65 are first drawworks 110, second drawworks 111, frame 120, LTW 121, UTW 122, float mechanism 123, mud bucket 130, including upper portion 124' and lower portion 124", third drawworks 113, racking arm 115, crown mounted heave compensator 117 with crown blocks 117*a*, 117*b* and 117*c*, derrick 118, guide rails 118*a*, drill floor 119 of the derrick 118, new stand of tubular 128 and drilling tubular 127.

Referring now to FIG. 67, which is a schematic of one embodiment of a drilling and tripping system 100 at t=56 seconds during drilling at 1 foot/second. The upper torque wrench 122 and lower torque wrench 121 engage above and below the saver sub 114*a* joint and the upper pipe ram 132 and lower pipe ram 133 of the mud bucket 130 close. Note that both wrenches are rotating throughout the drilling cycle to avoid damaging the tubular. Also shown in FIG. 66 are first drawworks 110, second drawworks 111, TDR 112, which is mounted on frame 120, including float mechanism 123, upper portion 124' and lower portion 124" of mud bucket 130, third drawworks 113, top drive 114, racking arm 115, crown mounted heave compensator 117 with crown blocks 117*a*, 117*b* and 117*c*, derrick 118, guide rails 118*a*, drill floor 119 of the derrick 118, new stand of tubular 128 and drilling tubular 127.

Referring now to FIG. 68, which is a schematic of one embodiment of a drilling and tripping system 100 at t=57 seconds during drilling at 1 foot/second. The fluid divert system (not shown) directs fluid into the lower portion 124" of the mud bucket 130. The top drive 114 and upper torque wrench 122 float mechanisms apply a separation force to the joint while the upper 122 and lower 121 torque wrenches break it out. Also shown in FIG. 68 are first drawworks 110, second drawworks 111, TDR 112, which is mounted on frame 120, float mechanism 123, upper portion 124', upper pipe ram 132, and lower pipe ram 133 of mud bucket 130, third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118, new stand of tubular 128 and drilling tubular 127.

Referring now to FIG. 69, which is a schematic of one embodiment of a drilling and tripping system 100 at t=60 seconds during drilling at 1 foot/second. The upper torque wrench 122 disengages. The TDR 112 is now carrying the weight of the drilling tubular 127. The blank ram 131 closes and mud is vacuumed from the upper portion 124' of the mud bucket 130 and saver sub 114*a*. Also shown in FIG. 69 are first drawworks 110, second drawworks 111, frame 120, LTW 121, float mechanism 123, lower portion 124", upper pipe ram 132 and lower pipe ram 133 of the mud bucket 130, third drawworks 113, top drive 114, racking arm 115, crown mounted heave compensator 117 with crown blocks 117*a*, 117*b* and 117*c*, derrick 118, guide rails 118*a*, drill floor 119 of the derrick 118 and new stand of tubular 128.

Referring now to FIG. 70, which is a schematic of one embodiment of a drilling and tripping system 100 at t=63 seconds during drilling at 1 foot/second. The upper pipe ram of the mud bucket 130 opens (thus not visible in FIG. 70). The top drive 114 is now fully disengaged from the drilling tubular 127 and TDR 112. Also shown in FIG. 70 are first drawworks 110, second drawworks 111, frame 120, LTW 121, UTW 122, float mechanism 123, mud bucket 130, including upper portion 124', lower portion 124", blank ram 131 and lower pipe ram 133, third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and new stand of tubular 128.

Referring now to FIG. 71, which is a schematic of one embodiment of a drilling and tripping system 100 at t=91 seconds during drilling at 1 foot/second. The top drive 114 hoist lifts back to the highest position ready for the next cycle, while the TDR 112 continues drilling down. Once the TDR 112 hoist has reached the correct position the cycle begins again. The cycle has taken 100 seconds and fed one stand of tubular into the hole. Also shown in FIG. 71 are first drawworks 110, second drawworks 111, frame 120, including LTW 121, UTW 122, float mechanism 123, mud bucket 130, including upper portion 124', lower portion 124", blank ram 131 and lower pipe ram 133, third drawworks 113, top drive 114, saver sub 114*a*, racking arm 115, crown mounted heave compensator 117 with crown blocks 117*a*, 117*b* and 117*c*, derrick 118, guide rails 118*a*, drill floor 119 of the derrick 118, new stand of tubular 128 and drilling tubular 127.

Back-Reaming at 1 Foot/Second

FIG. 72 through FIG. 83 provide "snapshots" of one embodiment of a presently disclosed drilling and tripping system 100 as it completes one cycle of back reaming at 1 foot/second. FIG. 72 is a schematic of one embodiment of a drilling and tripping system 100 at t=0 seconds during back-reaming at 1 foot/second. Consider the back reaming sequence to start with the top drive 114 just ready to receive the drilling tubular 127 from the TDR 112. The end of the saver sub 114*a* has just entered the upper portion 124' of the mud bucket 130. The blank ram 131 and lower pipe ram 133 of the mud bucket 130 are closed and the fluid divert system (not shown) has directed drilling fluid through the lower portion 124" of the mud bucket 130 into the tubular 127. The racking arm 115 gripper is empty and is waiting to remove a used stand 129 from the top drive 114 when required. The TDR 112 is raising the drilling tubular 127. The top drive 114 is rotating the saver sub 114*a* at the same speed as the drilling tubular 127 and its vertical velocity matches that of the TDR 112. Also shown in FIG. 72 are first drawworks 110, second drawworks 111, frame 120, including LTW 121, UTW 122, float mechanism 123, third drawworks 113, crown mounted heave compensator 117 with crown blocks 117*a*, 117*b* and 117*c*, derrick 118, guide rails 118*a* and drill floor 119 of the derrick 118.

Referring now to FIG. 73, which is a schematic of one embodiment of a drilling and tripping system 100 at t=4 seconds during back-reaming at 1 foot/second. The upper pipe ram 132 of the mud bucket 130 closes around the saver sub 114*a*. The fluid divert system (not shown) starts directing drilling fluid through the top drive 114 and saver sub 114*a*, filling the mud bucket 130. Once the mud bucket 130 is pressurized, the blank ram opens (thus not visible in FIG. 73), joining the upper portion 124' and lower portion 124" of the mud bucket 130. Also shown in FIG. 73 are first drawworks 110, second drawworks 111, TDR 112, which is mounted on frame 120, including LTW 121, UTW 122, float mechanism 123, lower pipe ram 133 of mud bucket 130, third drawworks 113, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 74, which is a schematic of one embodiment of a drilling and tripping system 100 at t=8 seconds during back-reaming at 1 foot/second. The upper torque wrench 122 engages with the saver sub 114*a*. The top drive 114 and upper torque wrench 122 float mechanisms apply an insertion force and the upper torque wrench 122 makes up the saver sub 114*a* joint. Also shown in FIG. 74 are first drawworks 110, second drawworks 111, TDR 112, which is mounted on frame 120, including LTW 121, float mechanism 123, mud bucket 130, including upper portion 124', lower portion 124", upper pipe ram 132 and lower pipe ram 133, third drawworks 113, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 75, which is a schematic of one embodiment of a drilling and tripping system 100 at t=9 seconds during back-reaming at 1 foot/second. The upper 122 and lower 121 torque wrenches disengage and the top drive 114 takes the weight of the drilling tubular 127. Drilling fluid is vacuumed from the mud bucket 130 and the upper pipe ram and lower pipe ram open (thus not visible in FIG. 75). At this point the TDR 112 is fully disengaged. Also shown in FIG. 75 are first drawworks 110, second drawworks 111, frame 120, including float mechanism 123, upper portion 124' and lower portion 124" of mud bucket 130, third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 76, which is a schematic of one embodiment of a drilling and tripping system 100 at t=35 seconds during back-reaming at 1 foot/second. The TDR 112 moves to its lowest position while the top drive 114 hoist continues to pull the drilling tubular 127 from the hole. Also shown in FIG. 76 are first drawworks 110, second drawworks 111, frame 120, including LTW 121, UTW 122, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 77, which is a schematic of one embodiment of a drilling and tripping system 100 at t=38 seconds during back-reaming at 1 foot/second. The system waits until the bottom joint of the next used stand to be removed starts to enter the TDR 112. The TDR 112 then matches vertical velocity with top drive 114. Also shown in FIG. 77 are first drawworks 110, second drawworks 111, frame 120, including LTW 121, UTW 122, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 78, which is a schematic of one embodiment of a drilling and tripping system 100 at t=39 seconds during back-reaming at 1 foot/second. The upper pipe ram 132 and lower pipe ram 133 of the mud bucket 130 close and the upper 122 and lower 121 torque wrenches engage with the tubular 127 either side of the joint. Also shown in FIG. 78 are first drawworks 110, second drawworks 111, TDR 112, which is mounted on frame 120, including float mechanism 123, mud bucket 130, including upper portion 124' and lower portion 124", third drawworks 113, top drive 114, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 79, which is a schematic of one embodiment of a drilling and tripping system 100 at t=40 seconds during back-reaming at 1 foot/second. The top drive 114 and upper torque wrench float mechanism apply a separation force and the upper torque wrench 122 breaks out the joint. The fluid divert system (not shown) directs drilling fluid into the mud bucket 130. Also shown in FIG. 79 are first drawworks 110, second drawworks 111, TDR 112, which is mounted on frame 120, including LTW 121, float mechanism 123, upper portion 124', lower portion 124", upper pipe ram 132, and lower pipe ram 133 of mud bucket 130, third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118, used stand of tubular 129 and drilling tubular 127.

Referring now to FIG. 80, which is a schematic of one embodiment of a drilling and tripping system 100 at t=43 seconds during back-reaming at 1 foot/second. The upper torque wrench 122 disengages and the blank ram 131 of the mud bucket 130 closes. Fluid is vacuumed from the upper portion 124' of the mud bucket 130 and the saver sub 114*a*. Once clear of fluid, the upper pipe ram is opened (thus not visible in FIG. 80). Also shown in FIG. 80 are first drawworks 110, second drawworks 111, TDR 112, which is mounted on frame 120, including LTW 121, float mechanism 123, lower portion 124" and lower pipe ram 133 of mud bucket 130, third drawworks 113, top drive 114, racking arm 115, crown mounted heave compensator 117 with crown blocks 117*a*, 117*b* and 117*c*, derrick 118, guide rails 118*a*, drill floor 119 of the derrick 118, used stand of tubular 129 and drilling tubular 127.

Referring now to FIG. 81, which is a schematic of one embodiment of a drilling and tripping system 100 at t=58 seconds during back-reaming at 1 foot/second. The top drive 114 accelerates upwards so that the lower end of the used stand 129 clears the top of the TDR 112. The top drive 114 then maintains this distance above the TDR 112. At the same time, the top drive 114 stops rotating and the TDR 112 continues pulling tubular 127 from the hole. Once the top drive 114 has stopped rotating, the racking arm 115 moves in and grips the used stand 129. Also shown in FIG. 81 are first drawworks 110, second drawworks 111, frame 120, LTW 121, UTW 122, float mechanism 123, mud bucket 130, including upper portion 124', lower portion 124", blank ram 131 and lower pipe ram 133, third drawworks 113, saver sub 114*a*, crown mounted heave compensator 117 with crown blocks 117*a*, 117*b* and 117*c*, derrick 118, guide rails 118*a* and drill floor 119 of the derrick 118.

Referring now to FIG. 82, which is a schematic of one embodiment of a drilling and tripping system 100 at t=64 seconds during back-reaming at 1 foot/second. The top drive 114 float mechanism applies a separation force and the top drive 114 breaks out the saver sub 114*a* joint. The racking arm 115 withdraws the used stand 129 and then begins the process of returning the used stand 129 to the pipe rack (not shown) ready for the next cycle. Also shown in FIG. 82 are first drawworks 110, second drawworks 111, TDR 112, which is mounted on frame 120, including LTW 121, UTW 122, float mechanism 123, mud bucket 130, including upper portion 124', lower portion 124", blank ram 131 and lower pipe ram 133, third drawworks 113, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 83, which is a schematic of one embodiment of a drilling and tripping system 100 at t=100 seconds during back-reaming at 1 foot/second. The top drive 114 lowers back down to the starting position ready for the next cycle. Once the saver sub 114*a* joint enters the mud bucket 130, the top drive 114 matches vertical velocity with the TDR 112 and starts rotating at the same speed as the drilling tubular 127. The top drive 114 matches vertical velocity with the TDR 112 such that the saver sub 114*a* joint stays in the upper portion 124' of the mud bucket 130. Simultaneously, the top drive 114 starts rotating at the same speed as the drilling tubular 127. The cycle now repeats, having taken 100 seconds to remove one used stand of tubular 129 from the hole. Also shown in FIG. 83 are first drawworks 110, second drawworks 111, frame 120, LTW 121, UTW 122, float mechanism 123, lower portion 124", blank ram 131 and lower pipe ram 133 of mud bucket 130, third drawworks 113, racking arm 115, crown mounted heave compensator 117 with crown blocks 117*a*, 117*b* and 117*c*, derrick 118, guide rails 118*a* and drill floor 119 of the derrick 118.

Tripping Out at 3 Feet/Second

FIG. 84 through FIG. 93 provide "snapshots" of one embodiment of a presently disclosed drilling and tripping system 100 as it completes one cycle of tripping out at 3 feet/second. FIG. 84 is a schematic representation of the drilling and tripping system 100 at t=0 seconds during tripping out at 3 feet/second. As with back reaming, consider the tripping out sequence to start with the top drive 114 just ready to receive the drilling tubular 127 from the TDR 112. The end of the saver sub 114*a* has just entered the upper portion 124' of the mud bucket 130. The racking arm 115 gripper is empty and is waiting to remove a used stand from the top drive 114 when required. The TDR 112 is raising the drilling tubular 127. The vertical velocity of the top drive 114 matches that of the TDR 112. Also shown in FIG. 84 are first drawworks 110, second drawworks 111, 120, LTW 121, UTW 122, float mechanism 123, lower portion 124" of mud bucket 130, third drawworks 113, crown mounted heave compensator 117 with crown blocks 117*a*, 117*b* and 117*c*, derrick 118, guide rails 118*a* and drill floor 119 of the derrick 118.

Referring now to FIG. 85, which is a schematic representation of the drilling and tripping system 100 at t=2 seconds during tripping out at 3 feet/second. The upper torque wrench 122 engages with the saver sub 114*a*. The top drive 114 and upper torque wrench 122 float mechanisms apply an insertion force and the upper torque wrench 122 makes up the saver sub 114*a* joint. Also shown in FIG. 85 are first drawworks 110, second drawworks 111, TDR 112, which is mounted on frame 120, including LTW 121, float mechanism 123, mud bucket 130, including upper portion 124' and lower portion 124", third drawworks 113, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 86, which is a schematic representation of the drilling and tripping system 100 at t=3 seconds during tripping out at 3 feet/second. The upper 122 and lower 121 torque wrenches disengage and the top drive 114 takes the weight of the drilling tubular 127. At this point the TDR 112 is fully disengaged. Also shown in FIG. 86 are first drawworks 110, second drawworks 111, frame 120, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 87, which is a schematic representation of the drilling and tripping system 100 at t=11 seconds during tripping out at 3 feet/second. The TDR 112 moves to its lowest position while the top drive 114 hoist continues to pull the drilling tubular 127 from the hole. Also shown in FIG. 87 are first drawworks 110, second drawworks 111, frame 120, LTW 121, UTW 122, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a* and drill floor 119 of the derrick 118.

Referring now to FIG. 88, which is a schematic representation of the drilling and tripping system 100 at t=13 seconds during tripping out at 3 feet/second. The system waits until the bottom joint of the next used stand to be removed starts to enter the TDR 112. The TDR 112 then matches vertical velocity with top drive 114. Also shown in FIG. 88 are first drawworks 110, second drawworks 111, frame 120, including LTW 121, UTW 122, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 89, which is a schematic representation of the drilling and tripping system 100 at t=14 seconds during tripping out at 3 feet/second. The upper 122 and lower 121 torque wrenches engage with the tubular 127 either side of the joint. The top drive 114 and upper torque wrench 122 float mechanism apply a separation force and the upper torque wrench 122 breaks out the joint. Also shown in FIG. 89 are first drawworks 110, second drawworks 111, TDR 112, which is mounted on frame 120, including float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and used stand of tubular 129.

Referring now to FIG. 90, which is a schematic representation of the drilling and tripping system 100 at t=16 seconds during tripping out at 3 feet/second. The upper torque wrench 122 disengages. The TDR 112 is now supporting the weight of the drilling tubular 127. Also shown in FIG. 90 are first drawworks 110, second drawworks 111, frame 120, LTW 121, float mechanism 123, mud bucket 130, including upper portion 124' and lower portion 124", third drawworks 113, top drive 114, saver sub 114*a*, racking arm 115, crown mounted heave compensator 117 with crown blocks 117*a*, 117*b* and 117*c*, derrick 118, guide rails 118*a*, drill floor 119 of the derrick 118 and used stand of tubular 128.

Referring now to FIG. 91, which is a schematic representation of the drilling and tripping system 100 at t=21 seconds during tripping out at 3 feet/second. The top drive 114 accelerates upwards so that the lower end of the used stand 129 clears the top of the TDR 112. The top drive 114 then maintains this distance above the TDR 112. The racking arm 115 moves in and grips the used stand 129. Also shown in FIG. 91 are first drawworks 110, second drawworks 111, frame 120, LTW 121, UTW 122, float mechanism 123, mud bucket 130, including upper portion 124' and lower portion 124", third drawworks 113, saver sub 114*a*, racking arm 115, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 92, which is a schematic representation of the drilling and tripping system 100 at t=25 seconds during tripping out at 3 feet/second. The top drive 114 float mechanism applies a separation force and the top drive 114 breaks out the saver sub 114*a* joint. The racking arm 115 withdraws the used stand 129 and then begins the process of returning the used stand 129 to the pipe rack (not shown) ready for the next cycle. Also shown in FIG. 92 are first drawworks 110, second drawworks 111, TDR 112, which is mounted on frame 120, including LTW 121, UTW 122, float mechanism 123, mud bucket 130, including upper portion 124' and lower portion 124", third drawworks 113, crown mounted heave compensator 117 with crown blocks 117*a*, 117*b* and 117*c*, derrick 118, guide rails 118*a*, drill floor 119 of the derrick 118 and drilling tubular 127.

Referring now to FIG. 93, which is a schematic representation of the drilling and tripping system 100 at t=34 seconds during tripping out at 3 feet/second. The top drive 114 lowers back down to the starting position ready for the next cycle. Once the saver sub 114*a* joint enters the mud bucket 130, the top drive 114 matches vertical velocity with the TDR 112 such that the saver sub 114*a* joint stays in the upper chamber 124' of the mud bucket 130. Simultaneously, the top drive 114 starts rotating at the same speed as the drilling tubular 127. The cycle now repeats, having taken 34 s to remove one used stand of tubular 129 from the hole. Also shown in FIG. 93 are first drawworks 110, second drawworks 111, frame 120, including LTW 121, UTW 122, float mechanism 123, lower portion 124" of mud bucket 130, third drawworks 113, racking arm 115, crown mounted heave compensator 117 with crown blocks 117*a*, 117*b* and 117*c*, derrick 118, guide rails 118*a* and drill floor 119 of the derrick 118.

Tripping In

The tripping in sequence is the same as the drilling sequence, except that mud is not pumped and the drill string does not rotate. This means that the upper pipe ram, blank ram and lower pipe ram of the mud bucket remain open at all times. The following sequence description is basically the same as for the drilling sequence, but with the mud bucket and rotation operations removed. Consider the tripping in sequence to start with the top drive in the "load" position and the lower torque wrench of the TDR supporting the weight of the drill string. The racking arm is holding a new pipe stand and is at a position ready to approach the top drive. The TDR hoist is lowering the drill string at the desired tripping in rate.

The top drive floating mechanism is retracted and the upper torque wrench floating mechanism is extended.

The tripping in sequence proceeds as follows. The racking arm moves the top joint of the new pipe stand under the saver sub. The top drive floating mechanism applies an insertion force and the top drive makes up the joint between the saver sub and the stand. The racking arm withdraws to a safe distance and then begins a new cycle of fetching a pipe stand from the rack and returning it to the starting position ready for the next cycle. The top drive hoist accelerates downwards to catch up with the TDR. At the same time, the top drive floating mechanism retracts. This continues until the bottom joint of the new pipe stand is inserted into the upper portion of the mud bucket. At this point the top drive hoist matches the motion of the TDR. The upper torque wrench engages on the pipe. The top drive floating mechanism applies an insertion force and the top drive makes up the joint between the stand and drill string. The upper and lower torque wrenches disengage. At this point the top drive is carrying the drill string.

The TDR hoist lifts the TDR to the disconnect position ready to disconnect the saver sub while the top drive continues to drill down. The system waits until the saver sub joint starts to enter the TDR. The TDR hoist matches motion to the top drive hoist such that the saver sub joint is located in the lower portion of the mud bucket. The upper and lower torque wrenches engage with the pipe. The top drive and upper torque wrench floating mechanisms apply a separation force to the joint while the upper and lower torque wrenches break it out. The upper torque wrench disengages. The top drive hoist raises the top drive up to the load position ready for the next cycle, while the TDR hoist continues descending at the required tripping in rate. Once the TDR hoist has reached the connect position, the cycle will begin again.

Sequence Control System

The sequences described above are relatively complex, with many potential interactions between the various subsystems of the drilling system. In order to simulate and ultimately control the drilling/reaming/tripping operations, it is useful to first construct state machines defining the behavior.

Rather than produce one large state machine controlling all operations of the drilling system, it is sensible to split the system into sub-systems. The following sections first describe state machines to control the racking system, the hoists, the top drive and the TDR. The remaining sections describe state machines to sequence sub-systems in drilling, back reaming, tripping in and tripping out operations.

Hoist Sequencing

The top drive and TDR hoist systems perform three tasks, namely moving to a fixed position (e.g., the loading/unloading position), moving up or down at a constant operating rate (e.g., drilling rate) and matching motion to another hoist (e.g., the top drive matches motion to the TDR to insert the saver sub into the mud bucket). Moving the large mass of the top drive, TDR and drill string requires smooth motion. This is achieved by not sending abrupt changes in speed demands to the drawworks drive. One of the simplest ways to ensure smooth velocity in a motion control system is to use trapezoidal velocity profiles. Motion to a fixed target position is split into three phases. In the first phase, the velocity increases at a constant rate of acceleration until the velocity achieves the maximum allowable value. In the second phase motion continues at this velocity. In the final phase, the velocity decreases at a constant rate of deceleration until at the same instant the velocity reaches zero and the target position is reached. For small movements, the maximum velocity will not be reached, the second phase disappears and the velocity profile becomes triangular.

Moving at operating rate can require an initial phase of acceleration or deceleration in order to smoothly achieve a target velocity. The hoist system is issued a target velocity A resulting in an acceleration phase. Sometime later, the hoist system is issued a lower target velocity B. This requires a period of deceleration in order to attain the required velocity.

Matching the motion of a hoist to a moving target typically requires a period of high speed motion to catch up with the target followed by a period of deceleration to match velocity. For example, to allow the top drive to catch up and match velocity with the TDR prior to connecting a new stand of pipe, initially the hoist accelerates up to maximum allowable velocity so as to catch up with the target. Then, at the appropriate time, the hoist decelerates so that the target velocity is reached at the same moment that the target position is reached.

The hoist state machine sequence arbitrarily starts with the hoist waiting at the target position (e.g., the loading position). If the state machine receives a "start operating" signal, it accelerates up to the operating rate and remains there. Alternatively, if the state machine receives a "match motion" signal, it accelerates to catch up with the target and then decelerates to match velocity. Once motion is matched or at operating rate, the state machine can respond to a "move to target position" signal. A trapezoidal profile can be used to provide smooth motion.

There are several significant position targets for the hoists as detailed herein. For the top drive, a "load" position at the top of the derrick is significant as this is where new pipe stands are attached to the saver sub or old pipe stands removed. A lower "receive" position is also used during back reaming and tripping out sequences. This is the position where the top drive waits for the TDR so that it can take over the role of driving the drill string. For the TDR hoist, the "connect" position is where the top drive needs to start attaching the saver sub during drilling and tripping in operations. The "disconnect" position is at the top of the TDR's travel. This is where it waits to disconnect the saver sub during a drilling or tripping in operation. Finally, there is also a "pick up" position where the TDR waits to disconnect a stand from the drill string during a back reaming or tripping out operation.

Racking Arm Sequencing

The role of the racking arm is to move pipe stands between the rack and the top drive saver sub. There are two positions of significance to the racking arm system. The first position is at the rack and is where the gripper needs to be to retrieve a new stand from the rack or store a stand back in the rack. The second position is the "ready" position. This is towards the top of the derrick with the arm withdrawn out of the path of the top drive. The racking arm waits here before loading a stand.

The racking arm state machine sequence starts with the racking arm at the rack position with the gripper empty (i.e., not holding a stand). From here a load or unload cycle can begin. If the state machine receives a "prepare to load" signal, the arm grips a stand in the rack, carries it to the ready position and then waits for a "load" signal. When received, the racking arm matches motion to the top drive (it will typically be moving down at tripping in or drilling rate). The racking arm then approaches the top drive with the stand and aligns it just under the saver sub. On receipt of a "release" signal, the racking arm lets go of the stand, withdraws and moves back to the rack. If the state machine receives a "prepare to unload" signal, the arm moves empty handed to match motion to the top drive (typically the top drive will be moving up at tripping out or reaming rate), with the arm withdrawn. On receipt of a "grip" signal, the racking arm will approach the top drive and grip the stand connected to the saver sub. On receipt of an "unload" signal, the racking arm will withdraw the stand, move back to the rack, and place the stand in the rack.

Top Drive System Sequencing

For the purposes of sequencing, the top drive system comprises the top drive motor and saver sub assembly, and the top drive floating mechanism. The roles of the top drive motor are to drive the drill string during drilling and back reaming operations, and to make up and break out pipe joints. These joints can either be between saver sub and drill stand or between two stands in the drill string. Making up or breaking out of a joint can be performed by the top drive alone, such as when a joint is made between the saver sub and a stand held by the racking arm. In this case the top drive has to provide the torque necessary to torque up or break a joint. The top drive can also work in tandem with the TDR in making up or breaking out a joint. Here, the upper torque wrench of the TDR provides the torque, with top drive motion slaved to the upper torque wrench. Since the inertia of the top drive is high, and the drill string even higher, it takes time for the top drive motor to accelerate up to speed and decelerate to rest. The purpose of the floating mechanism is to apply a specified downward or upward force to one part of a pipe joint during make up or break out, and also to retract the end of a pipe stand into the upper portion of the mud bucket during a break out operation.

The top drive state machine sequence starts with the top drive saver sub disconnected and no rotation. The top drive floating mechanism is retracted. There are two sets of transitions: one set that represents the sequence that is followed during a drilling or tripping in operation; and another set that represents the sequence followed during a back reaming or tripping out operation.

Consider first the drilling operation transitions. When the state machine receives a "make up saver sub" signal, the floating mechanism applies an insertion force and the top drive rotates to spin in and torque up the joint. On receipt of a "start rotating" signal, the top drives starts accelerating up to operating speed and the floating mechanism is retracted. The top drive is now connected to a drill stand (but not the drill string) and is rotating. The top drive then waits for an "allow stand make up" signal. When received, the speed demand for the top drive is slaved to the motion of the TDR upper torque wrench and an insertion force is applied using the floating mechanism. Mud flow to the top drive is also turned on. The top drive is now ready to assist the TDR in making up the joint between the drill stand and the drill string. On receipt of a "stand made up" signal, indicating that the TDR has completed the make up process, the top drive resumes rotating at the required operating speed.

On receipt of an "allow saver sub break out" signal, indicating that it is time to disconnect the saver sub and pass the drill string over to the TDR, the speed demand for the top drive is once more slaved to the motion of the upper torque wrench. The floating mechanism is used to apply a separation force to the joint. The top drive is now ready to assist the TDR in breaking out the joint between the saver sub and drill string. On receipt of a "saver sub broken out" signal, the floating mechanism is fully retracted and the flow of mud to the top drive turned off. Finally, on receipt of a "stop rotating" signal, the top drive decelerates to rest leaving the top drive system back in the initial state.

The back reaming operation transitions are essentially the same sequence as that detailed for the drilling operation transitions, but in reverse. Rotation and mud flow are not required during tripping in and tripping out operations. However, the same state machine can be used. Here, the open mud valve command is not issued and the operating speed is set to zero. Consequently, those transitions that require acceleration or deceleration occur instantaneously.

TDR Sequencing

The TDR includes a number of components that need sequencing, including the upper and lower torque wrenches, the upper pipe ram, blank ram and lower pipe ram of the mud bucket, and the mud valve and vacuuming system. The lower torque wrench supports the weight of the drill string and provides drilling and reaming torque. The upper torque wrench is used to tighten and loosen pipe joints. Both torque wrenches take time to engage with and disengage from the pipe. The upper pipe ram, blank ram and lower pipe ram of the mud bucket contain mud in the upper portion or lower portion of the mud bucket. These rams take time to open and close. The mud vacuuming system is used to remove mud from the mud bucket and saver sub. The TDR has to perform two sequences that switch between two basic states, fully disengaged and opened (providing no obstruction to the drill string passing through the TDR) and engaged with and driving the drill string (with the upper portion of the mud bucket empty).

FIG. 94 shows a state machine that sequences the operation of the TDR, including the upper and lower torque wrenches and the mud bucket. Transitions shown in solid lines are used during drilling and back reaming operations where mud circulation is required. Transitions shown in dashed lines are used during tripping in and tripping out operations. Consider first the sequences required for drilling and back reaming operations. The starting point sees the TDR engaged with and driving the drill string. The lower torque wrench is supporting the weight of the string and rotating at the required operating speed. The upper torque wrench is disengaged, but still rotating at operating speed. The upper pipe ram of the mud bucket is open and the upper portion of the mud bucket is empty of mud. The blank ram and lower pipe ram of the mud bucket are closed and the lower portion of the mud bucket is filled with mud, with mud flow to the lower port turned on.

When a "prepare to make up joint" signal is received, the upper pipe ram of the mud bucket closes sealing the upper portion of the mud bucket. The blank ram then opens and the upper torque wrench engages with the pipe. On receipt of a "make up joint" signal, the floating mechanism applies an insertion force to the joint (the top drive floating mechanism will also be doing the same thing). The joint is then made up using the upper torque wrench (the motion of the top drive is slaved to the upper torque wrench). At the same time the mud valve to the mud bucket is closed, as mud flow is now provided through the top drive and saver sub. The upper and lower torque wrenches are now disengaged and mud is vacuumed out of the mud bucket. The upper pipe ram and lower pipe ram of the mud bucket are opened and the floating mechanism on the upper torque wrench is fully retracted. At this point the TDR is fully disconnected from the drill string.

When a "prepare to break out joint" signal is received, the upper and lower torque wrenches are engaged and the upper pipe ram and lower pipe ram of the mud bucket are closed around the drill string. The mud valve to the TDR is opened, flooding the mud bucket with mud. On receipt of a "break out joint" signal, the upper torque wrench floating mechanism applies a separation force to the joint. The joint is then broken out using the upper torque wrench. The floating mechanism lifts the upper part of the joint into the upper portion of the mud bucket and the blank ram is closed. Mud is then vacuumed from the upper portion of the mud bucket and the upper torque wrench disengaged. At this point the TDR is disconnected from the upper pipe half of the pipe joint while the drill string is being driven by the lower torque wrench.

Mud circulation and rotation are not required during tripping in or out. The same state machine can be used to sequence operations in these cases. However, the transitions shown in broken lines are used to bypass the operation of the rams. Also, the operating speed is set to zero and the mud valve operation is disabled.

Drilling Operation Sequencing

The previous sections describe state machines for sequencing the hoist, racking arm, top drive and TDR sub-systems. This section describes a state machine which coordinates the sub-systems during a drilling operation.

The drilling operation is cyclic, but a starting point is required for the purposes of describing the state machine. This start point is chosen to be: top drive disconnected, not rotating and at the load position; TDR driving the drill string and moving downwards at rate of penetration; and racking arm tracking the top drive and ready to load a new stand. The first part of the cycle begins once the TDR has lowered the drill string to the point where a new stand needs to be added (the connect position described earlier). At this point, the top drive starts matching motion to the TDR and the racking arm presents the drill stand to the saver sub. The top drive makes up the joint and the racking arm withdraws. The end of the new stand is then inserted in the TDR and the TDR makes up this joint with the help of the top drive. The TDR then disengages from the pipe and moves to the disconnect position. The second part of the cycle starts when the saver sub has moved down far enough to need to be disconnected from the drill string. The TDR matches motion to the top drive and closes around the saver sub joint. The TDR then breaks out the joint in conjunction with the top drive and opens its upper chamber to release the saver sub. The top drive then moves to the load position ready for the next cycle.

Back Reaming Operation Sequencing

This section describes a state machine which coordinates the sub-systems during a back reaming operation. The back reaming operation is effectively the drilling operation in reverse. The start point of the cycle is chosen to be: top drive disconnected, stationary and at the receive position; TDR driving the drill string and moving upwards at back reaming rate; and racking arm tracking the top drive and ready to unload a stand. The first part of the cycle begins once the end of the saver sub has entered the TDR. At this point the top drive matches motion to the TDR and starts rotating. The TDR makes up the joint between the saver sub and drill string in conjunction with the top drive. The TDR then disconnects and moves to the pick-up position.

The second part of the cycle starts when the bottom joint of the top-most stand in the drill string enters the TDR. The TDR closes around and breaks the joint in conjunction with the top drive. The TDR then continues to drive the drill string while the top drive raises the stand out of the TDR. The racking arm then grips the stand, the top drive breaks out the joint between the stand and saver sub, and the racking arm returns the stand to the pipe rack. Finally, the top drive moves down to the receive position ready for the next cycle.

Tripping In Operation Sequencing

The state machine used to sequence the tripping in operation is virtually identical to that required for drilling. The only significant difference is that the top drive and wrenches do not rotate except when making up or breaking out a joint. Although the drilling state machine signals the top drive to start and stop rotating during certain transitions, the top drive state machine can effectively ignore this command and maintain zero speed.

Tripping Out Operation Sequencing

The state machine used to sequence the tripping out operation is virtually identical to that required for back reaming. Again, the only significant difference is that the top drive and wrenches do not rotate except when making up or breaking out a joint. Although the back reaming state machine signals the top drive to start and stop rotating during certain transitions, the top drive state machine can effectively ignore this command and maintain zero speed.

All of the devices, compositions and/or methods disclosed and claimed herein can be made and executed without undue experimentation in light of the present disclosure. While the systems and methods of this invention have been described in terms of preferred embodiments, it will be apparent to those of skill in the art that variations may be applied to the systems and/or methods and in the steps or in the sequence of steps of the method described herein without departing from the concept, spirit and scope of the invention. More specifically, it will be apparent that certain related components may be substituted for the components described herein while the same or similar results would be achieved. In addition, some operations may be modified, such as altering the timing of the operations described herein, or possibly modifying the sequence of operations described herein. Similarly, it will be appreciated that various data inputs and computer programming may be modified to provide greater or lesser automation of the operation of the apparatus and performance of the methods described herein. All such similar substitutes and modifications apparent to those skilled in the art are deemed to be within the spirit, scope and concept of the invention as defined by the appended claims.

What is claimed is:

1. A drilling and tripping system, comprising:

a) a plurality of lifting systems;

b) a traveling differential roughneck associated with at least one of said plurality of lifting systems;

c) a top drive associated with at least one of said plurality of lifting systems, said top drive connected to a saver sub;

d) a pipe handling and storage system associated with said traveling differential roughneck;

e) a drilling fluid diverting system associated with said traveling differential roughneck; and f) a control system, wherein said control system is operable to control the operation of said traveling differential roughneck.

2. The drilling and tripping system of claim 1, comprising a first lifting system, a second lifting system and a third lifting system.

3. The drilling and tripping system of claim 2, wherein said first lifting system, second lifting system or third lifting system comprises a drawworks, a winch, a hydraulic ram, a rack and pinion system, or a high load linear motor.

4. The drilling and tripping system of claim 2, wherein said first and second lifting system are associated with said traveling differential roughneck and said third lifting system is associated with said top drive.

5. The drilling and tripping system of claim 4, wherein said traveling differential roughneck comprises:

a) a frame;

b) a lower torque wrench;

c) an upper torque wrench; and d) a mud bucket.

6. The drilling and tripping system of claim 5, wherein said mud bucket comprises:

a) an upper rotating chamber comprising at least a first upper pipe ram;

b) a middle stationary chamber comprising a blank ram; and c) a lower rotating chamber comprising at least a first lower pipe ram.

7. The drilling and tripping system of claim 6, wherein said mud bucket further comprises a second upper pipe ram and a second lower pipe ram.

8. The drilling and tripping system of claim 5, wherein said lower torque wrench comprises:

a) a ring gear;

b) at least a first motor; and c) a plurality of cam locked jaws.

9. The drilling and tripping system of claim 5, wherein said upper torque wrench comprises:

a) a ring gear;

b) at least a first motor; and c) a plurality of cam locked jaws.

10. The drilling and tripping system of claim 9, wherein said upper torque wrench further comprises a float mechanism.

11. The drilling and tripping system of claim 9, wherein said top drive comprises a float mechanism.

12. The drilling and tripping system of claim 1, wherein said top drive comprises a float mechanism.

13. The drilling and tripping system of claim 1, wherein said control system comprises a computer, said computer further comprising instructions for operating the drilling and tripping system.

14. The drilling and tripping system of claim 13, wherein said control system comprises instructions for simultaneously controlling the operations of said lifting systems, said travelling differential roughneck, said top drive, said pipe handling and storage system, and said drilling fluid diverting system.

15. The drilling and tripping system of claim 14, wherein said control system comprises instructions responsive to data associated with drilling or tripping operations.

16. The drilling and tripping system of claim 15, wherein said control system comprises instructions responsive to data stored in non-volatile memory, real-time data associated with drilling or tripping operations, and user inputs.

17. A method for removing a portion of a drillstring from a hole, comprising:

a) outfitting a drilling rig with a drilling and tripping system comprising:

i) a plurality of lifting systems;

ii) a traveling differential roughneck associated with at least one of said plurality of lifting systems;

iii) a top drive associated with at least one of said plurality of lifting systems, said top drive connected to a saver sub;

iv) a pipe handling and storage system associated with said traveling differential roughneck;

v) a drilling fluid diverting system associated with said traveling differential roughneck; and vi) a control system operable to control at least a plurality of operations of said traveling differential roughneck; and b) operating said drilling and tripping system to remove at least a portion of said drillstring from said hole.

18. The method of claim 17, wherein said traveling differential roughneck comprises:

a) a frame;

b) a lower torque wrench;

c) an upper torque wrench; and d) a mud bucket.

19. The method of claim 18, wherein said mud bucket comprises:

a) an upper rotating chamber comprising at least a first upper pipe ram;

b) a middle stationary chamber comprising a blank ram; and c) a lower rotating chamber comprising at least a first lower pipe ram.

20. The method of claim 19, wherein said mud bucket further comprises a second upper pipe ram and a second lower pipe ram.

21. A method for drilling an oil or gas well, comprising:

a) outfitting a drilling rig with a drilling and tripping system comprising:

i) a plurality of lifting systems;

ii) a traveling differential roughneck associated with at least one of said plurality of lifting systems;

iii) a top drive associated with at least one of said plurality of lifting systems, said top drive connected to a saver sub;

iv) a pipe handling and storage system associated with said traveling differential roughneck;

v) a drilling fluid diverting system associated with said traveling differential roughneck; and vi) a control system operable to control at least a plurality of operations of said traveling differential roughneck; and b) operating said drilling and tripping system to drill said oil or gas well.

22. The method of claim 21, wherein said traveling differential roughneck comprises:

a) a frame;

b) a lower torque wrench;

c) an upper torque wrench; and d) a mud bucket.

23. The method of claim 22, wherein said mud bucket comprises:

a) an upper rotating chamber comprising at least a first upper pipe ram;

b) a middle stationary chamber comprising a blank ram; and c) a lower rotating chamber comprising at least a first lower pipe ram.

24. The method of claim 23, wherein said mud bucket further comprises a second upper pipe ram and a second lower pipe ram.

25. A method for removing a tubular from a riser or a cased hole without the need for fluid circulation or rotation of the tubular, comprising:

a) outfitting a drilling rig with a drilling and tripping system comprising:

i) a plurality of lifting systems;

ii) a traveling differential roughneck associated with at least one of said plurality of lifting systems;

iii) a top drive associated with at least one of said plurality of lifting systems, said top drive connected to a saver sub;

iv) a pipe handling and storage system associated with said traveling differential roughneck;

v) a drilling fluid diverting system associated with said traveling differential roughneck; and vi) a control system operable to control at least a plurality of operations of said traveling differential roughneck; and b) operating said drilling and tripping system to remove said tubular from said riser or said cased hole without the need for fluid circulation or rotation of the tubular.

26. The method of claim 25, wherein said traveling differential roughneck comprises:

a) a frame;

b) a lower torque wrench;

c) an upper torque wrench; and d) a mud bucket.

27. The method of claim 26, wherein said mud bucket comprises:

a) an upper rotating chamber comprising at least a first upper pipe ram;

b) a middle stationary chamber comprising a blank ram; and c) a lower rotating chamber comprising at least a first lower pipe ram.

28. The method of claim 27, wherein said mud bucket further comprises a second upper pipe ram and a second lower pipe ram.

* * * * *